United States Patent [19]

Shibata et al.

[11] Patent Number: 4,939,058

[45] Date of Patent: Jul. 3, 1990

[54] BISAZO PHOTO-RECEPTOR FOR ELECTROPHOTOGRAPHY

[75] Inventors: Toyoko Shibata, Zama; Takahiro Takagi, Kawasaki; Shinchi Suzuki, Hachioji; Hiroko Fukawa, Hachioji; Osamu Sasaki, Hachioji, all of Japan

[73] Assignee: Konica Corporation, Tokyo, Japan

[21] Appl. No.: 278,304

[22] Filed: Nov. 30, 1988

[30] Foreign Application Priority Data

| | | | |
|---|---|---|---|
| Dec. 2, 1987 | [JP] | Japan | 62-304861 |
| Dec. 2, 1987 | [JP] | Japan | 62-304862 |
| Dec. 10, 1987 | [JP] | Japan | 62-312558 |
| Dec. 30, 1987 | [JP] | Japan | 62-336384 |

[51] Int. Cl.[5] ..... G03G 5/06; G03G 5/087

[52] U.S. Cl. ..... 430/72; 430/58; 430/59; 430/75; 430/76; 430/79; 534/658

[58] Field of Search ..... 430/58, 59, 72, 75, 430/76, 79; 534/658

[56] References Cited

U.S. PATENT DOCUMENTS

| | | | |
|---|---|---|---|
| 4,612,271 | 9/1986 | Makino et al. | 430/72 |
| 4,797,337 | 1/1989 | Law et al. | 430/58 |
| 4,820,600 | 4/1989 | Akasaki et al. | 430/72 X |

FOREIGN PATENT DOCUMENTS

| | | | |
|---|---|---|---|
| 60-197764 | 10/1985 | Japan | 534/658 |

*Primary Examiner*—Roland E. Martin

*Attorney, Agent, or Firm*—Finnegan, Henderson, Farabow, Garrett and Dunner

[57] ABSTRACT

An electrophotographic photoreceptor having on a conductive support a photoconductive layer containing a specific azo compound is disclosed.

14 Claims, 2 Drawing Sheets

BISAZO PHOTO-RECEPTOR FOR ELECTROPHOTOGRAPHY

FIELD OF THE INVENTION

The present invention relates to a photo-receptor for electrophotography, more specifically to a photo-receptor for electrophotography which possesses a photosensitive layer containing a particular azo compound.

BACKGROUND OF THE INVENTION

As a conventional type of photo-receptor for electrophotograghy, inorganic photo-receptor having a photosensitive layer whose principal component is an inorganic photoconductive compound such as selenium, zinc oxide, cadmium sulfide, and silicone, has been in wide use. However, these photo-receptors are not necessarily satisfactory in terms of sensitivity, thermostability, moisture resistance, and durability. For example, when selenium is used as a photo-receptor, it easily deteriorates when it is crystallized, which can cause difficulty in manufacturing selenium. Also, it can be crystallized by heat and fingerprints. Cadmium sulfide has problems with moisture resistance durability, and zinc oxide has problems with durability.

To overcome the shortcomings inherent in the foregoing inorganic photo-receptors, research and development has actively been made to develop organic photo-receptor having organic photoconductive layers whose primary components are a variety of organic photoconductive compounds. For example, Japanese Patent Publication No. 10496/1975 discloses an organic photo-receptor having a photosensitive layer containing poly-N-vinylcarbazole and 2, 4, 7-trinitro-9-fluorenone. However, this photo-receptor is not necessarily satisfactory in terms of sensitivity and durability. To improve these shortcomings, attempts have been made to allot different substances to different functions, i.e., carrier generation and carrier transport, thereby to develop organic photo-receptors of higher-performance. This so-called function-separating type of photo-receptors has been the subject of many studies because the respective materials can be selected from wide variety of compounds and, for this reason, it has been expected to obtain photo-receptors with arbitrary proparties.

In the function-separating type photo-receptors, numerous number of compounds have been proposed as carrier-generation substances. As an example in which an inorganic compound is used as a carrier-generation substance amorphous selenium as disclosed in Japanese Patent Publication No. 16198/1968 may be mentioned. This compound is used in combination with an organic photoconductive compound, however, it cannot overcome the shortcomings of an amorphous selenium, which is liable to be crystallized by heat, leading to the deterioration of its properties as a photo-receptor.

Many other proposals have been made for photo-receptors for electrophotography using organic dyes and organic pigments as carrier-generation substances. For example, Japanese patents Open to Public Inspection Nos. 22834/1979, 73057/1980, 117151/1980, and 46237/1981, refer to the use of bis-azo compounds in the photosensitive layer. Those bis-azo compounds are, however, not necessarily satisfactory in terms of sensitivity, residual electric potential or stability in the repeated use, and in vie of its limited selection range of carrier transport substances. Thus they cannot fulfill the broad requirements of the electrophotographic process.

SUMMARY OF THE INVENTION

An object of the present invention is to provide a photo-receptor for electrophotography which contains a specific azo compound having superior carrier generation ability.

Another object of the present invention is to provide a photo-receptor for electrophotography having high sensitivity, small residual electric potential and high durability as well as improved durability in the repeated use.

Still another object of the present invention is to provide a photo-receptor for electrophotography which contains an azo compound which can also act as an effective carrier-generating substance in combination with a broad range of carrier transport substances.

As a result of repeating great endeavors on research work to achieve the above objects, the present inventor has discovered that particular azo compounds can act as the excellent effective components of the photo-receptors for electrophotography, thus completing the present invention.

Specifically, the above mentioned objects of the present invention can be achieved by a photo-receptor for electrophotography which comprises an electroconductive support and provided thereon a photosensitive layer containing at least one azo compound selected from those represented by formulae [I], [II], [III] and [IV];

General formula [I]

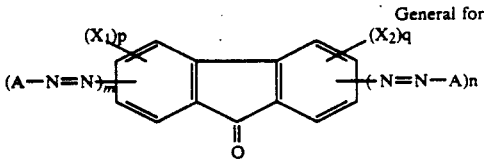

wherein, $X_1$ and $X_2$ independently, represent a halogen atom, a substituted or unsubstituted alkyl group, a substituted or unsubstituted alkoxy group, a nitro group, a cyano group, a hydroxy group, or a substituted or unsubstituted amino group, provided that at least one of $X_1$ and $X_2$ is a halogen atom;

Each of p an q is an integer of 0, 1 or 2, provided that they are not 0 at the same time, and when p and/or q are 2, $X_1$ and $X_2$, respectively may either be same groups or different ones; A is a group represented by the formula [a] below;

Formula [a]

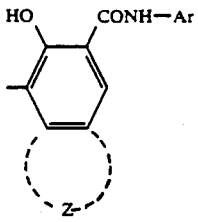

in which Ar represents an aromatic carbocyclic group or aromatic heterocyclic group having at least one fluorinated hydrocarbon group; Z represents a group of non-metal atoms necessary to form a substituted or unsubstituted aromatic carboncycle or a substituted or unsubstituted aromatic heterocycle, m and n each represent an integer of 0, 1 or 2, provided that m and n are not 0 at the same time;

Formula [II]

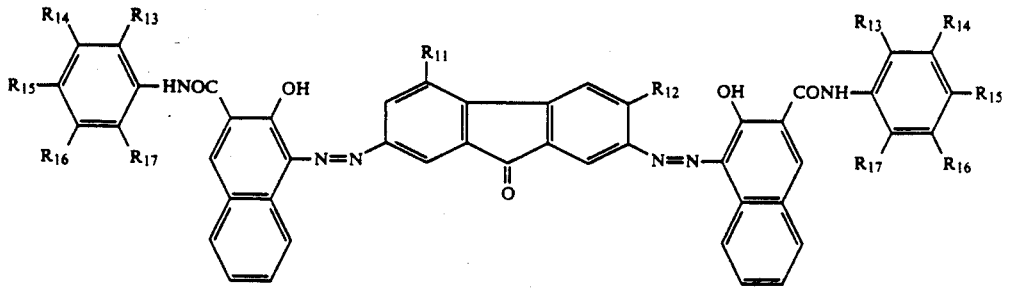

wherein, $R_{11}$ and $R_{12}$ independently represent a halogen group, an alkyl group, an alkoxy group, a nitro group, a cyano group or a hydroxy group, provided that $R_{11}$ and $R_{12}$, respectively, may be of either same or different groups; $R_{13}$ to $R_{17}$ independently represent a hydrogen atom, an alkyl group, an alkoxy group, a halogen atom, a cyano group or a nitro groups;

Formula [III]

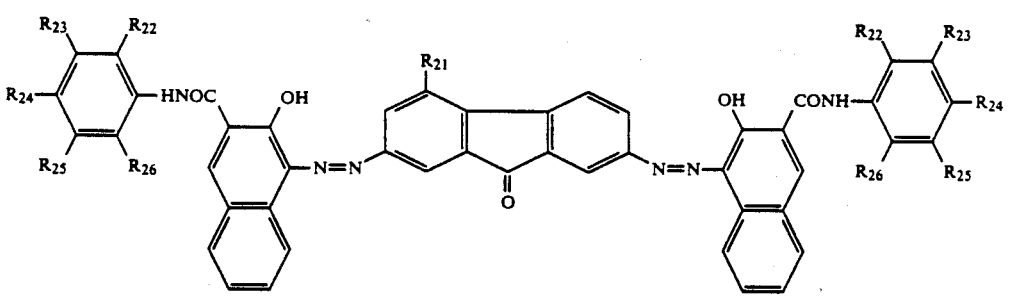

wherein, $R_{21}$ represents a halogen atom, an alkyl group, a nitro group, a cyano group or a hydroxy group; and $R_{22}$ to $R_{26}$ independently represent a hydrogen atom, an alkyl group, an alkoxy group, a halogen atom, a cyano group or a nitro group;

Formula [IV]

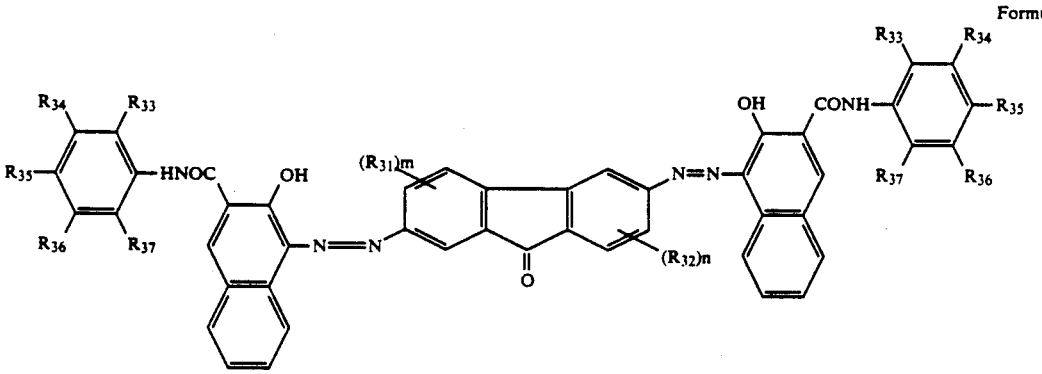

wherein, $R_{31}$ and $R_{32}$ independently represent a halogen atom, an alkyl group, an alkoxy group, a nitro group, a cyano group or a hydroxy group, provided that $R_{31}$ and $R_{32}$, respectively, may either be same or different; $R_{33}$ to $R_{37}$ independently represent a hydrogen atom, an alkyl group, an alkoxy group, a halogen atom, a cyano group or a nitro group; and m and n each represent an integer between 0 and 3.

Figure 1:
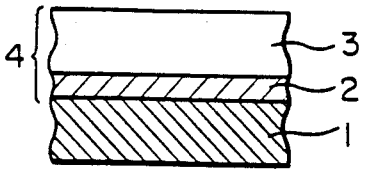
FIGS. 1 to 9 are sectional views which illustrate examples of the construction of the photo-receptor of the present invention, and numerals 1 to 6 in the drawings denote the following.

1—Electroconductive support
2—Carrier-generation layer
3—Carrier transport layer
4—Photosensitive layer
5—Intermediate layer
6—Protective layer

DETAILED DESCRIPTION OF THE INVENTION

As the examples of halogen atoms for $X_1$ and $X_2$ in formula [I], chlorine, bromide, fluorine and iodine atoms can be mentioned.

In the azo compounds of the present invention, at least one of $X_1$ and $X_2$ is a halogen atom.

The alkyl group for $X_1$ and $X_2$ is preferably a substituted or unsubstituted alkyl group with 1 to 4 caron atoms, including, for example, methyl, ethyl, beta-cyanoethyl, iso-propyl, trifluoromethyl, or t-butyl group.

The alkoxy group for $X_1$ and $X_2$ is preferably a substituted or unsubstituted alkoxy group having 1 to 4 carbon atoms, and examples of such alkoxy group includes methoxy, ethoxy, beta-chlorethoxy or sec-butoxy group.

As the example of the substituted or unsubstituted amino group for $X_1$ and $X_2$ amino group substituted by an alkyl group or an aryl group (preferably phenyl group), etc. including, for example, N-methylamino, N-ethylamino, N, N-dimethylamino, N, N-diethylamino, N-phenylamino and N, N-diphenylamino groups may be mentioned. Further, amino group substituted by an acyl group, such as acetylamino or P-chlorbenzoylamino group is also included.

In formula [I] p and q independently represent an integer of 0, 1 or 2, but they never become 0 at the same time, an alternative preferable case being $p=1$ and $q=0$ or $p=1$ and $q=1$.

Still further, when both p and q are 2, either a same group or different groups can be applied to $X_1$ and $X_2$, respectively.

In general formula [I] described previously, moreover, A is expressed, preferably by the General formula [a]:

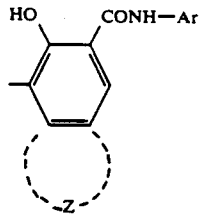

Formula [a]

In the above formula, while Ar represents an aromatic carbocyclic group or an aromatic heterocyclic group having at least one fluorinated hydrocarbon group, it is preferably a fluorinated hydrocarbon group having 1 or 4 carbon atoms in said fluorinated hydrocarbon group. Examples are the trifluoromethyl, pentafluoroethyl, tetrafluoroethyl, and heptafluoropropyl groups. A further preferable fluorinated hydrocarbon group of such examples is trifluoromethyl group. In addition, examples of this aromatic carboncyclic group can be the phenyl, naphthyl or anthryl group preferably the phenyl group. Still further, for example, the carbazolyl or dibenzofuryl group can be mentioned as said aromatic heterocyclic group. In the above mentioned aromatic carboncyclic group and aromatic heterocyclic group, in addition, substituent groups other than the above mentioned fluorinated hydrocarbon group can be illustrated by substituted or unsubstituted alkyl groups with 1 or 4 carbon atoms, for example, the methyl, ethyl, isopropyl, t-butyl or trifluoromethyl group, or the substituted or unsubstituted aralkyl group, for example, the benzyl or phenethyl group; halogen atoms, for example, chlorine, bromide, fluorine or iodine atoms; substituted or unsubstituted alkoxy groups with 1 to 4 carbon atoms, for example, methoxy group, ethoxy group, isopropoxy group, t-butoxy group, 2-chlorethoxy group; hydroxy groups; substituted or unsubstituted aryloxy groups, for example, p-chlorphenoxy group, 1-naphtoxy group; acyloxy groups, for example, acetyloxy group, p-cyanobenzoyloxy group; carboxyl groups and other ester groups, for example, ethoxycarbonyl group, m-bromophenoxycarbonyl group; carbamoyl groups, for example, aminocarbonyl, t-butylaminocarbonyl or anilinocarbonyl group; acyl groups, for example, acetyl group or o-nitrobenzoyl group; sulfo groups and sufamoyl groups, for example, the aminosulfonyl, t-butylaminosulfonyl or p-tolylaminosulfonyl group; amino groups and the acylamino groups, for example, the acetylamino or benzoylamino group; sulfonamide groups, for example, methanesulfonamide group, p-toluenesulfonamide group, etc.; cyano groups; nitro groups, etc. Preferable among these substituent groups are substituted or unsubstituted alkyl groups with 1 or 4 carbon atoms, for example, methyl group, ethyl group, iso-propyl group, t-butyl group, trifluoromethyl group, etc.; halogen atoms, for example, the chlorine, bromide, fluorine and iodine atoms; substituted or unsubstituted alkoxy groups with 1 or 4 carbon atoms, for example, the methoxy, ethoxy, t-butoxy or 2-chlormethoxy group; nitro groups; and cyano groups.

In the above mentioned General formula [a], the Z is a group of atoms necessary to form a substituted and unsubstituted aromatic carboncycle or a substituted and unsubstituted heterocycle, specifically representing a group of atoms is necessary to form, for example, a substituted or unstubstituted benzene ring, a substituted or unsubstituted naphthalene ring, a substituted and unsubstituted indole ring, or a substituted and unsubstituted carbazol ring.

As the substituent groups with the group of atoms necessary to form the above mentioned ring, for example, those listed for Ar can be mentioned, but they are preferably selected from a halogen atom (for example, chlorine atom, bromide atom, fluorine atom and iodine atom), a sulfo group, and a sulfamoyl group (for example, aminosulfonyl groups, p-tolylaminosulfonyl groups, etc.).

The azo compound expressed by the above mentioned General formula [I] of the present invention is preferably selected from the compound represented by the following General formulae [I-A], [I-B], [I-C] and [I-D].

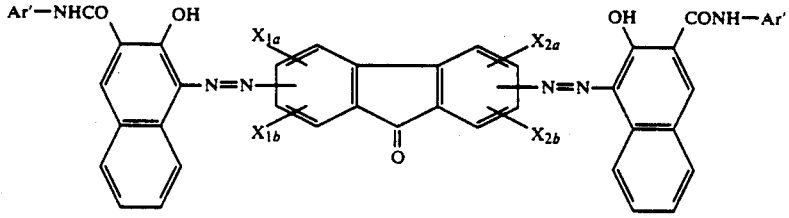

General formula [I-A]

-continued

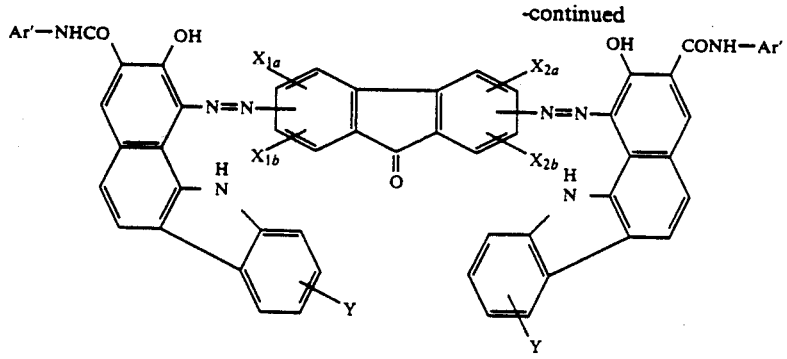

General formula [I-B]

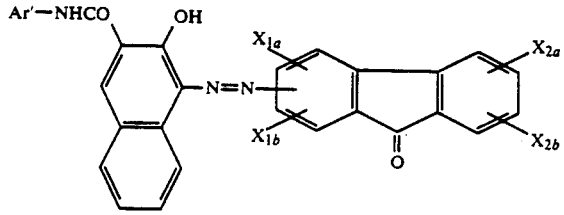

General formula [I-C]

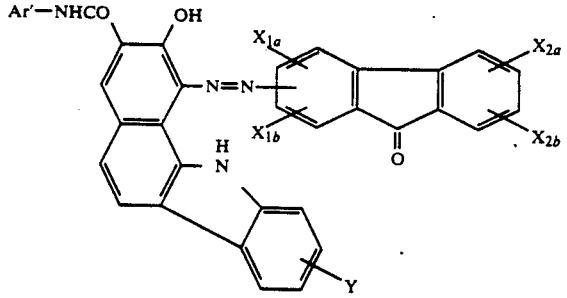

General formula [I-D]

In the above mentioned formulae, $X_{1a}$, $X_{1b}$, $X_{2a}$ and $X_{2b}$ are independently selected from a hydrogen atom, a halogen atom, a substituted or unsubstituted alkyl group, a substituted or unsubstituted alkoxy group, a nitro group, a cyano group, a hydroxy group, and a substitutued or unsubstituted amino group, and at least one of $X_{1a}$, $X_{1b}$, $X_{2a}$ and $X_{2b}$ are a halogen atom. $X_{1a}$ and $X_{1b}$, as well as $X_{2b}$ and $X_{2b}$, may have either the same or different group.

Ar' is synonymous with Ar as expressed in the earlier mentioned General formula [I].

Y is synonymous with the substituent group for Z in the earlier mentioned General formula [I].

Below is a description of the specific examples of the azo compound expressed by the above mentioned General formula [I] of the present invention, but the azo compounds of the present invention are in no way limited by such examples.

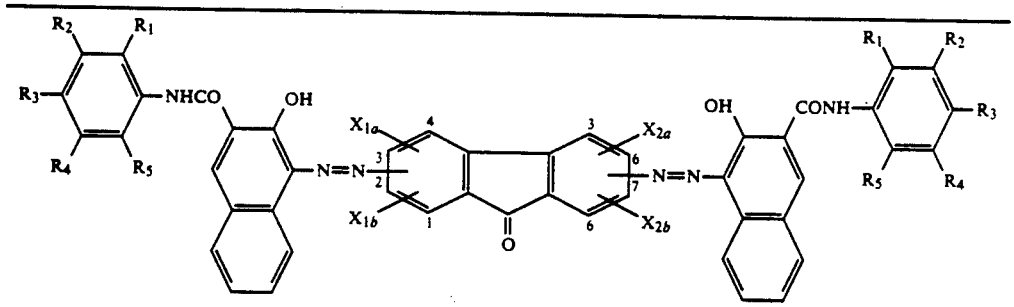

| No. | Azo-group Substituted Positions | X1a | X1b | X2a | X2b | $R_1$ | $R_2$ | $R_3$ | $R_4$ | $R_5$ |
|---|---|---|---|---|---|---|---|---|---|---|
| I-1 | 2, 7 | 4-F | H | H | H | H | $CF_3$ | H | H | H |
| I-2 | 2, 7 | 4-F | H | H | H | H | H | $CF_3$ | H | H |
| I-3 | 2, 7 | 4-F | H | H | H | $CF_3$ | H | H | H | H |
| I-4 | 2, 7 | 4-F | H | H | H | Cl | H | H | $CF_3$ | H |
| I-5 | 2, 7 | 4-F | H | H | H | H | $C_2F_5$ | H | H | H |
| I-6 | 2, 7 | 4-F | H | H | H | H | $C_3F_7$(n) | H | H | H |

-continued

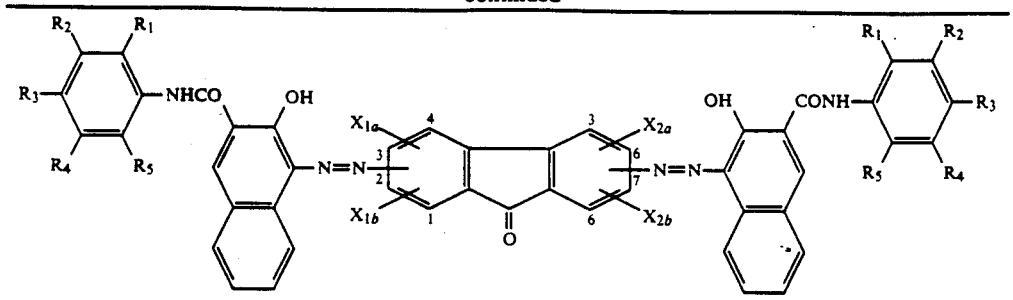

| No. | Azo-group Substituted Positions | X1a | X1b | X2a | X2b | $R_1$ | $R_2$ | $R_3$ | $R_4$ | $R_5$ |
|---|---|---|---|---|---|---|---|---|---|---|
| I-7 | 2, 7 | 4-F | H | H | H | H | $C_2F_4H$ | H | H | H |
| I-8 | 2, 7 | 4-F | H | H | H | H | $CF_3$ | Cl | H | H |
| I-9 | 2, 7 | 4-F | H | H | H | Br | H | H | $CF_3$ | H |
| I-10 | 2, 7 | 4-F | H | H | H | $CF_3$ | H | H | $CF_3$ | H |
| I-11 | 2, 7 | 4-F | H | 5-F | H | H | $CF_3$ | H | H | H |
| I-12 | 2, 7 | 4-F | H | 5-F | H | H | H | $CF_3$ | H | H |
| I-13 | 2, 7 | 4-F | H | 5-F | H | Cl | H | H | $CF_3$ | H |
| I-14 | 2, 7 | 3-F | H | 5-F | H | H | $CF_3$ | H | H | H |
| I-15 | 2, 7 | 3-F | H | 5-F | H | H | H | $CF_3$ | H | H |
| I-16 | 2, 7 | 1-F | H | 5-F | H | H | $CF_3$ | H | H | H |
| I-17 | 2, 7 | 3-F | H | 5-F | H | H | $CF_3$ | H | H | H |
| I-18 | 2, 7 | 3-F | H | 5-F | H | $CF_3$ | H | H | H | H |
| I-19 | 2, 7 | 3-F | H | 5-F | H | H | H | $CF_3$ | H | H |
| I-20 | 2, 7 | 3-F | H | 5-F | H | Cl | H | H | $CF_3$ | H |
| I-21 | 2, 7 | 3-F | H | 6-F | H | H | $CF_3$ | H | H | H |
| I-22 | 2, 7 | 3-F | H | 6-F | H | H | H | $CF_3$ | H | H |
| I-23 | 2, 7 | 3-F | H | 6-F | H | Cl | H | H | $CF_3$ | H |
| I-24 | 2, 7 | 1-F | 3-F | 6-F | H | H | $CF_3$ | H | H | H |
| I-25 | 2, 7 | 3-$CH_3$ | H | 6-F | H | H | $CF_3$ | H | H | H |
| I-26 | 2, 7 | 3-$OCH_3$ | H | 6-F | H | H | $CF_3$ | H | H | H |
| I-27 | 2, 7 | 3-$OCH_3$ | H | 5-F | H | H | $CF_3$ | H | H | H |
| I-28 | 2, 7 | 3-Cl | H | 5-F | H | H | $CF_3$ | H | H | H |
| I-29 | 2, 7 | 3-F | H | 6-Cl | H | H | $CF_3$ | H | H | H |
| I-30 | 2, 7 | 3-F | H | 6-Br | H | H | $CF_3$ | H | H | H |
| I-31 | 2, 7 | 3-N($CH_3$)$_2$ | H | 5-F | H | H | $CF_3$ | H | H | H |
| I-32 | 2, 7 | 3-F | H | 6-OH | H | H | $CF_3$ | H | H | H |
| I-33 | 2, 7 | 3-F | H | 5-CN | H | H | $CF_3$ | H | H | H |
| I-34 | 2, 7 | 4-F | H | 5-$NO_2$ | H | H | $CF_3$ | H | H | H |
| I-35 | 2, 7 | 3-$NHCOCH_3$ | 4-F | H | H | H | $CF_3$ | H | H | H |
| I-36 | 2, 7 | 4-Cl | H | H | H | H | $CF_3$ | H | H | H |
| I-37 | 2, 7 | 4-Cl | H | H | H | H | H | $CF_3$ | H | H |
| I-38 | 2, 7 | 4-Cl | H | H | H | $CF_3$ | H | H | H | H |
| I-39 | 2, 7 | 4-Cl | H | H | H | Cl | H | H | $CF_3$ | H |
| I-40 | 2, 7 | 4-Cl | H | H | H | H | $C_2F_5$ | H | H | H |
| I-41 | 2, 7 | 4-Cl | H | H | H | H | $C_3F_7$(n) | H | H | H |
| I-42 | 2, 7 | 4-Cl | H | H | H | H | $C_2F_4H$ | H | H | H |
| I-43 | 2, 7 | 4-Cl | H | H | H | H | $CF_3$ | Cl | H | H |
| I-44 | 2, 7 | 4-Cl | H | H | H | Br | H | H | $CF_3$ | H |
| I-45 | 2, 7 | 4-Cl | H | H | H | $CF_3$ | H | H | $CF_3$ | H |
| I-46 | 2, 7 | 4-Cl | H | 5-Cl | H | H | $CF_3$ | H | H | H |
| I-47 | 2, 7 | 4-Cl | H | 5-Cl | H | H | H | $CF_3$ | H | H |
| I-48 | 2, 7 | 4-Cl | H | 5-Cl | H | Cl | H | H | $CF_3$ | H |
| I-49 | 2, 7 | 3-Cl | H | 5-Cl | H | H | $CF_3$ | H | H | H |
| I-50 | 2, 7 | 3-Cl | H | 5-Cl | H | H | H | $CF_3$ | H | H |
| I-51 | 2, 7 | 1-Cl | H | 5-Cl | H | H | $CF_3$ | H | H | H |
| I-52 | 2, 7 | 3-Cl | H | H | H | H | $CF_3$ | H | H | H |
| I-53 | 2, 7 | 3-Cl | H | H | H | $CF_3$ | H | H | H | H |
| I-54 | 2, 7 | 3-Cl | H | H | H | H | H | $CF_3$ | H | H |
| I-55 | 2, 7 | 3-Cl | H | H | H | Cl | H | H | $CF_3$ | H |
| I-56 | 2, 7 | 3-Cl | H | 6-Cl | H | H | $CF_3$ | H | H | H |
| I-57 | 2, 7 | 3-Cl | H | 6-Cl | H | H | H | $CF_3$ | H | H |
| I-58 | 2, 7 | 3-Cl | H | 6-Cl | H | Cl | H | H | $CF_3$ | H |
| I-59 | 2, 7 | 1-Cl | 3-Cl | 6-Cl | H | H | $CF_3$ | H | H | H |
| I-60 | 2, 7 | 3-$CH_3$ | H | 6-Cl | H | H | $CF_3$ | H | H | H |
| I-61 | 2, 7 | 3-$OCH_3$ | H | 6-Cl | H | H | $CF_3$ | H | H | H |
| I-62 | 2, 7 | 3-$CH_3$ | H | 5-Cl | H | H | $CF_3$ | H | H | H |
| I-63 | 2, 7 | 3-F | H | 5-Cl | H | H | $CF_3$ | H | H | H |
| I-64 | 2, 7 | 3-Cl | H | 6-F | H | H | $CF_3$ | H | H | H |

-continued

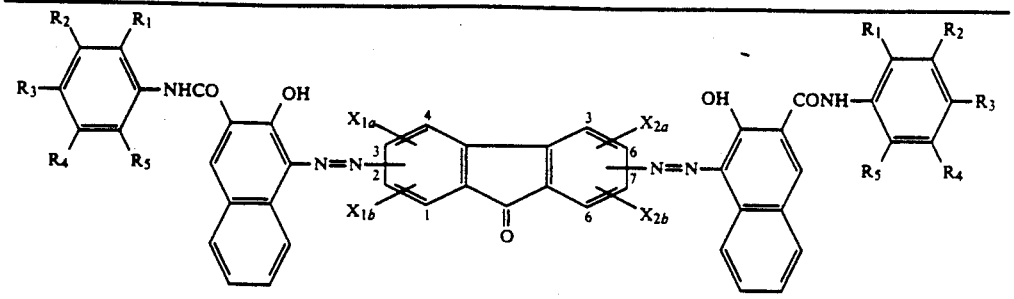

| No. | Azo-group Substituted Positions | X1a | X1b | X2a | X2b | $R_1$ | $R_2$ | $R_3$ | $R_4$ | $R_5$ |
|---|---|---|---|---|---|---|---|---|---|---|
| I-65 | 2, 7 | 3-Cl | H | 6-Br | H | H | $CF_3$ | H | H | H |
| I-66 | 2, 7 | 3-N(CH3)2 | H | 5-Cl | H | H | $CF_3$ | H | H | H |
| I-67 | 2, 7 | 3-Cl | H | 6-OH | H | H | H | $CF_3$ | H | H |
| I-68 | 2, 7 | 3-Cl | H | 5-CN | H | Cl | H | H | $CF_3$ | H |
| I-69 | 2, 7 | 3-Cl | H | 5-$NO_2$ | H | H | H | $CF_3$ | H | H |
| I-70 | 2, 7 | 3-$NHCOCH_3$ | 4-Cl | H | H | H | $CF_3$ | H | H | H |
| I-71 | 2, 7 | 4-Br | H | H | H | H | $CF_3$ | H | H | H |
| I-72 | 2, 7 | 4-Br | H | H | H | H | H | $CF_3$ | H | H |
| I-73 | 2, 7 | 4-Br | H | H | H | $CF_3$ | H | H | H | H |
| I-74 | 2, 7 | 4-Br | H | H | H | Cl | H | H | $CF_3$ | H |
| I-75 | 2, 7 | 4-Br | H | H | H | H | $C_2F_5$ | H | H | H |
| I-76 | 2, 7 | 4-Br | H | H | H | H | $C_3F_7$(n) | H | H | H |
| I-77 | 2, 7 | 4-Br | H | H | H | H | $C_2F_4H$ | H | H | H |
| I-78 | 2, 7 | 4-Br | H | H | H | H | $CF_3$ | Cl | H | H |
| I-79 | 2, 7 | 4-Br | H | H | H | Br | $CF_3$ | H | H | H |
| I-80 | 2, 7 | 4-Br | H | H | H | $CF_3$ | H | H | $CF_3$ | H |
| I-81 | 2, 7 | 4-Br | H | 5-Br | H | H | $CF_3$ | H | H | H |
| I-82 | 2, 7 | 4-Br | H | 5-Br | H | H | H | $CF_3$ | H | H |
| I-83 | 2, 7 | 4-Br | H | 5-Br | H | Cl | H | H | $CF_3$ | H |
| I-84 | 2, 7 | 3-Br | H | 5-Br | H | H | $CF_3$ | H | H | H |
| I-85 | 2, 7 | 3-Br | H | 5-Br | H | H | H | $CF_3$ | H | H |
| I-86 | 2, 7 | 1-Br | H | 5-Br | H | H | $CF_3$ | H | H | H |
| I-87 | 2, 7 | 3-Br | H | H | H | H | $CF_3$ | H | H | H |
| I-88 | 2, 7 | 3-Br | H | H | H | $CF_3$ | H | H | H | H |
| I-89 | 2, 7 | 3-Br | H | H | H | H | H | $CF_3$ | H | H |
| I-90 | 2, 7 | 3-Br | H | H | H | Cl | H | H | $CF_3$ | H |
| I-91 | 2, 7 | 3-Br | H | 6-Br | H | H | $CF_3$ | H | H | H |
| I-92 | 2, 7 | 3-Br | H | 6-Br | H | H | H | $CF_3$ | H | H |
| I-93 | 2, 7 | 3-Br | H | 6-Br | H | Cl | H | H | $CF_3$ | H |
| I-94 | 2, 7 | 1-Br | 3-Br | 6-Br | H | H | $CF_3$ | H | H | H |
| I-95 | 2, 7 | 3-$CH_3$ | H | 6-Br | H | H | $CF_3$ | H | H | H |
| I-96 | 2, 7 | 3-$OCH_3$ | H | 6-Br | H | H | $CF_3$ | H | H | H |
| I-97 | 2, 7 | 3-$CH_3$ | H | 5-Br | H | H | $CF_3$ | H | H | H |
| I-98 | 2, 7 | 3-Cl | H | 5-Br | H | H | $CF_3$ | H | H | H |
| I-99 | 2, 7 | 3-Br | H | 6-Cl | H | H | $CF_3$ | H | H | H |
| I-100 | 2, 7 | 3-Br | H | 6-F | H | H | $CF_3$ | H | H | H |
| I-101 | 2, 7 | 3-N(CH3)2 | H | 5-Br | H | H | $CF_3$ | H | H | H |
| I-102 | 2, 7 | 3-Br | H | 6-OH | H | H | H | $CF_3$ | H | H |
| I-103 | 2, 7 | 3-Br | H | 5-CN | H | Cl | H | H | $CF_3$ | H |
| I-104 | 2, 7 | 4-Br | H | 5-$NO_2$ | H | H | $CF_3$ | H | H | H |
| I-105 | 2, 7 | 3-$NHCOCH_3$ | 4-Br | H | H | H | $CF_3$ | H | H | H |
| I-106 | 2, 7 | 4-I | H | H | H | H | $CF_3$ | H | H | H |
| I-107 | 2, 7 | 4-I | H | H | H | H | H | $CF_3$ | H | H |
| I-108 | 2, 7 | 4-I | H | H | H | $CF_3$ | H | H | H | H |
| I-109 | 2, 7 | 4-I | H | H | H | Cl | H | H | $CF_3$ | H |
| I-110 | 2, 7 | 4-I | H | H | H | H | $C_2F_5$ | H | H | H |
| I-111 | 2, 7 | 4-I | H | H | H | H | $C_3F_7$(n) | H | H | H |
| I-112 | 2, 7 | 4-I | H | H | H | H | $C_2F_4H$ | H | H | H |
| I-113 | 2, 7 | 4-I | H | H | H | H | $CF_3$ | Cl | H | H |
| I-114 | 2, 7 | 4-I | H | H | H | Br | $CF_3$ | H | H | H |
| I-115 | 2, 7 | 4-I | H | H | H | $CF_3$ | H | H | $CF_3$ | H |
| I-116 | 2, 7 | 4-I | H | 5-I | H | H | $CF_3$ | H | H | H |
| I-117 | 2, 7 | 4-I | H | 5-I | H | H | H | $CF_3$ | H | H |

-continued

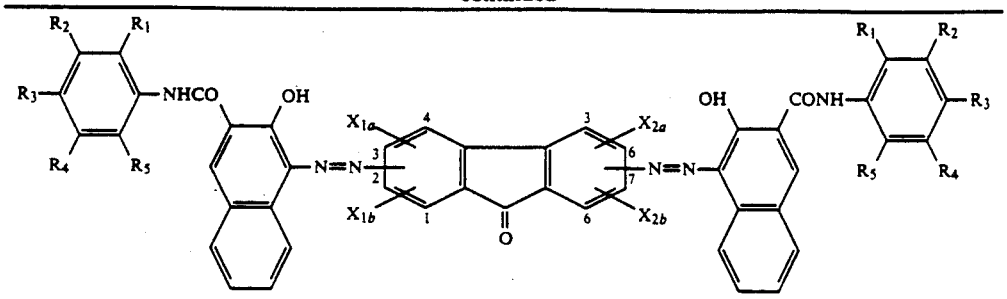

| No. | Azo-group Substituted Positions | X1a | X1b | X2a | X2b | $R_1$ | $R_2$ | $R_3$ | $R_4$ | $R_5$ |
|---|---|---|---|---|---|---|---|---|---|---|
| I-118 | 2, 7 | 4-I | H | 5-I | H | Cl | H | H | $CF_3$ | H |
| I-119 | 2, 7 | 3-I | H | 5-I | H | H | $CF_3$ | H | H | H |
| I-120 | 2, 7 | 3-I | H | 5-I | H | H | H | $CF_3$ | H | H |
| I-121 | 2, 7 | 1-I | H | 5-I | H | H | $CF_3$ | H | H | H |
| I-122 | 2, 7 | 3-I | H | 5-I | H | H | $CF_3$ | H | H | H |
| I-123 | 2, 7 | 3-I | H | 5-I | H | $CF_3$ | H | H | H | H |
| I-124 | 2, 7 | 3-I | H | 5-I | H | H | H | $CF_3$ | H | H |
| I-125 | 2, 7 | 3-I | H | 5-I | H | Cl | H | H | $CF_3$ | H |
| I-126 | 2, 7 | 3-I | H | 6-I | H | H | $CF_3$ | H | H | H |
| I-127 | 2, 7 | 3-I | H | 6-I | H | H | H | $CF_3$ | H | H |
| I-128 | 2, 7 | 3-I | H | 6-I | H | Cl | H | H | $CF_3$ | H |
| I-129 | 2, 7 | 1-I | 3-I | 6-I | H | H | $CF_3$ | H | H | H |
| I-130 | 2, 7 | 3-$CH_3$ | H | 6-I | H | H | $CF_3$ | H | H | H |
| I-131 | 2, 7 | 3-$OCH_3$ | H | 6-I | H | H | $CF_3$ | H | H | H |
| I-132 | 2, 7 | 3-$CH_3$ | H | 5-I | H | H | $CF_3$ | H | H | H |
| I-133 | 2, 7 | 3-Cl | H | 5-I | H | H | $CF_3$ | H | H | H |
| I-134 | 2, 7 | 3-I | H | 6-Cl | H | H | $CF_3$ | H | H | H |
| I-135 | 2, 7 | 3-I | H | 6-Br | H | H | $CF_3$ | H | H | H |
| I-136 | 2, 7 | 3-N($CH_3$)$_2$ | H | 5-I | H | H | $CF_3$ | H | H | H |
| I-137 | 2, 7 | 3-I | H | 6-OH | H | H | H | $CF_3$ | H | H |
| I-138 | 2, 7 | 3-I | H | 5-CN | H | Cl | H | H | $CF_3$ | H |
| I-139 | 2, 7 | 4-I | H | 5-$NO_2$ | H | H | $CF_3$ | H | H | H |
| I-140 | 2, 7 | 3-$NHCOCH_3$ | H | 4-I | H | H | $CF_3$ | H | H | H |
| I-141 | 2, 6 | 4-F | H | H | H | H | $CF_3$ | H | H | H |
| I-142 | 2, 6 | 4-F | H | H | H | H | H | $CF_3$ | H | H |
| I-143 | 2, 6 | 4-F | H | H | H | Cl | H | H | $CF_3$ | H |
| I-144 | 2, 6 | 4-Cl | H | H | H | H | $CF_3$ | H | H | H |
| I-145 | 2, 6 | 4-Cl | H | H | H | H | H | $CF_3$ | H | H |
| I-146 | 2, 6 | 4-Cl | H | H | H | Cl | H | H | $CF_3$ | H |
| I-147 | 2, 6 | 4-Br | H | H | H | H | $CF_3$ | H | H | H |
| I-148 | 2, 6 | 4-Br | H | H | H | H | H | $CF_3$ | H | H |
| I-149 | 2, 6 | 4-Br | H | H | H | Cl | H | H | $CF_3$ | H |
| I-150 | 2, 6 | 4-I | H | H | H | H | $CF_3$ | H | H | H |
| I-151 | 2, 6 | 4-I | H | H | H | H | H | $CF_3$ | H | H |
| I-152 | 2, 6 | 4-I | H | H | H | Cl | H | H | $CF_3$ | H |
| I-153 | 2, 6 | 4-I | H | H | H | Br | H | H | $CF_3$ | H |
| I-154 | 3, 6 | 2-F | H | 7-F | H | H | $CF_3$ | H | H | H |
| I-155 | 3, 6 | 4-F | H | H | H | H | $CF_3$ | H | H | H |
| I-156 | 3, 6 | 4-F | H | H | H | H | H | $CF_3$ | H | H |
| I-157 | 3, 6 | 4-F | H | H | H | Cl | H | H | $CF_3$ | H |
| I-158 | 3, 6 | 4-F | H | H | H | Br | H | H | $CF_3$ | H |
| I-159 | 3, 6 | 2-Cl | H | 7-Cl | H | H | $CF_3$ | H | H | H |
| I-160 | 3, 6 | 4-Cl | H | H | H | H | $CF_3$ | H | H | H |
| I-161 | 3, 6 | 4-Cl | H | H | H | H | H | $CF_3$ | H | H |
| I-162 | 3, 6 | 4-Cl | H | H | H | Cl | H | H | $CF_3$ | H |
| I-163 | 3, 6 | 2-Br | H | 7-Br | H | H | $CF_3$ | H | H | H |
| I-164 | 3, 6 | 4-Br | H | H | H | H | $CF_3$ | H | H | H |
| I-165 | 3, 6 | 4-Br | H | H | H | H | H | $CF_3$ | H | H |
| I-166 | 3, 6 | 4-Br | H | H | H | Cl | H | H | $CF_3$ | H |
| I-167 | 3, 6 | 2-I | H | 7-I | H | H | $CF_3$ | H | H | H |
| I-168 | 3, 6 | 4-I | H | H | H | H | $CF_3$ | H | H | H |
| I-169 | 3, 6 | 4-I | H | H | H | H | H | $CF_3$ | H | H |
| I-170 | 3, 6 | 4-I | H | H | H | Cl | H | H | $CF_3$ | H |
| I-171 | 1, 5 | 2-F | H | H | H | H | $CF_3$ | H | H | H |
| I-172 | 1, 5 | 2-Cl | H | H | H | H | $CF_3$ | H | H | H |
| I-173 | 1, 5 | 2-Br | H | H | H | H | $CF_3$ | H | H | H |
| I-174 | 1, 5 | 2-I | H | H | H | H | $CF_3$ | H | H | H |
| I-175 | 2, 5 | 3-F | H | H | H | H | $CF_3$ | H | H | H |

-continued

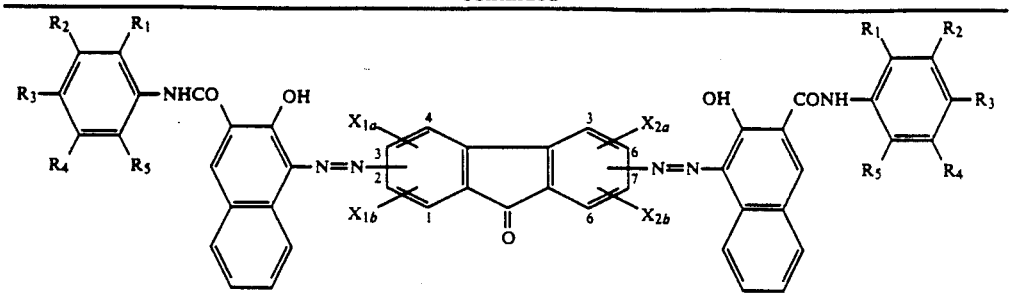

| No. | Azo-group Substituted Positions | X1a | X1b | X2a | X2b | $R_1$ | $R_2$ | $R_3$ | $R_4$ | $R_5$ |
|---|---|---|---|---|---|---|---|---|---|---|
| I-176 | 2, 5 | 3-Cl | H | H | H | H | $CF_3$ | H | H | H |
| I-177 | 2, 5 | 3-Br | H | H | H | H | $CF_3$ | H | H | H |
| I-178 | 2, 5 | 3-I | H | H | H | H | $CF_3$ | H | H | H |
| I-179 | 3, 5 | 2-F | H | H | H | H | $CF_3$ | H | H | H |
| I-180 | 3, 5 | 2-Cl | H | H | H | H | $CF_3$ | H | H | H |
| I-181 | 3, 5 | 2-Br | H | H | H | H | $CF_3$ | H | H | H |
| I-182 | 3, 5 | 2-I | H | H | H | H | $CF_3$ | H | H | H |
| I-183 | 4, 5 | 3-F | H | H | H | H | $CF_3$ | H | H | H |
| I-184 | 4, 5 | 3-Cl | H | H | H | H | $CF_3$ | H | H | H |
| I-185 | 4, 5 | 3-Br | H | H | H | H | $CF_3$ | H | H | H |
| I-186 | 4, 5 | 3-I | H | H | H | H | $CF_3$ | H | H | H |
| I-187 | 1, 8 | 3-F | H | H | H | H | $CF_3$ | H | H | H |
| I-188 | 1, 8 | 3-Cl | H | H | H | H | $CF_3$ | H | H | H |
| I-189 | 1, 8 | 3-Br | H | H | H | H | $CF_3$ | H | H | H |
| I-190 | 1, 8 | 3-I | H | H | H | H | $CF_3$ | H | H | H |

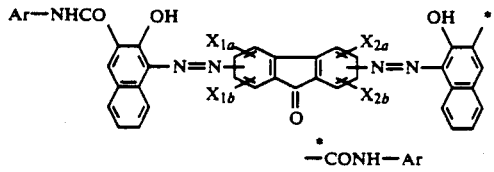

| No. | Azo-group Substituted Positions | $X_{1a}$ | $X_{1b}$ | $X_{2a}$ | $X_{2b}$ | Ar |
|---|---|---|---|---|---|---|
| I-191 | 2, 7 | 4-F | H | H | H | 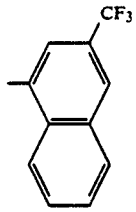 |
| I-192 | 2, 7 | 4-F | H | H | H | 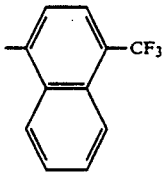 |
| I-193 | 2, 7 | 4-F | H | H | H | 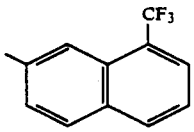 |

-continued

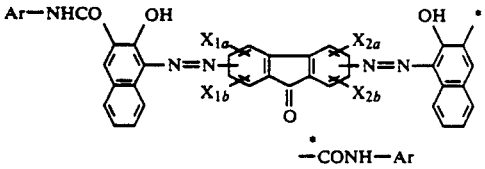

| No. | Azo-group Substituted Positions | $X_{1a}$ | $X_{1b}$ | $X_{2a}$ | $X_{2b}$ | Ar |
|---|---|---|---|---|---|---|
| I-194 | 2, 7 | 3-F | H | 6-F | H | 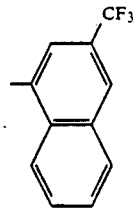 |
| I-195 | 2, 7 | 4-F | H | H | H | 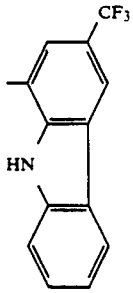 |

-continued
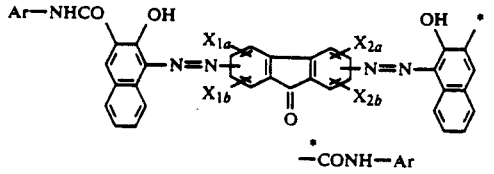
| No. | Azo-group Substituted Positions | $X_{1a}$ | $X_{1b}$ | $X_{2a}$ | $X_{2b}$ | Ar |
|---|---|---|---|---|---|---|
| I-196 | 2, 7 | 4-Cl | H | H | H | 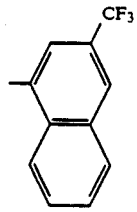 |
| I-197 | 2, 7 | 4-Cl | H | H | H | 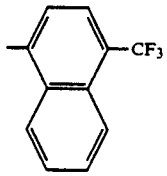 |
| I-198 | 2, 7 | 4-Cl | H | H | H | 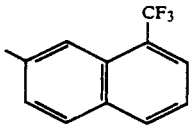 |
| I-199 | 2, 7 | 3-Cl | H | 6-Cl | H | 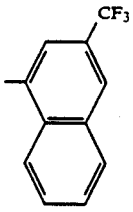 |
| I-200 | 2, 7 | 4-Cl | H | H | H | 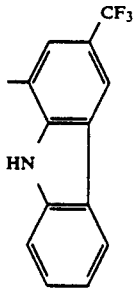 |
| I-201 | 2, 7 | 4-Br | H | H | H | 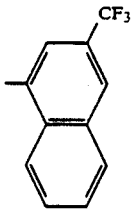 |
-continued
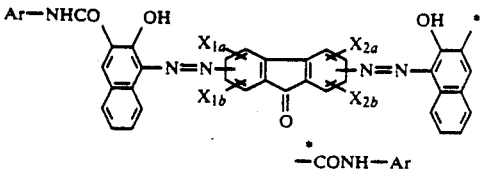
| No. | Azo-group Substituted Positions | $X_{1a}$ | $X_{1b}$ | $X_{2a}$ | $X_{2b}$ | Ar |
|---|---|---|---|---|---|---|
| I-202 | 2, 7 | 4-Br | H | H | H | 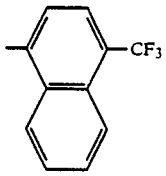 |
| I-203 | 2, 7 | 4-Br | H | H | H | 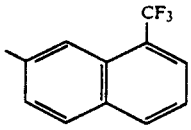 |
| I-204 | 2, 7 | 3-Br | H | 6-Br | H | 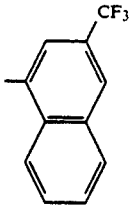 |
| I-205 | 2, 7 | 4-Br | H | H | H | 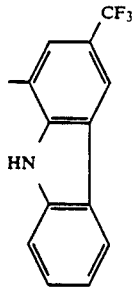 |
| I-206 | 2, 7 | 4-I | H | H | H | 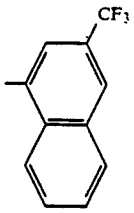 |
| I-207 | 2, 7 | 4-I | H | H | H | 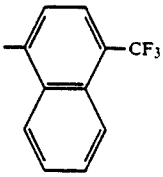 |

-continued
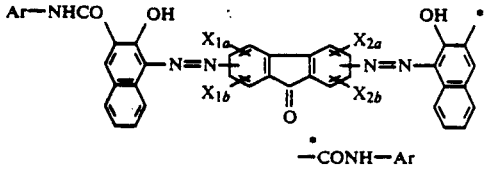
| No. | Azo-group Substituted Positions | $X_{1a}$ | $X_{1b}$ | $X_{2a}$ | $X_{2b}$ | Ar |
|---|---|---|---|---|---|---|
| I-208 | 2, 7 | 4-I | H | H | H | 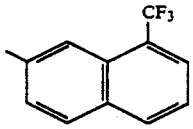 |
| I-209 | 2, 7 | 3-I | H | 6-I | H | 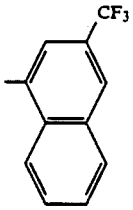 |
-continued
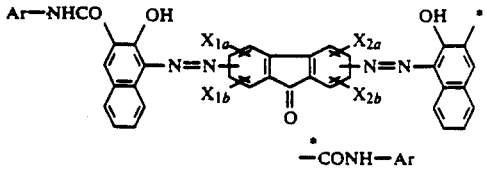
| No. | Azo-group Substituted Positions | $X_{1a}$ | $X_{1b}$ | $X_{2a}$ | $X_{2b}$ | Ar |
|---|---|---|---|---|---|---|
| I-210 | 2, 7 | 4-I | H | H | H | 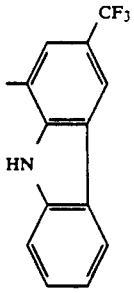 |
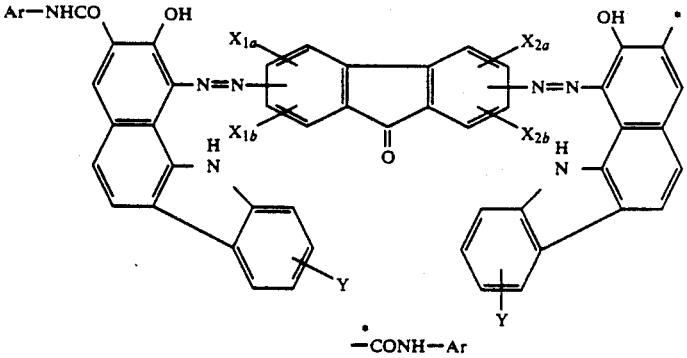
| No. | Azo-group Substituted Positions | $X_{1a}$ | $X_{1b}$ | $X_{2a}$ | $X_{2b}$ | YE | Ar |
|---|---|---|---|---|---|---|---|
| I-211 | 2, 7 | 4-F | H | H | H | H | 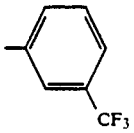 |
| I-212 | 2, 7 | 4-F | H | H | H | H | 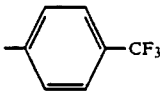 |
| I-213 | 2, 7 | 4-F | H | H | H | H | 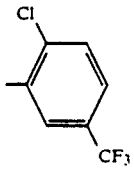 |

-continued
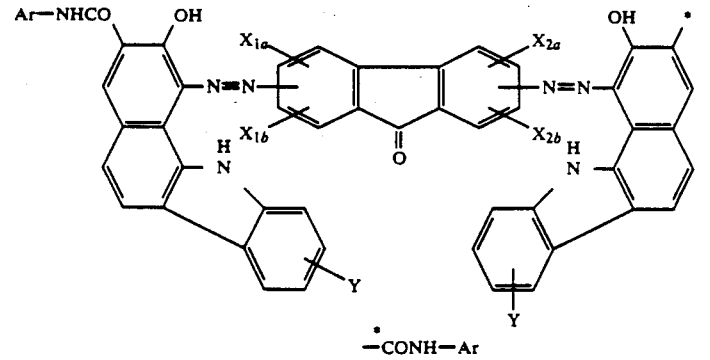
| No. | Azo-group Substituted Positions | $X_{1a}$ | $X_{1b}$ | $X_{2a}$ | $X_{2b}$ | YE | Ar |
|---|---|---|---|---|---|---|---|
| I-214 | 2, 7 | 3-F | H | H | H | Cl | 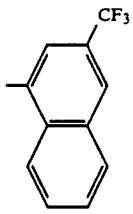 |
| I-215 | 2, 7 | 4-Cl | H | H | H | H | 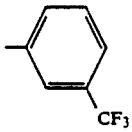 |
| I-216 | 2, 7 | 4-Cl | H | H | H | H | 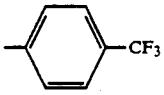 |
| I-217 | 2, 7 | 4-Cl | H | H | H | H | 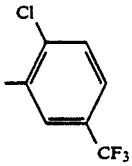 |
| I-218 | 2, 7 | 3-Cl | H | H | H | Cl | 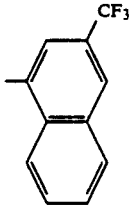 |
| I-219 | 2, 7 | 4-Br | H | H | H | H | 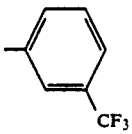 |
| I-220 | 2, 7 | 4-Br | H | H | H | H | 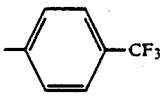 |

-continued
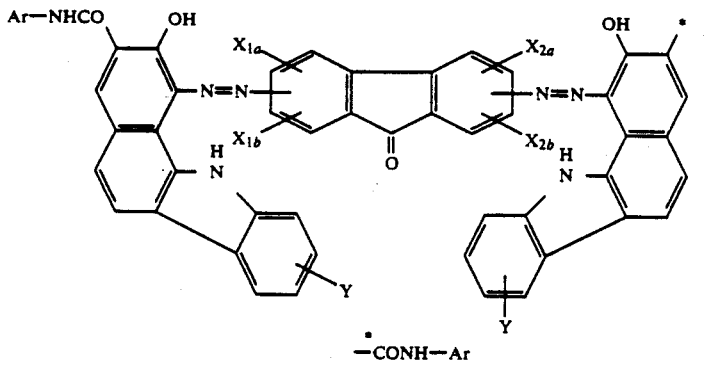
| No. | Azo-group Substituted Positions | $X_{1a}$ | $X_{1b}$ | $X_{2a}$ | $X_{2b}$ | YE | Ar |
|---|---|---|---|---|---|---|---|
| I-221 | 2, 7 | 4-Br | H | H | H | H | 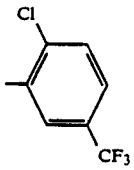 |
| I-222 | 2, 7 | 3-Br | H | H | H | Cl | 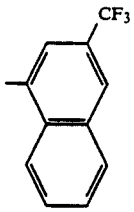 |
| I-223 | 2, 7 | 4-I | H | H | H | H | 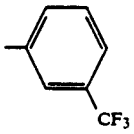 |
| I-224 | 2, 7 | 4-I | H | H | H | H | 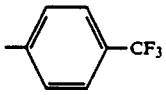 |
| I-225 | 2, 7 | 4-I | H | H | H | H | 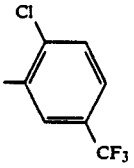 |
| I-226 | 2, 7 | 3-I | H | H | H | Cl | 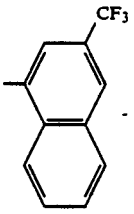 |

-continued
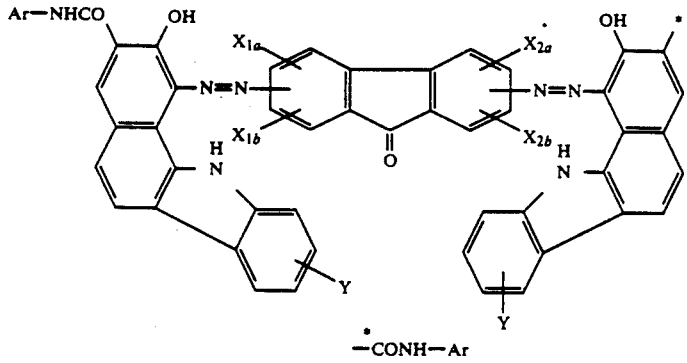
| No. | Azo-group Substituted Positions | $X_{1a}$ | $X_{1b}$ | $X_{2a}$ | $X_{2b}$ | YE | Ar |
|---|---|---|---|---|---|---|---|
| I-227 | 2, 6 | 4-F | H | H | H | H | 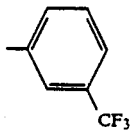 |
| I-228 | 2, 6 | 4-Cl | H | H | H | H | 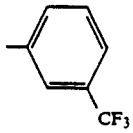 |
| I-229 | 2, 6 | 4-Br | H | H | H | H | 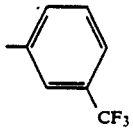 |
| I-230 | 2, 6 | 4-I | H | H | H | H | 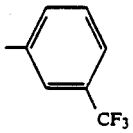 |
| I-231 | 3, 6 | 2-F | H | 7-F | H | H | 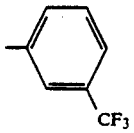 |
| I-232 | 3, 6 | 2-Cl | H | 7-Cl | H | H | 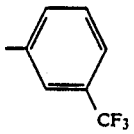 |
| I-233 | 3, 6 | 2-Br | H | 7-Br | H | H | 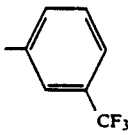 |

-continued

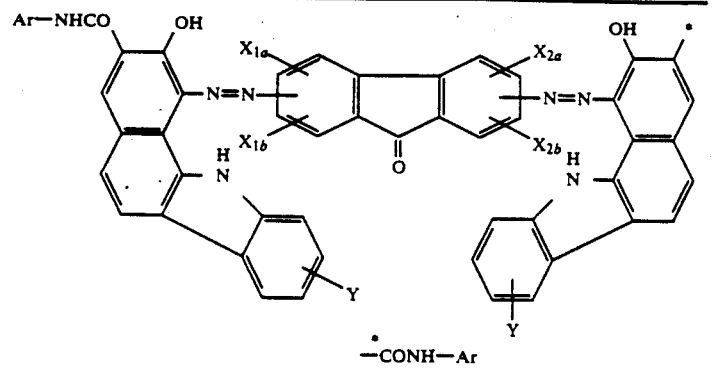

| No. | Azo-group Substituted Positions | $X_{1a}$ | $X_{1b}$ | $X_{2a}$ | $X_{2b}$ | YE | Ar |
|---|---|---|---|---|---|---|---|
| I-234 | 3, 6 | 2-I | H | 7-I | H | H | 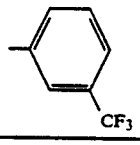 |

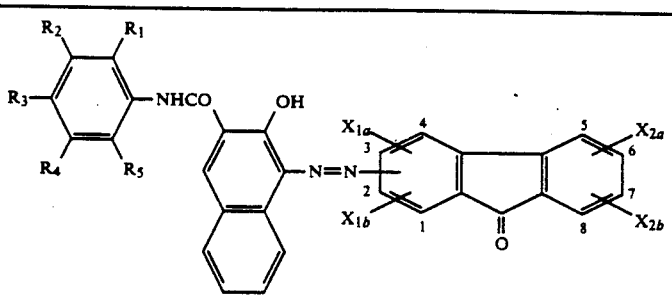

| No. | Azo-group Substituted Positions | $X_{1a}$ | $X_{1b}$ | $X_{2a}$ | $X_{2b}$ | $R_1$ | $R_2$ | $R_3$ | $R_4$ | $R_5$ |
|---|---|---|---|---|---|---|---|---|---|---|
| I-235 | 2 | 4-F | H | H | H | H | $CF_3$ | H | H | H |
| I-236 | 2 | 4-Cl | H | H | H | H | $CF_3$ | H | H | H |
| I-237 | 2 | 4-Br | H | H | H | H | $CF_3$ | H | H | H |
| I-238 | 2 | 4-I | H | H | H | H | $CF_3$ | H | H | H |
| I-239 | 2 | H | H | 5-F | H | H | $CF_3$ | H | H | H |
| I-240 | 2 | H | H | 5-Cl | H | H | $CF_3$ | H | H | H |
| I-241 | 2 | H | H | 5-Br | H | H | $CF_3$ | H | H | H |
| I-242 | 2 | H | H | 5-I | H | H | $CF_3$ | H | H | H |
| I-243 | 2 | 4-F | H | 7-OH | H | H | $CF_3$ | H | H | H |
| I-244 | 2 | 4-Cl | H | 7-OH | H | H | $CF_3$ | H | H | H |
| I-245 | 2 | 4-Br | H | 7-OH | H | H | $CF_3$ | H | H | H |
| I-246 | 2 | 4-I | H | 7-OH | H | H | $CF_3$ | H | H | H |
| I-247 | 2 | H | H | 5-F | 7-OH | H | $CF_3$ | H | H | H |
| I-248 | 2 | H | H | 5-Cl | 7-OH | H | $CF_3$ | H | H | H |
| I-249 | 2 | H | H | 5-Br | 7-OH | H | $CF_3$ | H | H | H |
| I-250 | 2 | H | H | 5-I | 7-OH | H | $CF_3$ | H | H | H |

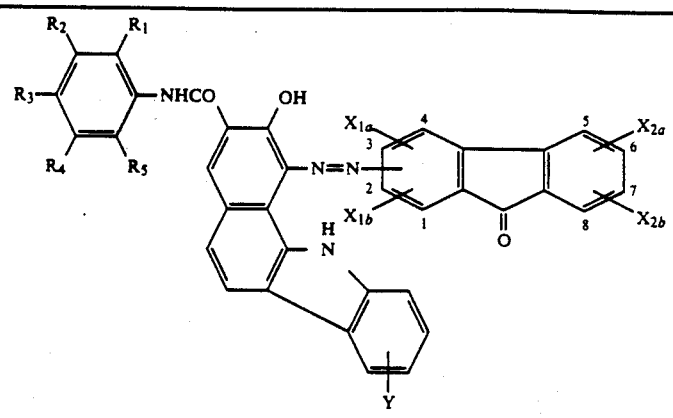

| No. | Azo-group Substituted Positions | $X_{1a}$ | $X_{1b}$ | $X_{2a}$ | $X_{2b}$ | Y | $R_1$ | $R_2$ | $R_3$ | $R_4$ | $R_5$ |
|---|---|---|---|---|---|---|---|---|---|---|---|
| I-251 | 2 | 4-F | H | H | H | H | H | $CF_3$ | H | H | H |
| I-252 | 2 | 4-Cl | H | H | H | H | H | $CF_3$ | H | H | H |
| I-253 | 2 | 4-Br | H | H | H | H | H | $CF_3$ | H | H | H |
| I-254 | 2 | 4-I | H | H | H | Cl | H | $CF_3$ | H | H | H |
| I-255 | 2 | H | H | 5-F | H | Cl | H | $CF_3$ | H | H | H |
| I-256 | 2 | H | H | 5-Cl | H | H | H | $CF_3$ | H | H | H |
| I-257 | 2 | H | H | 5-Br | H | H | H | $CF_3$ | H | H | H |
| I-258 | 2 | H | H | 5-I | H | H | H | $CF_3$ | H | H | H |
| I-259 | 2 | 4-F | H | 7-OH | H | Cl | H | $CF_3$ | H | H | H |
| I-260 | 2 | 4-Cl | H | 7-OH | H | H | H | $CF_3$ | H | H | H |
| I-261 | 2 | 4-Br | H | 7-OH | H | H | H | $CF_3$ | H | H | H |
| I-262 | 2 | 4-I | H | 7-OH | H | H | H | $CF_3$ | H | H | H |
| I-263 | 2 | H | H | 5-F | 7-OH | H | H | $CF_3$ | H | H | H |
| I-264 | 2 | H | H | 5-Cl | 7-OH | H | H | $CF_3$ | H | H | H |
| I-265 | 2 | H | H | 5-Br | 7-OH | H | H | $CF_3$ | H | H | H |
| I-266 | 2 | H | H | 5-I | 7-OH | Cl | H | $CF_3$ | H | H | H |

The azo compound expressed by the above mentioned General formula [I] of the present invention can be easily synthesized by a known process.

EXAMPLE OF SYNTHESIS 1

(Synthesis of an illustrated compound I-71)

2.89 g (0.01 mol) of 2, 7-diamino-4-brom-9-fluorenone was dispersed in 10 mL of hydrochloric acid and 20 mL of water, and a solution formed by dissolving 1.40 g (0.02 mol) of sodium nitrite in 5 mL of water was added in drops to the above solution while maintaining the temperature at 5° C. or lower. After such a solution continued to be further agitated for 1 hour at the above temperature, insoluble substances were removed by filtration, and a solution prepared by dissolving 4.6 g of 6-ammonium phosphate fluoride in 50 mL of water was added to the resulting filtrate. The precipitated tetrazonium salt was obtained by filtration and was then dissolved in 100 mL of N, N-dimethylformamide (DMF). A solution formed by dissolving 6.62 g (0.02 mol) of 2-hydroxy-3-naphthoic acid-3'-trifluoromethylanilide in 200 mL of DMF was further added in drops to the above solution with the temperature being kept at 5° C. or lower.

With the temperature being continuously kept at 5° C. or lower, a solution formed by dissolving 6 g (0.04 mol) of triethanolamine in 30 mL of DMF was added in drops, followed by agitation for 1 hour at 5° C. or lower and further for 4 hours at the room temperature. After the reaction, the precipitated crystals were obtained by filtration, washed with DMF and then with water and dried, thus resulting in 8.71 g of the target substance.

Theoretical value:
C=60.5%, H=2.77%, and N=8.63%.
Found value:
C=60.1%, H=2.95%, and N=8.72%.

EXAMPLE OF SYNTHESIS 2

(Synthesis of an illustrated compound I-219)

2.89 g (0.01 mol) of 2, 7-diamino-4-brom-9-fluorenone was dispersed in 10 mL of hydrochloric acid and 20 mL of water, and a solution formed by dissolving 1.40 g (0.02 mol) of sodium nitrite in 5 mL of water was added in drops to the foregoing solution while maintaining the temperature at 5° C. or lower. After further agitation for 1 hour at the above temperature, insoluble substances were removed by filtration, and a solution formed by dissolving 4.6 g of 6-ammonium phosphate fluoride in 50 mL of water was added to the resulting filtrate. The precipitated tetrazonium salt was obtained by filtration and was then dissolved in 100 mL of N, N-dimethylformamide (DMF). A solution formed by dissolving 8.40 g (0.02 mol) of 2-hydroxy-3- (3'-trifluoromethylphenylcarbamoyl) benzo [a] carbazole in 200 mL of DMF was added in drops with the temperature being kept at 5° C. or lower.

With the temperature continuing to be kept at 5° C. or lower, a solution formed by dissolving 6 g (0.04 mol) of triethanolamine in 30 mL of DMF was added in drops, followed by agitation for 1 hour at 5° C. or lower and further for 4 hours at the room temperature. After the reaction, the precipitated crystals were gained by filtration, washed with DMF and then washed with water, and were then dried, thus resulting in 5.2 g of the target substance.

Theoretical value:

C=63.6%, H=2.87%, and N=9.73%.

Found value:

C=63.4%, H=2.97%, and N=10.01%.

In the same process as described in the above mentioned Example of Synthesis 1, the other compounds of the present invention can also be prepared by producing diazonium salts with use of the respectively corresponding amino compounds and then allowing such salts to react with 2-hydroxy-3-naphthoic acid-substituted anilide or 2-hydroxy-3- (substituent phenylcarbamoyl) benzo [a]-substituted or unsubstituted carbazole.

The example of the halogen atom for $R_{11}$ and $R_{12}$ in General formula [II] can be illustrated as a chlorine atom, a bromide atom and an iodine atom, among which chlorine atom or bromide atom is preferable.

The alkyl group for $R_{11}$ and $R_{12}$ is preferably an alkyl group having 1 to 4 carbon atoms, for example, methyl group, ethyl group, isopropyl group, t-butyl group, trifluoromethyl group, etc.

The alkoxy group for $R_{11}$ and $R_{12}$ is preferably an alkoxy groups having 1 to 4 carbon atoms, such as methoxy group, ethoxy group, isopropoxy group, t-butoxy group, 2-chloroethoxy group, etc.

$R_{11}$ and $R_{12}$ are preferably selected from a halogen atom, an alkyl group and an alkoxy group. These $R_{11}$ and $R_{12}$ may be either same or different.

The alkyl group, alkoxy group and halogen atom represented by $R_{13}$ to $R_{17}$ can be illustrated by the same specific examples as those described in relation to $R_{11}$ and $R_{12}$ above.

The followings are examples of the azo compound represented by the above mentioned General formula [II] but the azo compounds of the present invention are in no way limited by such examples.

| No. | $R_{11}$ | $R_{12}$ | $R_{13}$ | $R_{14}$ | $R_{15}$ | $R_{16}$ | $R_{17}$ |
|---|---|---|---|---|---|---|---|
| II-1 | $CH_3$ | $CH_3$ | H | H | H | H | H |
| II-2 | $CH_3$ | $CH_3$ | $CH_3$ | H | H | H | H |
| II-3 | $CH_3$ | $CH_3$ | H | $CH_3$ | H | H | H |
| II-4 | $CH_3$ | $CH_3$ | H | H | $CH_3$ | H | H |
| II-5 | $CH_3$ | $CH_3$ | Cl | H | H | H | H |
| II-6 | $CH_3$ | $CH_3$ | H | Cl | H | H | H |
| II-7 | $CH_3$ | $CH_3$ | H | H | Cl | H | H |
| II-8 | $CH_3$ | $CH_3$ | Br | H | H | H | H |
| II-9 | $CH_3$ | $CH_3$ | H | Br | H | H | H |
| II-10 | $CH_3$ | $CH_3$ | H | H | Br | H | H |
| II-11 | $CH_3$ | $CH_3$ | I | H | H | H | H |
| II-12 | $CH_3$ | $CH_3$ | H | I | H | H | H |
| II-13 | $CH_3$ | $CH_3$ | H | H | I | H | H |
| II-14 | $CH_3$ | $CH_3$ | F | H | H | H | H |
| II-15 | $CH_3$ | $CH_3$ | H | F | H | H | H |
| II-16 | $CH_3$ | $CH_3$ | H | H | F | H | H |
| II-17 | $CH_3$ | $CH_3$ | $OCH_3$ | H | H | H | H |
| II-18 | $CH_3$ | $CH_3$ | H | $OCH_3$ | H | H | H |
| II-19 | $CH_3$ | $CH_3$ | H | H | $OCH_3$ | H | H |
| II-20 | $CH_3$ | $CH_3$ | $NO_2$ | H | H | H | H |
| II-21 | $CH_3$ | $CH_3$ | H | $NO_2$ | H | H | H |
| II-22 | $CH_3$ | $CH_3$ | H | H | $NO_2$ | H | H |
| II-23 | $CH_3$ | $CH_3$ | CN | H | H | H | H |
| II-24 | $CH_3$ | $CH_3$ | H | CN | H | H | H |
| II-25 | $CH_3$ | $CH_3$ | H | H | CN | H | H |
| II-26 | $CH_3$ | $CH_3$ | $CF_3$ | H | H | H | H |
| II-27 | $CH_3$ | $CH_3$ | H | $CF_3$ | H | H | H |
| II-28 | $CH_3$ | $CH_3$ | H | H | $CF_3$ | H | H |
| II-29 | $CH_3$ | $CH_3$ | Cl | $NO_2$ | H | H | H |
| II-30 | $CH_3$ | $CH_3$ | Cl | H | $NO_2$ | H | H |
| II-31 | $CH_3$ | $CH_3$ | Cl | H | H | $NO_2$ | H |
| II-32 | $CH_3$ | $CH_3$ | Cl | $CH_3$ | H | H | H |
| II-33 | $CH_3$ | $CH_3$ | Cl | H | $CH_3$ | H | H |
| II-34 | $CH_3$ | $CH_3$ | Cl | H | H | $CH_3$ | H |
| II-35 | $CH_3$ | $CH_3$ | Cl | Cl | H | H | H |
| II-36 | $CH_3$ | $CH_3$ | Cl | H | Cl | H | H |
| II-37 | $CH_3$ | $CH_3$ | Cl | H | H | Cl | H |
| II-38 | $CH_3$ | $CH_3$ | H | Cl | Cl | H | H |
| II-39 | $CH_3$ | $CH_3$ | H | Cl | H | Cl | H |
| II-40 | $CH_3$ | $CH_3$ | $CH_3$ | $CH_3$ | H | H | H |
| II-41 | $CH_3$ | $CH_3$ | $CH_3$ | H | $CH_3$ | H | H |
| II-42 | $CH_3$ | $CH_3$ | $CH_3$ | H | H | $CH_3$ | H |
| II-43 | $CH_3$ | $CH_3$ | $CH_3$ | Cl | H | H | H |
| II-44 | $CH_3$ | $CH_3$ | $CH_3$ | H | Cl | H | H |
| II-45 | $CH_3$ | $CH_3$ | $CH_3$ | H | H | Cl | H |
| II-46 | $CH_3$ | $CH_3$ | H | $CH_3$ | $CH_3$ | H | H |
| II-47 | $CH_3$ | $CH_3$ | H | $CH_3$ | H | $CH_3$ | H |
| II-48 | $CH_3$ | $CH_3$ | $OCH_3$ | Cl | H | H | H |
| II-49 | $CH_3$ | $CH_3$ | $OCH_3$ | H | Cl | H | H |
| II-50 | $CH_3$ | $CH_3$ | $OCH_3$ | H | H | Cl | H |
| II-51 | $CH_3$ | $CH_3$ | $OCH_3$ | $OCH_3$ | H | H | H |
| II-52 | $CH_3$ | $CH_3$ | $OCH_3$ | H | $OCH_3$ | H | H |
| II-53 | $CH_3$ | $CH_3$ | $OCH_3$ | H | H | $OCH_3$ | H |
| II-54 | $CH_3$ | $CH_3$ | $OCH_3$ | $CH_3$ | H | H | H |
| II-55 | $CH_3$ | $CH_3$ | $OCH_3$ | H | $CH_3$ | H | H |
| II-56 | $CH_3$ | $CH_3$ | $OCH_3$ | H | H | $CH_3$ | H |
| II-57 | $CH_3$ | $CH_3$ | H | $OCH_3$ | $OCH_3$ | H | H |

-continued

| No. | $R_{11}$ | $R_{12}$ | $R_{13}$ | $R_{14}$ | $R_{15}$ | $R_{16}$ | $R_{17}$ |
|---|---|---|---|---|---|---|---|
| II-58 | $CH_3$ | $CH_3$ | H | $OCH_3$ | H | $OCH_3$ | H |
| II-59 | $CH_3$ | $CH_3$ | I | I | H | H | H |
| II-60 | $CH_3$ | $CH_3$ | I | H | I | H | H |
| II-61 | $CH_3$ | $CH_3$ | I | H | H | I | H |
| II-62 | $CH_3$ | $CH_3$ | H | I | I | H | H |
| II-63 | $CH_3$ | $CH_3$ | H | I | H | I | H |
| II-64 | $CH_3$ | $CH_3$ | F | F | H | H | H |
| II-65 | $CH_3$ | $CH_3$ | F | H | F | H | H |
| II-66 | $CH_3$ | $CH_3$ | F | H | H | F | H |
| II-67 | $CH_3$ | $CH_3$ | H | F | F | H | H |
| II-68 | $CH_3$ | $CH_3$ | H | F | H | F | H |
| II-69 | $CH_3$ | $CH_3$ | Br | Br | H | H | H |
| II-70 | $CH_3$ | $CH_3$ | Br | H | Br | H | H |
| II-71 | $CH_3$ | $CH_3$ | Br | H | H | Br | H |
| II-72 | $CH_3$ | $CH_3$ | H | Br | Br | H | H |
| II-73 | $CH_3$ | $CH_3$ | H | Br | H | Br | H |
| II-74 | $CH_3$ | $CH_3$ | $CH_3$ | H | H | H | $CH_3$ |
| II-75 | $CH_3$ | $CH_3$ | $OCH_3$ | H | H | H | $OCH_3$ |
| II-76 | $CH_3$ | $CH_3$ | Cl | H | H | H | Cl |
| II-77 | $CH_3$ | $CH_3$ | Br | H | H | H | Br |
| II-78 | $OCH_3$ | $OCH_3$ | H | H | H | H | H |
| II-79 | $OCH_3$ | $OCH_3$ | $CH_3$ | H | H | H | H |
| II-80 | $OCH_3$ | $OCH_3$ | H | $CH_3$ | H | H | H |
| II-81 | $OCH_3$ | $OCH_3$ | H | H | $CH_3$ | H | H |
| II-82 | $OCH_3$ | $OCH_3$ | Cl | H | H | H | H |
| II-83 | $OCH_3$ | $OCH_3$ | H | Cl | H | H | H |
| II-84 | $OCH_3$ | $OCH_3$ | H | H | Cl | H | H |
| II-85 | $OCH_3$ | $OCH_3$ | Br | H | H | H | H |
| II-86 | $OCH_3$ | $OCH_3$ | H | Br | H | H | H |
| II-87 | $OCH_3$ | $OCH_3$ | H | H | Br | H | H |
| II-88 | $OCH_3$ | $OCH_3$ | I | H | H | H | H |
| II-89 | $OCH_3$ | $OCH_3$ | H | I | H | H | H |
| II-90 | $OCH_3$ | $OCH_3$ | H | H | I | H | H |
| II-91 | $OCH_3$ | $OCH_3$ | F | H | H | H | H |
| II-92 | $OCH_3$ | $OCH_3$ | H | F | H | H | H |
| II-93 | $OCH_3$ | $OCH_3$ | H | H | F | H | H |
| II-94 | $OCH_3$ | $OCH_3$ | $OCH_3$ | H | H | H | H |
| II-95 | $OCH_3$ | $OCH_3$ | H | $OCH_3$ | H | H | H |
| II-96 | $OCH_3$ | $OCH_3$ | H | H | $OCH_3$ | H | H |
| II-97 | $OCH_3$ | $OCH_3$ | $NO_2$ | H | H | H | H |
| II-98 | $OCH_3$ | $OCH_3$ | H | $NO_2$ | H | H | H |
| II-99 | $OCH_3$ | $OCH_3$ | H | H | $NO_2$ | H | H |
| II-100 | $OCH_3$ | $OCH_3$ | CN | H | H | H | H |
| II-101 | $OCH_3$ | $OCH_3$ | H | CN | H | H | H |
| II-102 | $OCH_3$ | $OCH_3$ | H | H | CN | H | H |
| II-103 | $OCH_3$ | $OCH_3$ | $CF_3$ | H | H | H | H |
| II-104 | $OCH_3$ | $OCH_3$ | H | $CF_3$ | H | H | H |
| II-105 | $OCH_3$ | $OCH_3$ | H | H | $CF_3$ | H | H |
| II-106 | $OCH_3$ | $OCH_3$ | Cl | Cl | H | H | H |
| II-107 | $OCH_3$ | $OCH_3$ | Cl | H | Cl | H | H |
| II-108 | $OCH_3$ | $OCH_3$ | Cl | H | H | Cl | H |
| II-109 | $OCH_3$ | $OCH_3$ | Cl | $NO_2$ | H | H | H |
| II-110 | $OCH_3$ | $OCH_3$ | Cl | H | $NO_2$ | H | H |
| II-111 | $OCH_3$ | $OCH_3$ | Cl | H | H | $NO_2$ | H |
| II-112 | $OCH_3$ | $OCH_3$ | Cl | $CH_3$ | H | H | H |
| II-113 | $OCH_3$ | $OCH_3$ | Cl | H | $CH_3$ | H | H |
| II-114 | $OCH_3$ | $OCH_3$ | Cl | H | H | $CH_3$ | H |
| II-115 | $OCH_3$ | $OCH_3$ | H | Cl | Cl | H | H |
| II-116 | $OCH_3$ | $OCH_3$ | H | Cl | H | Cl | H |
| II-117 | $OCH_3$ | $OCH_3$ | $CH_3$ | $CH_3$ | H | H | H |
| II-118 | $OCH_3$ | $OCH_3$ | $CH_3$ | H | $CH_3$ | H | H |
| II-119 | $OCH_3$ | $OCH_3$ | $CH_3$ | H | H | $CH_3$ | H |
| II-120 | $OCH_3$ | $OCH_3$ | $CH_3$ | Cl | H | H | H |
| II-121 | $OCH_3$ | $OCH_3$ | $CH_3$ | H | Cl | H | H |
| II-122 | $OCH_3$ | $OCH_3$ | $CH_3$ | H | H | Cl | H |
| II-123 | $OCH_3$ | $OCH_3$ | $CH_3$ | $OCH_3$ | H | H | H |
| II-124 | $OCH_3$ | $OCH_3$ | $CH_3$ | H | $OCH_3$ | H | H |
| II-125 | $OCH_3$ | $OCH_3$ | $CH_3$ | H | H | $OCH_3$ | H |
| II-126 | $OCH_3$ | $OCH_3$ | H | $CH_3$ | $CH_3$ | H | H |
| II-127 | $OCH_3$ | $OCH_3$ | H | $CH_3$ | H | $CH_3$ | H |
| II-128 | $OCH_3$ | $OCH_3$ | $OCH_3$ | Cl | H | H | H |
| II-129 | $OCH_3$ | $OCH_3$ | $OCH_3$ | H | Cl | H | H |
| II-130 | $OCH_3$ | $OCH_3$ | $OCH_3$ | H | H | Cl | H |
| II-131 | $OCH_3$ | $OCH_3$ | $OCH_3$ | $OCH_3$ | H | H | H |
| II-132 | $OCH_3$ | $OCH_3$ | $OCH_3$ | H | $OCH_3$ | H | H |
| II-133 | $OCH_3$ | $OCH_3$ | $OCH_3$ | H | H | $OCH_3$ | H |
| II-134 | $OCH_3$ | $OCH_3$ | $OCH_3$ | $CH_3$ | H | H | H |
| II-135 | $OCH_3$ | $OCH_3$ | $OCH_3$ | H | $CH_3$ | H | H |
| II-136 | $OCH_3$ | $OCH_3$ | $OCH_3$ | H | H | $CH_3$ | H |
| II-137 | $OCH_3$ | $OCH_3$ | H | $OCH_3$ | $OCH_3$ | H | H |
| II-138 | $OCH_3$ | $OCH_3$ | H | $OCH_3$ | H | $OCH_3$ | H |

-continued

| No. | $R_{11}$ | $R_{12}$ | $R_{13}$ | $R_{14}$ | $R_{15}$ | $R_{16}$ | $R_{17}$ |
|---|---|---|---|---|---|---|---|
| II-139 | $OCH_3$ | $OCH_3$ | H | Cl | H | Cl | H |
| II-140 | $OCH_3$ | $OCH_3$ | $CH_3$ | $CH_3$ | H | H | $CH_3$ |
| II-141 | $OCH_3$ | $OCH_3$ | $CH_3$ | H | $CH_3$ | H | $CH_3$ |
| II-142 | $OCH_3$ | $OCH_3$ | $CH_3$ | H | H | $CH_3$ | $CH_3$ |
| II-143 | $OCH_3$ | $OCH_3$ | $CH_3$ | Cl | H | H | $CH_3$ |
| II-144 | $OCH_3$ | $OCH_3$ | $CH_3$ | H | Cl | H | $CH_3$ |
| II-145 | $OCH_3$ | $OCH_3$ | $CH_3$ | H | H | Cl | $CH_3$ |
| II-146 | $OCH_3$ | $OCH_3$ | H | $CH_3$ | $CH_3$ | H | $CH_3$ |
| II-147 | $OCH_3$ | $OCH_3$ | H | $CH_3$ | H | $CH_3$ | $CH_3$ |
| II-148 | $OCH_3$ | $OCH_3$ | $OCH_3$ | Cl | H | H | $OCH_3$ |
| II-149 | $OCH_3$ | $OCH_3$ | $OCH_3$ | H | Cl | H | $OCH_3$ |
| II-150 | $OCH_3$ | $OCH_3$ | $OCH_3$ | H | H | Cl | $OCH_3$ |
| II-151 | $OCH_3$ | $OCH_3$ | $OCH_3$ | $OCH_3$ | H | H | $OCH_3$ |
| II-152 | $OCH_3$ | $OCH_3$ | $OCH_3$ | H | $OCH_3$ | H | $OCH_3$ |
| II-153 | $OCH_3$ | $OCH_3$ | $OCH_3$ | H | H | $OCH_3$ | $OCH_3$ |
| II-154 | $OCH_3$ | $OCH_3$ | $OCH_3$ | $CH_3$ | H | H | $OCH_3$ |
| II-155 | $OCH_3$ | $OCH_3$ | $OCH_3$ | H | $CH_3$ | H | $OCH_3$ |
| II-156 | $OCH_3$ | $OCH_3$ | $OCH_3$ | H | H | $CH_3$ | $OCH_3$ |
| II-157 | $OCH_3$ | $OCH_3$ | H | $OCH_3$ | $OCH_3$ | H | $OCH_3$ |
| II-158 | $OCH_3$ | $OCH_3$ | H | $OCH_3$ | H | $OCH_3$ | $OCH_3$ |
| II-159 | $OCH_3$ | $OCH_3$ | I | I | H | H | H |
| II-160 | $OCH_3$ | $OCH_3$ | I | H | I | H | H |
| II-161 | $OCH_3$ | $OCH_3$ | I | H | H | I | H |
| II-162 | $OCH_3$ | $OCH_3$ | H | I | I | H | H |
| II-163 | $OCH_3$ | $OCH_3$ | H | I | H | I | H |
| II-164 | $OCH_3$ | $OCH_3$ | F | F | H | H | H |
| II-165 | $OCH_3$ | $OCH_3$ | F | H | F | H | H |
| II-166 | $OCH_3$ | $OCH_3$ | F | H | H | F | H |
| II-167 | $OCH_3$ | $OCH_3$ | H | F | F | H | H |
| II-168 | $OCH_3$ | $OCH_3$ | H | F | H | F | H |
| II-169 | $OCH_3$ | $OCH_3$ | Br | Br | H | H | H |
| II-170 | $OCH_3$ | $OCH_3$ | Br | H | Br | H | H |
| II-171 | $OCH_3$ | $OCH_3$ | Br | H | H | Br | H |
| II-172 | $OCH_3$ | $OCH_3$ | H | Br | Br | H | H |
| II-173 | $OCH_3$ | $OCH_3$ | H | Br | H | Br | H |
| II-174 | $OCH_3$ | $OCH_3$ | $CH_3$ | H | H | H | $CH_3$ |
| II-175 | $OCH_3$ | $OCH_3$ | $OCH_3$ | H | H | H | $OCH_3$ |
| II-176 | $OCH_3$ | $OCH_3$ | Br | H | H | H | Br |
| II-177 | $CH_3$ | $OCH_3$ | H | H | H | H | H |
| II-178 | $CH_3$ | $OCH_3$ | $CH_3$ | H | H | H | H |
| II-179 | $CH_3$ | $OCH_3$ | H | $CH_3$ | H | H | H |
| II-180 | $CH_3$ | $OCH_3$ | H | H | $CH_3$ | H | H |
| II-181 | $CH_3$ | $OCH_3$ | Cl | H | H | H | H |
| II-182 | $CH_3$ | $OCH_3$ | H | Cl | H | H | H |
| II-183 | $CH_3$ | $OCH_3$ | H | H | Cl | H | H |
| II-184 | $CH_3$ | $OCH_3$ | Br | H | H | H | H |
| II-185 | $CH_3$ | $OCH_3$ | H | Br | H | H | H |
| II-186 | $CH_3$ | $OCH_3$ | H | H | Br | H | H |
| II-187 | $CH_3$ | $OCH_3$ | I | H | H | H | H |
| II-188 | $CH_3$ | $OCH_3$ | H | I | H | H | H |
| II-189 | $CH_3$ | $OCH_3$ | H | H | I | H | H |
| II-190 | $CH_3$ | $OCH_3$ | F | H | H | H | H |
| II-191 | $CH_3$ | $OCH_3$ | H | F | H | H | H |
| II-192 | $CH_3$ | $OCH_3$ | H | H | F | H | H |
| II-193 | $CH_3$ | $OCH_3$ | $OCH_3$ | H | H | H | H |
| II-194 | $CH_3$ | $OCH_3$ | H | $OCH_3$ | H | H | H |
| II-195 | $CH_3$ | $OCH_3$ | H | H | $OCH_3$ | H | H |
| II-196 | $CH_3$ | $OCH_3$ | $NO_2$ | H | H | H | H |
| II-197 | $CH_3$ | $OCH_3$ | H | $NO_2$ | H | H | H |
| II-198 | $CH_3$ | $OCH_3$ | H | H | $NO_2$ | H | H |
| II-199 | $CH_3$ | $OCH_3$ | CN | H | H | H | H |
| II-200 | $CH_3$ | $OCH_3$ | H | CN | H | H | H |
| II-201 | $CH_3$ | $OCH_3$ | H | H | CN | H | H |
| II-202 | $CH_3$ | $OCH_3$ | $CF_3$ | H | H | H | H |
| II-203 | $CH_3$ | $OCH_3$ | H | $CF_3$ | H | H | H |
| II-204 | $CH_3$ | $OCH_3$ | H | H | $CF_3$ | H | H |
| II-205 | $CH_3$ | $OCH_3$ | Cl | Cl | H | H | H |
| II-206 | $CH_3$ | $OCH_3$ | Cl | H | Cl | H | H |
| II-207 | $CH_3$ | $OCH_3$ | Cl | H | H | Cl | H |
| II-208 | $CH_3$ | $OCH_3$ | Cl | $NO_2$ | H | H | H |
| II-209 | $CH_3$ | $OCH_3$ | Cl | H | $NO_2$ | H | H |
| II-210 | $CH_3$ | $OCH_3$ | Cl | H | H | $NO_2$ | H |
| II-211 | $CH_3$ | $OCH_3$ | Cl | $CH_3$ | H | H | H |
| II-212 | $CH_3$ | $OCH_3$ | Cl | H | $CH_3$ | H | H |
| II-213 | $CH_3$ | $OCH_3$ | Cl | H | H | $CH_3$ | H |
| II-214 | $CH_3$ | $OCH_3$ | H | Cl | Cl | H | H |
| II-215 | $CH_3$ | $OCH_3$ | H | Cl | H | Cl | H |
| II-216 | $CH_3$ | $OCH_3$ | $CH_3$ | $CH_3$ | H | H | H |
| II-217 | $CH_3$ | $OCH_3$ | $CH_3$ | H | $CH_3$ | H | H |
| II-218 | $CH_3$ | $OCH_3$ | $CH_3$ | H | H | $CH_3$ | H |
| II-219 | $CH_3$ | $OCH_3$ | $CH_3$ | Cl | H | H | H |

-continued

| No. | $R_{11}$ | $R_{12}$ | $R_{13}$ | $R_{14}$ | $R_{15}$ | $R_{16}$ | $R_{17}$ |
|---|---|---|---|---|---|---|---|
| II-220 | $CH_3$ | $OCH_3$ | $CH_3$ | H | Cl | H | H |
| II-221 | $CH_3$ | $OCH_3$ | $CH_3$ | H | H | Cl | H |
| II-222 | $CH_3$ | $OCH_3$ | $CH_3$ | $OCH_3$ | H | H | H |
| II-223 | $CH_3$ | $OCH_3$ | $CH_3$ | H | $OCH_3$ | H | H |
| II-224 | $CH_3$ | $OCH_3$ | $CH_3$ | H | H | $OCH_3$ | H |
| II-225 | $CH_3$ | $OCH_3$ | H | $CH_3$ | $CH_3$ | H | H |
| II-226 | $CH_3$ | $OCH_3$ | H | $CH_3$ | H | $CH_3$ | H |
| II-227 | $CH_3$ | $OCH_3$ | $OCH_3$ | Cl | H | H | H |
| II-228 | $CH_3$ | $OCH_3$ | $OCH_3$ | H | Cl | H | H |
| II-229 | $CH_3$ | $OCH_3$ | $OCH_3$ | H | H | Cl | H |
| II-230 | $CH_3$ | $OCH_3$ | $OCH_3$ | $OCH_3$ | H | H | H |
| II-231 | $CH_3$ | $OCH_3$ | $OCH_3$ | H | $OCH_3$ | H | H |
| II-232 | $CH_3$ | $OCH_3$ | $OCH_3$ | H | H | $OCH_3$ | H |
| II-233 | $CH_3$ | $OCH_3$ | $OCH_3$ | $CH_3$ | H | H | H |
| II-234 | $CH_3$ | $OCH_3$ | $OCH_3$ | H | $CH_3$ | H | H |
| II-235 | $CH_3$ | $OCH_3$ | $OCH_3$ | H | H | $CH_3$ | H |
| II-236 | $CH_3$ | $OCH_3$ | H | $OCH_3$ | $OCH_3$ | H | H |
| II-237 | $CH_3$ | $OCH_3$ | H | $OCH_3$ | H | $OCH_3$ | H |
| II-238 | $CH_3$ | $OCH_3$ | $CH_3$ | $CH_3$ | H | H | $CH_3$ |
| II-239 | $CH_3$ | $OCH_3$ | $CH_3$ | H | $CH_3$ | H | $CH_3$ |
| II-240 | $CH_3$ | $OCH_3$ | $CH_3$ | H | H | $CH_3$ | $CH_3$ |
| II-241 | $CH_3$ | $OCH_3$ | $CH_3$ | Cl | H | H | $CH_3$ |
| II-242 | $CH_3$ | $OCH_3$ | $CH_3$ | H | Cl | H | $CH_3$ |
| II-243 | $CH_3$ | $OCH_3$ | $CH_3$ | H | H | Cl | $CH_3$ |
| II-244 | $CH_3$ | $OCH_3$ | H | $CH_3$ | $CH_3$ | H | $CH_3$ |
| II-245 | $CH_3$ | $OCH_3$ | H | $CH_3$ | H | $CH_3$ | $CH_3$ |
| II-246 | $CH_3$ | $OCH_3$ | $OCH_3$ | Cl | H | H | $OCH_3$ |
| II-247 | $CH_3$ | $OCH_3$ | $OCH_3$ | H | Cl | H | $OCH_3$ |
| II-248 | $CH_3$ | $OCH_3$ | $OCH_3$ | H | H | Cl | $OCH_3$ |
| II-249 | $CH_3$ | $OCH_3$ | $OCH_3$ | $OCH_3$ | H | H | $OCH_3$ |
| II-250 | $CH_3$ | $OCH_3$ | $OCH_3$ | H | $OCH_3$ | H | $OCH_3$ |
| II-251 | $CH_3$ | $OCH_3$ | $OCH_3$ | H | H | $OCH_3$ | $OCH_3$ |
| II-252 | $CH_3$ | $OCH_3$ | $OCH_3$ | $CH_3$ | H | H | $OCH_3$ |
| II-253 | $CH_3$ | $OCH_3$ | $OCH_3$ | H | $CH_3$ | H | $OCH_3$ |
| II-254 | $CH_3$ | $OCH_3$ | $OCH_3$ | H | H | $CH_3$ | $OCH_3$ |
| II-255 | $CH_3$ | $OCH_3$ | H | $OCH_3$ | $OCH_3$ | H | $OCH_3$ |
| II-256 | $CH_3$ | $OCH_3$ | H | $OCH_3$ | H | $OCH_3$ | $OCH_3$ |
| II-257 | $CH_3$ | $OCH_3$ | I | I | H | H | H |
| II-258 | $CH_3$ | $OCH_3$ | I | H | I | H | H |
| II-259 | $CH_3$ | $OCH_3$ | I | H | H | I | H |
| II-260 | $CH_3$ | $OCH_3$ | H | I | I | H | H |
| II-261 | $CH_3$ | $OCH_3$ | H | I | H | I | H |
| II-262 | $CH_3$ | $OCH_3$ | F | F | H | H | H |
| II-263 | $CH_3$ | $OCH_3$ | F | H | F | H | H |
| II-264 | $CH_3$ | $OCH_3$ | F | H | H | F | H |
| II-265 | $CH_3$ | $OCH_3$ | H | F | F | H | H |
| II-266 | $CH_3$ | $OCH_3$ | H | F | H | F | H |
| II-267 | $CH_3$ | $OCH_3$ | Br | Br | H | H | H |
| II-268 | $CH_3$ | $OCH_3$ | Br | H | Br | H | H |
| II-269 | $CH_3$ | $OCH_3$ | Br | H | H | Br | H |
| II-270 | $CH_3$ | $OCH_3$ | H | Br | Br | H | H |
| II-271 | $CH_3$ | $OCH_3$ | H | Br | H | Br | H |
| II-272 | $CH_3$ | $OCH_3$ | $CH_3$ | H | H | H | $CH_3$ |
| II-273 | $CH_3$ | $OCH_3$ | $OCH_3$ | H | H | H | $OCH_3$ |
| II-274 | $CH_3$ | $OCH_3$ | Br | H | H | H | Br |
| II-275 | $CH_3$ | $OCH_3$ | Cl | H | H | H | Cl |
| II-276 | $CH_3$ | $OCH_3$ | $CH_3$ | H | H | H | Cl |
| II-277 | Cl | Cl | H | H | H | H | H |
| II-278 | Cl | Cl | $CH_3$ | H | H | H | H |
| II-279 | Cl | Cl | H | $CH_3$ | H | H | H |
| II-280 | Cl | Cl | H | H | $CH_3$ | H | H |
| II-281 | Cl | Cl | Cl | H | H | H | H |
| II-282 | Cl | Cl | H | Cl | H | H | H |
| II-283 | Cl | Cl | H | H | Cl | H | H |
| II-284 | Cl | Cl | Br | H | H | H | H |
| II-285 | Cl | Cl | H | Br | H | H | H |
| II-286 | Cl | Cl | H | H | Br | H | H |
| II-287 | Cl | Cl | I | H | H | H | H |
| II-288 | Cl | Cl | H | I | H | H | H |
| II-289 | Cl | Cl | H | H | I | H | H |
| II-290 | Cl | Cl | F | H | H | H | H |
| II-291 | Cl | Cl | H | F | H | H | H |
| II-292 | Cl | Cl | H | H | F | H | H |
| II-293 | Cl | Cl | $OCH_3$ | H | H | H | H |
| II-294 | Cl | Cl | H | $OCH_3$ | H | H | H |
| II-295 | Cl | Cl | H | H | $OCH_3$ | H | H |
| II-296 | Cl | Cl | $NO_2$ | H | H | H | H |
| II-297 | Cl | Cl | H | $NO_2$ | H | H | H |
| II-298 | Cl | Cl | H | H | $NO_2$ | H | H |
| II-299 | Cl | Cl | CN | H | H | H | H |
| II-300 | Cl | Cl | H | CN | H | H | H |

-continued

| No. | $R_{11}$ | $R_{12}$ | $R_{13}$ | $R_{14}$ | $R_{15}$ | $R_{16}$ | $R_{17}$ |
|---|---|---|---|---|---|---|---|
| II-301 | Cl | Cl | H | H | CN | H | H |
| II-302 | Cl | Cl | $CF_3$ | H | H | H | H |
| II-303 | Cl | Cl | H | $CF_3$ | H | H | H |
| II-304 | Cl | Cl | H | H | $CF_3$ | H | H |
| II-305 | Cl | Cl | Cl | Cl | H | H | H |
| II-306 | Cl | Cl | Cl | H | Cl | H | H |
| II-307 | Cl | Cl | Cl | H | H | Cl | H |
| II-308 | Cl | Cl | Cl | $NO_2$ | H | H | H |
| II-309 | Cl | Cl | Cl | H | $NO_2$ | H | H |
| II-310 | Cl | Cl | Cl | H | H | $NO_2$ | H |
| II-311 | Cl | Cl | Cl | $CH_3$ | H | H | H |
| II-312 | Cl | Cl | Cl | H | $CH_3$ | H | H |
| II-313 | Cl | Cl | Cl | H | H | $CH_3$ | H |
| II-314 | Cl | Cl | H | Cl | Cl | H | H |
| II-315 | Cl | Cl | H | Cl | H | Cl | H |
| II-316 | Cl | Cl | $CH_3$ | $CH_3$ | H | H | H |
| II-317 | Cl | Cl | $CH_3$ | H | $CH_3$ | H | H |
| II-318 | Cl | Cl | $CH_3$ | H | H | $CH_3$ | H |
| II-319 | Cl | Cl | $CH_3$ | Cl | H | H | H |
| II-320 | Cl | Cl | $CH_3$ | H | Cl | H | H |
| II-321 | Cl | Cl | $CH_3$ | H | H | Cl | H |
| II-322 | Cl | Cl | $CH_3$ | $OCH_3$ | H | H | H |
| II-323 | Cl | Cl | $CH_3$ | H | $OCH_3$ | H | H |
| II-324 | Cl | Cl | $CH_3$ | H | H | $OCH_3$ | H |
| II-325 | Cl | Cl | H | $CH_3$ | $CH_3$ | H | H |
| II-326 | Cl | Cl | H | $CH_3$ | H | $CH_3$ | H |
| II-327 | Cl | Cl | $OCH_3$ | Cl | H | H | H |
| II-328 | Cl | Cl | $OCH_3$ | H | Cl | H | H |
| II-329 | Cl | Cl | $OCH_3$ | H | H | Cl | H |
| II-330 | Cl | Cl | $OCH_3$ | $OCH_3$ | H | H | H |
| II-331 | Cl | Cl | $OCH_3$ | H | $OCH_3$ | H | H |
| II-332 | Cl | Cl | $OCH_3$ | H | H | $OCH_3$ | H |
| II-333 | Cl | Cl | $OCH_3$ | $CH_3$ | H | H | H |
| II-334 | Cl | Cl | $OCH_3$ | H | $CH_3$ | H | H |
| II-335 | Cl | Cl | $OCH_3$ | H | H | $CH_3$ | H |
| II-336 | Cl | Cl | H | $OCH_3$ | $OCH_3$ | H | H |
| II-337 | Cl | Cl | H | $OCH_3$ | H | $OCH_3$ | H |
| II-338 | Cl | Cl | $CH_3$ | $CH_3$ | H | H | $CH_3$ |
| II-339 | Cl | Cl | $CH_3$ | H | $CH_3$ | H | $CH_3$ |
| II-340 | Cl | Cl | $CH_3$ | H | H | $CH_3$ | $CH_3$ |
| II-341 | Cl | Cl | $CH_3$ | Cl | H | H | $CH_3$ |
| II-342 | Cl | Cl | $CH_3$ | H | Cl | H | $CH_3$ |
| II-343 | Cl | Cl | $CH_3$ | H | H | Cl | $CH_3$ |
| II-344 | Cl | Cl | H | $CH_3$ | $CH_3$ | H | $CH_3$ |
| II-345 | Cl | Cl | H | $CH_3$ | H | $CH_3$ | $CH_3$ |
| II-346 | Cl | Cl | $OCH_3$ | Cl | H | H | $OCH_3$ |
| II-347 | Cl | Cl | $OCH_3$ | H | Cl | H | $OCH_3$ |
| II-348 | Cl | Cl | $OCH_3$ | H | H | Cl | $OCH_3$ |
| II-349 | Cl | Cl | $OCH_3$ | $OCH_3$ | H | H | $OCH_3$ |
| II-350 | Cl | Cl | $OCH_3$ | H | $OCH_3$ | H | $OCH_3$ |
| II-351 | Cl | Cl | $OCH_3$ | H | H | $OCH_3$ | $OCH_3$ |
| II-352 | Cl | Cl | $OCH_3$ | $CH_3$ | H | H | $OCH_3$ |
| II-353 | Cl | Cl | $OCH_3$ | H | $CH_3$ | H | $OCH_3$ |
| II-354 | Cl | Cl | $OCH_3$ | H | H | $CH_3$ | $OCH_3$ |
| II-355 | Cl | Cl | H | $OCH_3$ | $OCH_3$ | H | $OCH_3$ |
| II-356 | Cl | Cl | H | $OCH_3$ | H | $OCH_3$ | $OCH_3$ |
| II-357 | Cl | Cl | I | I | H | H | H |
| II-358 | Cl | Cl | I | H | I | H | H |
| II-359 | Cl | Cl | I | H | H | I | H |
| II-360 | Cl | Cl | H | I | I | H | H |
| II-361 | Cl | Cl | H | I | H | I | H |
| II-362 | Cl | Cl | F | F | H | H | H |
| II-363 | Cl | Cl | F | H | F | H | H |
| II-364 | Cl | Cl | F | H | H | F | H |
| II-365 | Cl | Cl | H | F | F | H | H |
| II-366 | Cl | Cl | H | F | H | F | H |
| II-367 | Cl | Cl | Br | Br | H | H | H |
| II-368 | Cl | Cl | Br | H | Br | H | H |
| II-369 | Cl | Cl | Br | H | H | Br | H |
| II-370 | Cl | Cl | H | Br | Br | H | H |
| II-371 | Cl | Cl | H | Br | H | Br | H |
| II-372 | Cl | Cl | $CH_3$ | H | H | H | $CH_3$ |
| II-373 | Cl | Cl | $OCH_3$ | H | H | H | $OCH_3$ |
| II-374 | Cl | Cl | Br | H | H | H | Br |
| II-375 | Cl | Cl | Cl | H | H | H | Cl |
| II-376 | Cl | Cl | $CH_3$ | H | H | H | Cl |
| II-377 | Cl | $CH_3$ | H | H | H | H | H |
| II-378 | Cl | $CH_3$ | $CH_3$ | H | H | H | H |
| II-379 | Cl | $CH_3$ | H | $CH_3$ | H | H | H |
| II-380 | Cl | $CH_3$ | H | H | $CH_3$ | H | H |
| II-381 | Cl | $CH_3$ | Cl | H | H | H | H |

-continued

| No. | $R_{11}$ | $R_{12}$ | $R_{13}$ | $R_{14}$ | $R_{15}$ | $R_{16}$ | $R_{17}$ |
|---|---|---|---|---|---|---|---|
| II-382 | Cl | $CH_3$ | H | Cl | H | H | H |
| II-383 | Cl | $CH_3$ | H | H | Cl | H | H |
| II-384 | Cl | $CH_3$ | Br | H | H | H | H |
| II-385 | Cl | $CH_3$ | H | Br | H | H | H |
| II-386 | Cl | $CH_3$ | H | H | Br | H | H |
| II-387 | Cl | $CH_3$ | I | H | H | H | H |
| II-388 | Cl | $CH_3$ | H | I | H | H | H |
| II-389 | Cl | $CH_3$ | H | H | I | H | H |
| II-390 | Cl | $CH_3$ | F | H | H | H | H |
| II-391 | Cl | $CH_3$ | H | F | H | H | H |
| II-392 | Cl | $CH_3$ | H | H | F | H | H |
| II-393 | Cl | $CH_3$ | $OCH_3$ | H | H | H | H |
| II-394 | Cl | $CH_3$ | H | $OCH_3$ | H | H | H |
| II-395 | Cl | $CH_3$ | H | H | $OCH_3$ | H | H |
| II-396 | Cl | $CH_3$ | $NO_2$ | H | H | H | H |
| II-397 | Cl | $CH_3$ | H | $NO_2$ | H | H | H |
| II-398 | Cl | $CH_3$ | H | H | $NO_2$ | H | H |
| II-399 | Cl | $CH_3$ | CN | H | H | H | H |
| II-400 | Cl | $CH_3$ | H | CN | H | H | H |
| II-401 | Cl | $CH_3$ | H | H | CN | H | H |
| II-402 | Cl | $CH_3$ | $CF_3$ | H | H | H | H |
| II-403 | Cl | $CH_3$ | H | $CF_3$ | H | H | H |
| II-404 | Cl | $CH_3$ | H | H | $CF_3$ | H | H |
| II-405 | Cl | $CH_3$ | Cl | Cl | H | H | H |
| II-406 | Cl | $CH_3$ | Cl | H | Cl | H | H |
| II-407 | Cl | $CH_3$ | Cl | H | H | Cl | H |
| II-408 | Cl | $CH_3$ | Cl | $NO_2$ | H | H | H |
| II-409 | Cl | $CH_3$ | Cl | H | $NO_2$ | H | H |
| II-410 | Cl | $CH_3$ | Cl | H | H | $NO_2$ | H |
| II-411 | Cl | $CH_3$ | Cl | $CH_3$ | H | H | H |
| II-412 | Cl | $CH_3$ | Cl | H | $CH_3$ | H | H |
| II-413 | Cl | $CH_3$ | Cl | H | H | $CH_3$ | H |
| II-414 | Cl | $CH_3$ | H | Cl | Cl | H | H |
| II-415 | Cl | $CH_3$ | H | Cl | H | Cl | H |
| II-416 | Cl | $CH_3$ | $CH_3$ | $CH_3$ | H | H | H |
| II-417 | Cl | $CH_3$ | $CH_3$ | H | $CH_3$ | H | H |
| II-418 | Cl | $CH_3$ | $CH_3$ | H | H | $CH_3$ | H |
| II-419 | Cl | $CH_3$ | $CH_3$ | Cl | H | H | H |
| II-420 | Cl | $CH_3$ | $CH_3$ | H | Cl | H | H |
| II-421 | Cl | $CH_3$ | $CH_3$ | H | H | Cl | H |
| II-422 | Cl | $CH_3$ | $CH_3$ | $OCH_3$ | H | H | H |
| II-423 | Cl | $CH_3$ | $CH_3$ | H | $OCH_3$ | H | H |
| II-424 | Cl | $CH_3$ | $CH_3$ | H | H | $OCH_3$ | H |
| II-425 | Cl | $CH_3$ | H | $CH_3$ | $CH_3$ | H | H |
| II-426 | Cl | $CH_3$ | H | $CH_3$ | H | $CH_3$ | H |
| II-427 | Cl | $CH_3$ | $OCH_3$ | Cl | H | H | H |
| II-428 | Cl | $CH_3$ | $OCH_3$ | H | Cl | H | H |
| II-429 | Cl | $CH_3$ | $OCH_3$ | H | H | Cl | H |
| II-430 | Cl | $CH_3$ | $OCH_3$ | $OCH_3$ | H | H | H |
| II-431 | Cl | $CH_3$ | $OCH_3$ | H | $OCH_3$ | H | H |
| II-432 | Cl | $CH_3$ | $OCH_3$ | H | H | $OCH_3$ | H |
| II-433 | Cl | $CH_3$ | $OCH_3$ | $CH_3$ | H | H | H |
| II-434 | Cl | $CH_3$ | $OCH_3$ | H | $CH_3$ | H | H |
| II-435 | Cl | $CH_3$ | $OCH_3$ | H | H | $CH_3$ | H |
| II-436 | Cl | $CH_3$ | H | $OCH_3$ | $OCH_3$ | H | H |
| II-437 | Cl | $CH_3$ | H | $OCH_3$ | H | $OCH_3$ | H |
| II-438 | Cl | $CH_3$ | $CH_3$ | $CH_3$ | H | H | $CH_3$ |
| II-439 | Cl | $CH_3$ | $CH_3$ | H | $CH_3$ | H | $CH_3$ |
| II-440 | Cl | $CH_3$ | $CH_3$ | H | H | $CH_3$ | $CH_3$ |
| II-441 | Cl | $CH_3$ | $CH_3$ | Cl | H | H | $CH_3$ |
| II-442 | Cl | $CH_3$ | $CH_3$ | H | Cl | H | $CH_3$ |
| II-443 | Cl | $CH_3$ | $CH_3$ | H | H | Cl | $CH_3$ |
| II-444 | Cl | $CH_3$ | H | $CH_3$ | $CH_3$ | H | $CH_3$ |
| II-445 | Cl | $CH_3$ | H | $CH_3$ | H | $CH_3$ | $CH_3$ |
| II-446 | Cl | $CH_3$ | $OCH_3$ | Cl | H | H | $OCH_3$ |
| II-447 | Cl | $CH_3$ | $OCH_3$ | H | Cl | H | $OCH_3$ |
| II-448 | Cl | $CH_3$ | $OCH_3$ | H | H | Cl | $OCH_3$ |
| II-449 | Cl | $CH_3$ | $OCH_3$ | $OCH_3$ | H | H | $OCH_3$ |
| II-450 | Cl | $CH_3$ | $OCH_3$ | H | $OCH_3$ | H | $OCH_3$ |
| II-451 | Cl | $CH_3$ | $OCH_3$ | H | H | $OCH_3$ | $OCH_3$ |
| II-452 | Cl | $CH_3$ | $OCH_3$ | $CH_3$ | H | H | $OCH_3$ |
| II-453 | Cl | $CH_3$ | $OCH_3$ | H | $CH_3$ | H | $OCH_3$ |
| II-454 | Cl | $CH_3$ | $OCH_3$ | H | H | $CH_3$ | $OCH_3$ |
| II-455 | Cl | $CH_3$ | H | $OCH_3$ | $OCH_3$ | H | $OCH_3$ |
| II-456 | Cl | $CH_3$ | H | $OCH_3$ | H | $OCH_3$ | $OCH_3$ |
| II-457 | Cl | $CH_3$ | I | I | H | H | H |
| II-458 | Cl | $CH_3$ | I | H | I | H | H |
| II-459 | Cl | $CH_3$ | I | H | H | I | H |
| II-460 | Cl | $CH_3$ | H | I | I | H | H |
| II-461 | Cl | $CH_3$ | H | I | H | I | H |
| II-462 | Cl | $CH_3$ | F | F | H | H | H |

-continued

| No. | $R_{11}$ | $R_{12}$ | $R_{13}$ | $R_{14}$ | $R_{15}$ | $R_{16}$ | $R_{17}$ |
|---|---|---|---|---|---|---|---|
| II-463 | Cl | $CH_3$ | F | H | F | H | H |
| II-464 | Cl | $CH_3$ | F | H | H | F | H |
| II-465 | Cl | $CH_3$ | H | F | F | H | H |
| II-466 | Cl | $CH_3$ | H | F | H | F | H |
| II-467 | Cl | $CH_3$ | Br | Br | H | H | H |
| II-468 | Cl | $CH_3$ | Br | H | Br | H | H |
| II-469 | Cl | $CH_3$ | Br | H | H | Br | H |
| II-470 | Cl | $CH_3$ | H | Br | Br | H | H |
| II-471 | Cl | $CH_3$ | H | Br | H | Br | H |
| II-472 | Cl | $CH_3$ | $CH_3$ | H | H | H | $CH_3$ |
| II-473 | Cl | $CH_3$ | $OCH_3$ | H | H | H | $OCH_3$ |
| II-474 | Cl | $CH_3$ | Br | H | H | H | Br |
| II-475 | Cl | $CH_3$ | Cl | H | H | H | Cl |
| II-476 | Cl | $CH_3$ | $CH_3$ | H | H | H | Cl |
| II-477 | $CH_3$ | Cl | H | H | H | H | H |
| II-478 | $CH_3$ | Cl | $CH_3$ | H | H | H | H |
| II-479 | $CH_3$ | Cl | H | $CH_3$ | H | H | H |
| II-480 | $CH_3$ | Cl | H | H | $CH_3$ | H | H |
| II-481 | $CH_3$ | Cl | Cl | H | H | H | H |
| II-482 | $CH_3$ | Cl | H | Cl | H | H | H |
| II-483 | $CH_3$ | Cl | H | H | Cl | H | H |
| II-484 | $CH_3$ | Cl | Br | H | H | H | H |
| II-485 | $CH_3$ | Cl | H | Br | H | H | H |
| II-486 | $CH_3$ | Cl | H | H | Br | H | H |
| II-487 | $CH_3$ | Cl | I | H | H | H | H |
| II-488 | $CH_3$ | Cl | H | I | H | H | H |
| II-489 | $CH_3$ | Cl | H | H | I | H | H |
| II-490 | $CH_3$ | Cl | F | H | H | H | H |
| II-491 | $CH_3$ | Cl | H | F | H | H | H |
| II-492 | $CH_3$ | Cl | H | H | F | H | H |
| II-493 | $CH_3$ | Cl | $OCH_3$ | H | H | H | H |
| II-494 | $CH_3$ | Cl | H | $OCH_3$ | H | H | H |
| II-495 | $CH_3$ | Cl | H | H | $OCH_3$ | H | H |
| II-496 | $CH_3$ | Cl | $NO_2$ | H | H | H | H |
| II-497 | $CH_3$ | Cl | H | $NO_2$ | H | H | H |
| II-498 | $CH_3$ | Cl | H | H | $NO_2$ | H | H |
| II-499 | $CH_3$ | Cl | CN | H | H | H | H |
| II-500 | $CH_3$ | Cl | H | CN | H | H | H |
| II-501 | $CH_3$ | Cl | H | H | CN | H | H |
| II-502 | $CH_3$ | Cl | $CF_3$ | H | H | H | H |
| II-503 | $CH_3$ | Cl | H | $CF_3$ | H | H | H |
| II-504 | $CH_3$ | Cl | H | H | $CF_3$ | H | H |
| II-505 | $CH_3$ | Cl | Cl | Cl | H | H | H |
| II-506 | $CH_3$ | Cl | Cl | H | Cl | H | H |
| II-507 | $CH_3$ | Cl | Cl | H | H | Cl | H |
| II-508 | $CH_3$ | Cl | Cl | $NO_2$ | H | H | H |
| II-509 | $CH_3$ | Cl | Cl | H | $NO_2$ | H | H |
| II-510 | $CH_3$ | Cl | Cl | H | H | $NO_2$ | H |
| II-511 | $CH_3$ | Cl | Cl | $CH_3$ | H | H | H |
| II-512 | $CH_3$ | Cl | Cl | H | $CH_3$ | H | H |
| II-513 | $CH_3$ | Cl | Cl | H | H | $CH_3$ | H |
| II-514 | $CH_3$ | Cl | H | Cl | Cl | H | H |
| II-515 | $CH_3$ | Cl | H | Cl | H | Cl | H |
| II-516 | $CH_3$ | Cl | $CH_3$ | $CH_3$ | H | H | H |
| II-517 | $CH_3$ | Cl | $CH_3$ | H | $CH_3$ | H | H |
| II-518 | $CH_3$ | Cl | $CH_3$ | H | H | $CH_3$ | H |
| II-519 | $CH_3$ | Cl | $CH_3$ | Cl | H | H | H |
| II-520 | $CH_3$ | Cl | $CH_3$ | H | Cl | H | H |
| II-521 | $CH_3$ | Cl | $CH_3$ | H | H | Cl | H |
| II-522 | $CH_3$ | Cl | $CH_3$ | $OCH_3$ | H | H | H |
| II-523 | $CH_3$ | Cl | $CH_3$ | H | $OCH_3$ | H | H |
| II-524 | $CH_3$ | Cl | $CH_3$ | H | H | $OCH_3$ | H |
| II-525 | $CH_3$ | Cl | H | $CH_3$ | $CH_3$ | H | H |
| II-526 | $CH_3$ | Cl | H | $CH_3$ | H | $CH_3$ | H |
| II-527 | $CH_3$ | Cl | $OCH_3$ | Cl | H | H | H |
| II-528 | $CH_3$ | Cl | $OCH_3$ | H | Cl | H | H |
| II-529 | $CH_3$ | Cl | $OCH_3$ | H | H | Cl | H |
| II-530 | $CH_3$ | Cl | $OCH_3$ | $OCH_3$ | H | H | H |
| II-531 | $CH_3$ | Cl | $OCH_3$ | H | $OCH_3$ | H | H |
| II-532 | $CH_3$ | Cl | $OCH_3$ | H | H | $OCH_3$ | H |
| II-533 | $CH_3$ | Cl | $OCH_3$ | $CH_3$ | H | H | H |
| II-534 | $CH_3$ | Cl | $OCH_3$ | H | $CH_3$ | H | H |
| II-535 | $CH_3$ | Cl | $OCH_3$ | H | H | $CH_3$ | H |
| II-536 | $CH_3$ | Cl | H | $OCH_3$ | $OCH_3$ | H | H |
| II-537 | $CH_3$ | Cl | H | $OCH_3$ | H | $OCH_3$ | H |
| II-538 | $CH_3$ | Cl | $CH_3$ | $CH_3$ | H | H | $CH_3$ |
| II-539 | $CH_3$ | Cl | $CH_3$ | H | $CH_3$ | H | $CH_3$ |
| II-540 | $CH_3$ | Cl | $CH_3$ | H | H | $CH_3$ | $CH_3$ |
| II-541 | $CH_3$ | Cl | $CH_3$ | Cl | H | H | $CH_3$ |
| II-542 | $CH_3$ | Cl | $CH_3$ | H | Cl | H | $CH_3$ |
| II-543 | $CH_3$ | Cl | $CH_3$ | H | H | Cl | $CH_3$ |

-continued

| No. | $R_{11}$ | $R_{12}$ | $R_{13}$ | $R_{14}$ | $R_{15}$ | $R_{16}$ | $R_{17}$ |
|---|---|---|---|---|---|---|---|
| II-544 | $CH_3$ | Cl | H | $CH_3$ | $CH_3$ | H | $CH_3$ |
| II-545 | $CH_3$ | Cl | H | $CH_3$ | H | $CH_3$ | $CH_3$ |
| II-546 | $CH_3$ | Cl | $OCH_3$ | Cl | H | H | $OCH_3$ |
| II-547 | $CH_3$ | Cl | $OCH_3$ | H | Cl | H | $OCH_3$ |
| II-548 | $CH_3$ | Cl | $OCH_3$ | H | H | Cl | $OCH_3$ |
| II-549 | $CH_3$ | Cl | $OCH_3$ | $OCH_3$ | H | H | $OCH_3$ |
| II-550 | $CH_3$ | Cl | $OCH_3$ | H | $OCH_3$ | H | $OCH_3$ |
| II-551 | $CH_3$ | Cl | $OCH_3$ | H | H | $OCH_3$ | $OCH_3$ |
| II-552 | $CH_3$ | Cl | $OCH_3$ | $CH_3$ | H | H | $OCH_3$ |
| II-553 | $CH_3$ | Cl | $OCH_3$ | H | H | H | $OCH_3$ |
| II-554 | $CH_3$ | Cl | $OCH_3$ | H | $CH_3$ | H | $OCH_3$ |
| II-555 | $CH_3$ | Cl | $OCH_3$ | H | H | $CH_3$ | $OCH_3$ |
| II-556 | $CH_3$ | Cl | H | $OCH_3$ | $OCH_3$ | H | $OCH_3$ |
| II-557 | $CH_3$ | Cl | H | $OCH_3$ | H | $OCH_3$ | $OCH_3$ |
| II-558 | $CH_3$ | Cl | I | I | H | H | H |
| II-559 | $CH_3$ | Cl | I | H | I | H | H |
| II-560 | $CH_3$ | Cl | I | H | H | I | H |
| II-561 | $CH_3$ | Cl | H | I | I | H | H |
| II-562 | $CH_3$ | Cl | H | I | H | I | H |
| II-563 | $CH_3$ | Cl | F | F | H | H | H |
| II-564 | $CH_3$ | Cl | F | H | F | H | H |
| II-565 | $CH_3$ | Cl | F | H | H | F | H |
| II-566 | $CH_3$ | Cl | H | F | F | H | H |
| II-567 | $CH_3$ | Cl | H | F | H | F | H |
| II-568 | $CH_3$ | Cl | Br | Br | H | H | H |
| II-569 | $CH_3$ | Cl | Br | H | Br | H | H |
| II-570 | $CH_3$ | Cl | Br | H | H | Br | H |
| II-571 | $CH_3$ | Cl | H | Br | Br | H | H |
| II-572 | $CH_3$ | Cl | H | Br | H | Br | H |
| II-573 | $CH_3$ | Cl | $CH_3$ | H | H | H | $CH_3$ |
| II-574 | $CH_3$ | Cl | $OCH_3$ | H | H | H | $OCH_3$ |
| II-575 | $CH_3$ | Cl | Br | H | H | H | Br |
| II-576 | $CH_3$ | Cl | Cl | H | H | H | Cl |
| II-577 | $CH_3$ | Cl | $CH_3$ | H | H | H | Cl |
| II-578 | Cl | Br | H | H | H | H | H |
| II-579 | Cl | Br | $CH_3$ | H | H | H | H |
| II-580 | Cl | Br | H | $CH_3$ | H | H | H |
| II-581 | Cl | Br | H | H | $CH_3$ | H | H |
| II-582 | Cl | Br | Cl | H | H | H | H |
| II-583 | Cl | Br | H | Cl | H | H | H |
| II-584 | Cl | Br | H | H | Cl | H | H |
| II-585 | Cl | Br | Br | H | H | H | H |
| II-586 | Cl | Br | H | Br | H | H | H |
| II-587 | Cl | Br | H | H | Br | H | H |
| II-588 | Cl | Br | I | H | H | H | H |
| II-589 | Cl | Br | H | I | H | H | H |
| II-590 | Cl | Br | H | H | I | H | H |
| II-591 | Cl | Br | F | H | H | H | H |
| II-592 | Cl | Br | H | F | H | H | H |
| II-593 | Cl | Br | H | H | F | H | H |
| II-594 | Cl | Br | $OCH_3$ | H | H | H | H |
| II-595 | Cl | Br | H | $OCH_3$ | H | H | H |
| II-596 | Cl | Br | H | H | $OCH_3$ | H | H |
| II-597 | Cl | Br | $NO_2$ | H | H | H | H |
| II-598 | Cl | Br | H | $NO_2$ | H | H | H |
| II-599 | Cl | Br | H | H | $NO_2$ | H | H |
| II-600 | Cl | Br | CN | H | H | H | H |
| II-601 | Cl | Br | H | CN | H | H | H |
| II-602 | Cl | Br | H | H | CN | H | H |
| II-603 | Cl | Br | $CF_3$ | H | H | H | H |
| II-604 | Cl | Br | H | $CF_3$ | H | H | H |
| II-605 | Cl | Br | H | H | $CF_3$ | H | H |
| II-606 | Cl | Br | Cl | Cl | H | H | H |
| II-607 | Cl | Br | Cl | H | Cl | H | H |
| II-608 | Cl | Br | Cl | H | H | Cl | H |
| II-609 | Cl | Br | Cl | $NO_2$ | H | H | H |
| II-610 | Cl | Br | Cl | H | $NO_2$ | H | H |
| II-611 | Cl | Br | Cl | H | H | $NO_2$ | H |
| II-612 | Cl | Br | Cl | $CH_3$ | H | H | H |
| II-613 | Cl | Br | Cl | H | $CH_3$ | H | H |
| II-614 | Cl | Br | Cl | H | H | $CH_3$ | H |
| II-615 | Cl | Br | H | Cl | Cl | H | H |
| II-616 | Cl | Br | H | Cl | H | Cl | H |
| II-617 | Cl | Br | $CH_3$ | $CH_3$ | H | H | H |
| II-618 | Cl | Br | $CH_3$ | H | $CH_3$ | H | H |
| II-619 | Cl | Br | $CH_3$ | H | H | $CH_3$ | H |
| II-620 | Cl | Br | $CH_3$ | Cl | H | H | H |
| II-621 | Cl | Br | $CH_3$ | H | Cl | H | H |
| II-622 | Cl | Br | $CH_3$ | H | H | Cl | H |
| II-623 | Cl | Br | $CH_3$ | $OCH_3$ | H | H | H |
| II-624 | Cl | Br | $CH_3$ | H | $OCH_3$ | H | H |

-continued

| No. | $R_{11}$ | $R_{12}$ | $R_{13}$ | $R_{14}$ | $R_{15}$ | $R_{16}$ | $R_{17}$ |
|---|---|---|---|---|---|---|---|
| II-625 | Cl | Br | $CH_3$ | H | H | $OCH_3$ | H |
| II-626 | Cl | Br | H | $CH_3$ | $CH_3$ | H | H |
| II-627 | Cl | Br | H | $CH_3$ | H | $CH_3$ | H |
| II-628 | Cl | Br | $OCH_3$ | Cl | H | H | H |
| II-629 | Cl | Br | $OCH_3$ | H | Cl | H | H |
| II-630 | Cl | Br | $OCH_3$ | H | H | Cl | H |
| II-631 | Cl | Br | $OCH_3$ | $OCH_3$ | H | H | H |
| II-632 | Cl | Br | $OCH_3$ | H | $OCH_3$ | H | H |
| II-633 | Cl | Br | $OCH_3$ | H | H | $OCH_3$ | H |
| II-634 | Cl | Br | $OCH_3$ | $CH_3$ | H | H | H |
| II-635 | Cl | Br | $OCH_3$ | H | $CH_3$ | H | H |
| II-636 | Cl | Br | $OCH_3$ | H | H | $CH_3$ | H |
| II-637 | Cl | Br | H | $OCH_3$ | $OCH_3$ | H | H |
| II-638 | Cl | Br | H | $OCH_3$ | H | $OCH_3$ | H |
| II-639 | Cl | Br | I | I | H | H | H |
| II-640 | Cl | Br | I | H | I | H | H |
| II-641 | Cl | Br | I | H | H | I | H |
| II-642 | Cl | Br | H | I | I | H | H |
| II-643 | Cl | Br | H | I | H | I | H |
| II-644 | Cl | Br | F | F | H | H | H |
| II-645 | Cl | Br | F | H | F | H | H |
| II-646 | Cl | Br | F | H | H | F | H |
| II-647 | Cl | Br | H | F | F | H | H |
| II-648 | Cl | Br | H | F | H | F | H |
| II-649 | Cl | Br | Br | Br | H | H | H |
| II-650 | Cl | Br | Br | H | Br | H | H |
| II-651 | Cl | Br | Br | H | H | Br | H |
| II-652 | Cl | Br | H | Br | Br | H | H |
| II-653 | Cl | Br | H | Br | H | Br | H |
| II-654 | Cl | Br | $CH_3$ | H | H | H | $CH_3$ |
| II-655 | Cl | Br | $OCH_3$ | H | H | H | $OCH_3$ |
| II-656 | Cl | Br | Br | H | H | H | Br |
| II-657 | Cl | Br | Cl | H | H | H | Cl |
| II-658 | Cl | Br | $CH_3$ | H | H | H | Cl |
| II-659 | $NO_2$ | $NO_2$ | H | H | H | H | H |
| II-660 | $NO_2$ | $NO_2$ | $CH_3$ | H | H | H | H |
| II-661 | $NO_2$ | $NO_2$ | H | $CH_3$ | H | H | H |
| II-662 | $NO_2$ | $NO_2$ | H | H | $CH_3$ | H | H |
| II-663 | $NO_2$ | $NO_2$ | Cl | H | H | H | H |
| II-664 | $NO_2$ | $CH_3$ | H | Cl | H | H | H |
| II-665 | $NO_2$ | $CH_3$ | H | H | Cl | H | H |
| II-666 | $NO_2$ | $CH_3$ | Br | H | H | H | H |
| II-667 | $NO_2$ | $CH_3$ | H | Br | H | H | H |
| II-668 | $NO_2$ | $OCH_3$ | Br | Br | H | Br | H |
| II-669 | $NO_2$ | $OCH_3$ | F | F | H | H | H |
| II-670 | $NO_2$ | $OCH_3$ | F | H | F | H | H |
| II-671 | $NO_2$ | Cl | F | H | H | F | H |
| II-672 | $NO_2$ | Cl | H | F | F | H | H |
| II-673 | $NO_2$ | Cl | H | F | H | F | H |
| II-674 | CN | CN | H | H | H | H | H |
| II-675 | CN | CN | $CH_3$ | H | H | H | H |
| II-676 | CN | CN | H | $CH_3$ | H | H | H |
| II-677 | CN | CN | H | H | $CH_3$ | H | H |
| II-678 | CN | Br | Cl | H | H | H | H |
| II-679 | CN | Br | H | Cl | H | H | H |
| II-680 | CN | Br | H | H | Cl | H | H |
| II-681 | CN | $OCH_3$ | Br | H | H | H | H |
| II-682 | CN | $OCH_3$ | H | Br | H | H | H |
| II-683 | CN | $OCH_3$ | H | H | Br | H | H |
| II-684 | CN | $CH_3$ | I | H | H | H | H |
| II-685 | CN | $CH_3$ | H | I | H | H | H |
| II-686 | CN | $CH_3$ | H | H | I | H | H |
| II-687 | OH | H | F | H | H | H | H |
| II-688 | OH | H | H | F | H | H | H |
| II-689 | OH | H | H | H | F | H | H |
| II-690 | OH | H | $OCH_3$ | H | H | H | H |
| II-691 | OH | H | H | $OCH_3$ | H | H | H |

The bio-azo compound represented by the above mentioned General formula [II] of the present invention can be easily synthsized by a known process.

EXAMPLE OF SYNTHESIS 3

(Synthesis of an illustrated compound II-6)

2.38 g (0.01 mol) of 2, 7-diamino-3, 5-dimethyl-9-fluorenone was dispersed in 10 mL of hydrochloric acid and 20 mL of water, and a solution formed by dissolving 1.40 g (0.02 mol) of sodium nitrite in 5 mL of water was added in drops to the foregoing solution while the temperature was maintained at 5° C. or lower. After said solution was agitated for 1 hour at this temperature, insoluble substances were removed by filtration, and a solution formed by dissolving 4.9 g of 6-ammonium phosphate fluoride in 50 mL of water was further added to the resulting filtrate. The precipitated tetrazonium salt was obtained by filtration and was dissolved in 100 mL of N, N-dimethylformamide (DMF). With the temperature kept at 5° C or lower, this solution then underwent addition in drops of a solution formed by dissolving 5.94 g (0.02 mol) of 2-hydroxy-3-naphthoic acid-3'-chloranilide in 200 mL of DMF.

Continuing to be maintained at 5° C. or lower, the above solution further underwent addition in drops of a solution of 6 g (0.04 mol) of triethanolamine dissolved in 30 mL of DMF, followed by agitation for 1 hour at 5° C. or lower and for 4 hours at the room temperature. After the reaction, the precipitated crystals were obtained by filtration, and were washed with DMF and then with water to be dried, thus resulting in 5.6 g of the target substance.

Theoretical value:

C=68.79%, H=3.74%, and N=9.82%.

Found value:

C=68.95%, H=3.86%, and N=9.98%.

EXAMPLE OF SYNTHESIS 4

(Synthesis of an illustrated compound II-583)

3.24 g (0.01 mol) of 2, 7-diamino-3-bromo-5-chloro-9-fluorenone was dispersed in 10 mL of hydrochloric acid and 20 mL of water, and a solution formed by dissolving 1.40 g (0.02 mol) of sodium nitrite in 5 mL of water was added in drops to the above solution while it was maintained at 5° C. or lower. After the solution thus prepared was agitated for 1 hour at the above temperature, insoluble substances were removed by filtration, and the resulting filtrate then received a solution formed by dissolving 4.9 g of 6-ammonium phosphate fluoride in 50 mL of water. The precipitated tetrazonium salt was gained by filtration and was then dissolved in 100 mL of N, N-dimethylformamide (DMF). 5.94 g (0.02 mol) of 2-hydroxy-3-naphthoic acid-3'-chloranilide was dissolved in 200 mL of DMF, and the resulting solution was added in drops to the above mentioned solution while the temperature was kept at 5° C. or lower.

With the temperature continuing to be kept at 5° C. or lower, a solution formed by dissolving 6 g (0.04 mol) of triethanolamine in 30 mL of DMF was added in drops, followed by agitation for 1 hour at 5° C. or lower and further for 4 hours at the room temperature. After the reaction, the precipitated crystals were obtained by filtration, and washed with DMF and then with water, and were then dried, thus resulting in 5.3 g of the target substance.

Theoretical value:

C=59.99%, H=2.76%, and N=8.93%.

Found value:

C=60.01%, H=2.8%, and N=8.97%.

The other compounds of the present invention can be prepared, in the same process as in the above mentioned Example of Synthesis 1, by forming a tetrazo product with use of 2, 7'-diamino-4, 6-substitution-9-fluorenone and then allowing the reaction of 2-hydroxy-3-naphthoic acid-substituted anilide.

The halogen atoms of $R_{21}$ in General formula [III] can be illustrated by such examples as chlorine atom, bromide atom and iodine atom, among which the chlorine or bromide atom is preferable.

Preferable as the alkyl group of $R_{21}$ is an alkyl group having 1 to 4 carbon atoms, for example, a methyl, ethyl, isopropyl, t-butyl or trifluoromethyl group.

The alkoxy group for $R_{21}$ is preferably an alkoxy group having 1 to 4 carbon atoms, which can be illustrated by, for example, a methoxy, ethoxy, isopropoxy, t-butoxy group, or 2-chloroethoxy group.

Among the examples of $R_{21}$, preferable are a halogen atom, an alkyl group and an alkoxy group.

The alkyl group, alkoxy group and halogen atom as represented by $R_{22}$ to $R_{26}$ can be illustrated by the same specific examples as those described in relation to $R_{21}$ mentioned above.

In the next, the specific examples of the azo compound represented by the above mentioned General formula [III] will be described, but the azo compounds of the present invention are in no way limited by such examples.

| No | $R_{21}$ | $R_{22}$ | $R_{23}$ | $R_{24}$ | $R_{25}$ | $R_{26}$ |
|---|---|---|---|---|---|---|
| III-1 | $CH_3$ | H | H | H | H | H |
| III-2 | $CH_3$ | $CH_3$ | H | $CH_3$ | H | H |
| III-3 | $CH_3$ | $CH_3$ | H | H | H | H |
| III-4 | $CH_3$ | H | $CH_3$ | H | H | H |
| III-5 | $CH_3$ | H | H | $CH_3$ | H | H |
| III-6 | $CH_3$ | Cl | H | H | H | H |
| III-7 | $CH_3$ | H | Cl | H | H | H |
| III-8 | $CH_3$ | H | H | Cl | H | H |
| III-9 | $CH_3$ | H | Cl | H | Cl | H |
| III-10 | $CH_3$ | Br | H | H | H | H |
| III-11 | $CH_3$ | H | Br | H | H | H |
| III-12 | $CH_3$ | H | H | Br | H | H |
| III-13 | $CH_3$ | $OCH_3$ | H | H | H | H |
| III-14 | $CH_3$ | H | $OCH_3$ | H | H | H |
| III-15 | $CH_3$ | H | H | $OCH_3$ | H | H |
| III-16 | $CH_3$ | $NO_2$ | H | H | H | H |
| III-17 | $CH_3$ | H | $NO_2$ | H | H | H |
| III-18 | $CH_3$ | H | H | $NO_2$ | H | H |
| III-19 | $CH_3$ | CN | H | H | H | H |
| III-20 | $CH_3$ | H | CN | H | H | H |
| III-21 | $CH_3$ | H | H | CN | H | H |
| III-22 | $CH_3$ | $OCH_3$ | H | H | $OCH_3$ | H |
| III-23 | $CH_3$ | Cl | H | H | Cl | H |
| III-24 | $CH_3$ | $CH_3$ | H | H | Cl | H |
| III-25 | $CH_3$ | $OCH_3$ | H | $OCH_3$ | H | H |
| III-26 | $CH_3$ | $CH_3$ | H | Cl | H | H |
| III-27 | $CH_3$ | $OCH_3$ | H | $OCH_3$ | Cl | H |
| III-54 | Cl | H | H | H | H | H |
| III-55 | Cl | $CH_3$ | H | $CH_3$ | H | H |
| III-56 | Cl | $CH_3$ | H | H | H | H |
| III-57 | Cl | H | $CH_3$ | H | H | H |
| III-58 | Cl | H | H | $CH_3$ | H | H |
| III-59 | Cl | Cl | H | H | H | H |
| III-60 | Cl | H | Cl | H | H | H |
| III-61 | Cl | H | H | Cl | H | H |
| III-62 | Cl | H | Cl | H | Cl | H |
| III-63 | Cl | Br | H | H | H | H |
| III-64 | Cl | H | Br | H | H | H |
| III-65 | Cl | H | H | Br | H | H |
| III-66 | Cl | $OCH_3$ | H | H | H | H |
| III-67 | Cl | H | $OCH_3$ | H | H | H |
| III-68 | Cl | H | H | $OCH_3$ | H | H |
| III-69 | Cl | $NO_2$ | H | H | H | H |
| III-70 | Cl | H | $NO_2$ | H | H | H |
| III-71 | Cl | H | H | $NO_2$ | H | H |
| III-72 | Cl | CN | H | H | H | H |
| III-73 | Cl | H | CN | H | H | H |
| III-74 | Cl | H | H | CN | H | H |
| III-75 | Cl | $OCH_3$ | H | H | $OCH_3$ | H |
| III-76 | Cl | Cl | H | H | Cl | H |
| III-77 | Cl | $CH_3$ | H | H | $CH_3$ | H |
| III-78 | Cl | $OCH_3$ | H | $OCH_3$ | H | H |
| III-79 | Cl | $CH_3$ | H | Cl | H | H |
| III-80 | Cl | $OCH_3$ | H | $OCH_3$ | Cl | H |
| III-81 | $NO_2$ | H | H | H | H | H |
| III-82 | $NO_2$ | $CH_3$ | H | H | H | H |
| III-83 | $NO_2$ | H | $CH_3$ | H | H | H |
| III-84 | $NO_2$ | H | H | $CH_3$ | H | H |
| III-85 | $NO_2$ | $CH_3$ | H | $CH_3$ | H | H |
| III-86 | $NO_2$ | Cl | H | H | H | H |
| III-87 | $NO_2$ | H | Cl | H | H | H |
| III-88 | $NO_2$ | H | H | Cl | H | H |
| III-89 | $NO_2$ | H | Cl | H | Cl | H |
| III-90 | $NO_2$ | Br | H | H | H | H |

-continued

| No | $R_{21}$ | $R_{22}$ | $R_{23}$ | $R_{24}$ | $R_{25}$ | $R_{26}$ |
|---|---|---|---|---|---|---|
| III-91 | $NO_2$ | H | Br | H | H | H |
| III-92 | $NO_2$ | H | H | Br | H | H |
| III-93 | $NO_2$ | $OCH_3$ | H | H | H | H |
| III-94 | $NO_2$ | H | $OCH_3$ | H | H | H |
| III-95 | $NO_2$ | H | H | $OCH_3$ | H | H |
| III-96 | $NO_2$ | $NO_2$ | H | H | H | H |
| III-97 | $NO_2$ | H | $NO_2$ | H | H | H |
| III-98 | $NO_2$ | H | H | $NO_2$ | H | H |
| III-99 | $NO_2$ | CN | H | H | H | H |
| III-100 | $NO_2$ | H | CN | H | H | H |
| III-101 | $NO_2$ | H | H | CN | H | H |
| III-102 | $NO_2$ | $OCH_3$ | H | H | $OCH_3$ | H |
| III-103 | $NO_2$ | Cl | H | H | Cl | H |
| III-104 | $NO_2$ | $CH_3$ | H | H | Cl | H |
| III-105 | $NO_2$ | $OCH_3$ | H | $OCH_3$ | H | H |
| III-106 | $NO_2$ | $CH_3$ | H | Cl | H | H |
| III-107 | $NO_2$ | $OCH_3$ | H | $OCH_3$ | H | H |
| III-108 | Br | H | H | H | H | H |
| III-109 | Br | $CH_3$ | H | $CH_3$ | H | H |
| III-110 | Br | $CH_3$ | H | H | H | H |
| III-111 | Br | H | $CH_3$ | H | H | H |
| III-112 | Br | H | H | $CH_3$ | H | H |
| III-113 | Br | Cl | H | H | H | H |
| III-114 | Br | H | Cl | H | H | H |
| III-115 | Br | H | H | Cl | H | H |
| III-116 | Br | H | Cl | H | Cl | H |
| III-117 | Br | Br | H | H | H | H |
| III-118 | Br | H | Br | H | H | H |
| III-119 | Br | H | H | Br | H | H |
| III-120 | Br | $OCH_3$ | H | H | H | H |
| III-121 | Br | H | $OCH_3$ | H | H | H |
| III-122 | Br | H | H | $OCH_3$ | H | H |
| III-123 | Br | $NO_2$ | H | H | H | H |
| III-124 | Br | H | $NO_2$ | H | H | H |
| III-125 | Br | H | H | $NO_2$ | H | H |
| III-126 | Br | CN | H | H | H | H |
| III-127 | Br | H | CN | H | H | H |
| III-128 | Br | H | H | CN | H | H |
| III-129 | Br | $OCH_3$ | H | H | $OCH_3$ | H |
| III-130 | Br | Cl | H | H | Cl | H |
| III-131 | Br | $CH_3$ | H | H | Cl | H |
| III-132 | Br | $OCH_3$ | H | $OCH_3$ | H | H |
| III-133 | Br | $CH_3$ | H | Cl | H | H |
| III-134 | Br | $OCH_3$ | H | $OCH_3$ | Cl | H |
| III-135 | F | H | H | H | H | H |
| III-136 | F | $CH_3$ | H | $CH_3$ | H | H |
| III-137 | F | $CH_3$ | H | H | H | H |
| III-138 | F | H | $CH_3$ | H | H | H |
| III-139 | F | H | H | $CH_3$ | H | H |
| III-140 | F | Cl | H | H | H | H |
| III-141 | F | H | Cl | H | H | H |
| III-142 | F | H | H | Cl | H | H |
| III-143 | F | H | Cl | H | Cl | H |
| III-144 | F | Br | H | H | H | H |
| III-145 | F | H | Br | H | H | H |
| III-146 | F | H | H | Br | H | H |
| III-147 | F | $OCH_3$ | H | H | H | H |
| III-148 | F | H | $OCH_3$ | H | H | H |
| III-149 | F | H | H | $OCH_3$ | H | H |
| III-150 | F | $NO_2$ | H | H | H | H |
| III-151 | F | H | $NO_2$ | H | H | H |
| III-152 | F | H | H | $NO_2$ | H | H |
| III-153 | F | CN | H | H | H | H |
| III-154 | F | H | CN | H | H | H |
| III-155 | F | H | H | CN | H | H |
| III-156 | F | $OCH_3$ | H | H | $OCH_3$ | H |
| III-157 | F | Cl | H | H | Cl | H |
| III-158 | F | $CH_3$ | H | H | Cl | H |
| III-159 | F | $OCH_3$ | H | $OCH_3$ | H | H |
| III-160 | F | $CH_3$ | H | Cl | H | H |
| III-161 | F | $OCH_3$ | H | $OCH_3$ | Cl | H |
| III-162 | I | H | H | H | H | H |
| III-163 | I | $CH_3$ | H | $CH_3$ | H | H |
| III-164 | I | $CH_3$ | H | H | H | H |
| III-165 | I | H | $CH_3$ | H | H | H |
| III-166 | I | H | H | $CH_3$ | H | H |
| III-167 | I | Cl | H | H | H | H |
| III-168 | I | H | Cl | H | H | H |
| III-169 | I | H | H | Cl | H | H |
| III-170 | I | H | Cl | H | Cl | H |
| III-171 | I | Br | H | H | H | H |

-continued

| No | $R_{21}$ | $R_{22}$ | $R_{23}$ | $R_{24}$ | $R_{25}$ | $R_{26}$ |
|---|---|---|---|---|---|---|
| III-172 | I | H | Br | H | H | H |
| III-173 | I | H | H | Br | H | H |
| III-174 | I | $OCH_3$ | H | H | H | H |
| III-175 | I | H | $OCH_3$ | H | H | H |
| III-176 | I | H | H | $OCH_3$ | H | H |
| III-177 | I | $NO_2$ | H | H | H | H |
| III-178 | I | H | $NO_2$ | H | H | H |
| III-179 | I | H | H | $NO_2$ | H | H |
| III-180 | I | CN | H | H | H | H |
| III-181 | I | H | CN | H | H | H |
| III-182 | I | H | H | CN | H | H |
| III-183 | I | $OCH_3$ | H | H | $OCH_3$ | H |
| III-184 | I | Cl | H | H | Cl | H |
| III-185 | I | $CH_3$ | H | H | Cl | H |
| III-186 | I | $OCH_3$ | H | $OCH_3$ | Cl | H |
| III-187 | CN | H | H | H | H | H |
| III-188 | CN | $CH_3$ | H | $CH_3$ | H | H |
| III-189 | CN | $CH_3$ | H | H | H | H |
| III-190 | CN | H | $CH_3$ | H | H | H |
| III-191 | CN | H | H | $CH_3$ | H | H |
| III-192 | CN | Cl | H | H | H | H |
| III-193 | CN | H | Cl | H | H | H |
| III-194 | CN | H | H | Cl | H | H |
| III-195 | CN | H | Cl | H | Cl | H |
| III-196 | CN | Br | H | H | H | H |
| III-197 | CN | H | Br | H | H | H |
| III-198 | CN | H | H | Br | H | H |
| III-199 | CN | $OCH_3$ | H | H | H | H |
| III-200 | CN | H | $OCH_3$ | H | H | H |
| III-201 | CN | H | H | $OCH_3$ | H | H |
| III-202 | CN | $NO_2$ | H | H | H | H |
| III-203 | CN | H | $NO_2$ | H | H | H |
| III-204 | CN | H | H | $NO_2$ | H | H |
| III-205 | CN | CN | H | H | H | H |
| III-206 | CN | H | CN | H | H | H |
| III-207 | CN | H | H | CN | H | H |
| III-208 | CN | $OCH_3$ | H | H | $OCH_3$ | H |
| III-209 | CN | Cl | H | H | Cl | H |
| III-210 | CN | $OCH_3$ | H | $OCH_3$ | Cl | H |
| III-211 | $CH_3$ | Cl | $NO_2$ | H | H | H |
| III-212 | $CH_3$ | Cl | H | $NO_2$ | H | H |
| III-213 | $CH_3$ | Cl | H | H | $NO_2$ | H |
| III-214 | $CH_3$ | Cl | $CH_3$ | H | H | H |
| III-215 | $CH_3$ | Cl | H | $CH_3$ | H | H |
| III-216 | $CH_3$ | Cl | H | H | $CH_3$ | H |
| III-217 | $CH_3$ | Cl | Cl | H | H | H |
| III-218 | $CH_3$ | Cl | H | Cl | H | H |
| III-219 | $CH_3$ | $CH_3$ | $CH_3$ | H | H | H |
| III-220 | $CH_3$ | $CH_3$ | H | H | $CH_3$ | H |
| III-221 | $CH_3$ | $CF_3$ | H | H | H | H |
| III-222 | $CH_3$ | H | $CF_3$ | H | H | H |
| III-223 | $CH_3$ | H | H | $CF_3$ | H | H |
| III-224 | $CH_3$ | I | H | H | H | H |
| III-225 | $CH_3$ | H | I | H | H | H |
| III-226 | $CH_3$ | H | H | I | H | H |
| III-227 | $CH_3$ | F | H | H | H | H |
| III-228 | $CH_3$ | H | F | H | H | H |
| III-229 | $CH_3$ | H | H | F | H | H |
| III-230 | $CH_3$ | $OCH_3$ | $CH_3$ | H | H | H |
| III-231 | $CH_3$ | $OCH_3$ | H | $CH_3$ | H | H |
| III-232 | $CH_3$ | $OCH_3$ | H | H | $CH_3$ | H |
| III-233 | $CH_3$ | I | I | H | H | H |
| III-234 | $CH_3$ | I | H | I | H | H |
| III-235 | $CH_3$ | I | H | H | I | H |
| III-236 | $CH_3$ | F | F | H | H | H |
| III-237 | $CH_3$ | F | H | F | H | H |
| III-238 | $CH_3$ | F | H | H | F | H |
| III-239 | $CH_3$ | $OCH_3$ | $OCH_3$ | H | H | H |
| III-240 | $CH_3$ | $OCH_3$ | H | $OCH_3$ | H | H |
| III-271 | Cl | Cl | $NO_2$ | H | H | H |
| III-272 | Cl | Cl | H | $NO_2$ | H | H |
| III-273 | Cl | Cl | H | H | $NO_2$ | H |
| III-274 | Cl | Cl | $CH_3$ | H | H | H |
| III-275 | Cl | Cl | H | $CH_3$ | H | H |
| III-276 | Cl | Cl | H | H | $CH_3$ | H |
| III-277 | Cl | Cl | Cl | H | H | H |
| III-278 | Cl | Cl | H | Cl | H | H |
| III-279 | Cl | $CH_3$ | $CH_3$ | H | H | H |
| III-280 | Cl | $CH_3$ | H | H | $CH_3$ | H |
| III-281 | Cl | $CF_3$ | H | H | H | H |
| III-282 | Cl | H | $CF_3$ | H | H | H |

-continued

| No | $R_{21}$ | $R_{22}$ | $R_{23}$ | $R_{24}$ | $R_{25}$ | $R_{26}$ |
|---|---|---|---|---|---|---|
| III-283 | Cl | H | H | $CF_3$ | H | H |
| III-284 | Cl | I | H | H | H | H |
| III-285 | Cl | H | I | H | H | H |
| III-286 | Cl | H | H | I | H | H |
| III-287 | Cl | F | H | H | H | H |
| III-288 | Cl | H | F | H | H | H |
| III-289 | Cl | H | H | F | H | H |
| III-290 | Cl | $OCH_3$ | $CH_3$ | H | H | H |
| III-291 | Cl | $OCH_3$ | H | $CH_3$ | H | H |
| III-292 | Cl | $OCH_3$ | H | H | $CH_3$ | H |
| III-293 | Cl | I | I | H | H | H |
| III-294 | Cl | I | H | I | H | H |
| III-295 | Cl | I | H | H | I | H |
| III-296 | Cl | F | F | H | H | H |
| III-297 | Cl | F | H | F | H | H |
| III-298 | Cl | F | H | H | F | H |
| III-299 | Cl | $OCH_3$ | $OCH_3$ | H | H | H |
| III-300 | Cl | $OCH_3$ | H | $OCH_3$ | H | H |
| III-301 | $NO_2$ | Cl | $NO_2$ | H | H | H |
| III-302 | $NO_2$ | Cl | H | $NO_2$ | H | H |
| III-303 | $NO_2$ | Cl | H | H | $NO_2$ | H |
| III-304 | $NO_2$ | Cl | $CH_3$ | H | H | H |
| III-305 | $NO_2$ | Cl | H | $CH_3$ | H | H |
| III-306 | $NO_2$ | Cl | H | H | $CH_3$ | H |
| III-307 | $NO_2$ | Cl | Cl | H | H | H |
| III-308 | $NO_2$ | Cl | H | Cl | H | H |
| III-309 | $NO_2$ | $CH_3$ | $CH_3$ | H | H | H |
| III-310 | $NO_2$ | $CH_3$ | H | H | $CH_3$ | H |
| III-311 | $NO_2$ | $CF_3$ | H | H | H | H |
| III-312 | $NO_2$ | H | $CF_3$ | H | H | H |
| III-313 | $NO_2$ | H | H | $CF_3$ | H | H |
| III-314 | $NO_2$ | I | H | H | H | H |
| III-315 | $NO_2$ | H | I | H | H | H |
| III-316 | $NO_2$ | H | H | I | H | H |
| III-317 | $NO_2$ | F | H | H | H | H |
| III-318 | $NO_2$ | H | F | H | H | H |
| III-319 | $NO_2$ | H | H | F | H | H |
| III-320 | $NO_2$ | $OCH_3$ | $CH_3$ | H | H | H |
| III-321 | $NO_2$ | $OCH_3$ | H | $CH_3$ | H | H |
| III-322 | $NO_2$ | $OCH_3$ | H | H | $CH_3$ | H |
| III-323 | $NO_2$ | I | I | H | H | H |
| III-324 | $NO_2$ | I | H | I | H | H |
| III-325 | $NO_2$ | I | H | H | I | H |
| III-326 | $NO_2$ | F | F | H | H | H |
| III-327 | $NO_2$ | F | H | F | H | H |
| III-328 | $NO_2$ | F | H | H | F | H |
| III-329 | $NO_2$ | $OCH_3$ | $OCH_3$ | H | H | H |
| III-330 | $NO_2$ | $OCH_3$ | H | $OCH_3$ | H | H |
| III-331 | Br | Cl | $NO_2$ | H | H | H |
| III-332 | Br | Cl | H | $NO_2$ | H | H |
| III-333 | Br | Cl | H | H | $NO_2$ | H |
| III-334 | Br | Cl | $CH_3$ | H | H | H |
| III-335 | Br | Cl | H | $CH_3$ | H | H |
| III-336 | Br | Cl | H | H | $CH_3$ | H |
| III-337 | Br | Cl | Cl | H | H | H |
| III-338 | Br | Cl | H | Cl | H | H |
| III-339 | Br | $CH_3$ | $CH_3$ | H | H | H |
| III-340 | Br | $CH_3$ | H | H | $CH_3$ | H |
| III-341 | Br | $CF_3$ | H | H | H | H |
| III-342 | Br | H | $CF_3$ | H | H | H |
| III-343 | Br | H | H | $CF_3$ | H | H |
| III-344 | Br | I | H | H | H | H |
| III-345 | Br | H | I | H | H | H |
| III-346 | Br | H | H | I | H | H |
| III-347 | Br | F | H | H | H | H |
| III-348 | Br | H | F | H | H | H |
| III-349 | Br | H | H | F | H | H |
| III-350 | Br | $OCH_3$ | $CH_3$ | H | H | H |
| III-351 | Br | $OCH_3$ | H | $CH_3$ | H | H |
| III-352 | Br | $OCH_3$ | H | H | $CH_3$ | H |
| III-353 | Br | I | I | H | H | H |
| III-354 | Br | I | H | I | H | H |
| III-355 | Br | I | H | H | I | H |
| III-356 | Br | F | F | H | H | H |
| III-357 | Br | F | H | F | H | H |
| III-358 | Br | F | H | H | F | H |
| III-359 | F | Cl | $NO_2$ | H | H | H |
| III-360 | F | Cl | H | $NO_2$ | H | H |
| III-361 | F | Cl | H | H | $NO_2$ | H |
| III-362 | F | Cl | $CH_3$ | H | H | H |
| III-363 | F | Cl | H | $CH_3$ | H | H |

-continued

| No | $R_{21}$ | $R_{22}$ | $R_{23}$ | $R_{24}$ | $R_{25}$ | $R_{26}$ |
|---|---|---|---|---|---|---|
| III-364 | F | Cl | H | H | $CH_3$ | H |
| III-365 | F | Cl | Cl | H | H | H |
| III-366 | F | Cl | H | Cl | H | H |
| III-367 | F | $CH_3$ | $CH_3$ | H | H | H |
| III-368 | F | $CH_3$ | H | H | $CH_3$ | H |
| III-369 | F | $CF_3$ | H | H | H | H |
| III-370 | F | H | $CF_3$ | H | H | H |
| III-371 | F | H | H | $CF_3$ | H | H |
| III-372 | F | I | H | H | H | H |
| III-373 | F | H | I | H | H | H |
| III-374 | F | H | H | I | H | H |
| III-375 | F | F | H | H | H | H |
| III-376 | F | H | F | H | H | H |
| III-377 | F | H | H | F | H | H |
| III-378 | F | $OCH_3$ | $CH_3$ | H | H | H |
| III-379 | F | $OCH_3$ | H | $CH_3$ | H | H |
| III-380 | F | $OCH_3$ | H | H | $CH_3$ | H |
| III-381 | F | I | I | H | H | H |
| III-382 | F | I | H | I | H | H |
| III-383 | F | I | H | H | I | H |
| III-384 | F | F | F | H | H | H |
| III-385 | F | F | H | F | H | H |
| III-386 | F | F | H | H | F | H |
| III-387 | I | Cl | $NO_2$ | H | H | H |
| III-388 | I | Cl | H | $NO_2$ | H | H |
| III-389 | I | Cl | H | H | $NO_2$ | H |
| III-390 | I | Cl | $CH_3$ | H | H | H |
| III-391 | I | Cl | H | $CH_3$ | H | H |
| III-392 | I | Cl | H | H | $CH_3$ | H |
| III-393 | I | Cl | Cl | H | H | H |
| III-394 | I | Cl | H | Cl | H | H |
| III-395 | I | $CH_3$ | $CH_3$ | H | H | H |
| III-396 | I | $CH_3$ | H | H | $CH_3$ | H |
| III-397 | I | $CF_3$ | H | H | H | H |
| III-398 | I | H | $CF_3$ | H | H | H |
| III-399 | I | H | H | $CF_3$ | H | H |
| III-400 | I | I | H | H | H | H |
| III-401 | I | H | I | H | H | H |
| III-402 | I | H | H | I | H | H |
| III-403 | I | F | H | H | H | H |
| III-404 | I | H | F | H | H | H |
| III-405 | I | H | H | F | H | H |
| III-406 | I | $OCH_3$ | $CH_3$ | H | H | H |
| III-407 | I | $OCH_3$ | H | $CH_3$ | H | H |
| III-408 | I | $OCH_3$ | H | H | $CH_3$ | H |
| III-409 | I | I | I | H | H | H |
| III-410 | I | I | H | I | H | H |
| III-411 | I | I | H | H | I | H |
| III-412 | I | F | F | H | H | H |
| III-413 | I | F | H | F | H | H |
| III-414 | I | F | H | H | F | H |
| III-415 | CN | Cl | $NO_2$ | H | H | H |
| III-416 | CN | Cl | H | $NO_2$ | H | H |
| III-417 | CN | Cl | H | H | $NO_2$ | H |
| III-418 | CN | Cl | $CH_3$ | H | H | H |
| III-419 | CN | Cl | H | $CH_3$ | H | H |
| III-420 | CN | Cl | H | H | $CH_3$ | H |
| III-421 | CN | Cl | Cl | H | H | H |
| III-422 | CN | Cl | H | Cl | H | H |
| III-423 | CN | $CH_3$ | $CH_3$ | H | H | H |
| III-424 | CN | $CH_3$ | H | H | $CH_3$ | H |
| III-425 | CN | $CF_3$ | H | H | H | H |
| III-426 | CN | H | $CF_3$ | H | H | H |
| III-427 | CN | H | H | $CF_3$ | H | H |
| III-428 | CN | I | H | H | H | H |
| III-429 | CN | H | I | H | H | H |
| III-430 | CN | H | H | I | H | H |
| III-431 | CN | F | H | H | H | H |
| III-432 | CN | H | F | H | H | H |
| III-433 | CN | H | H | F | H | H |
| III-434 | CN | $OCH_3$ | $CH_3$ | H | H | H |
| III-435 | CN | $OCH_3$ | H | $CH_3$ | H | H |
| III-436 | CN | $OCH_3$ | H | H | $CH_3$ | H |
| III-437 | CN | I | I | H | H | H |
| III-438 | CN | I | H | I | H | H |
| III-439 | CN | I | H | H | I | H |
| III-440 | CN | F | F | H | H | H |
| III-441 | CN | F | H | F | H | H |
| III-442 | CN | F | H | H | F | H |
| III-443 | OH | H | H | H | H | H |
| III-444 | OH | H | $CH_3$ | H | H | H |

-continued

| No | $R_{21}$ | $R_{22}$ | $R_{23}$ | $R_{24}$ | $R_{25}$ | $R_{26}$ |
|---|---|---|---|---|---|---|
| III-445 | OH | Cl | H | H | H | H |
| III-446 | OH | H | H | CN | H | H |
| III-447 | OH | H | H | $OCH_3$ | H | H |
| III-448 | OH | $NO_2$ | H | H | H | H |
| III-449 | OH | H | $CF_3$ | H | H | H |
| III-450 | OH | $CH_3$ | H | H | $CH_3$ | H |

The bio-azo compound represented by the above mentioned General formula [III] of the present invention can be easily synthesized by a known process.

EXAMPLE OF SYNTHESIS 5

(Synthesis of an illustrated compound III-7)

2.24 g (0.01 mol) of 2, 7-diamino-4-methyl-9-fluorenone was dispersed in 10 mL of hydrochloric acid and 20 mL of water, and a solution formed by dissolving 1.40 g (0.02 mol) of sodium nitrite in 5 mL of water was added in drops to the above solution while maintaining the temperature at 5° C. or lower. After this solution continued to be agitated further for 1 hour at this temperature, insoluble substances were removed by filtration, and the resulting filtrate then received the addition of a solution formed by dissolving 4.9 g of ammonium phosphate fluoride in 50 mL of water. The precipitated tetrazonium salt was obtained by filtration and was then dissolved in 100 mL of N, N-dimethylformamide (DMF). With the temperature kept at 5° C. or lower, a solution formed by dissolving 5.94 g (0.02 mol) of 2hydroxy-3-naphthoic acid-3'-chloranilide in 200 mL of DMF was added in drops to the above solution.

With the temperature being continuously kept at 5° C. or lower, a solution formed by dissolving 6 g (0.04 mol) of triethanolamine in 30 mL of DMF was added in drops, followed by agitation for 1 hour at 5° C. or lower and further for 4 hours at the room temperature. After the reaction, the precipitated crystals were obtained by filtration, washed with DMF and then with water, and then dried, thus resulting in 5.6 g of the target substance.

Theoretical value:

C=68.5%, H=3.56%, and N=9.98%.

Found value:

C=68.22%, H=4.01%, and N=10.01%.

EXAMPLE OF SYNTHESIS 6

(Synthesis of an illustated compound III-114)

2.89 g (0.01 mol) of 2, 7-diamino-4-brom-9-fluorenone was dispersed in 10 mL of hydrochloric acid and 20 mL of water, and a solution formed by dissolving 1.40 g (0.02 mol) of sodium nitrite in 5 mL of water was added in drops to the above solution while the temperature was kept at 5° C. or lower. After this solution was continuously agitated further for 1 hour at this temperature, insoluble substances were removed by filtration, and a solution was formed by dissolving 4.9 g of 6-ammonium phosphate fluoride in 50 mL of water and added to the filtrate. The precipitated tetrazonium salt was gained by filtration and was then dissolved in 100 mL of N, N-dimethylformamide (DMF). With the temperature being kept at 5° C. or lower, the solution was allowed to have the addition in drops of a solution formed by dissolving 5.94 g (0.02 mol) of 2-hydroxy-3-naphthoic acid-3'-chloranilide in 200 mL of DMF.

With the temperature being continuously maintained at 5° C. or lower, a solution made by dissolving 6 g (0.04 mol) of triethanolamine in 30 mL of DMF was added in drops to the above solution, followed by agitation for 1 hour at 5° C. or lower and further for 4. hours at the room temperature. After the reaction, the precipitated crystals were obtained by filtration, washed with DMF and then with water, and were then dried, thus resulting in 5.2 g of the target substance.

Theoretical value:

C=62.28%, H=2.98%, and N=9.27%.

Found value:

C=62.33%, H=3.05%, and N=9.38%.

The other compounds of the present invention can be prepared, in the same process as described in Example of Synthesis 1, by producing a tetrazo product with use of 2, 7-diamino-4-substitution-9-fluorenone and then allowing the reaction of 2-hydroxy-3-naphthoic acid-substituted anilide.

The halogen atom for $R_{31}$ and $R_{32}$, in General formula [IV] is preferably selected from a chlorine atom, a bromide atom, a fluorine atom and an iodine atom, among which chlorine or bromide atom is preferable.

The alky group for $R_{31}$ and $R_{32}$ is preferably an alkyl group with 1 to 4 carbon atoms; for example, a methyl group, an ethyl group, an isopropyl group, a t-butyle group, or a trifluoromethyl group.

The alkoxy group for $R_{31}$ and $R_{32}$ is preferably an alkoxy group with 1 to 4 carbon atoms, including for example, a methoxy group, an ethoxy group, an isopropoxy group, a t-butoxy group, or a 2-chloroethoxy group.

Preferable substituents for $R_{31}$ and $R_{32}$ are a halogen atom, an alkyl group and an alkoxy group.

The alkyl group, alkoxy group and halogen atom for $R_{33}$ to $R_{37}$ can be illustrated by the same specific examples as those for $R_{32}$.

The azo compound expressed by the above mentioned General formula [IV] can be illustrated specifically by the following General formulae [IV-A] to [IV-I]:

[IV-A]
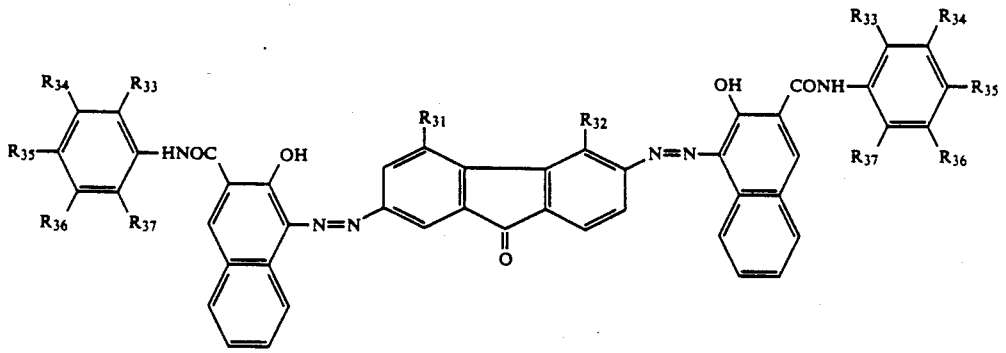
[IV-B]
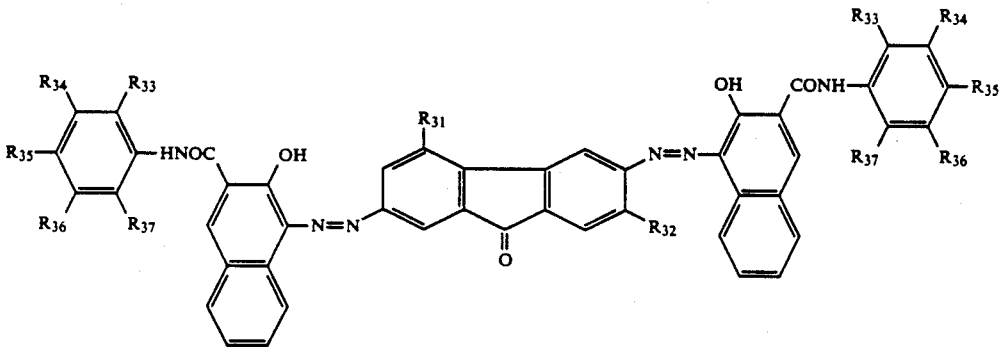
[IV-C]
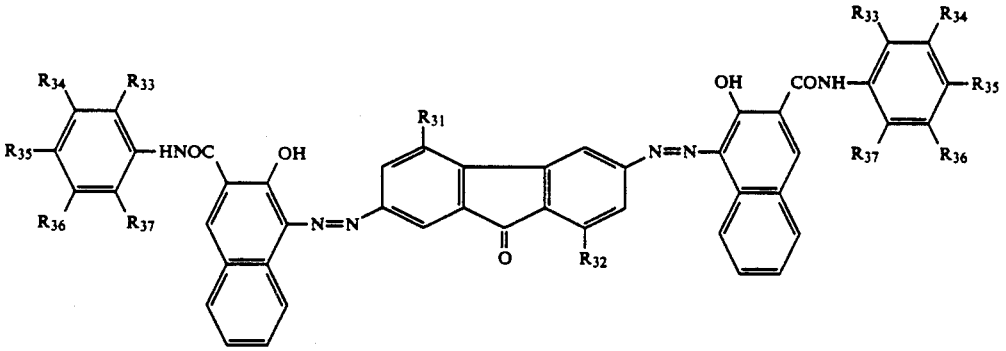
[IV-D]
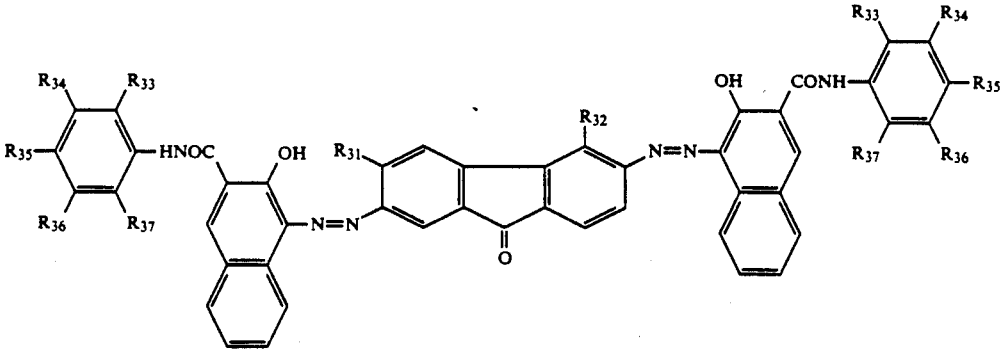

-continued
[IV-E]
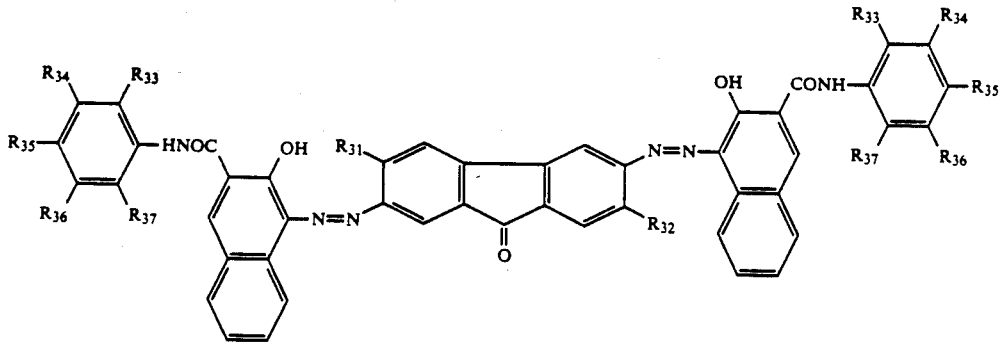
[IV-F]
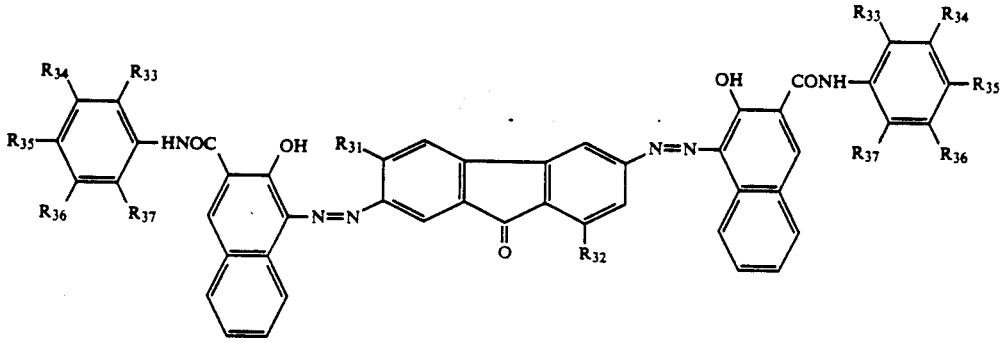
[IV-G]
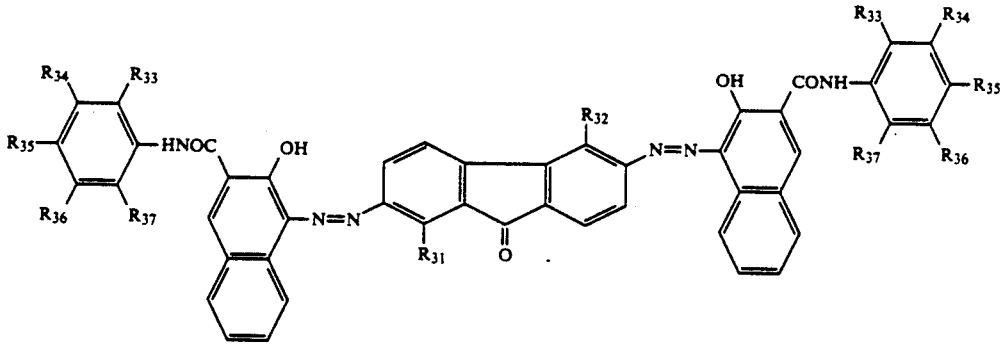
[IV-H]
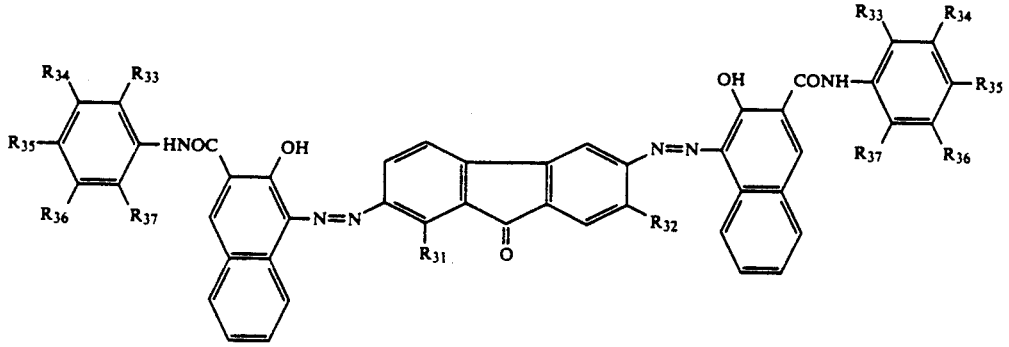

-continued

[IV-I]

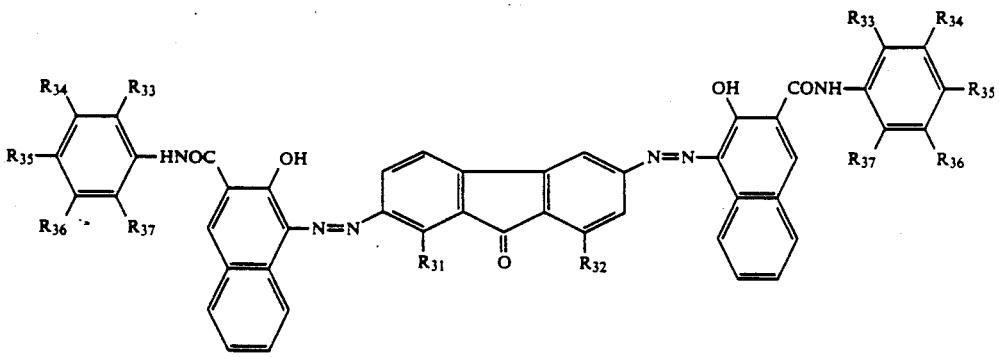

Next is specific examples of the azo compound represented by the above mentioned General formula [IV] of the present invention, but they are in no way limited by such examples.

| | $R_{31}$, $R_{32}$ = NONE $R_{37}$ = H | | | |
|---|---|---|---|---|
| No. | $R_{33}$ | $R_{34}$ | $R_{35}$ | $R_{36}$ |
| IV-1 | H | H | H | H |
| IV-2 | $CH_3$ | H | H | H |
| IV-3 | H | $CH_3$ | H | H |
| IV-4 | H | H | $CH_3$ | H |
| IV-5 | Cl | H | H | H |
| IV-6 | H | Cl | H | H |
| IV-7 | H | H | Cl | H |
| IV-8 | Br | H | H | H |
| IV-9 | H | Br | H | H |
| IV-10 | H | H | Br | H |
| IV-11 | I | H | H | H |
| IV-12 | H | I | H | H |
| IV-13 | H | H | I | H |
| IV-14 | F | H | H | H |
| IV-15 | H | F | H | H |
| IV-16 | H | H | F | H |
| IV-17 | $OCH_3$ | H | H | H |
| IV-18 | H | $OCH_3$ | H | H |
| IV-19 | H | H | $OCH_3$ | H |
| IV-20 | $NO_2$ | H | H | H |
| IV-21 | H | $NO_2$ | H | H |
| IV-22 | H | H | $NO_2$ | H |
| IV-23 | CN | H | H | H |
| IV-24 | H | CN | H | H |
| IV-25 | H | H | CN | H |
| IV-26 | $CF_3$ | H | H | H |
| IV-27 | H | $CF_3$ | H | H |
| IV-28 | H | H | $CF_3$ | H |
| IV-29 | Cl | $NO_2$ | H | H |
| IV-30 | Cl | H | $NO_2$ | H |
| IV-31 | Cl | H | H | $NO_2$ |
| IV-32 | Cl | $CH_3$ | H | H |
| IV-33 | Cl | H | $CH_3$ | H |
| IV-34 | Cl | H | H | $CH_3$ |
| IV-35 | Cl | Cl | H | H |
| IV-36 | Cl | H | Cl | H |
| IV-37 | Cl | H | H | Cl |
| IV-38 | H | Cl | Cl | H |
| IV-39 | H | Cl | H | Cl |
| IV-40 | $CH_3$ | $CH_3$ | H | H |
| IV-41 | $CH_3$ | H | $CH_3$ | H |
| IV-42 | $CH_3$ | H | H | $CH_3$ |
| IV-43 | $CH_3$ | Cl | H | H |
| IV-44 | $CH_3$ | H | Cl | H |
| IV-45 | $CH_3$ | H | H | Cl |
| IV-46 | H | $CH_3$ | $CH_3$ | H |
| IV-47 | H | $CH_3$ | H | $CH_3$ |
| IV-48 | $OCH_3$ | Cl | H | H |
| IV-49 | $OCH_3$ | H | Cl | H |
| IV-50 | $OCH_3$ | H | H | Cl |
| IV-51 | $OCH_3$ | $OCH_3$ | H | H |
| IV-52 | $OCH_3$ | H | $OCH_3$ | H |

-continued

| | $R_{31}$, $R_{32}$ = NONE $R_{37}$ = H | | | |
|---|---|---|---|---|
| No. | $R_{33}$ | $R_{34}$ | $R_{35}$ | $R_{36}$ |
| IV-53 | $OCH_3$ | H | H | $OCH_3$ |
| IV-54 | $OCH_3$ | $CH_3$ | H | H |
| IV-55 | $OCH_3$ | H | $CH_3$ | H |
| IV-56 | $OCH_3$ | H | H | $CH_3$ |
| IV-57 | H | $OCH_3$ | $OCH_3$ | H |
| IV-58 | H | $OCH_3$ | H | $OCH_3$ |
| IV-59 | I | I | H | H |
| IV-60 | I | H | I | H |
| IV-61 | I | H | H | I |
| IV-62 | H | I | I | H |
| IV-63 | H | I | H | I |
| IV-64 | $CH_3$ | $CH_3$ | H | $CH_3$ |
| IV-65 | $OCH_3$ | $OCH_3$ | H | $OCH_3$ |
| IV-66 | Cl | Cl | H | Cl |
| IV-67 | Br | Br | H | Br |
| IV-68 | F | F | H | H |
| IV-69 | F | H | F | H |
| IV-70 | F | H | H | F |
| IV-71 | H | F | F | H |
| IV-72 | H | F | H | F |

| | $R_{31}$, $R_{32}$ = NONE $R_{36}$ = H | | | |
|---|---|---|---|---|
| No. | $R_{33}$ | $R_{34}$ | $R_{35}$ | $R_{37}$ |
| IV-73 | $CH_3$ | H | H | $CH_3$ |
| IV-74 | $OCH_3$ | H | H | $OCH_3$ |
| IV-75 | Cl | H | H | Cl |
| IV-76 | Br | H | H | Br |

| | $R_{31}$ = $CH_3$ $R_{32}$ = $OCH_3$ $R_{37}$ = H | | | |
|---|---|---|---|---|
| No. | $R_{33}$ | $R_{34}$ | $R_{35}$ | $R_{36}$ |
| IV-77 | H | H | H | H |
| IV-78 | $CH_3$ | H | H | H |
| IV-79 | H | $CH_3$ | H | H |
| IV-80 | H | H | $CH_3$ | H |
| IV-81 | Cl | H | H | H |
| IV-82 | H | Cl | H | H |
| IV-83 | H | H | Cl | H |
| IV-84 | Br | H | H | H |
| IV-85 | H | Br | H | H |
| IV-86 | H | H | Br | H |
| IV-87 | I | H | H | H |
| IV-88 | H | I | H | H |
| IV-89 | H | H | I | H |
| IV-90 | F | H | H | H |
| IV-91 | H | F | H | H |
| IV-92 | H | H | F | H |
| IV-93 | $OCH_3$ | H | H | H |

-continued $R_{31} = CH_3$, $R_{32} = OCH_3$, $R_{37} = H$

| No. | $R_{33}$ | $R_{34}$ | $R_{35}$ | $R_{36}$ |
|---|---|---|---|---|
| IV-94 | H | $OCH_3$ | H | H |
| IV-95 | H | H | $OCH_3$ | H |
| IV-96 | $NO_2$ | H | H | H |
| IV-97 | H | $NO_2$ | H | H |
| IV-98 | H | H | $NO_2$ | H |
| IV-99 | CN | H | H | H |
| IV-100 | H | CN | H | H |
| IV-101 | H | H | CN | H |
| IV-102 | $CF_3$ | H | H | H |
| IV-103 | H | $CF_3$ | H | H |
| IV-104 | H | H | $CF_3$ | H |
| IV-105 | Cl | $NO_2$ | H | H |
| IV-106 | Cl | H | $NO_2$ | H |
| IV-107 | Cl | H | H | $NO_2$ |
| IV-108 | Cl | $CH_3$ | H | H |
| IV-109 | Cl | H | $CH_3$ | H |
| IV-110 | Cl | H | H | $CH_3$ |
| IV-111 | Cl | Cl | H | H |
| IV-112 | Cl | H | Cl | H |
| IV-113 | Cl | H | H | Cl |
| IV-114 | H | Cl | Cl | H |
| IV-115 | H | Cl | H | Cl |
| IV-116 | $CH_3$ | $CH_3$ | H | H |
| IV-117 | $CH_3$ | H | $CH_3$ | H |
| IV-118 | $CH_3$ | H | H | $CH_3$ |
| IV-119 | $CH_3$ | Cl | H | H |
| IV-120 | $CH_3$ | H | Cl | H |
| IV-121 | $CH_3$ | H | H | Cl |
| IV-122 | H | $CH_3$ | $CH_3$ | H |
| IV-123 | H | $CH_3$ | H | $CH_3$ |
| IV-124 | $OCH_3$ | Cl | H | H |
| IV-125 | $OCH_3$ | H | Cl | H |
| IV-126 | $OCH_3$ | H | H | Cl |
| IV-127 | $OCH_3$ | $OCH_3$ | H | H |
| IV-128 | $OCH_3$ | H | $OCH_3$ | H |
| IV-129 | $OCH_3$ | H | H | $OCH_3$ |
| IV-130 | $OCH_3$ | $CH_3$ | H | H |
| IV-131 | $OCH_3$ | H | $CH_3$ | H |
| IV-132 | $OCH_3$ | H | H | $CH_3$ |
| IV-133 | H | $OCH_3$ | $OCH_3$ | H |
| IV-134 | H | $OCH_3$ | H | $OCH_3$ |
| IV-135 | I | I | H | H |
| IV-136 | I | H | I | H |
| IV-137 | I | H | H | I |
| IV-138 | H | I | I | H |
| IV-139 | H | I | H | I |
| IV-140 | $CH_3$ | $CH_3$ | H | $CH_3$ |
| IV-141 | $OCH_3$ | $OCH_3$ | H | $OCH_3$ |
| IV-142 | Cl | Cl | H | Cl |
| IV-143 | Br | Br | H | Br |
| IV-144 | F | F | H | H |
| IV-145 | F | H | F | H |
| IV-146 | F | H | H | F |
| IV-147 | H | F | F | H |
| IV-148 | H | F | H | F |

$R_{31} = CH_3$, $R_{32} = OCH_3$, $R_{36} = H$

| No. | $R_{33}$ | $R_{34}$ | $R_{35}$ | $R_{37}$ |
|---|---|---|---|---|
| IV-149 | $CH_3$ | H | H | $CH_3$ |
| IV-150 | $OCH_3$ | H | H | $OCH_3$ |
| IV-151 | Cl | H | H | Cl |
| IV-152 | Br | H | H | Br |

$R_{31} = CH_3$, $R_{32} = Cl$, $R_{37} = H$

| No. | $R_{33}$ | $R_{34}$ | $R_{35}$ | $R_{36}$ |
|---|---|---|---|---|
| IV-153 | H | H | H | H |

-continued $R_{31} = CH_3$, $R_{32} = Cl$, $R_{37} = H$

| No. | $R_{33}$ | $R_{34}$ | $R_{35}$ | $R_{36}$ |
|---|---|---|---|---|
| IV-154 | $CH_3$ | H | H | H |
| IV-155 | H | $CH_3$ | H | H |
| IV-156 | H | H | $CH_3$ | H |
| IV-157 | Cl | H | H | H |
| IV-158 | H | Cl | H | H |
| IV-159 | H | H | Cl | H |
| IV-160 | Br | H | H | H |
| IV-161 | H | Br | H | H |
| IV-162 | H | H | Br | H |
| IV-163 | I | H | H | H |
| IV-164 | H | I | H | H |
| IV-165 | H | H | I | H |
| IV-166 | F | H | H | H |
| IV-167 | H | F | H | H |
| IV-168 | H | H | F | H |
| IV-169 | $OCH_3$ | H | H | H |
| IV-170 | H | $OCH_3$ | H | H |
| IV-171 | H | H | $OCH_3$ | H |
| IV-172 | $NO_2$ | H | H | H |
| IV-173 | H | $NO_2$ | H | H |
| IV-174 | H | H | $NO_2$ | H |
| IV-175 | CN | H | H | H |
| IV-176 | H | CN | H | H |
| IV-177 | H | H | CN | H |
| IV-178 | $CF_3$ | H | H | H |
| IV-179 | H | $CF_3$ | H | H |
| IV-180 | H | H | $CF_3$ | H |
| IV-181 | Cl | $NO_2$ | H | H |
| IV-182 | Cl | H | $NO_2$ | H |
| IV-183 | Cl | H | H | $NO_2$ |
| IV-184 | Cl | $CH_3$ | H | H |
| IV-185 | Cl | H | $CH_3$ | H |
| IV-186 | Cl | H | H | $CH_3$ |
| IV-187 | Cl | Cl | H | H |
| IV-188 | Cl | H | Cl | H |
| IV-189 | Cl | H | H | Cl |
| IV-190 | H | Cl | Cl | H |
| IV-191 | H | Cl | H | Cl |
| IV-192 | $CH_3$ | $CH_3$ | H | H |
| IV-193 | $CH_3$ | H | $CH_3$ | H |
| IV-194 | $CH_3$ | H | H | $CH_3$ |
| IV-195 | $CH_3$ | Cl | H | H |
| IV-196 | $CH_3$ | H | Cl | H |
| IV-197 | $CH_3$ | H | H | Cl |
| IV-198 | H | $CH_3$ | $CH_3$ | H |
| IV-199 | H | $CH_3$ | H | $CH_3$ |
| IV-200 | $OCH_3$ | Cl | H | H |
| IV-201 | $OCH_3$ | H | Cl | H |
| IV-202 | $OCH_3$ | H | H | Cl |
| IV-203 | $OCH_3$ | $OCH_3$ | H | H |
| IV-204 | $OCH_3$ | H | $OCH_3$ | H |
| IV-205 | $OCH_3$ | H | H | $OCH_3$ |
| IV-206 | $OCH_3$ | $CH_3$ | H | H |
| IV-207 | $OCH_3$ | H | $CH_3$ | H |
| IV-208 | $OCH_3$ | H | H | $CH_3$ |
| IV-209 | H | $OCH_3$ | $OCH_3$ | H |
| IV-210 | H | $OCH_3$ | H | $OCH_3$ |
| IV-211 | I | I | H | H |
| IV-212 | I | H | I | H |
| IV-213 | I | H | H | I |
| IV-214 | H | I | I | H |
| IV-215 | H | I | H | I |
| IV-216 | $CH_3$ | $CH_3$ | H | $CH_3$ |
| IV-217 | $OCH_3$ | $OCH_3$ | H | $OCH_3$ |
| IV-218 | Cl | Cl | H | Cl |
| IV-219 | Br | Br | H | Br |
| IV-220 | F | F | H | H |
| IV-221 | F | H | F | H |
| IV-222 | F | H | H | F |
| IV-223 | H | F | F | H |
| IV-224 | H | F | H | F |

$R_{31} = CH_3$, $R_{32} = Cl$, $R_{36} = H$

| No. | $R_{33}$ | $R_{34}$ | $R_{35}$ | $R_{37}$ |
|---|---|---|---|---|
| IV-225 | $CH_3$ | H | H | $CH_3$ |
| IV-226 | $OCH_3$ | H | H | $OCH_3$ |
| IV-227 | Cl | H | H | Cl |
| IV-228 | Br | H | H | Br |

$R_{31} = CH_3$, $R_{32} = Br$, $R_{37} = H$

| No. | $R_{33}$ | $R_{34}$ | $R_{35}$ | $R_{36}$ |
|---|---|---|---|---|
| IV-229 | H | H | H | H |
| IV-230 | $CH_3$ | H | H | H |
| IV-231 | H | $CH_3$ | H | H |
| IV-232 | H | H | $CH_3$ | H |
| IV-233 | Cl | H | H | H |
| IV-234 | H | Cl | H | H |
| IV-235 | H | H | Cl | H |
| IV-236 | Br | H | H | H |
| IV-237 | H | Br | H | H |
| IV-238 | H | H | Br | H |
| IV-239 | I | H | H | H |
| IV-240 | H | I | H | H |
| IV-241 | H | H | I | H |
| IV-242 | F | H | H | H |
| IV-243 | H | F | H | H |
| IV-244 | H | H | F | H |
| IV-245 | $OCH_3$ | H | H | H |
| IV-246 | H | $OCH_3$ | H | H |
| IV-247 | H | H | $OCH_3$ | H |
| IV-248 | $NO_2$ | H | H | H |
| IV-249 | H | $NO_2$ | H | H |
| IV-250 | H | H | $NO_2$ | H |
| IV-251 | CN | H | H | H |
| IV-252 | H | CN | H | H |
| IV-253 | H | H | CN | H |
| IV-254 | $CF_3$ | H | H | H |
| IV-256 | H | $CF_3$ | H | H |
| IV-257 | H | H | $CF_3$ | H |
| IV-258 | Cl | $NO_2$ | H | H |
| IV-259 | Cl | H | $NO_2$ | H |
| IV-260 | Cl | H | H | $NO_2$ |
| IV-261 | Cl | $CH_3$ | H | H |
| IV-262 | Cl | H | $CH_3$ | H |
| IV-263 | Cl | H | H | $CH_3$ |
| IV-264 | Cl | Cl | H | H |
| IV-265 | Cl | H | Cl | H |
| IV-266 | Cl | H | H | Cl |
| IV-267 | H | Cl | Cl | H |
| IV-268 | H | Cl | H | Cl |
| IV-269 | $CH_3$ | $CH_3$ | H | H |
| IV-270 | $CH_3$ | H | $CH_3$ | H |
| IV-271 | $CH_3$ | H | H | $CH_3$ |
| IV-272 | $CH_3$ | Cl | H | H |
| IV-273 | $CH_3$ | H | Cl | H |
| IV-274 | $CH_3$ | H | H | Cl |
| IV-275 | H | $CH_3$ | $CH_3$ | H |
| IV-276 | H | $CH_3$ | H | $CH_3$ |
| IV-277 | $OCH_3$ | Cl | H | H |
| IV-278 | $OCH_3$ | H | Cl | H |
| IV-279 | $OCH_3$ | H | H | Cl |
| IV-280 | $OCH_3$ | $OCH_3$ | H | H |
| IV-281 | $OCH_3$ | H | $OCH_3$ | H |
| IV-282 | $OCH_3$ | H | H | $OCH_3$ |
| IV-283 | $OCH_3$ | $CH_3$ | H | H |
| IV-284 | $OCH_3$ | H | $CH_3$ | H |
| IV-285 | $OCH_3$ | H | H | $CH_3$ |
| IV-286 | H | $OCH_3$ | $OCH_3$ | H |
| IV-287 | H | $OCH_3$ | H | $OCH_3$ |
| IV-288 | I | I | H | H |
| IV-289 | I | H | I | H |
| IV-290 | I | H | H | I |
| IV-291 | H | I | I | H |
| IV-292 | H | I | H | I |
| IV-293 | $CH_3$ | $CH_3$ | H | $CH_3$ |
| IV-294 | $OCH_3$ | $OCH_3$ | H | $OCH_3$ |

-continued $R_{31} = CH_3$, $R_{32} = Br$, $R_{37} = H$

| No. | $R_{33}$ | $R_{34}$ | $R_{35}$ | $R_{36}$ |
|---|---|---|---|---|
| IV-295 | Cl | Cl | H | Cl |
| IV-296 | Br | Br | H | Br |
| IV-297 | F | F | H | H |
| IV-298 | F | H | F | H |
| IV-299 | F | H | H | F |
| IV-300 | H | F | F | H |
| IV-301 | H | F | H | F |

$R_{31} = CH_3$, $R_{32} = Br$, $R_{36} = H$

| No. | $R_{33}$ | $R_{34}$ | $R_{35}$ | $R_{37}$ |
|---|---|---|---|---|
| IV-302 | $CH_3$ | H | H | $CH_3$ |
| IV-303 | $OCH_3$ | H | H | $OCH_3$ |
| IV-304 | Cl | H | H | Cl |
| IV-305 | Br | H | H | Br |

$R_{31} = CH_3$, $R_{32} = F$, $R_{37} = H$

| No. | $R_{33}$ | $R_{34}$ | $R_{35}$ | $R_{36}$ |
|---|---|---|---|---|
| IV-306 | H | H | H | H |
| IV-307 | $CH_3$ | H | H | H |
| IV-308 | H | $CH_3$ | H | H |
| IV-309 | H | H | $CH_3$ | H |
| IV-310 | Cl | H | H | H |
| IV-311 | H | Cl | H | H |
| IV-312 | H | H | Cl | H |
| IV-313 | Br | H | H | H |
| IV-314 | H | Br | H | H |
| IV-315 | H | H | Br | H |
| IV-316 | I | H | H | H |
| IV-317 | H | I | H | H |
| IV-318 | H | H | I | H |
| IV-319 | F | H | H | H |
| IV-320 | H | F | H | H |
| IV-321 | H | H | F | H |
| IV-322 | $OCH_3$ | H | H | H |
| IV-323 | H | $OCH_3$ | H | H |

| No. | $R_{33}$ | $R_{34}$ | $R_{35}$ | $R_{36}$ |
|---|---|---|---|---|
| IV-324 | H | H | $OCH_3$ | H |
| IV-325 | $NO_2$ | H | H | H |
| IV-326 | H | $NO_2$ | H | H |
| IV-327 | H | H | $NO_2$ | H |
| IV-328 | CN | H | H | H |
| IV-329 | H | CN | H | H |
| IV-330 | H | H | CN | H |
| IV-331 | $CF_3$ | H | H | H |
| IV-332 | H | $CF_3$ | H | H |
| IV-333 | H | H | $CF_3$ | H |
| IV-334 | Cl | $NO_2$ | H | H |
| IV-335 | Cl | H | $NO_2$ | H |
| IV-336 | Cl | H | H | $NO_2$ |
| IV-337 | Cl | $CH_3$ | H | H |
| IV-338 | Cl | H | $CH_3$ | H |
| IV-339 | Cl | H | H | $CH_3$ |
| IV-340 | Cl | Cl | H | H |
| IV-341 | Cl | H | Cl | H |

$R_{31} = CH_3$, $R_{32} = I$, $R_{37} = H$

| No. | $R_{33}$ | $R_{34}$ | $R_{35}$ | $R_{36}$ |
|---|---|---|---|---|
| IV-342 | Cl | H | H | Cl |
| IV-343 | H | Cl | Cl | H |

-continued $R_{31} = CH_3$
$R_{32} = I$
$R_{37} = H$

| No. | $R_{33}$ | $R_{34}$ | $R_{35}$ | $R_{36}$ |
|---|---|---|---|---|
| IV-345 | H | Cl | H | Cl |
| IV-346 | $CH_3$ | $CH_3$ | H | H |
| IV-347 | $CH_3$ | H | $CH_3$ | H |
| IV-348 | $CH_3$ | H | H | $CH_3$ |
| IV-349 | $CH_3$ | Cl | H | H |
| IV-350 | $CH_3$ | H | Cl | H |
| IV-351 | $CH_3$ | H | H | Cl |
| IV-352 | H | $CH_3$ | $CH_3$ | H |
| IV-353 | H | $CH_3$ | H | $CH_3$ |
| IV-354 | $OCH_3$ | Cl | H | H |
| IV-355 | $OCH_3$ | H | Cl | H |
| IV-356 | $OCH_3$ | H | H | Cl |
| IV-357 | $OCH_3$ | $OCH_3$ | H | H |
| IV-358 | $OCH_3$ | H | $OCH_3$ | H |
| IV-359 | $OCH_3$ | H | H | $OCH_3$ |
| IV-360 | $OCH_3$ | $CH_3$ | H | H |
| IV-361 | $OCH_3$ | H | $CH_3$ | H |
| IV-362 | $OCH_3$ | H | H | $CH_3$ |
| IV-363 | H | $OCH_3$ | $OCH_3$ | H |
| IV-364 | H | $OCH_3$ | H | $OCH_3$ |
| IV-365 | I | I | H | H |
| IV-366 | I | H | I | H |
| IV-367 | I | H | H | I |
| IV-368 | H | I | I | H |
| IV-369 | H | I | H | I |
| IV-370 | $CH_3$ | $CH_3$ | H | $CH_3$ |
| IV-371 | $OCH_3$ | $OCH_3$ | H | $OCH_3$ |
| IV-372 | Cl | Cl | H | Cl |
| IV-373 | Br | Br | H | Br |
| IV-374 | F | F | H | H |
| IV-375 | F | H | F | H |
| IV-376 | F | H | H | F |
| IV-377 | H | F | F | H |
| IV-378 | H | F | H | F |

$R_{31} = CH_3$
$R_{32} = F$
$R_{36} = H$

| No. | $R_{33}$ | $R_{34}$ | $R_{35}$ | $R_{37}$ |
|---|---|---|---|---|
| IV-379 | $CH_3$ | H | H | $CH_3$ |
| IV-380 | $OCH_3$ | H | H | $OCH_3$ |
| IV-381 | Cl | H | H | Cl |
| IV-382 | Br | H | H | Br |

$R_{31} = CH_3$
$R_{32} = CN$
$R_{37} = H$

| No. | $R_{33}$ | $R_{34}$ | $R_{35}$ | $R_{36}$ |
|---|---|---|---|---|
| IV-383 | H | H | H | H |
| IV-384 | $CH_3$ | H | H | H |
| IV-385 | H | $CH_3$ | H | H |
| IV-386 | H | H | $CH_3$ | H |
| IV-387 | Cl | H | H | H |
| IV-388 | H | Cl | H | H |
| IV-389 | H | H | Cl | H |
| IV-390 | Br | H | H | H |
| IV-391 | H | Br | H | H |
| IV-392 | H | H | Br | H |
| IV-393 | I | H | H | H |
| IV-394 | H | I | H | H |
| IV-395 | H | H | I | H |
| IV-396 | F | H | H | H |
| IV-397 | H | F | H | H |
| IV-398 | H | H | F | H |
| IV-399 | $OCH_3$ | H | H | H |
| IV-400 | H | $OCH_3$ | H | H |

$R_{31} = CH_3$
$R_{32} = NO_2$
$R_{37} = H$

| No. | $R_{33}$ | $R_{34}$ | $R_{35}$ | $R_{36}$ |
|---|---|---|---|---|
| IV-401 | H | H | $OCH_3$ | H |
| IV-402 | $NO_2$ | H | H | H |
| IV-403 | H | $NO_2$ | H | H |
| IV-404 | H | H | $NO_2$ | H |
| IV-405 | CN | H | H | H |
| IV-406 | H | CN | H | H |
| IV-407 | H | H | CN | H |
| IV-408 | $CF_3$ | H | H | H |
| IV-409 | H | $CF_3$ | H | H |
| IV-410 | H | H | $CF_3$ | H |
| IV-411 | Cl | $NO_2$ | H | H |
| IV-412 | Cl | H | $NO_2$ | H |
| IV-413 | Cl | H | H | $NO_2$ |
| IV-414 | Cl | $CH_3$ | H | H |
| IV-415 | Cl | H | $CH_3$ | H |
| IV-416 | Cl | H | H | $CH_3$ |
| IV-417 | Cl | Cl | H | H |
| IV-418 | Cl | H | Cl | H |

$R_{31} = CH_3$
$R_{32} = CF_3$
$R_{37} = H$

| No. | $R_{33}$ | $R_{34}$ | $R_{35}$ | $R_{36}$ |
|---|---|---|---|---|
| IV-419 | Cl | H | H | Cl |
| IV-420 | H | Cl | Cl | H |
| IV-421 | H | Cl | H | Cl |
| IV-422 | $CH_3$ | $CH_3$ | H | H |
| IV-423 | $CH_3$ | H | $CH_3$ | H |
| IV-424 | $CH_3$ | H | H | $CH_3$ |
| IV-425 | $CH_3$ | Cl | H | H |
| IV-426 | $CH_3$ | H | Cl | H |
| IV-427 | $CH_3$ | H | H | Cl |
| IV-428 | H | $CH_3$ | $CH_3$ | H |
| IV-429 | H | $CH_3$ | H | $CH_3$ |
| IV-430 | $OCH_3$ | Cl | H | H |
| IV-431 | $OCH_3$ | H | Cl | H |
| IV-432 | $OCH_3$ | H | H | Cl |
| IV-433 | $OCH_3$ | $OCH_3$ | H | H |
| IV-434 | $OCH_3$ | H | $OCH_3$ | H |
| IV-435 | $OCH_3$ | H | H | $OCH_3$ |
| IV-436 | $OCH_3$ | $CH_3$ | H | H |

$R_{31}, R_{32} = OCH_3$
$R_{37} = H$

| No. | $R_{33}$ | $R_{34}$ | $R_{35}$ | $R_{36}$ |
|---|---|---|---|---|
| IV-437 | H | H | H | H |
| IV-438 | $CH_3$ | H | H | H |
| IV-439 | H | $CH_3$ | H | H |
| IV-440 | H | H | $CH_3$ | H |
| IV-441 | Cl | H | H | H |
| IV-442 | H | Cl | H | H |
| IV-443 | H | H | Cl | H |
| IV-444 | Br | H | H | H |
| IV-445 | H | Br | H | H |
| IV-446 | H | H | Br | H |
| IV-447 | I | H | H | H |
| IV-448 | H | I | H | H |
| IV-449 | H | H | I | H |
| IV-450 | F | H | H | H |
| IV-451 | H | F | H | H |
| IV-452 | H | H | F | H |
| IV-453 | $OCH_3$ | H | H | H |
| IV-454 | H | $OCH_3$ | H | H |

$R_{31} = OCH_3$
$R_{32} = CH_3$
$R_{37} = H$

| No. | $R_{33}$ | $R_{34}$ | $R_{35}$ | $R_{36}$ |
|---|---|---|---|---|
| IV-455 | H | H | $OCH_3$ | H |
| IV-456 | $NO_2$ | H | H | H |
| IV-457 | H | $NO_2$ | H | H |
| IV-458 | H | H | $NO_2$ | H |
| IV-459 | CN | H | H | H |
| IV-460 | H | CN | H | H |
| IV-461 | H | H | CN | H |
| IV-462 | $CF_3$ | H | H | H |
| IV-463 | H | $CF_3$ | H | H |
| IV-464 | H | H | $CF_3$ | H |
| IV-465 | Cl | $NO_2$ | H | H |
| IV-466 | Cl | H | $NO_2$ | H |
| IV-467 | Cl | H | H | $NO_2$ |
| IV-468 | Cl | $CH_3$ | H | H |
| IV-469 | Cl | H | $CH_3$ | H |
| IV-470 | Cl | H | H | $CH_3$ |
| IV-471 | Cl | Cl | H | H |
| IV-472 | Cl | H | Cl | H |

$R_{31} = OCH_3$
$R_{32} = Cl$
$R_{37} = H$

| No. | $R_{33}$ | $R_{34}$ | $R_{35}$ | $R_{36}$ |
|---|---|---|---|---|
| IV-473 | Cl | H | H | Cl |
| IV-474 | H | Cl | Cl | H |
| IV-475 | H | Cl | H | Cl |
| IV-476 | $CH_3$ | H | $CH_3$ | H |
| IV-477 | $CH_3$ | H | H | $CH_3$ |
| IV-478 | $CH_3$ | Cl | H | H |
| IV-479 | $CH_3$ | H | Cl | H |
| IV-480 | $CH_3$ | H | H | Cl |
| IV-481 | H | $CH_3$ | $CH_3$ | H |
| IV-482 | H | $CH_3$ | H | $CH_3$ |
| IV-483 | $OCH_3$ | Cl | H | H |
| IV-484 | $OCH_3$ | H | Cl | H |
| IV-485 | $OCH_3$ | H | H | Cl |
| IV-486 | $OCH_3$ | $OCH_3$ | H | H |
| IV-487 | $OCH_3$ | H | $OCH_3$ | H |
| IV-488 | $OCH_3$ | H | H | $OCH_3$ |
| IV-489 | $OCH_3$ | $CH_3$ | H | H |

$R_{31} = OCH_3$
$R_{32} = Br$
$R_{37} = H$

| No. | $R_{33}$ | $R_{34}$ | $R_{35}$ | $R_{36}$ |
|---|---|---|---|---|
| IV-490 | $OCH_3$ | H | $CH_3$ | H |
| IV-491 | $OCH_3$ | H | H | $CH_3$ |
| IV-492 | H | $OCH_3$ | $OCH_3$ | H |
| IV-493 | H | $OCH_3$ | H | $OCH_3$ |
| IV-494 | I | I | H | H |
| IV-495 | I | H | I | H |
| IV-496 | I | H | H | I |
| IV-497 | H | I | I | H |
| IV-498 | H | I | H | I |
| IV-499 | $CH_3$ | $CH_3$ | H | $CH_3$ |
| IV-500 | $OCH_3$ | $OCH_3$ | H | $OCH_3$ |
| IV-501 | Cl | Cl | H | Cl |
| IV-502 | Br | Br | H | Br |
| IV-503 | F | F | H | H |
| IV-504 | F | H | F | H |
| IV-505 | F | H | H | F |
| IV-506 | H | F | F | H |
| IV-507 | H | F | H | F |

$R_{31}, R_{32} = OCH_3$
$R_{36} = H$

| No. | $R_{33}$ | $R_{34}$ | $R_{35}$ | $R_{37}$ |
|---|---|---|---|---|
| IV-508 | $CH_3$ | H | H | $CH_3$ |
| IV-509 | $OCH_3$ | H | H | $OCH_3$ |
| IV-510 | Cl | H | H | Cl |
| IV-511 | Br | H | H | Br |

$R_{31}, R_{32} = CH_3$
$R_{37} = H$

| No. | $R_{33}$ | $R_{34}$ | $R_{35}$ | $R_{36}$ |
|---|---|---|---|---|
| IV-512 | H | H | H | H |
| IV-513 | $CH_3$ | H | H | H |
| IV-514 | H | $CH_3$ | H | H |
| IV-515 | H | H | $CH_3$ | H |
| IV-516 | Cl | H | H | H |
| IV-517 | H | Cl | H | H |
| IV-518 | H | H | Cl | H |
| IV-519 | Br | H | H | H |
| IV-520 | H | Br | H | H |
| IV-521 | H | H | Br | H |
| IV-522 | I | H | H | H |
| IV-523 | H | I | H | H |
| IV-524 | H | H | I | H |
| IV-525 | F | H | H | H |
| IV-526 | H | F | H | H |
| IV-527 | H | H | F | H |
| IV-528 | $OCH_3$ | H | H | H |
| IV-529 | H | $OCH_3$ | H | H |
| IV-530 | H | H | $OCH_3$ | H |
| IV-531 | $NO_2$ | H | H | H |
| IV-532 | H | $NO_2$ | H | H |
| IV-533 | H | H | $NO_2$ | H |
| IV-534 | CN | H | H | H |
| IV-535 | H | CN | H | H |
| IV-536 | H | H | CN | H |
| IV-537 | $CF_3$ | H | H | H |
| IV-538 | H | $CF_3$ | H | H |
| IV-539 | H | H | $CF_3$ | H |
| IV-540 | Cl | $NO_2$ | H | H |
| IV-541 | Cl | H | $NO_2$ | H |
| IV-542 | Cl | H | H | $NO_2$ |
| IV-543 | Cl | $CH_3$ | H | H |
| IV-544 | Cl | H | $CH_3$ | H |
| IV-545 | Cl | H | H | $CH_3$ |
| IV-546 | Cl | Cl | H | H |
| IV-547 | Cl | H | Cl | H |

$R_{31} = OCH_3$
$R_{32} = Br$
$R_{37} = H$

| No. | $R_{33}$ | $R_{34}$ | $R_{35}$ | $R_{36}$ |
|---|---|---|---|---|
| IV-548 | Cl | H | H | Cl |
| IV-549 | H | Cl | Cl | H |
| IV-550 | H | Cl | H | Cl |
| IV-551 | $CH_3$ | $CH_3$ | H | H |
| IV-552 | $CH_3$ | H | $CH_3$ | H |
| IV-553 | $CH_3$ | H | H | $CH_3$ |
| IV-554 | $CH_3$ | Cl | H | H |
| IV-555 | $CH_3$ | H | Cl | H |
| IV-556 | $CH_3$ | H | H | Cl |
| IV-557 | H | $CH_3$ | $CH_3$ | H |
| IV-558 | H | $CH_3$ | H | $CH_3$ |
| IV-559 | $OCH_3$ | Cl | H | H |
| IV-560 | $OCH_3$ | H | Cl | H |
| IV-561 | $OCH_3$ | H | H | Cl |
| IV-562 | $OCH_3$ | $OCH_3$ | H | H |
| IV-563 | $OCH_3$ | H | $OCH_3$ | H |
| IV-564 | $OCH_3$ | H | H | $OCH_3$ |
| IV-565 | $OCH_3$ | $CH_3$ | H | H |

$R_{31} = OCH_3$ $R_{37} = H$
$R_{32} = I$

| No. | $R_{33}$ | $R_{34}$ | $R_{35}$ | $R_{36}$ |
|---|---|---|---|---|

-continued

| | | | | |
|---|---|---|---|---|
| IV-566 | Cl | H | H | Cl |
| IV-567 | H | Cl | Cl | H |
| IV-568 | H | Cl | H | Cl |
| IV-569 | $CH_3$ | $CH_3$ | H | H |
| IV-570 | $CH_3$ | H | $CH_3$ | H |
| IV-571 | $CH_3$ | H | H | $CH_3$ |
| IV-572 | $CH_3$ | Cl | H | H |
| IV-573 | $CH_3$ | H | Cl | H |
| IV-574 | $CH_3$ | H | H | Cl |

$R_{31} = OCH_3$ $R_{37} = H$
$R_{32} = F$

| No. | $R_{33}$ | $R_{34}$ | $R_{35}$ | $R_{36}$ |
|---|---|---|---|---|
| IV-575 | H | $CH_3$ | $CH_3$ | H |
| IV-576 | H | $CH_3$ | H | $CH_3$ |
| IV-577 | $OCH_3$ | Cl | H | H |
| IV-578 | $OCH_3$ | H | Cl | H |
| IV-579 | $OCH_3$ | H | H | Cl |
| IV-580 | $OCH_3$ | $OCH_3$ | H | H |
| IV-581 | $OCH_3$ | H | $OCH_3$ | H |
| IV-582 | $OCH_3$ | H | H | $OCH_3$ |
| IV-583 | $OCH_3$ | $CH_3$ | H | H |

$R_{31} = OCH_3$
$R_{32} = CN$
$R_{37} = H$

| No. | $R_{33}$ | $R_{34}$ | $R_{35}$ | $R_{36}$ |
|---|---|---|---|---|
| IV-584 | Cl | H | H | Cl |
| IV-585 | H | Cl | Cl | H |
| IV-586 | H | Cl | H | Cl |
| IV-587 | $CH_3$ | $CH_3$ | H | H |
| IV-588 | $CH_3$ | H | $CH_3$ | H |
| IV-589 | $CH_3$ | H | H | $CH_3$ |

$R_{31} = OCH_3$
$R_{32} = NO_2$
$R_{37} = H$

| No. | $R_{33}$ | $R_{34}$ | $R_{35}$ | $R_{36}$ |
|---|---|---|---|---|
| IV-590 | $CH_3$ | Cl | H | H |
| IV-591 | $CH_3$ | H | Cl | H |
| IV-592 | $CH_3$ | H | H | Cl |
| IV-593 | H | $CH_3$ | $CH_3$ | H |
| IV-594 | H | $CH_3$ | H | $CH_3$ |
| IV-595 | $OCH_3$ | Cl | H | H |
| IV-596 | $OCH_3$ | H | Cl | H |

$R_{31} = OCH_3$
$R_{32} = CF_3$
$R_{37} = H$

| No. | $R_{33}$ | $R_{34}$ | $R_{35}$ | $R_{36}$ |
|---|---|---|---|---|
| IV-597 | $OCH_3$ | H | H | Cl |
| IV-598 | $OCH_3$ | $OCH_3$ | H | H |
| IV-599 | $OCH_3$ | H | $OCH_3$ | H |
| IV-600 | $OCH_3$ | H | H | $OCH_3$ |
| IV-601 | $OCH_3$ | $CH_3$ | H | H |

$R_{31} = OCH_3$
$R_{32} = CF_3$
$R_{36} = H$

| No. | $R_{33}$ | $R_{34}$ | $R_{35}$ | $R_{37}$ |
|---|---|---|---|---|
| IV-602 | $CH_3$ | H | H | $CH_3$ |
| IV-603 | $OCH_3$ | H | H | $OCH_3$ |
| IV-604 | Cl | H | H | Cl |

-continued $R_{31} = OCH_3$
$R_{32} = CF_3$
$R_{36} = H$

| No. | $R_{33}$ | $R_{34}$ | $R_{35}$ | $R_{37}$ |
|---|---|---|---|---|
| IV-605 | Br | H | H | Br |

$R_{31}, R_{32} = Cl$
$R_{37} = H$

| No. | $R_{33}$ | $R_{34}$ | $R_{35}$ | $R_{36}$ |
|---|---|---|---|---|
| IV-606 | H | H | H | H |
| IV-607 | $CH_3$ | H | H | H |
| IV-608 | H | $CH_3$ | H | H |
| IV-609 | H | H | $CH_3$ | H |
| IV-610 | Cl | H | H | H |
| IV-611 | H | Cl | H | H |
| IV-612 | H | H | Cl | H |
| IV-613 | Br | H | H | H |
| IV-614 | H | Br | H | H |
| IV-615 | H | H | Br | H |
| IV-616 | I | H | H | H |
| IV-617 | H | I | H | H |
| IV-618 | H | H | I | H |
| IV-619 | F | H | H | H |
| IV-620 | H | F | H | H |
| IV-621 | H | H | F | H |
| IV-622 | $OCH_3$ | H | H | H |
| IV-623 | H | $OCH_3$ | H | H |
| IV-624 | H | H | $OCH_3$ | H |
| IV-625 | $NO_2$ | H | H | H |
| IV-626 | H | $NO_2$ | H | H |
| IV-627 | H | H | $NO_2$ | H |
| IV-628 | CN | H | H | H |
| IV-629 | H | CN | H | H |
| IV-630 | H | H | CN | H |
| IV-631 | $CF_3$ | H | H | H |
| IV-632 | H | $CF_3$ | H | H |
| IV-633 | H | H | $CF_3$ | H |
| IV-634 | Cl | $NO_2$ | H | H |
| IV-635 | Cl | H | $NO_2$ | H |
| IV-636 | Cl | H | H | $NO_2$ |
| IV-637 | Cl | $CH_3$ | H | H |
| IV-638 | Cl | H | $CH_3$ | H |
| IV-639 | Cl | H | H | $CH_3$ |
| IV-640 | Cl | Cl | H | H |
| IV-641 | Cl | H | Cl | H |

$R_{31} = Cl$
$R_{32} = CH_3$
$R_{37} = H$

| No. | $R_{33}$ | $R_{34}$ | $R_{35}$ | $R_{36}$ |
|---|---|---|---|---|
| IV-642 | H | H | $OCH_3$ | H |
| IV-643 | $NO_2$ | H | H | H |
| IV-644 | H | $NO_2$ | H | H |
| IV-645 | H | H | $NO_2$ | H |
| IV-646 | CN | H | H | H |
| IV-647 | H | CN | H | H |
| IV-648 | H | H | CN | H |
| IV-649 | $CF_3$ | H | H | H |
| IV-650 | H | $CF_3$ | H | H |
| IV-651 | H | H | $CF_3$ | H |
| IV-652 | Cl | $NO_2$ | H | H |
| IV-653 | Cl | H | $NO_2$ | H |
| IV-654 | Cl | H | H | $NO_2$ |
| IV-655 | Cl | $CH_3$ | H | H |
| IV-656 | Cl | H | $CH_3$ | H |
| IV-657 | Cl | H | H | $CH_3$ |
| IV-658 | Cl | Cl | H | H |
| IV-659 | Cl | H | Cl | H |

$R_{31}$ = Cl
$R_{32}$ = $OCH_3$
$R_{37}$ = H

| No. | $R_{33}$ | $R_{34}$ | $R_{35}$ | $R_{36}$ |
|---|---|---|---|---|
| IV-660 | Cl | H | H | Cl |
| IV-661 | H | Cl | Cl | H |
| IV-662 | H | Cl | H | Cl |
| IV-663 | $CH_3$ | $CH_3$ | H | H |
| IV-664 | $CH_3$ | H | $CH_3$ | H |
| IV-665 | $CH_3$ | H | H | $CH_3$ |
| IV-666 | $CH_3$ | Cl | H | H |
| IV-667 | $CH_3$ | H | Cl | H |
| IV-668 | $CH_3$ | H | H | Cl |
| IV-669 | H | $CH_3$ | $CH_3$ | H |
| IV-670 | H | $CH_3$ | H | $CH_3$ |
| IV-671 | $OCH_3$ | Cl | H | H |
| IV-672 | $OCH_3$ | H | Cl | H |
| IV-673 | $OCH_3$ | H | H | Cl |
| IV-674 | $OCH_3$ | $OCH_3$ | H | H |
| IV-675 | $OCH_3$ | H | $OCH_3$ | H |
| IV-676 | $OCH_3$ | H | H | $OCH_3$ |
| IV-677 | $OCH_3$ | $CH_3$ | H | H |

$R_{31}$ = Cl
$R_{32}$ = Br
$R_{37}$ = H

| No. | $R_{33}$ | $R_{34}$ | $R_{35}$ | $R_{36}$ |
|---|---|---|---|---|
| IV-678 | $OCH_3$ | H | $CH_3$ | H |
| IV-679 | $OCH_3$ | H | H | $CH_3$ |
| IV-680 | H | $OCH_3$ | $OCH_3$ | H |
| IV-681 | H | $OCH_3$ | H | $OCH_3$ |
| IV-682 | I | I | H | H |
| IV-683 | I | H | I | H |
| IV-684 | I | H | H | I |

$R_{31}$ = Cl
$R_{32}$ = F
$R_{37}$ = H

| No. | $R_{33}$ | $R_{34}$ | $R_{35}$ | $R_{36}$ |
|---|---|---|---|---|
| IV-685 | H | I | I | H |
| IV-686 | H | I | H | I |
| IV-687 | $CH_3$ | $CH_3$ | H | $CH_3$ |
| IV-688 | $OCH_3$ | $OCH_3$ | H | $OCH_3$ |
| IV-689 | Cl | Cl | H | Cl |
| IV-690 | Br | Br | H | Br |

$R_{31}$ = Cl
$R_{32}$ = I
$R_{37}$ = H

| No. | $R_{33}$ | $R_{34}$ | $R_{35}$ | $R_{36}$ |
|---|---|---|---|---|
| IV-691 | H | H | H | H |
| IV-692 | $CH_3$ | H | H | H |
| IV-693 | H | $CH_3$ | H | H |
| IV-694 | H | H | $CH_3$ | H |
| IV-695 | Cl | H | H | H |
| IV-696 | H | Cl | H | H |

$R_{31}$ = Cl
$R_{32}$ = CN
$R_{37}$ = H

| No. | $R_{33}$ | $R_{34}$ | $R_{35}$ | $R_{36}$ |
|---|---|---|---|---|
| IV-697 | H | H | Cl | H |
| IV-698 | Br | H | H | H |
| IV-699 | H | Br | H | H |
| IV-700 | H | H | Br | H |

-continued $R_{31}$ = Cl
$R_{32}$ = CN
$R_{37}$ = H

| No. | $R_{33}$ | $R_{34}$ | $R_{35}$ | $R_{36}$ |
|---|---|---|---|---|
| IV-701 | I | H | H | H |

$R_{31}$ = Cl
$R_{32}$ = $CF_3$
$R_{37}$ = H

| No. | $R_{33}$ | $R_{34}$ | $R_{35}$ | $R_{36}$ |
|---|---|---|---|---|
| IV-702 | F | F | H | H |
| IV-703 | F | H | F | H |
| IV-704 | F | H | H | F |
| IV-705 | H | F | F | H |
| IV-706 | H | F | H | F |

$R_{31}$ = Cl
$R_{32}$ = $NO_2$
$R_{36}$ = H

| No. | $R_{33}$ | $R_{34}$ | $R_{35}$ | $R_{37}$ |
|---|---|---|---|---|
| IV-707 | $CH_3$ | H | H | $CH_3$ |
| IV-708 | $OCH_3$ | H | H | $OCH_3$ |
| IV-709 | Cl | H | H | Cl |
| IV-710 | Br | H | H | Br |

$R_{31}$, $R_{32}$ = Br
$R_{37}$ = H

| No. | $R_{33}$ | $R_{34}$ | $R_{35}$ | $R_{36}$ |
|---|---|---|---|---|
| IV-711 | H | H | H | H |
| IV-712 | $CH_3$ | H | H | H |
| IV-713 | H | $CH_3$ | H | H |
| IV-714 | H | H | $CH_3$ | H |
| IV-715 | Cl | H | H | H |
| IV-716 | H | Cl | H | H |
| IV-717 | H | H | Cl | H |
| IV-718 | Br | H | H | H |
| IV-719 | H | Br | H | H |
| IV-720 | H | H | Br | H |

$R_{31}$ = Br
$R_{32}$ = $CH_3$
$R_{37}$ = H

| No. | $R_{33}$ | $R_{34}$ | $R_{35}$ | $R_{36}$ |
|---|---|---|---|---|
| IV-721 | I | H | H | H |
| IV-722 | H | I | H | H |
| IV-723 | H | H | I | H |
| IV-724 | F | H | H | H |
| IV-725 | H | F | H | H |

$R_{31}$ = Br $R_{37}$ = H
$R_{32}$ = $OCH_3$

| No. | $R_{33}$ | $R_{34}$ | $R_{35}$ | $R_{36}$ |
|---|---|---|---|---|
| IV-726 | H | H | F | H |
| IV-727 | $OCH_3$ | H | H | H |
| IV-728 | H | $OCH_3$ | H | H |

$R_{31}$ = Br $R_{37}$ = H
$R_{32}$ = Cl

| No. | $R_{33}$ | $R_{34}$ | $R_{35}$ | $R_{36}$ |
|---|---|---|---|---|
| IV-729 | H | H | $OCH_3$ | H |
| IV-730 | $NO_2$ | H | H | H |
| IV-731 | H | $NO_2$ | H | H |
| IV-732 | H | H | $NO_2$ | H |
| IV-733 | CN | H | H | H |

$R_{31}$ = Br $R_{37}$ = H
$R_{32}$ = F

| No. | $R_{33}$ | $R_{34}$ | $R_{35}$ | $R_{36}$ |
|---|---|---|---|---|
| IV-734 | H | CN | H | H |
| IV-735 | H | H | CN | H |
| IV-736 | $CF_3$ | H | H | H |
| IV-737 | H | $CF_3$ | H | H |

$R_{31}$ = Br $R_{37}$ = H
$R_{32}$ = I

| No. | $R_{33}$ | $R_{34}$ | $R_{35}$ | $R_{36}$ |
|---|---|---|---|---|
| IV-738 | Cl | H | H | Cl |
| IV-739 | H | Cl | Cl | H |
| IV-740 | H | Cl | H | Cl |
| IV-741 | $CH_3$ | $CH_3$ | H | H |
| IV-742 | $CH_3$ | H | $CH_3$ | H |

$R_{31}$ = Br $R_{37}$ = H
$R_{32}$ = CN

| No. | $R_{33}$ | $R_{34}$ | $R_{35}$ | $R_{36}$ |
|---|---|---|---|---|
| IV-42 | $CH_3$ | H | H | $CH_3$ |
| IV-743 | $CH_3$ | Cl | H | H |
| IV-745 | $CH_3$ | H | Cl | H |
| IV-746 | $CH_3$ | H | H | Cl |

$R_{31}$ = Br $R_{37}$ = H
$R_{32}$ = $NO_2$

| No. | $R_{33}$ | $R_{34}$ | $R_{35}$ | $R_{36}$ |
|---|---|---|---|---|
| IV-747 | H | $CH_3$ | $CH_3$ | H |
| IV-748 | H | $CH_3$ | H | $CH_3$ |
| IV-749 | $OCH_3$ | Cl | H | H |
| IV-750 | $OCH_3$ | H | Cl | H |

$R_{31}$ = Br
$R_{32}$ = $CF_3$
$R_{37}$ = H

| No. | $R_{33}$ | $R_{34}$ | $R_{35}$ | $R_{36}$ |
|---|---|---|---|---|
| IV-751 | $OCH_3$ | H | H | Cl |
| IV-752 | $OCH_3$ | $OCH_3$ | H | H |
| IV-753 | $OCH_3$ | H | $OCH_3$ | H |
| IV-754 | $OCH_3$ | H | H | $OCH_3$ |
| IV-755 | $OCH_3$ | $CH_3$ | H | H |

$R_{31}$, $R_{32}$ = F
$R_{37}$ = H

| No. | $R_{33}$ | $R_{34}$ | $R_{35}$ | $R_{36}$ |
|---|---|---|---|---|
| IV-756 | $OCH_3$ | H | $CH_3$ | H |
| IV-757 | $OCH_3$ | H | H | $CH_3$ |
| IV-758 | H | $OCH_3$ | $OCH_3$ | H |

-continued

| | | | | |
|---|---|---|---|---|
| IV-759 | H | $OCH_3$ | H | $OCH_3$ |
| IV-760 | I | I | H | H |
| IV-761 | I | H | I | H |
| IV-762 | I | H | H | I |
| IV-763 | H | I | I | H |
| IV-764 | H | I | H | I |
| IV-765 | $CH_3$ | $CH_3$ | H | $CH_3$ |
| IV-766 | $OCH_3$ | $OCH_3$ | H | $OCH_3$ |
| IV-767 | Cl | Cl | H | Cl |

$R_{31}$ = F
$R_{32}$ = $CH_3$
$R_{37}$ = H

| No. | $R_{33}$ | $R_{34}$ | $R_{35}$ | $R_{36}$ |
|---|---|---|---|---|
| IV-768 | Br | Br | H | Br |
| IV-769 | F | F | H | H |
| IV-770 | F | H | F | H |
| IV-771 | F | H | H | F |
| IV-772 | H | F | F | H |
| IV-773 | H | F | H | F |

$R_{31}$ = F
$R_{32}$ = $OCH_3$
$R_{36}$ = H

| No. | $R_{33}$ | $R_{34}$ | $R_{35}$ | $R_{37}$ |
|---|---|---|---|---|
| IV-774 | $CH_3$ | H | H | $CH_3$ |
| IV-775 | $OCH_3$ | H | H | $OCH_3$ |
| IV-776 | Cl | H | H | Cl |
| IV-777 | Br | H | H | Br |

$R_{31}$ = F
$R_{32}$ = Cl
$R_{37}$ = H

| No. | $R_{33}$ | $R_{34}$ | $R_{35}$ | $R_{36}$ |
|---|---|---|---|---|
| IV-778 | H | H | H | H |
| IV-779 | $CH_3$ | H | H | H |
| IV-780 | H | $CH_3$ | H | H |
| IV-781 | H | H | $CH_3$ | H |
| IV-782 | Cl | H | H | H |

$R_{31}$ = F
$R_{32}$ = Br
$R_{37}$ = H

| No. | $R_{33}$ | $R_{34}$ | $R_{35}$ | $R_{36}$ |
|---|---|---|---|---|
| IV-783 | H | Cl | H | H |
| IV-784 | H | H | Cl | H |
| IV-785 | Br | H | H | H |
| IV-786 | H | Br | H | H |

$R_{31}$ = F
$R_{32}$ = I
$R_{37}$ = H

| No. | $R_{33}$ | $R_{34}$ | $R_{35}$ | $R_{36}$ |
|---|---|---|---|---|
| IV-787 | H | H | Br | H |
| IV-788 | I | H | H | H |
| IV-789 | H | I | H | H |
| IV-790 | H | H | I | H |

$R_{31}$ = F

-continued $R_{32}$ = CN
$R_{37}$ = H

| No. | $R_{33}$ | $R_{34}$ | $R_{35}$ | $R_{36}$ |
|---|---|---|---|---|
| IV-791 | F | H | H | H |
| IV-792 | H | F | H | H |
| IV-793 | H | H | F | H |
| IV-794 | $OCH_3$ | H | H | H |
| IV-795 | H | $OCH_3$ | H | H |

$R_{31}$ = F
$R_{32}$ = $NO_2$
$R_{37}$ = H

| No. | $R_{33}$ | $R_{34}$ | $R_{35}$ | $R_{36}$ |
|---|---|---|---|---|
| IV-796 | H | H | $OCH_3$ | H |
| IV-797 | $NO_2$ | H | H | H |
| IV-798 | H | $NO_2$ | H | H |
| IV-799 | H | H | $NO_2$ | H |

$R_{31}$ = F
$R_{32}$ = $CF_3$
$R_{37}$ = H

| No. | $R_{33}$ | $R_{34}$ | $R_{35}$ | $R_{36}$ |
|---|---|---|---|---|
| IV-800 | CN | H | H | H |
| IV-801 | H | CN | H | H |
| IV-802 | H | H | CN | H |
| IV-803 | $CF_3$ | H | H | H |

$R_{31}$, $R_{32}$ = I
$R_{37}$ = H

| No. | $R_{33}$ | $R_{34}$ | $R_{35}$ | $R_{36}$ |
|---|---|---|---|---|
| IV-804 | H | $CF_3$ | H | H |
| IV-805 | H | H | $CF_3$ | H |
| IV-806 | Cl | $NO_2$ | H | H |
| IV-807 | Cl | H | $NO_2$ | H |
| IV-808 | Cl | H | H | $NO_2$ |

$R_{31}$ = I
$R_{32}$ = $CH_3$
$R_{37}$ = H

| No. | $R_{33}$ | $R_{34}$ | $R_{35}$ | $R_{36}$ |
|---|---|---|---|---|
| IV-809 | Cl | $CH_3$ | H | H |
| IV-810 | Cl | H | $CH_3$ | H |
| IV-811 | Cl | H | H | $CH_3$ |
| IV-812 | Cl | Cl | H | H |
| IV-813 | Cl | H | Cl | H |

$R_{31}$ = I
$R_{32}$ = $OCH_3$
$R_{37}$ = H

| No. | $R_{33}$ | $R_{34}$ | $R_{35}$ | $R_{36}$ |
|---|---|---|---|---|
| IV-814 | Cl | H | H | Cl |
| IV-815 | H | Cl | Cl | H |
| IV-816 | H | Cl | H | Cl |
| IV-817 | $CH_3$ | $CH_3$ | H | H |

$R_{31}$ = I
$R_{32}$ = Cl
$R_{37}$ = H

-continued

| No. | $R_{33}$ | $R_{34}$ | $R_{35}$ | $R_{36}$ |
|---|---|---|---|---|
| IV-818 | $CH_3$ | H | $CH_3$ | H |
| IV-819 | $CH_3$ | H | H | $CH_3$ |
| IV-820 | $CH_3$ | Cl | H | H |
| VI-821 | $CH_3$ | H | Cl | H |

$R_{31}$ = I
$R_{32}$ = Br
$R_{37}$ = H

| No. | $R_{33}$ | $R_{34}$ | $R_{35}$ | $R_{36}$ |
|---|---|---|---|---|
| IV-822 | $CH_3$ | H | H | Cl |
| IV-823 | H | $CH_3$ | $CH_3$ | H |
| IV-824 | H | $CH_3$ | H | $CH_3$ |
| IV-825 | $OCH_3$ | Cl | H | H |

$R_{31}$ = I
$R_{32}$ = F
$R_{37}$ = H

| No. | $R_{33}$ | $R_{34}$ | $R_{35}$ | $R_{36}$ |
|---|---|---|---|---|
| IV-826 | $OCH_3$ | H | Cl | H |
| IV-827 | $OCH_3$ | H | H | Cl |
| IV-828 | $OCH_3$ | $OCH_3$ | H | H |

$R_{31}$ = I
$R_{32}$ = $NO_2$
$R_{37}$ = H

| No. | $R_{33}$ | $R_{34}$ | $R_{35}$ | $R_{36}$ |
|---|---|---|---|---|
| IV-829 | $OCH_3$ | H | $OCH_3$ | H |
| IV-830 | $OCH_3$ | H | H | $OCH_3$ |
| IV-831 | $OCH_3$ | $CH_3$ | H | H |

$R_{31}$ = I
$R_{32}$ = CN
$R_{37}$ = H

| No. | $R_{33}$ | $R_{34}$ | $R_{35}$ | $R_{36}$ |
|---|---|---|---|---|
| IV-832 | $OCH_3$ | H | $CH_3$ | H |
| IV-834 | $OCH_3$ | H | H | $CH_3$ |
| IV-835 | H | $OCH_3$ | $OCH_3$ | H |

$R_{31}$, $R_{32}$ = CN
$R_{37}$ = H

| No. | $R_{33}$ | $R_{34}$ | $R_{35}$ | $R_{36}$ |
|---|---|---|---|---|
| IV-836 | I | H | H | I |
| IV-837 | H | I | I | H |
| IV-838 | H | I | H | I |
| IV-839 | $CH_3$ | $CH_3$ | H | $CH_3$ |
| IV-840 | $OCH_3$ | $OCH_3$ | H | $OCH_3$ |
| IV-841 | Cl | Cl | H | Cl |

$R_{31}$ = CN
$R_{32}$ = $CH_3$
$R_{37}$ = H

| No. | $R_{33}$ | $R_{34}$ | $R_{35}$ | $R_{36}$ |
|---|---|---|---|---|
| IV-842 | Br | Br | H | Br |
| IV-843 | F | F | H | H |
| IV-844 | F | H | F | H |
| IV-845 | F | H | H | F |
| IV-846 | H | F | F | H |

-continued

| | | | | |
|---|---|---|---|---|
| IV-847 | H | F | H | F |

$R_{31}$ = CN $R_{37}$ = H
$R_{32}$ = $OCH_3$

| No. | $R_{33}$ | $R_{34}$ | $R_{35}$ | $R_{36}$ |
|---|---|---|---|---|
| IV-848 | H | I | H | H |
| IV-849 | H | H | I | H |
| IV-850 | F | H | H | H |

$R_{31}$ = CN $R_{37}$ = H
$R_{32}$ = Br

| No. | $R_{33}$ | $R_{34}$ | $R_{35}$ | $R_{36}$ |
|---|---|---|---|---|
| IV-851 | H | F | H | H |
| IV-852 | H | H | F | H |
| IV-853 | $OCH_3$ | H | H | H |
| IV-854 | H | $OCH_3$ | H | H |

$R^{31}$, $R^{32}$ = $NO_2$
$R_{37}$ = H

| No. | $R_{33}$ | $R_{34}$ | $R_{35}$ | $R_{36}$ |
|---|---|---|---|---|
| IV-855 | H | H | $OCH_3$ | H |
| IV-856 | $NO_2$ | H | H | H |
| IV-857 | H | $NO_2$ | H | H |
| IV858 | H | H | $NO_2$ | H |

$R_{31}$ = $NO_2$ $R_{37}$ = H
$R_{32}$ = $CH_3$

| No. | $R_{33}$ | $R_{34}$ | $R_{35}$ | $R_{36}$ |
|---|---|---|---|---|
| IV-859 | CN | H | H | H |
| IV-860 | H | CN | H | H |
| IV-861 | H | H | CN | H |
| IV-862 | $CF_3$ | H | H | H |

$R_{31}$ = $NO_2$ $R_{37}$ = H
$R_{32}$ = $OCH_3$

| No. | $R_{33}$ | $R_{34}$ | $R_{35}$ | $R_{36}$ |
|---|---|---|---|---|
| IV-863 | H | $CF_3$ | H | H |
| IV-864 | H | H | $CF_3$ | H |
| IV-865 | Cl | $NO_2$ | H | H |

$R_{31}$ = $NO_2$ $R_{37}$ = H
$R_{32}$ = Cl

| No. | $R_{33}$ | $R_{34}$ | $R_{35}$ | $R_{36}$ |
|---|---|---|---|---|
| IV-866 | Cl | H | $NO_2$ | H |
| IV-867 | Cl | H | H | $NO_2$ |
| IV-868 | Cl | $CH_3$ | H | H |

$R_{31}$ = $NO_2$
$R_{32}$ = CN
$R_{37}$ = H

| No. | $R_{33}$ | $R_{34}$ | $R_{35}$ | $R_{36}$ |
|---|---|---|---|---|
| IV-869 | Cl | H | $CH_3$ | H |
| IV-870 | Cl | H | H | $CH_3$ |
| IV-871 | Cl | Cl | H | H |

-continued $R_{31}$ = $NO_2$
$R_{32}$ = CN
$R_{37}$ = H

| No. | $R_{33}$ | $R_{34}$ | $R_{35}$ | $R_{36}$ |
|---|---|---|---|---|
| IV-872 | Cl | H | Cl | H |

$R_{31}$, $R_{32}$ = $CF_3$
$R_{37}$ = H

| No. | $R_{33}$ | $R_{34}$ | $R_{35}$ | $R_{36}$ |
|---|---|---|---|---|
| IV-873 | Cl | H | H | Cl |
| IV-874 | H | Cl | Cl | H |
| IV-875 | H | Cl | H | Cl |
| IV-876 | $CH_3$ | $CH_3$ | H | H |

$R_{31}$ = $CF_3$
$R_{32}$ = $CH_3$
$R_{37}$ = H

| No. | $R_{33}$ | $R_{34}$ | $R_{35}$ | $R_{36}$ |
|---|---|---|---|---|
| IV-877 | $CH_3$ | H | $CH_3$ | H |
| IV-878 | $CH_3$ | H | H | $CH_3$ |
| IV-879 | $CH_3$ | Cl | H | H |
| IV-880 | $CH_3$ | H | Cl | H |

$R_{31}$ = $CF_3$
$R_{32}$ = Br
$R_{37}$ = H

| No. | $R_{33}$ | $R_{34}$ | $R_{35}$ | $R_{36}$ |
|---|---|---|---|---|
| IV-881 | $CH_3$ | H | H | Cl |
| IV-882 | H | $CH_3$ | $CH_3$ | H |
| IV-883 | H | $CH_3$ | H | $CH_3$ |
| IV-884 | $OCH_3$ | Cl | H | H |

$R_{31}$ = $CF_3$ $R_{37}$ = H
$R_{32}$ = $NO_2$

| No. | $R_{33}$ | $R_{34}$ | $R_{35}$ | $R_{36}$ |
|---|---|---|---|---|
| IV-885 | $OCH_3$ | H | Cl | H |
| IV-886 | $OCH_3$ | H | H | Cl |
| IV-887 | $OCH_3$ | $OCH_3$ | H | H |
| IV-888 | $OCH_3$ | H | $OCH_3$ | H |

$R_{31}$ = $CF_3$ $R_{37}$ = H
$R_{32}$ = CN

| No. | $R_{33}$ | $R_{34}$ | $R_{35}$ | $R_{36}$ |
|---|---|---|---|---|
| IV-889 | $OCH_3$ | H | H | $OCH_3$ |
| IV-890 | $OCH_3$ | $CH_3$ | H | H |

$R_{31}$, $R_{32}$ = OH
$R_{37}$ = H

| No. | $R_{33}$ | $R_{34}$ | $R_{35}$ | $R_{36}$ |
|---|---|---|---|---|
| IV-891 | $OCH_3$ | H | $CH_3$ | H |
| IV-892 | $OCH_3$ | H | H | $CH_3$ |
| IV-893 | H | $OCH_3$ | $OCH_3$ | H |
| IV-894 | H | $OCH_3$ | H | $OCH_3$ |
| IV-895 | I | I | H | H |

$R_{31}$ = OH $R_{37}$ = H
$R_{32}$ = $CH_3$

| No. | $R_{33}$ | $R_{34}$ | $R_{35}$ | $R_{36}$ |
|---|---|---|---|---|
| IV-896 | I | H | I | H |
| IV-897 | I | H | H | I |
| IV-898 | H | I | I | H |
| IV-899 | H | I | H | I |
| IV-900 | $CH_3$ | $CH_3$ | H | $CH_3$ |

$R_{31}$ = OH $R_{37}$ = H
$R_{32}$ = $OCH_3$

| No. | $R_{33}$ | $R_{34}$ | $R_{35}$ | $R_{36}$ |
|---|---|---|---|---|
| IV-901 | $OCH_3$ | $OCH_3$ | H | $OCH_3$ |
| IV-902 | Cl | Cl | H | Cl |
| IV-903 | Br | Br | H | Br |

$R_{31}$ = OH $R_{37}$ = H
$R_{32}$ = $NO_2$

| No. | $R_{33}$ | $R_{34}$ | $R_{35}$ | $R_{36}$ |
|---|---|---|---|---|
| IV-904 | $CH_3$ | H | H | H |
| IV-905 | H | $CH_3$ | H | H |
| IV-906 | H | H | $CH_3$ | H |
| IV-907 | Cl | H | H | H |

$R_{31}$ = OH $R_{37}$ = H
$R_{32}$ = Br

| No. | $R_{33}$ | $R_{34}$ | $R_{35}$ | $R_{36}$ |
|---|---|---|---|---|
| IV-908 | H | Cl | H | H |
| IV-909 | H | H | Cl | H |
| IV-910 | Br | H | H | H |
| IV-911 | H | Br | H | H |

$R_{31}$ = OH $R_{36}$ = H
$R_{32}$ = CH

| No. | $R_{33}$ | $R_{34}$ | $R_{35}$ | $R_{37}$ |
|---|---|---|---|---|
| IV-912 | $CH_3$ | H | H | $CH_3$ |
| IV-913 | $OCH_3$ | H | H | $OCH_3$ |
| IV-914 | Cl | H | H | Cl |
| IV-915 | Br | H | H | Br |

$R_{31}$ = H $R_{37}$ = H
$R_{32}$ = $CH_3$

| No. | $R_{33}$ | $R_{34}$ | $R_{35}$ | $R_{36}$ |
|---|---|---|---|---|
| IV-916 | H | H | H | H |
| IV-917 | $CH_3$ | H | H | H |
| IV-918 | H | $CH_3$ | H | H |
| IV-919 | H | H | $CH_3$ | H |
| IV-920 | Cl | H | H | H |

$R_{31}$ = H $R_{37}$ = H
$R_{32}$ = $OCH_3$

| No. | $R_{33}$ | $R_{34}$ | $R_{35}$ | $R_{36}$ |
|---|---|---|---|---|
| IV-921 | H | Cl | H | H |
| IV-922 | H | H | Cl | H |
| IV-923 | Br | H | H | H |
| IV-924 | H | Br | H | H |

$R_{31}$ = H $R_{37}$ = H
$R_{32}$ = Cl

| No. | $R_{33}$ | $R_{34}$ | $R_{35}$ | $R_{36}$ |
|---|---|---|---|---|
| IV-925 | H | H | Br | H |
| IV-926 | I | H | H | H |
| IV-927 | H | I | H | H |
| IV-928 | H | H | CN | H |

$R_{31}$ = H $R_{37}$ = H
$R_{32}$ = CN

| No. | $R_{33}$ | $R_{34}$ | $R_{35}$ | $R_{36}$ |
|---|---|---|---|---|
| IV-929 | H | H | F | H |
| IV-930 | $OCH_3$ | H | H | H |
| IV-931 | H | $OCH_3$ | H | H |

$R_{31}$ = H
$R_{32}$ = $CF_3$
$R_{37}$ = H

| No. | $R_{33}$ | $R_{34}$ | $R_{35}$ | $R_{36}$ |
|---|---|---|---|---|
| IV-932 | H | H | $OCH_3$ | H |
| IV-933 | $NO_2$ | H | H | H |
| IV-934 | H | $NO_2$ | H | H |
| IV-935 | H | H | $NO_2$ | H |
| IV-936 | CN | H | H | H |

$R_{31}$ = H
$R_{32}$ = OH
$R_{37}$ = H

| No. | $R_{33}$ | $R_{34}$ | $R_{35}$ | $R_{36}$ |
|---|---|---|---|---|
| IV-937 | H | CN | H | H |
| IV-938 | H | H | CN | H |
| IV-939 | $CF_3$ | H | H | H |
| IV-940 | H | $CF_3$ | H | H |
| IV-941 | H | H | $CF_3$ | H |
| IV-942 | Cl | $NO_2$ | H | H |

The azo compound of the present invention as represented by the above mentioned General formula [IV] can also be expressed specifically by the following General formula [IV-J]:

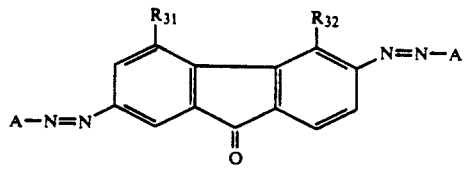

[IV-J]

The compound represented by the above mentioned General formula [IV-J] can be illustrated by the below specified examples:

| No. | A |
|---|---|
| IV-943 | 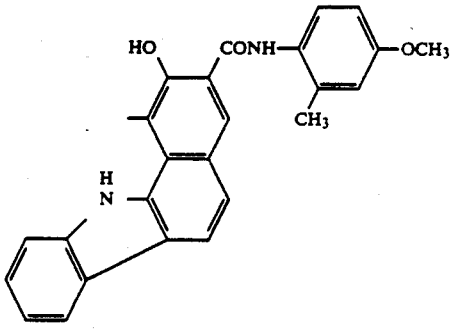 |
| IV-944 | 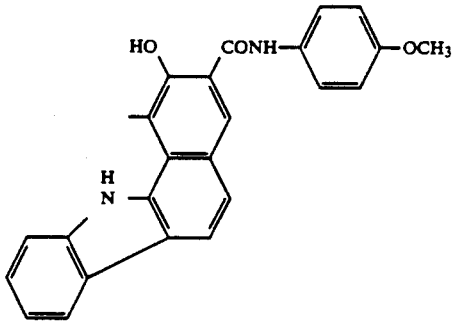 |
| IV-945 | 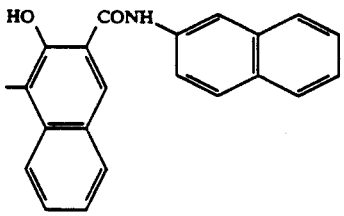 |
| IV-946 | 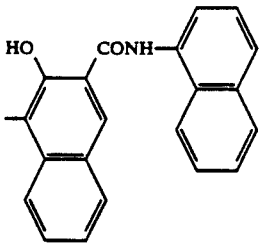 |
| IV-947 | 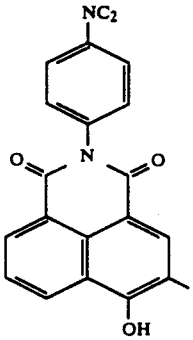 |
-continued
| No. | A |
|---|---|
| IV-948 | 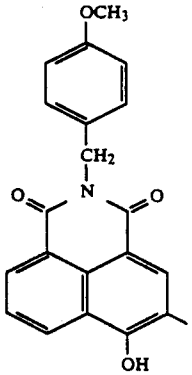 |
| IV-949 | 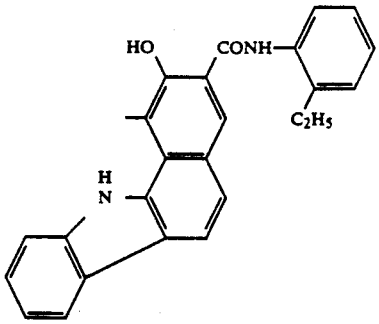 |
| IV-950 | 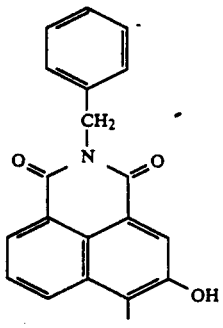 |
| IV-951 | 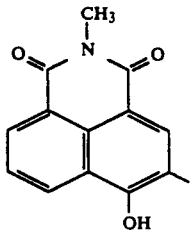 |
| IV-952 | 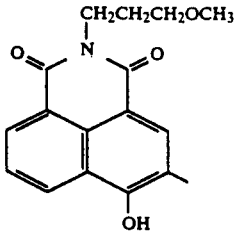 |

-continued
| No. | A |
|---|---|
| IV-953 | 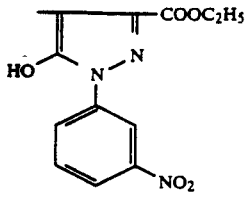 |
| IV-954 | 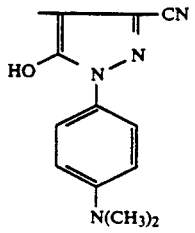 |
| IV-955 | 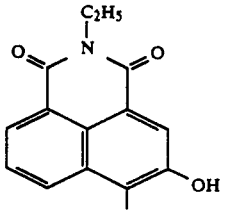 |
| IV-956 | 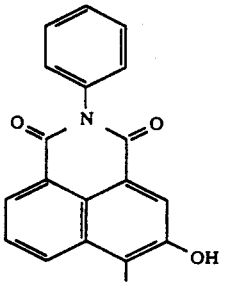 |
| IV-957 | 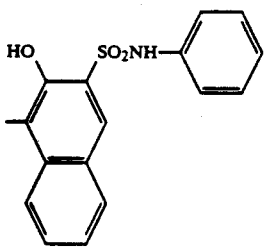 |
| IV-958 | 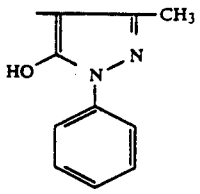 |
-continued
| No. | A |
|---|---|
| IV-959 | 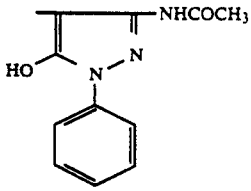 |
| IV-960 | 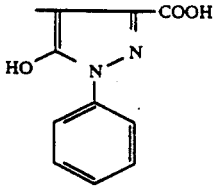 |
| IV-961 | 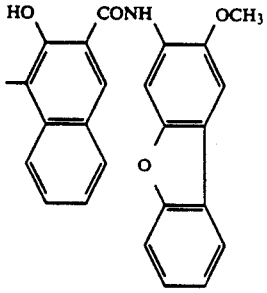 |
| IV-962 | 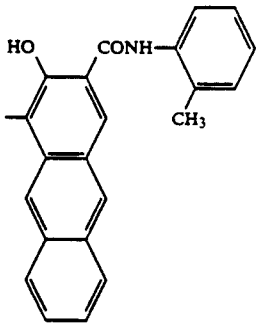 |
| IV-963 | 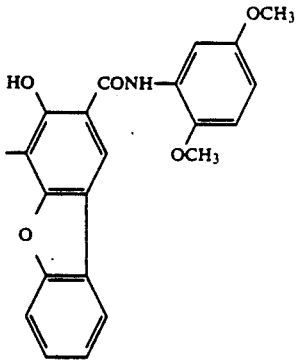 |

-continued
| No. | A |
|---|---|
| IV-964 | 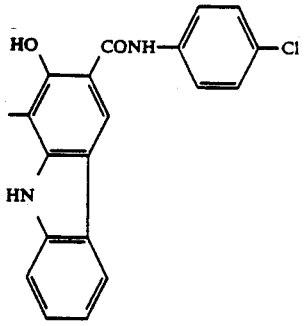 |
| IV-965 | 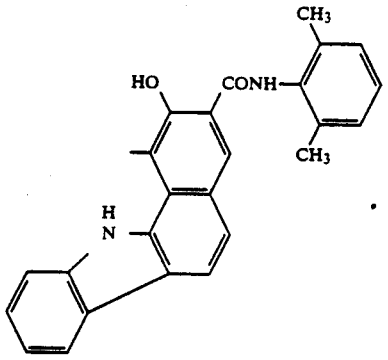 |
| IV-966 | 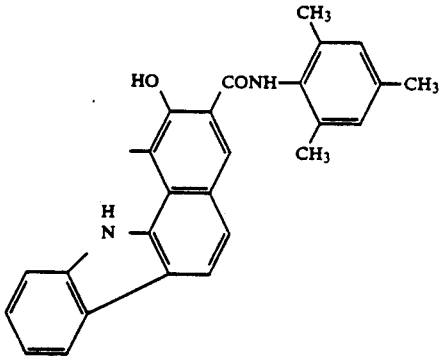 |
| IV-967 | 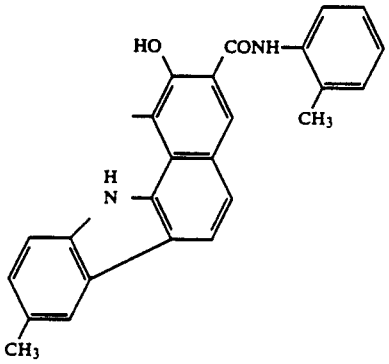 |
-continued
| No. | A |
|---|---|
| IV-968 | 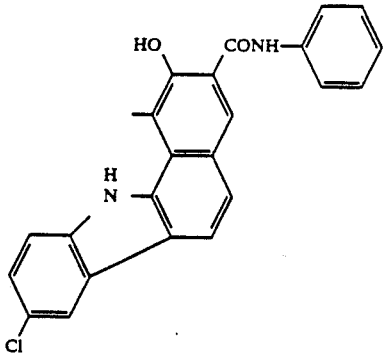 |
| IV-969 | 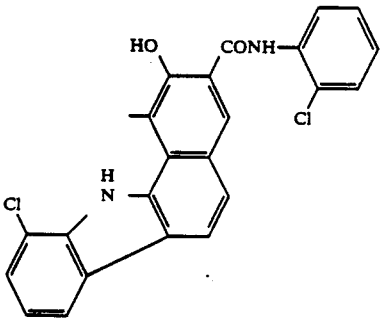 |
| IV-970 | 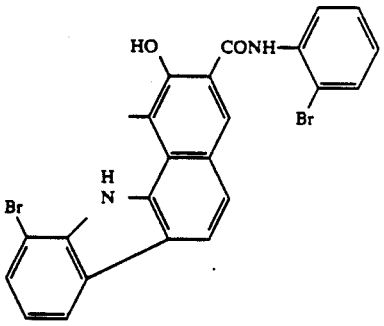 |
| IV-971 | 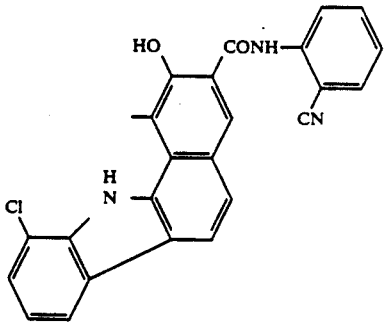 |

-continued
| No. | A |
|---|---|
| IV-972 | 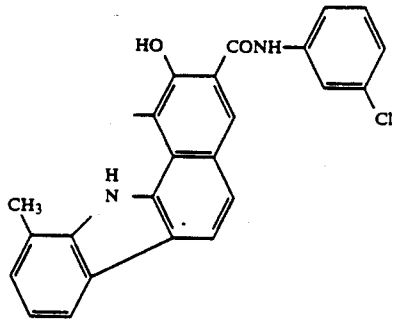 |
| IV-973 | 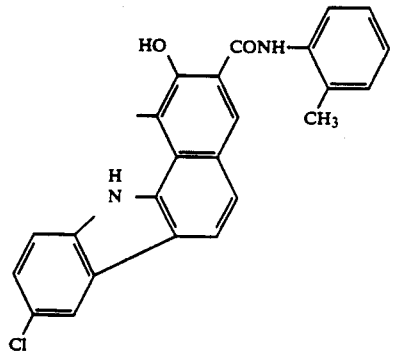 |
| IV-974 | 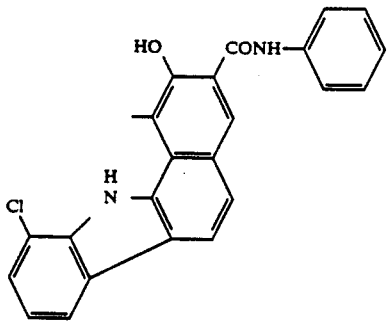 |
| IV-975 | 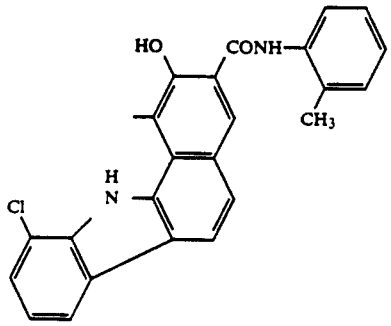 |
-continued
| No. | A |
|---|---|
| IV-976 | 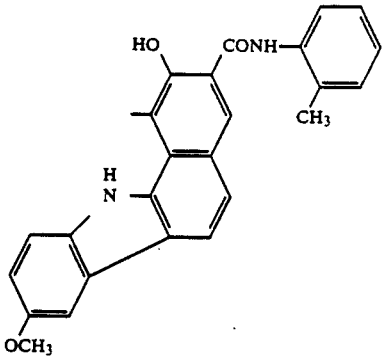 |
| IV-977 | 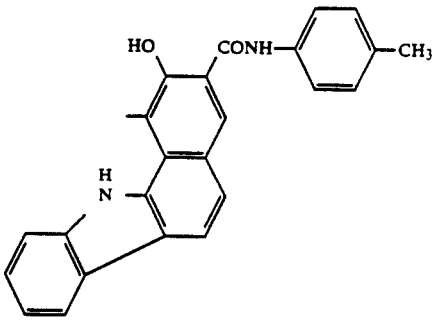 |
| IV-978 | 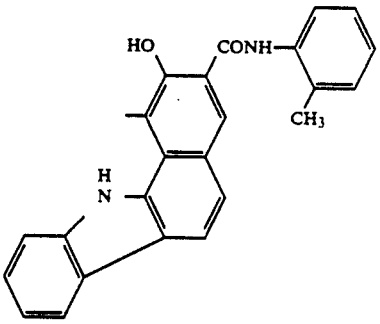 |
| IV-979 | 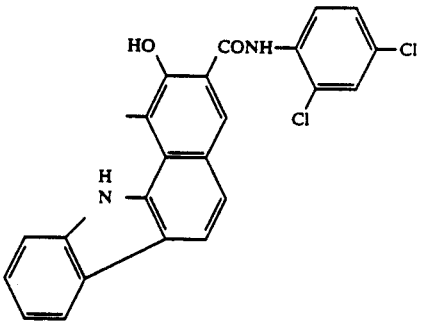 |

-continued

| No. | A |
|---|---|
| IV-980 | 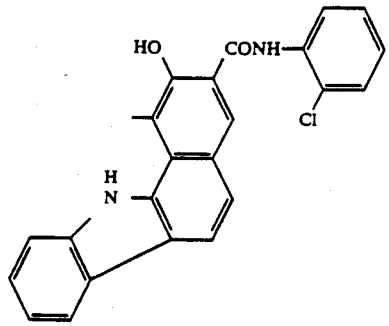 |

$R_{31}$, $R_{32}$ = NONE

Furthermore, the bis-azo compound of the present invention as represented by the above mentioned General formula [IV] can be expressed specifically by the following General formulae [IV-K] to [IV-S]:

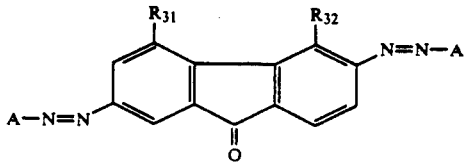
[IV-K]

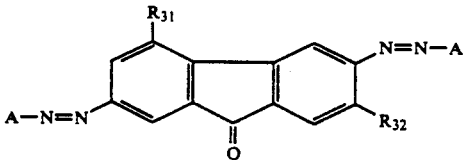
[IV-L]

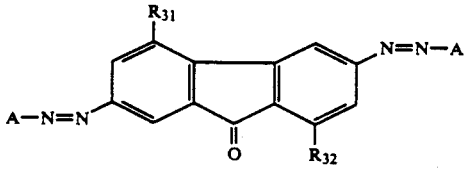
[IV-M]

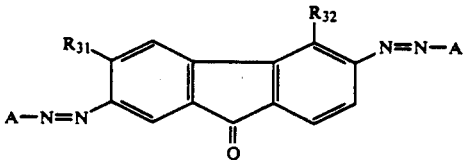
[IV-N]

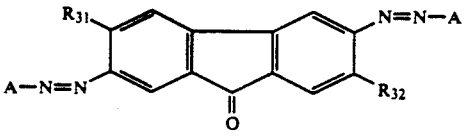
[IV-O]

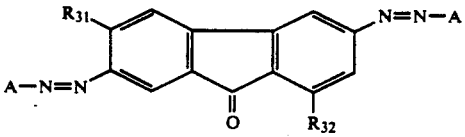
[IV-P]

-continued

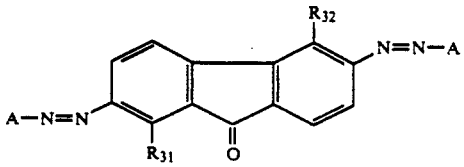
[IV-Q]

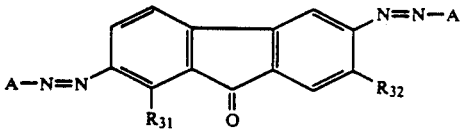
[IV-R]

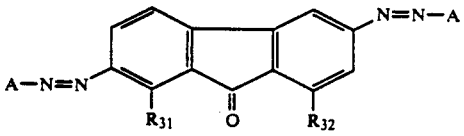
[IV-S]

The examples listed below can be specified to illustrate the compounds represented by the above General formulas [IV-K] to [IV-S]:

| No. | A |
|---|---|
| | $R_{31}$, $R_{32}$ = $CH_3$ |
| IV-981 | 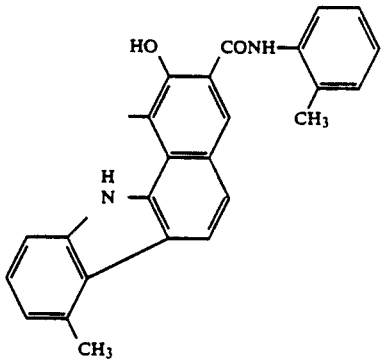 |
| IV-982 | 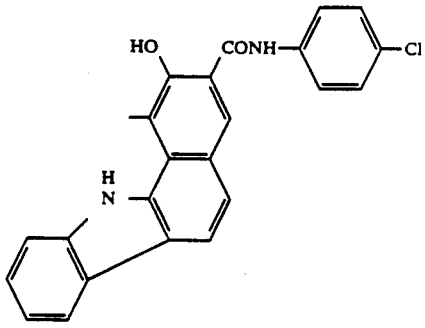 |

-continued
No. A
IV-983
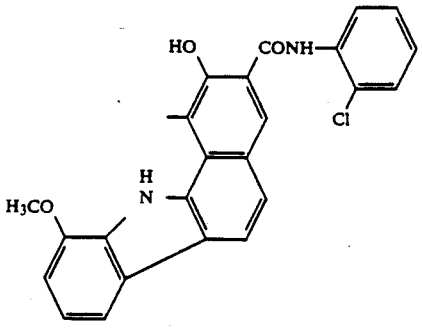
IV-984
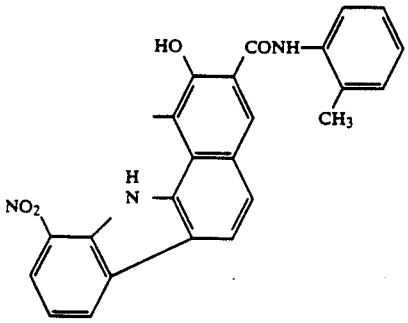
$R_{31} = CH_3$, $R_{32} = OCH_3$
IV-985
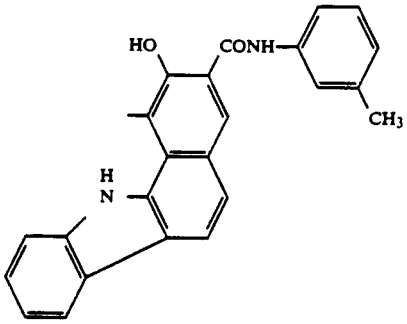
IV-986
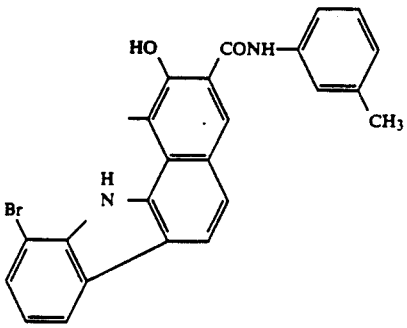
-continued
No. A
IV-987
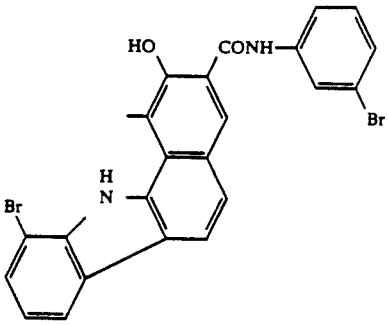
IV-988
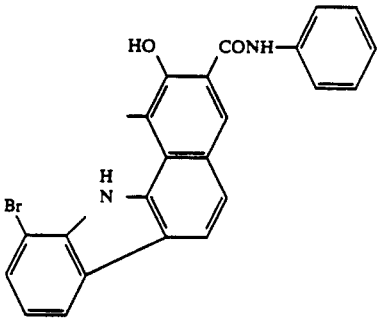
$R_{31} = CH_3$, $R_{32} = Cl$
IV-989
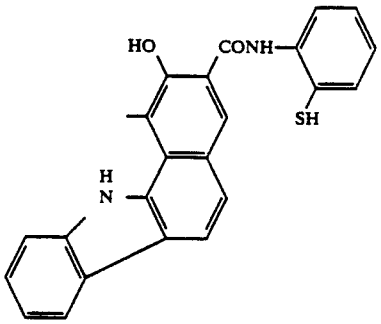
IV-990
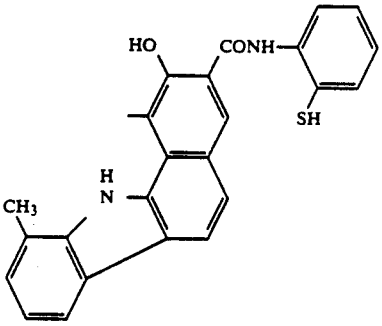

-continued
| No. | A |
|---|---|
| IV-991 | 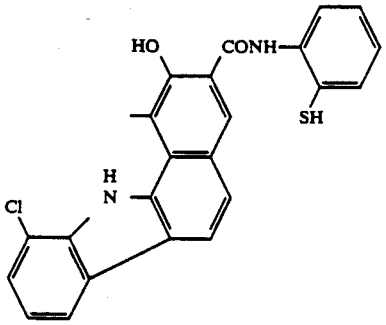 |
| IV-992 | 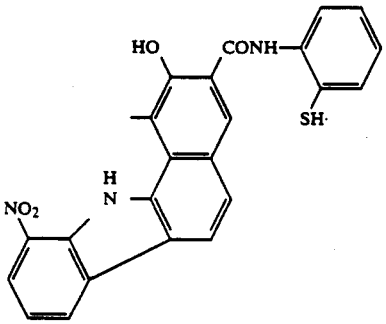 |
| | $R_{31}$ = $CH_3$, $R_{32}$ = NONE |
| IV-993 | 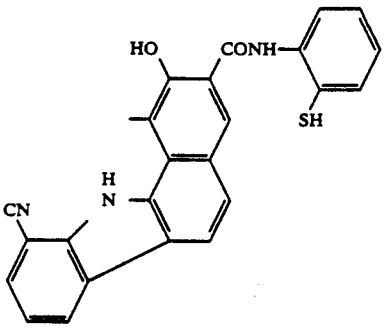 |
| IV-994 | 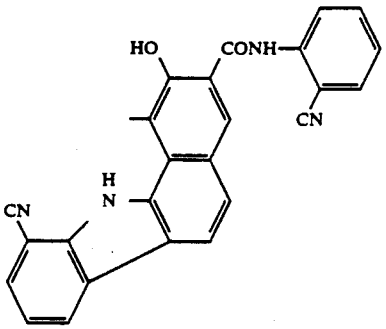 |
-continued
| No. | A |
|---|---|
| IV-995 | 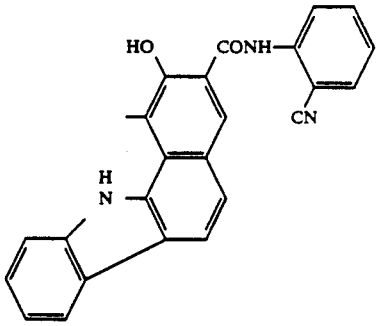 |
| IV-996 | 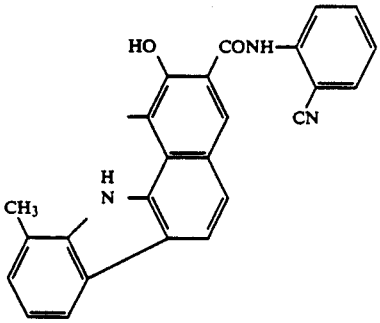 |
| | $R_{31}$ = $OCH_3$, $R_{32}$ = CN |
| IV-997 | 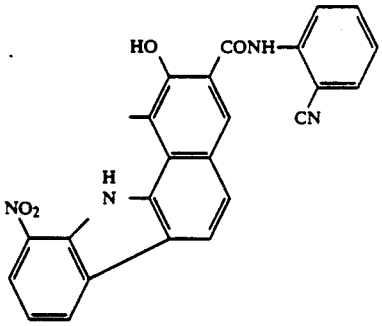 |
| IV-998 | 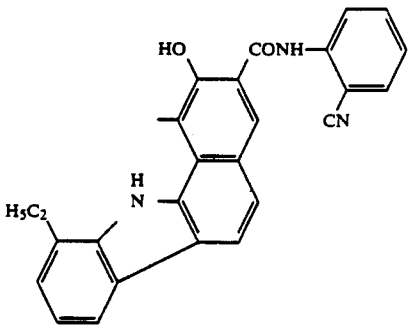 |

-continued
No. A
IV-999
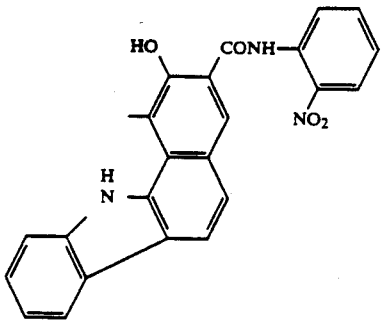
IV-1000
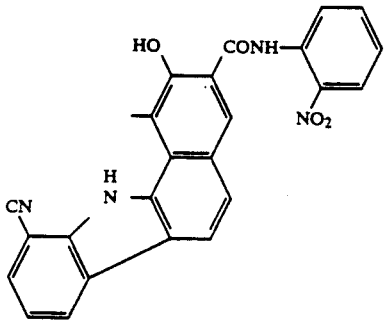
$R_{31} = OCH_3$, $R_{32} = NO_2$
IV-1001
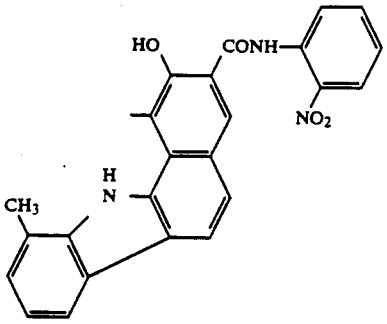
IV-1002
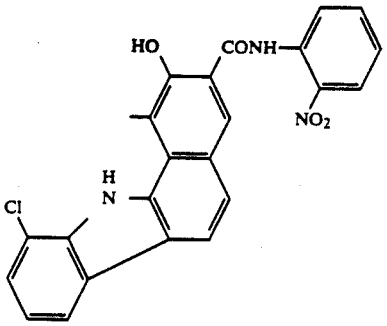
-continued
No. A
IV-1003
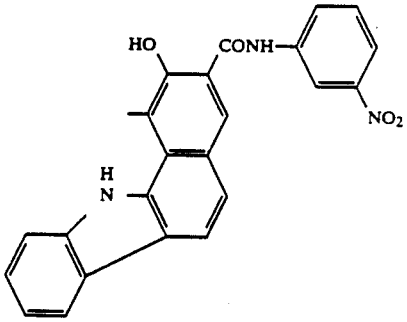
IV-1004
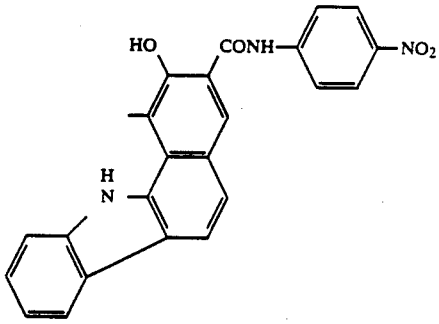
$R_{31} = OCH_3$, $R_{32} = CF_3$
IV-1005
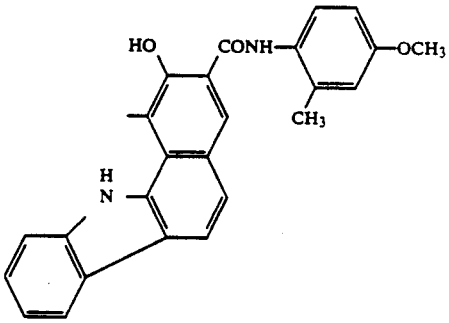
IV-1006
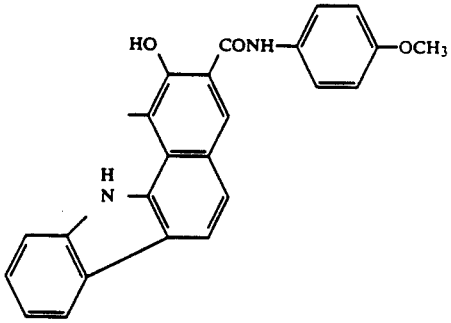

-continued
| No. | A |
|---|---|
| IV-1007 | 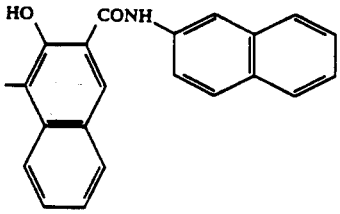 |
| IV-1008 | 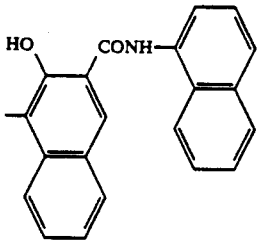 |
| $R_{31}$, $R_{32}$ = Cl | |
| IV-1009 | 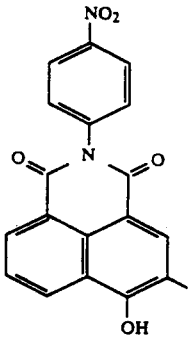 |
| IV-1010 | 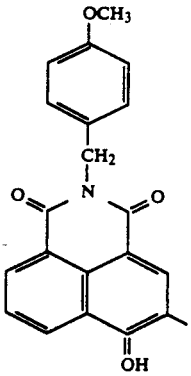 |
| IV-1011 | 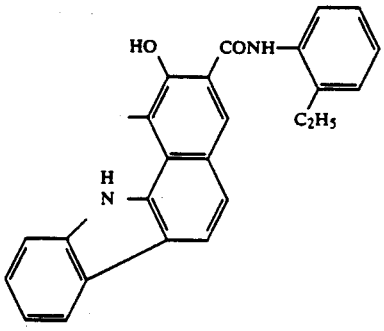 |
-continued
| No. | A |
|---|---|
| $R_{31}$ = Cl, $R_{32}$ = $CH_3$ | |
| IV-1012 | 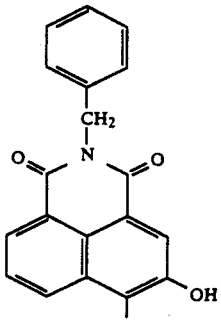 |
| IV-1013 | 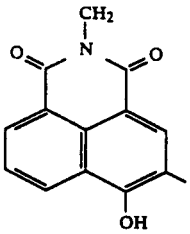 |
| IV-1014 | 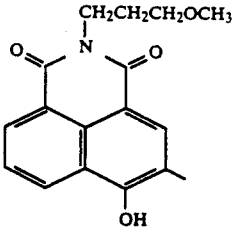 |
| $R_{31}$ = Br, $R_{32}$ = $OCH_3$ | |
| IV-1015 | 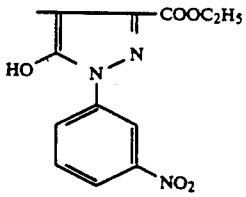 |
| IV-1016 | 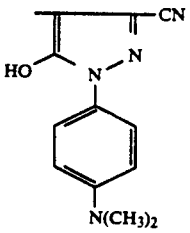 |
| IV-1017 | 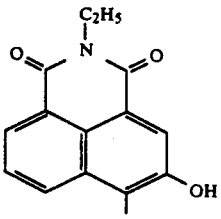 |

-continued
| No. | A |
|---|---|
| IV-1018 | 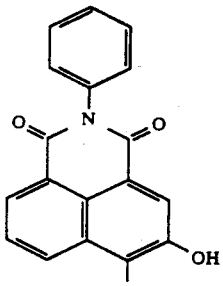 |
| | $R_{31}$ = Br, $R_{32}$ = NONE |
| IV-1019 | 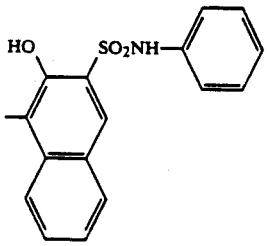 |
| IV-1020 | 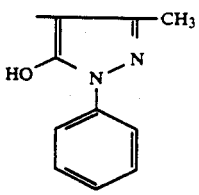 |
| IV-1021 | 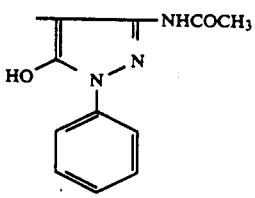 |
| IV-1022 | 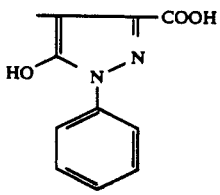 |
| | $R_{31}$ = Br, $R_{32}$ = CN |
| IV-1023 | 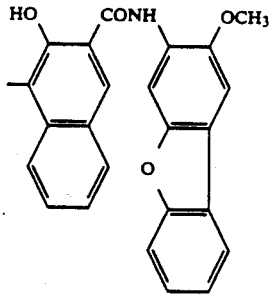 |
-continued
| No. | A |
|---|---|
| IV-1024 | 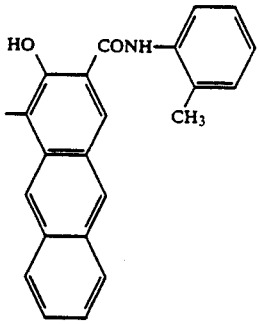 |
| IV-1025 | 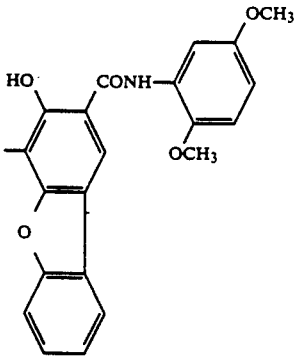 |
| IV-1026 | 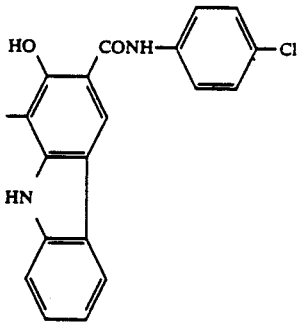 |
| | $R_{31}$ = Br, $R_{32}$ = $NO_2$ |
| IV-1027 | 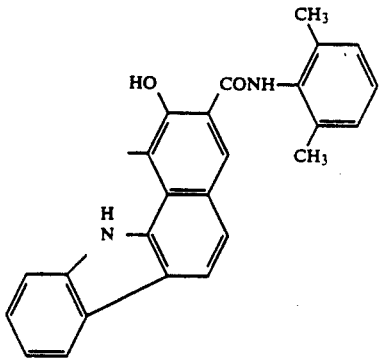 |

-continued
| No. | A |
|---|---|
| IV-1028 | 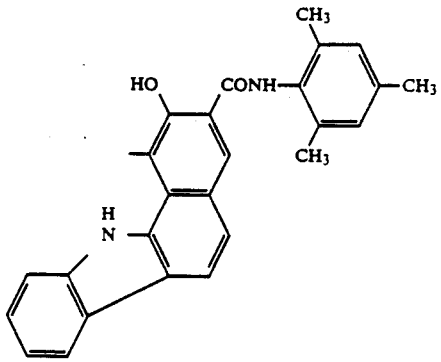 |
| IV-1029 | 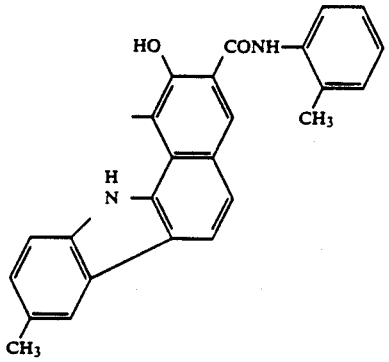 |
| IV-1030 | 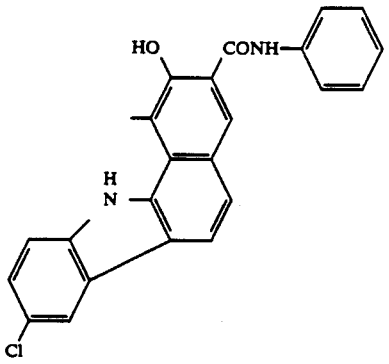 |
| | $R_{31}$ = Br, $R_{32}$ = $CF_3$ |
| IV-1031 | 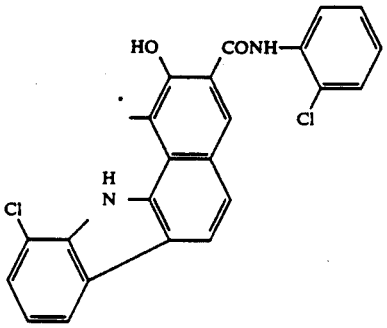 |
-continued
| No. | A |
|---|---|
| IV-1032 | 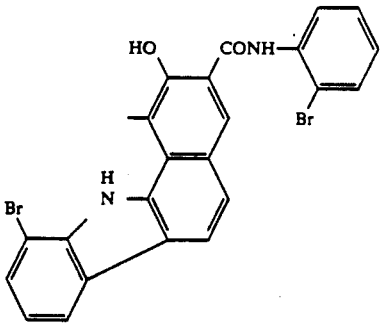 |
| IV-1033 | 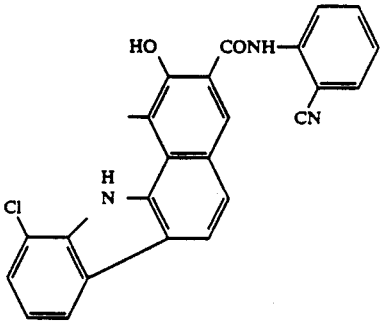 |
| IV-1034 | 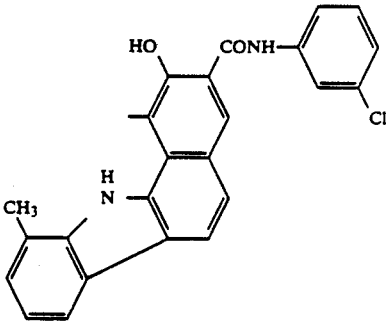 |
| | $R_{31}$, $R_{32}$ = CN |
| IV-1035 | 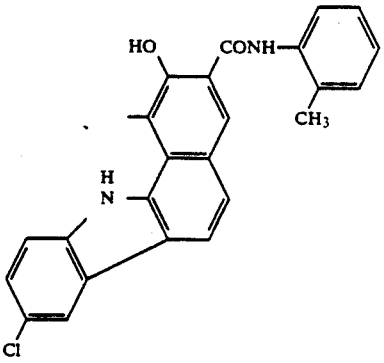 |

-continued
| No. | A |
|---|---|
| IV-1036 | 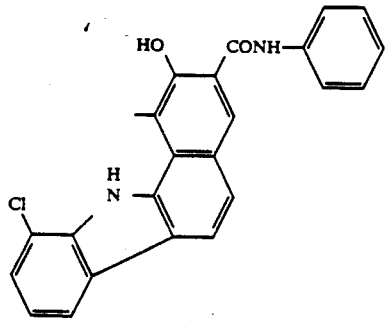 |
| IV-1037 | 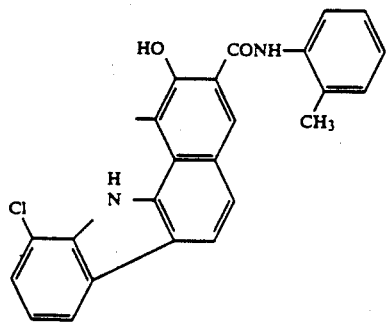 |
| IV-1038 | 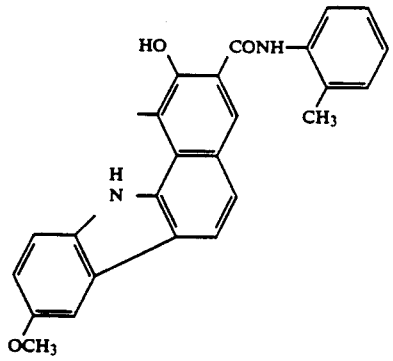 |
| | $R_{31}$ = CN, $R_{32}$ = $CH_3$ |
| IV-1039 | 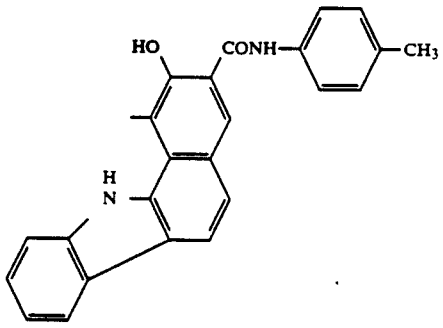 |
-continued
| No. | A |
|---|---|
| IV-1040 | 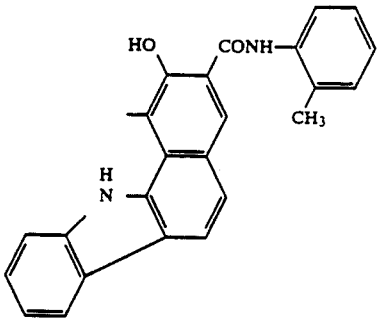 |
| IV-1041 | 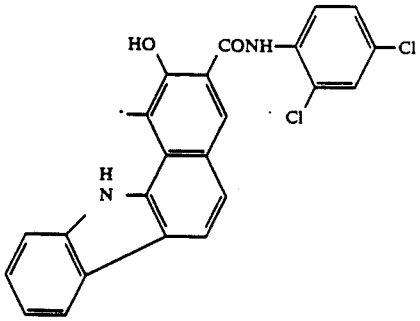 |
| IV-1042 | 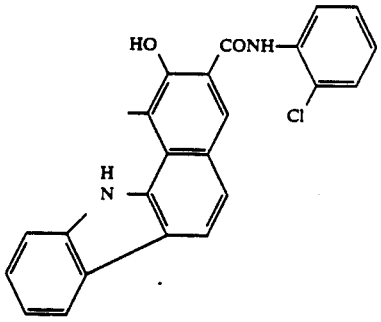 |
| | $R_{31}$ = CN; $R_{32}$ = Cl |
| IV-1043 | 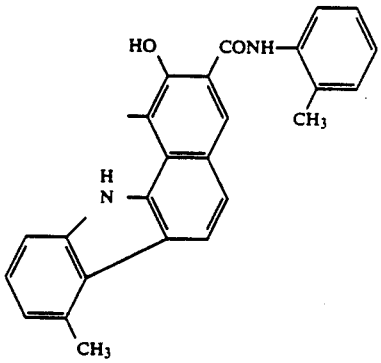 |

-continued
| No. | A |
|---|---|
| IV-1045 | 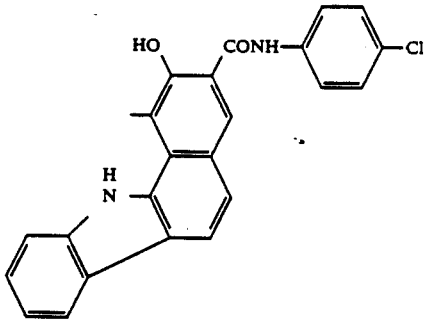 |
| IV-1046 | 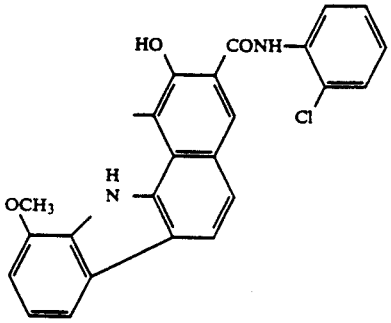 |
| IV-1047 | 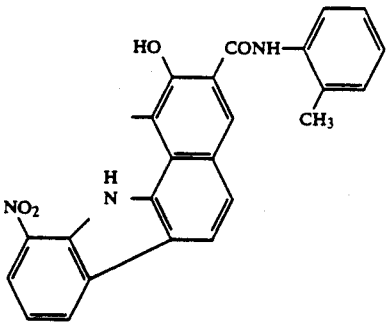 |
| | $R_{31}$, $R_{32}$ = $NO_2$ |
| IV-1048 | 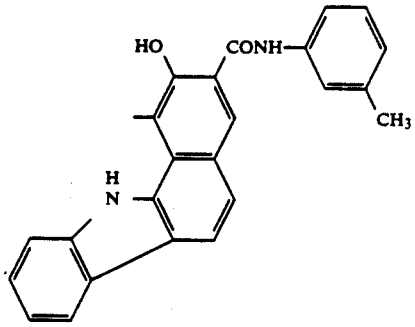 |
-continued
| No. | A |
|---|---|
| IV-1049 | 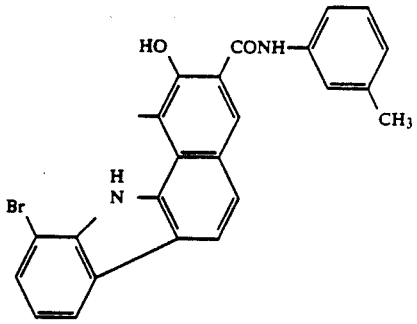 |
| IV-1050 | 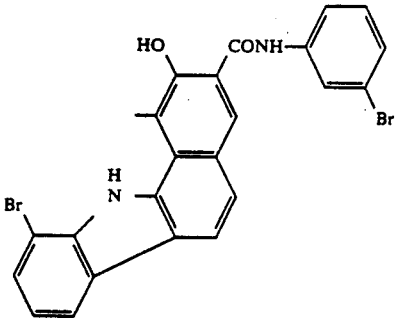 |
| IV-1051 | 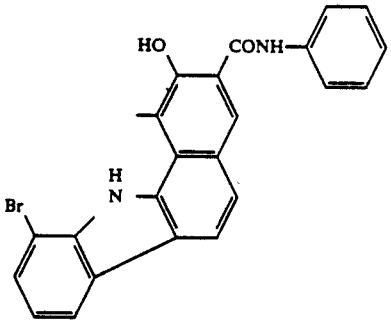 |
| | $R_{31}$ = $NO_2$, $R_{32}$ = NONE |
| IV-1052 | 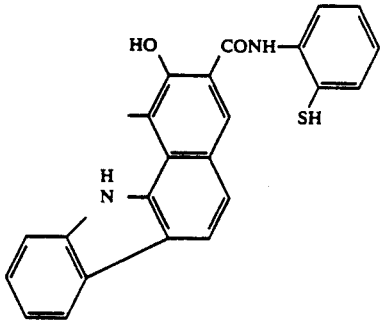 |

-continued
| No. | A |
|---|---|
| IV-1053 | 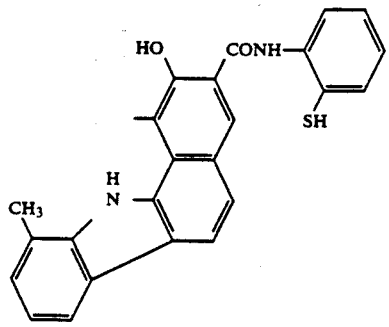 |
| IV-1054 | 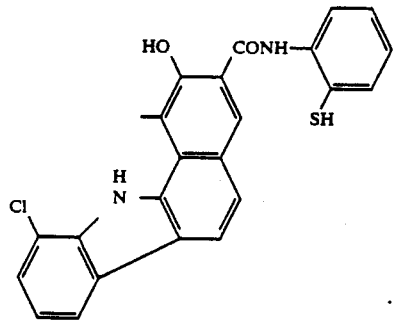 |
| IV-1055 | 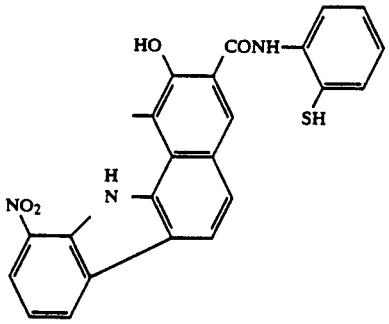 |
| | $R_{31}$ = $NO_2$, $R_{32}$ = $CH_3$ |
| IV-1056 | 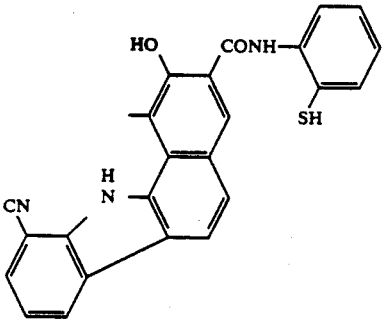 |
-continued
| No. | A |
|---|---|
| IV-1057 | 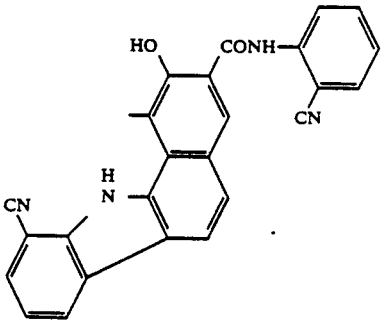 |
| IV-1058 | 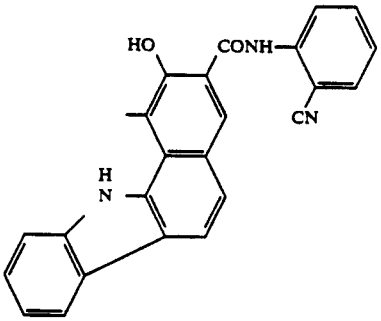 |
| IV-1059 | 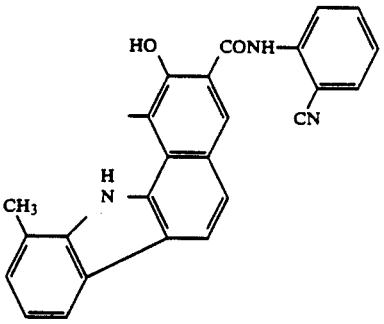 |
| | $R_{31}$ = $NO_2$, $R_{32}$ = OH |
| IV-1060 | 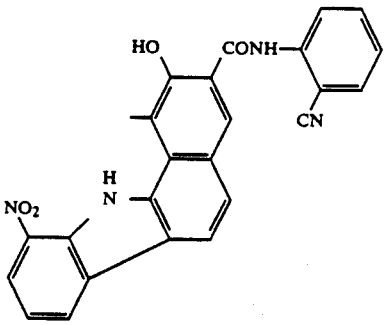 |

-continued
| No. | A |
|---|---|
| IV-1061 | 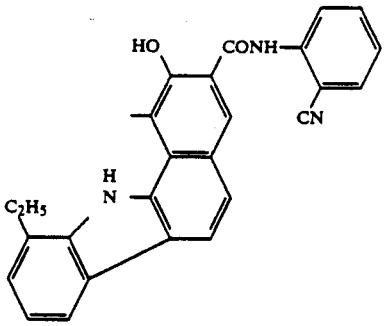 |
| IV-1062 | 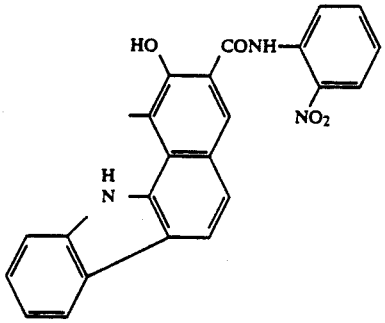 |
| IV-1063 | 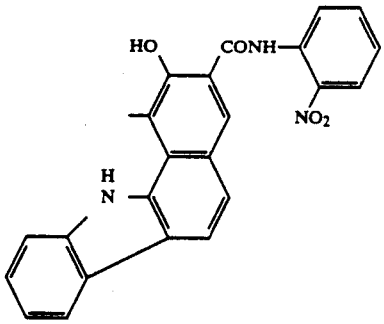 |
| | $R^{31}$, $R^{32}$ = $CF_3$ |
| IV-1064 | 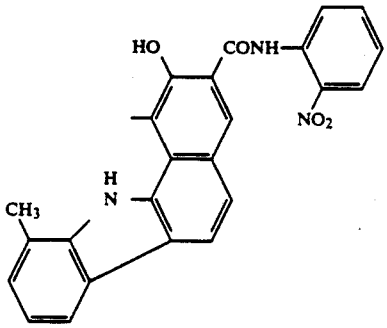 |
-continued
| No. | A |
|---|---|
| IV-1065 | 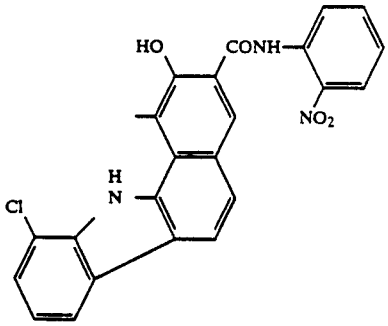 |
| IV-1066 | 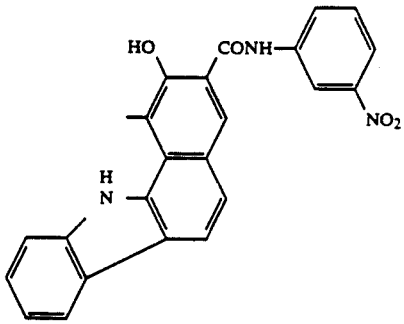 |
| IV-1067 | 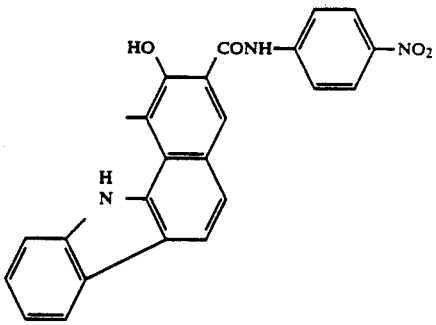 |
| | $R_{31}$ = $CF_3$, $R_{32}$ = $CH_3$ |
| IV-1068 | 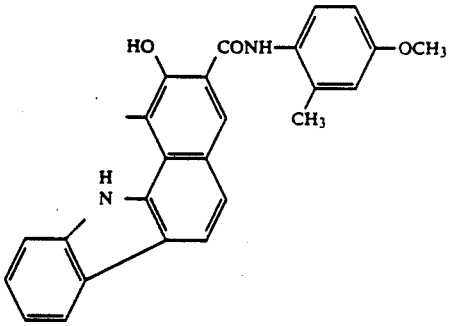 |

-continued
| No. | A |
|---|---|
| IV-1069 | 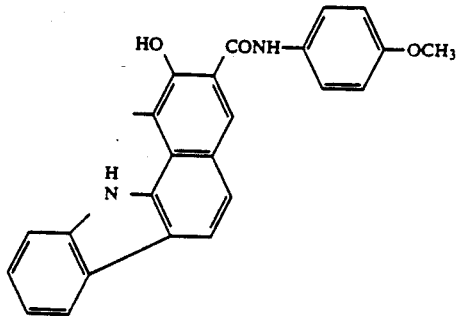 |
| IV-1070 | 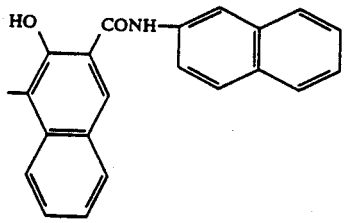 |
| IV-1071 | 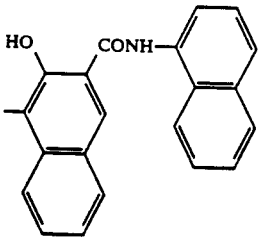 $R_{31} = CF_3$, $R_{32} = Cl$ |
| IV-1072 | 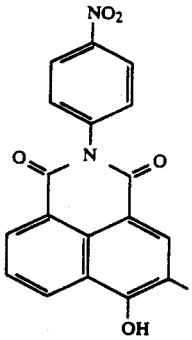 |
| IV-1073 | 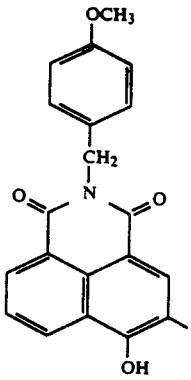 |
-continued
| No. | A |
|---|---|
| IV-1074 | 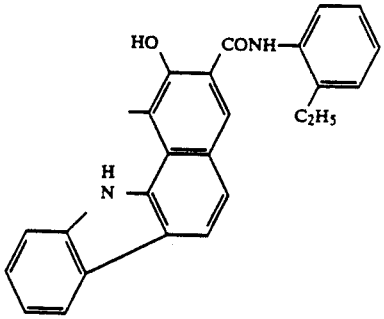 $R_{31} = CF_3$, $R_{32} = NO_2$ |
| IV-1075 | 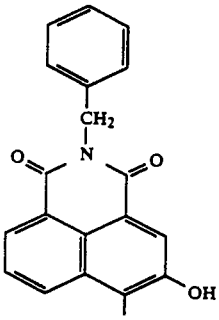 |
| IV-1076 | 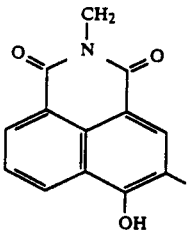 |
| IV-1077 | 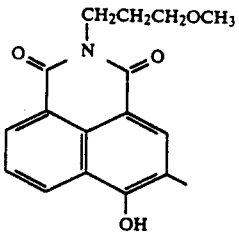 |
| IV-1078 | 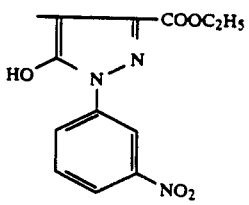 |

-continued
| No. | A |
|---|---|
| IV-1079 | 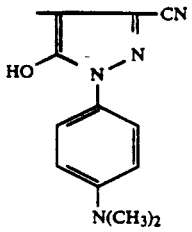 |
| IV-1080 | 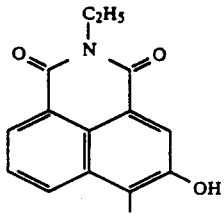 |
| IV-1081 | 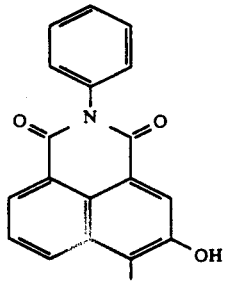 |
| $R_{31}$ = OH, $R_{32}$ = NONE | |
| IV-1082 | 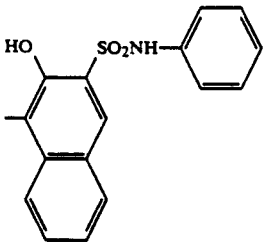 |
| IV-1083 | 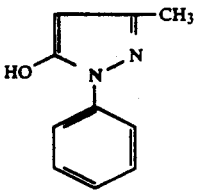 |
| IV-1084 | 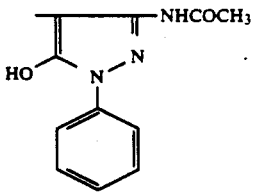 |
-continued
| No. | A |
|---|---|
| IV-1085 | 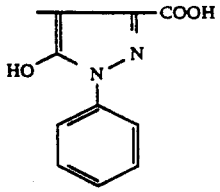 |
| $R_{31}$, $R_{32}$ = OH | |
| IV-1086 | 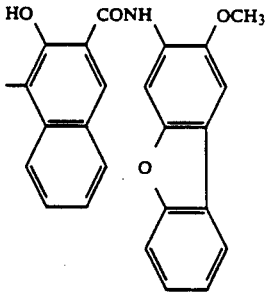 |
| IV-1087 | 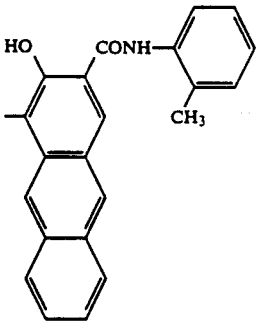 |
| IV-1088 | 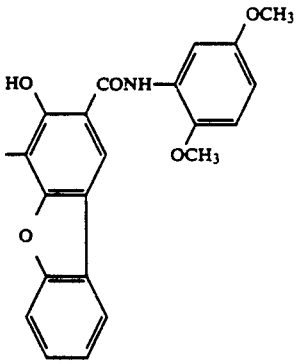 |
| IV-1089 | 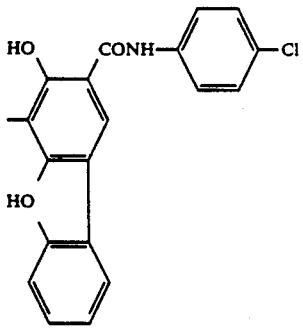 |

-continued

| No. | A |
|---|---|
| | $R_{31}$ = OH, $R_{32}$ = Cl |
| IV-1090 | 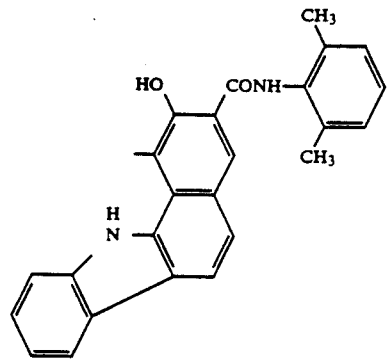 |
| IV-1091 | 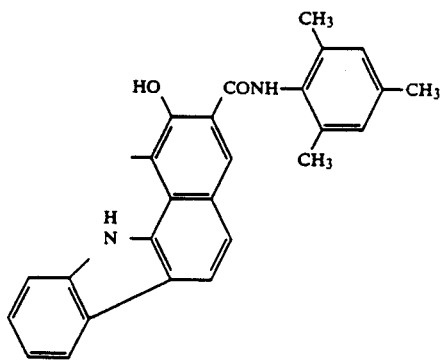 |
| IV-1092 | 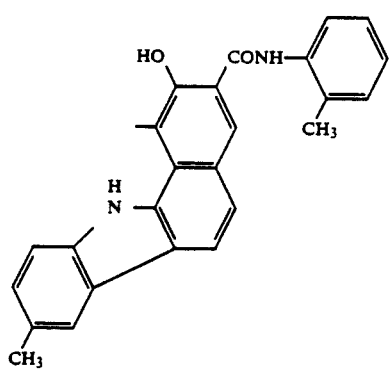 |
| IV-1093 | 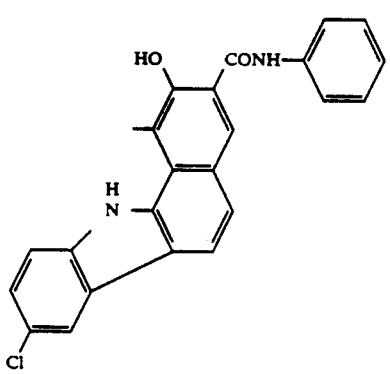 |

The azo compound represented by the above mentioned General formula [IV] of the present invention can be easily synthesized by a known process.

EXAMPLE OF SYNTHESIS 7

(Synthesis of an illustrated compound IV-6 represented by General formula [IV-A])

2.10 g (0.01 mol) of 2, 6-diamino-9-fluorenone was dispersed in 10 mL of hydrochloric acid and 20 mL of water, and a solution formed by dissolving 1.4 g of sodium nitrite in 5 mL of water was added in drops to the above solution while the temperature is kept at 5° C. or lower. After this solution was continuously agitated for 1 hour at this temperature, insoluble substances were removed by filtration, and a solution formed by dissolving 4.6 g of 6-ammonium phosphate fluoride in 50 mL of water was then added to the filtrate. Precipitated tetrazonium salt was obtained by filtration and was then dissolved in 100 mL of N, N-dimethylformamide (DMF). With the temperature being kept at 5° C. or lower, a solution formed by dissolving 5.94 g (0.02 mol) of 2-hydroxy-3-naphthoic acid-3'-chloranilide in 200 mL of DMF was added in drops to the above solution.

While maintaining the temperature at 5° C. or lower, a solution formed by dissolving 6 g (0.04 mol) of triethanolamine in 30 mL of DMF was added in drops to the above-mentioned solution, agitated for 1 hour at 5° C. or lower and then agitated for 4 hours at room temperature. After the reaction, the precipitated crystals were obtained by filtration, washed with DMF and then with water, and were then dried, resulting in 5.89 g of the target substance.

The calculated values were C=68.2%, H=3.4%, and N=10.2%. The obtained values were C=68.5%, H=3.7%, and N=10.0%.

EXAMPLE OF SYNTHESIS 8

(Synthesis of an illustrated compound IV-160 represented by General formula [IV-B])

2.59 g (0.01 mol) of 2, 6-diamino-4-methyl-7-chlor-9fluorenone was dispersed in 10 mL of hydrochloric acid and 20 mL of water, and a solution formed by dissolving 1.4 g (0.02 mol) of sodium nitrite in 5 mL of water was added in drops to the above solution while the temperature was kept at 5° C. or lower. After this solution was agitated for 1 hour at the above temperature, insoluble substances were removed by filtration, and a solution formed by dissolving 4.6 g of 6-ammonium phosphate fluoride was added to the filtrate. Precipitated tetrazonium salt obtained by filtration and was then dissolved in 100 mL of N, N-dimethylformamide (DMF). With the temperature being maintained at 5° C. or lower, a solution formed by dissolving 6.84 g (0.02 mol) of 2-hydroxy-3 naphthoic acid-2'- bromanilide in 200 mL of DMF was added in drops. Maintaining the temperature at 5° C. or lower, a solution formed by dissolved 6 g (0.04 mol) of triethanolamine in 30 mL of DMF and further agitation for 1 hour at 5° C. or lower and for 4 hours at room temperature was added in drops. After the reaction, the precipitated crystals were obtained by filtration, washed with DMF and further with water, and then dried, thus resulting in 6.21 g of the target substance.

Calculated values were C=59.7%, H=3.1%, and N=8.7%.

Obtained values were C=59.2%, H=3.6%, and N=8.9%.

EXAMPLE OF SYNTHESIS 9

(Synthesis of an illustated compound IV-719 repesented by General formula [IV-E])

3.68 g (0.01 mol) of 2, 6-diamino-3, 7-dibrom-9-fluorenone was dispersed 10 mL of hydrochloric acid and 20 mL of water, and a solution formed by dissolving 1.4 g (0.02 mol) of sodium nitrite in 5 mL of water was added in drops to the above solution while the temperature was kept at 5° C. or lower. This solution was continuously agitated further for 1 hour at this a temperature, insoluble substances were removed by filtration, and a solution formed by dissolving 4.6 g of 6-ammonium phosphate fluoride was added to the filtrate. The precipitated tetrazonium salt was obtained by filtration and then dissolved in 100 mL of N, N-dimethylformamide (DMF). With the temperature being kept at 5° C. or lower, a solution formed by dissolving 6.84 g (0.02 mol) of 2-hydroxy-3-naphthoic acid-3'-bromanilide in 200 mL of DMF was added in drops.

With the temperature continuously kept at 5° C. or lower, a solution formed of 6 g (0.04 mol) of triethanolamine in 30 mL of DMF, followed by agitation for 1 hour at 5° C. or lower then agitation for 4 hours at the room temperature was added in drops to the above solution. After the reaction, the precipitated crystals were obtained by filtration, washed with DMF and then with water, and were then dried, resulting in 6.34 g of the target substance.

Calculated values were C=52.5%, H=2.5%, and N=7.8%.

Obtained values were C=52.2%, H=2.8%, and N=8.2%.

EXAMPLE OF SYNTHESIS 10

(Synthesis of an illustrated compound IV-943 represented by General formula [IV-J])

2.10 g (0.01 mol) of 2, 6-diamino-9-fluorenone was dispersed in 10 mL of hydrochloric acid and 20 mL of water, and a solution formed by dissolving 1.4 g (0.02 mol) of sodium nitrite in 5 mL of water was added in drops to the above solution while the temperature was kept at 5° C. or less. After this solution was continuously agitated for 1 hour at this temperature, insoluble substances were removed by filtration. Then, a solution formed by 4.6 g of ammonium phosphate fluoride in 50 mL of water was added to the filtrate. The precipitated crystals were obtained by filtration and were then dissolved in 100 mL of N, N-dimethylformamide (DMF). With the temperature being kept at 5° C. or less, a solution formed by dissolving 7.80 g (0.02 mol) of 2-hydroxy-3-(4-methoxy-2-methylphenylcarbamoyl)-benzo[a]-carbazole in 200 mL of DMF was then added to the solution.

With the temperature being continuously kept at 5° C. or less, a solution formed by dissolving 6 g (0.04 mol) of triethanolamine in 30 mL of DMF, followed by agitation for 1 hour at 5° C. or lower and then agitated for 4 hours at room temperature was then added in drops. After the reaction, the precipitated crystals were gained by filtration, washed with DMF and further with water, and then dried, thus resulting in 6.51 g of the target substance.

Calculated values were C=73.8%, H=4.29%, and N=10.9%. Obtained values were C=73.5%, H=4.36%, and N=11.2%.

EXAMPLE OF SYNTHESIS 11

(Synthesis of an illustrated compound IV-1048 represented by General formula [IV-O])

2.60 g (0.01 mol) of 2, 6-diamino-3, 7-dinitro-9-fluorenone was dispersed in 10 mL of hydrochloric acid and 20 mL of water, and a solution formed by dissolving 1.4 g (0.02 mol) of sodium nitrite in 5 mL of water was added in drops to the above solution while the temperature was maintained at 5° C. or less. After this solution was agitated continously for 1 hour at the above temperature, insoluble substances were removed by filtration, and a solution formed by dissolving 4.6 g of 6-ammonium phosphate fluoride in 50 mL of water was added to the filtrate. The precipitated tetrazonium salt was obtained by filtration and was then dissolved in 100 mL of N, N-dimethylformamide (DMF). With the temperature being kept at 5° C. or lower, a solution formed by dissolving 7.32 g (0.02 mol) of 2-hydroxy-3-(3-methyphenylcarbamoyl)benzo[a]carbazole in 200 mL of DMF was added to the solution in drops.

Maintaining the temperature at 5° C. or less, the above solution received the addition in drops of a solution formed by dissolving 6 g (0.04 mol) of triethanolamine in 30 mL of DMF, followed by agitation for 1 hour at 5° C. or less and then for 4 hours at room temperature. After the reaction, the precipitated crystals were obtained by filtration, washed with DMF and then with water, and was then dried, thus resulting in 6.58 g of the target substance.

Calculated values were C=69.5%, H=3.60%, and N=13.3%. Obtained values were C=69.1%, H=3.67%, and N=13.6%.

EXAMPLE OF SYNTHESIS 12

(Synthesis of an illustrated compound IV-1006 represented 7 by General formula [IV-S])

3.08 g (0.01 mol) of 2, 6-diamino-1-methoxy-7-trifluoromethyl-9-fluorenone was dispersed in 10 mL of hydrochloric acid and 20 mL of water, and a solution formed by dissolving 1.4 g (0.02 mol) of sodium nitrite in 5 mL of water was added in drops to the above solution while the temperature was maintained at 5° C. or less. After this solution was continuously agitated for 1 hour at this temperature, insoluble substances were removed by filtration. Then, a solution formed by dissolving 4.6 g of 6-ammonium phosphate fluoride in 50 mL of water was added to the resultant filtrate. The precipitated tetrazonium salt was obtained by filtration and was then dissolved in 100 mL of N, N-dimethylformamide (DMF). Being kept at 5° C. or lower, this solution underwent the addition in drops of a solution formed by dissolving 7.89 g (0.02 mol) of 2-hydroxy-3-(2, 4, 6-trimethylphenylcarbamoyl)-benzo[a]carbazole in 200 mL of DMF.

While maintaining the solution at 5° C. or less, a solution formed by dissolving 6 g (0.04 mol) of triethanolamine in 30 mL of DMF, followed by agitation for 1 hour at 5° C. or lower and then agitated for 4 hours at room temperature was added in drops to the above selection. After the reaction, the precipitated crystals were obtained by filtration, washed with DMF and then with water, and were then dried, thus resulting in 8.54 g of the target substance.

Calculated values were C=73.8%, H=4.49%, and N=7.7%. Obtained values were C=72.9%, H=4.73%, and N=7.9%.

The other compounds of the present invention can be prepared, using the process described in the Example of Synthesis, by producing a tetrazo product with use of 2, 6-diamino-substituted, unsubstituted 9-fluorenone and then allowing the reaction of 2-hydroxy-3 naphthoic acid-substituted anilide, 2-hydroxy-3 (substituted, unsubstituted phenylcarbamoyl)-benzo[a]substituted, unsubstituted phenylcarbazole, or N-substitutued, unsubstituted-3 or 4-hydroxy-1, 8-naphthalimido.

The azo compound of the present invention has excellent electroconductivity, enabling a photo-receptor for electrophotography of the present invention to be produced by providing a photosensitive layer, which allows said azo compound to be dispersed in a binder, on an eletroconductive support. The azo compound of the present invention can be formed into a so-called function-separating type of photo-receptor by using said azo compound as a carrier-generation substance utilizing its superior carrier-generating ability as well as by using conjunctively a carrier-transport substance that can act effectively in combination with the above mentioned azo compound. Although the above mentioned function-separating type of photo-receptor may be of a mixed dispersion type of said both substances, it is preferably lamination type of photo-receptor that ensures lamination of a carrier-generation layer containing a carrier-generation substance which contains the azo compound of the present invention and a carrier-transport layer containing a carrier-transport substance.

Figure 2:
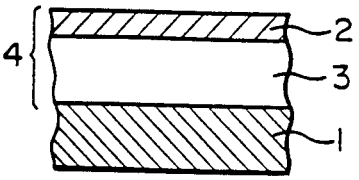
Figure 5:
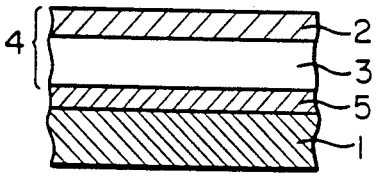
Figure 3:
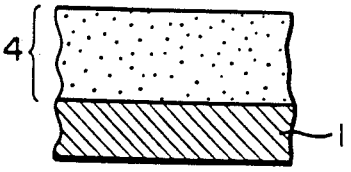

Photo-receptors for electrophotography of the present invention can be illustrated by, for example, one in which, as shown in FIG. 1, a photosensitive layer 4 of a laminated construction of the function-separating type is provided on a support 1 (which is an eletroconductive support or one with an eletroconductive layer provided on a sheet) with its lower layer being a carrier-generation layer 2 which contains a carrier-generation substance and, as occasion demands, a binder resin and with its upper layer being a carrier-transport layer 3 which contains a carrier-transport substance and a binder resin; one in which, as shown in FIG. 2, photosensitive layer 4 of a laminated construction is provided on said support 1 with its lower layer being carrier-transport layer 3 and with its upper layer being said carrier-generation layer 2; and one in which, as shown in FIG. 3, said photosensitive layer 4 containing a carrier-generation substance, a carrier-transport substance and a binder resin is provided on said support 1.

In case of a photosensitive layer of the laminated construction, the carrier-generation layer is preferably a layer which is made of the thinnest possible film within a range of thicknesses sufficient to generate photo-carriers to allow the great majority of the volume of incident light to be absorbed in a charge-generation layer, causing the generation of many charge-generation carriers, as well as allowing the generated charge carriers to be injected in the carrier-transport layer without suffering inactivation due to rebinding and trapping.

In addition, the carrier-transport layer is junctioned electrically with the above mentioned carrier-generation layer and is able to receive the charge carriers injected from the charge-generation layer in the presence of an electric field and is able to transport these charge carriers to its surface.

In the function-separating type of photo-receptor of a single-layer construction, furthermore, generation and transport of photo-carriers are performed with a single layer, in which a carrier-generation substance and a carrier-transport substance are electrically junctioned, and/or the carrier-generation substance also contributes to the transport of carriers.

Figure 4:
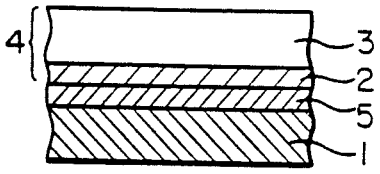
Figure 6:
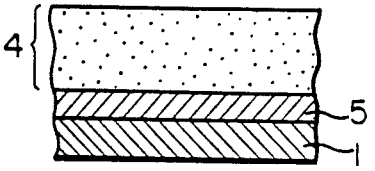
Figure 7:
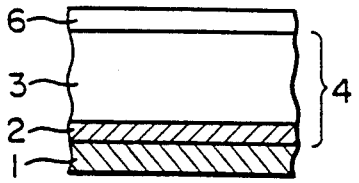
Figure 8:
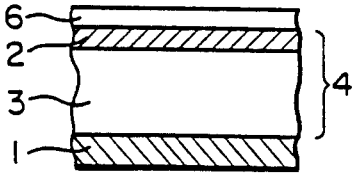
Figure 9:
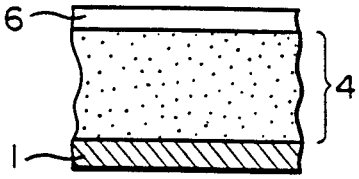

Still further, the carrier-generation layer may contain both the carrier-generation substance and the carrier-transport substance. In any construction of layers, a protective layer may be provided on the photosensitive layer as illustrated in FIG. 7 or FIG. 9, and as further shown in FIG. 4 or FIG. 6, subbing layer (an intermediate layer) having a barrier function and adhesiveness may be provided between the support and the photosensitive layer.

The binder resins usable for the photosensitive layer, the protective layer and the intermediate layer can be illustrated by, for example, the addition-polymerization type of resins, polyadditon type of resins and polycondensation type of resins such as polystyrene, polyethylene, polypropylene, acrylic resin, methacrylic resin, vinyl chloride resin, vinyl acetate resin, poly(vinyl butyral) resin, epoxy resin, polyurethane resin, phenol resin, polyester resin, alkyd resin, polycarbonate resin, silicone resin, melamine resin, etc., as well as copolymer resins containing 2 or more of the repeated units of the above resins, for example, insulating resins such as vinyl chloride-vinyl acetate-maleic anhydride copolymer resins, and high molecular organic semiconductors such as poly-N-vinylcarbazole, etc.

Organic amines can be added into the photosensitive layers of the present invention to improve the carrier-generation function of the carrier-generation substances, the addition of secondary amines in particular being preferable.

These secondary amines can be illustrated by, for example, dimethylamine, di-n propylamine, di-isopropylamine, di-n butylamine, di-isobutylamine, di-n amylamine, di-isoamylamine, di-n hexylamine, di-isohexylamine, di-n pentylamine, di-isopentylamine, di-n octylamine, di-isooctylamine, di-n nonylamine, di-isononylamine, di-n decylamine, di-isodecylamine, di-n monodecylamine, di-isomonodecylamine, di-n dodecylamine, di-isododecylamine, etc.

Furthermore, the added amounts of the above mentioned organic amines as for each carrier-generation substance are equal to, or less than, that of the concerned carrier-generation substance, preferably in range of moles accounting for 0.2 times to 0.005 times the amounts of these substances.

In the photosensitive layers of the present invention, in addition, an antioxidant can be added to prevent ozone deterioration.

Typical examples embodying such an antioxidant are listed below, but the said antioxidants are not limited by those examples.

Group (I): Hindered phenols

Dibutylhydroxytoluene, 2,2'-methylenebis (6-t-butyl-4-methylphenol), 4,4'-butylidenebis (6-t-butyl-3-methylphenol), 4,4'-thiobis (6-t-butyl-3-methyphenol), 2,2'-butylidenebis (6-t-butyl-4-methylphenol), alpha-tocopherol, beta-tocopherol, 2,2,4-trimethyl-6-hydroxy-7-t-butylchroman, pentaerithtyl-tetrakis [3-(3,5-di-t-butyl-4-hydroxyphenyl) propionate], 2,2'-thiodiethylenebis [3-(3,5-di-t-butyl-4-hydroxyphenyl) propionate], 1,6-hexanediolbis [3-(3,5-di-t-butyl-4-hydroxyphenyl) propionate], butylhydroxyanisole, dibutylhyroxyanisol, 1-[2-(3,5-di-tert-butyl-4-hydroxyphenyl) propionyloxy ethyl]-4-[3-(3,5-di-tert-butyl-4-hydroxyphenyl) propionyloxy]-2, 2,6,6-tetramethylpiperidyl, etc.

Group (II): Paraphenylenediamines

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, etc.

Group (III): Hydroquinones 2,5-di-t-octylhydroquinone, 2,6-didodecylhydroquinone, 2-dodecylhydroquinone, 2-dodecyl-5-chlorohydroquinone, 2-toctyl-5-methyhydroquinone, 2-(2-octadecenyl)-5-methylhydroquinone, etc.

Group (IV): Organic sulfur compounds

Dilauryl-3,3'-thiodipropionate, distearyl-3,3'-thodipropionate, ditetradecyl-3,3'-thiodipropionate, etc.

Group (V): Organic phosphorus compounds

Triphenylphosphine, tri(nonylphenyl)phosphine, tri(dinonylphenyl)phosphine, tricresylphosphine, tri(2,4-dibutylphenoxy)phosphine, etc.

The above compounds are known antioxidants for rubber, plastic, fats and oils, and commerical products are easily obtained.

These antioxidants may be added to the carrier-generation layer, the carrier-transport layer and the protective layer, but they are preferably added to the carrier-transport layer. The added amount of each of the above antioxidants in such a case is 0.1 to 100 parts by weight, preferably 1 to 50 parts by weight and particularly preferably 5 to 25 parts by weight, respectively against 100 parts by weight of the carrier-transport substance.

For an electroconductive support to support the above mentioned photosensitive layer, an alternative choice can be a metallic plate, metallic drum or metallic foil made of aluminum, or nickel, a plastic film evaporated with aluminum tin oxide, or indium oxide or a film or drum made of paper or plastic, to which electroconductive substances are applied.

In the present invention, the carrier-generation layer can be typically provided by applying a dispersion solution, which is obtained by allowing the above mentioned azo compound of the present invention alone or together with a proper binder resin to be dispersed in a proper dispersion medium or solvent, to the support or onto the intermediate layer or the carrier-transport layer by dipping, spraying, spreading, or rolling and then drying the applied solution.

The azo compound of the present invention can be formed into fine particles with the proper particle size by a ball or sand mill, and then be dispersed in a dispersion medium.

Used for the dispersion of the azo compound of the present invention are ball mill, homomixer, sand mill, ultrasonic dispersion machine, attritor, etc.

The dispersion medium for the azo compound of the present invention can be hydrocarbons such as hexane, benzene, toluene, or xylene; hydrocarbon halogenides such as methylenechloride, methylenebromide, 1,2-dichloroethane, syn-tetrachloroethane, cis-1,2-dichloroethylene, 1,1,2-trichloroethane, 1,1,1-trichloroethane, 1,2-dichloropropane, chloroform, bromoform, or chlorbenzene; ketones such as acetone, methylethylketone, or cyclohexanone; esters such as ethyl acetate, or butyl acetate; alcohols such as methanol, ethanol, propanol, butanol, cyclohexanol, heptanol, ethyleneglycol, methylcellosolve, ethylcellosolve, cellosolve or acetate, and such derivatives as ethers and acetals including tetrahydrofuran, 1,4-dioxane, furan, and fulfural, amines such as pyridine, n-butylamine, diethylamine, ethylenediamine, and isopropanolamine; nitrogen compounds such as amides including N,N-dimethylformaminde, etc.; fatty acids and phenols; and such sulfur and phosphorus compounds as triethyl phosphate.

In case that the photo-receptor of the present invention is of a lamination-type construction, the weightwise ratio of the binder to the carrier-generation substance and the carrier-transport substance in the carrier-generation layer is 0 to 100:1 to 500:0 to 500.

When the percentage content of the carrier-generation substance is smaller than the above, it will cause a low photo-sensitivity as well as an increase in residual electric potential, and when the content is larger than the above, it will lower to the dark attenuation and receptive potential.

The membrane thickness of the carrier-generation layer formed as mentioned above is preferably between 0.01 and 10 μm, and optionally between 0.1 and 5 μm.

Furthermore, the carrier-transport layer can be formed by applying and drying a dispersion solution which is prepared by allowing the carrier-transport substance alone or together with the above mentioned binder resin to be dissolved and dispersed in a proper solvent or dispersion medium. The dispersion medium used to disperse the above carrier-generation substance can be used as the dispersion medium to be used in such a case.

Although there is no particular limitation on the carrier-transport substance to be usable in the present invention, examples include oxazole derivatives, oxadiazole derivatives, thiazole derivatives, triazole derivatives, imidazole derivatives, imidazolone derivatives, imidazolidine derivatives, bisimidazolidine derivatives, styryl compounds, hydrazone compounds, pyrazoline derivatives, amine derivatives, oxazolone derivatives, benzothiazole derivatives, quinazoline derivatives, benzofuran derivatives, acridine derivatives, phenazine derivatives, aminostylben derivatives, poly-N-vinylcarbazole, poly-1-vinylpyrene, and poly-9-vinylanthrocene.

The carrier-transport substances used in the present invention are preferably those which possess a superior ability to transport holes, which are generated at the time of light exposure, to the side of the support as well as are suitable for combination with the azo compounds of the present invention, and preferable carrier-transport substances can be illustrated by the examples represented by the below General formulae (A), (B) and (C).

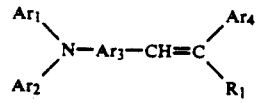

General formula (A)

In the above General formula, however, $Ar_1$, $Ar_2$ and $Ar_4$, are independently selected from a substituted or unsubstituted aryl group, $Ar_3$ represents a substituted or unsubstituted arylene group, and $R_1$ represents a hydrogen atom, a substituted or unsubstituted alkyl group, or a substituted or unsubstituted aryl group.

Specific examples of above compounds are disclosed in detail in pages 3 and 4 of Japanese Patent Publication Open to Public Inspection Nos. 65440/1983 and on pages 3 to 6 of 198043/1983.

General formula (B)

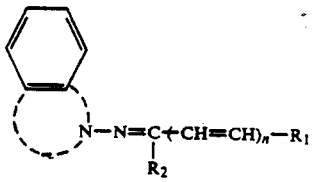

In the above General formula, however, $R_1$ is a substituted or unsubstituted aryl group, or a substituted or unsubstituted heterocyclic group, and $R_2$ represents a hydrogen atom, a substituted or unsubstituted alkyl group, or a substituted or unsubstituted aryl group. The details are disclosed in Japanese Patent Publication Open to Public Inspection Nos. 134642/1983 and 166354/1983.

General formula (C)

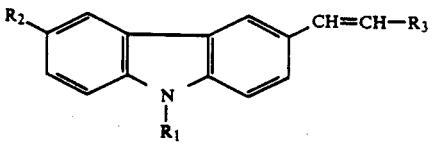

In the above table, $R_1$ is a substituted or unsubstituted aryl group, $R_2$ represents a hydrogen atom, a hologen atom, a substituted or unsubstituted alkyl group, a substituted or unsubstituted alkoxy group, a substituted or unsubstituted amino group, or a hydroxy group, and $R_3$ represents a substituted or unsubstituted aryl group, or a substituted or unsubstituted heterocyclic group. The synthesis processes and examples of these compounds are disclosed in Japanese Patent Publication Open to Public Inspection No. 148750/1982.

The other preferable carrier-transport substances of the present invention can be illustrated by the hydrazone compounds disclosed in the Japanese Patent Publications Open to Public Inspection No. 67940/1982, No. 15252/1984 and No. 101844/1982.

Per 100 parts by weight of the binder resin in the carrier-transport layer, the carrier-transport substance accounts for preferably 20 to 200 parts by weight and particularly preferably 30 to 150 parts by weight.

The membrane thickness of the carrier-transport layer as formed above is preferably 5 to 50 μm, and particularly preferably 5 to 30 μm.

In case of the single-layer function-sepatating type of photo-receptor for electrophotography using an azo compound of the present invention, the ratio among the binder, the bis-azo compound of the present invention and the carrier-transport substance is preferably 0 to 100:1 to 500:0 to 500, and the memberane thickness of the photosensitive layer as formed is preferably between 5 and 50 μm and optimally between 5 and 30 μm.

In the present invention, the carrier-generation layer can be allowed to contain one type or two or more types of electron-accepting substance to improve the sensitivity, reduce residual potential, or decrease fatigue during repeated use.

Examples of the electron-accepting substance which can be used can be illustrated by succinic anhydride, maleic anhydride, dibrom-maleic anhydride, phthalic anhydride, tetrachlor-phthalic anhydride, tetrabromphthalic anhydride, 3-nitro-phthalic anhydride, 4-nitrophthalic anhydride, pyromellitic anhydride, mellitic anhydride, tetracyanoethylene, tetracyanoquinodimethane, o-dinitrobenzene, m-dinitrobenzene, 1,3,5-trinitrobenzene, paranitrobenzonitrile, picrylchloride, quinonechlorimide, chloranil, bromanil, dichlorodicyanoparabenzoquinone, anthraquinone, dinitroanthraquinone, 2,7-dinitrofluorenone, 2,4,7-trinitrofluorenone, 2,4,5,7-tetranitrofluorenone, 9-fluorenylidene [dicyanomethylenemalonodinitrile], polynitro-9-fluorenylidene-[dicyanomethylenemalonodinitrile], picric acid, o-nitro-benzoic acid, p-nitro-benzoic acid, 3,5dinitro-benzoic acid, pentafluoro-benzoic acid, 5-nitrosalicylic acid, phthalic acid, mellitic acid, and other compounds with greater electron affinities. Further, in regard to the added amount of the electron-generation substance, the weightwise ratio of the azo compound of the present invention to the above electron-accepting substance is 100:0.01 to 200, and optimally 100:0.1 to 100.

The above electron-accepting substance may be added to the carrier-transport layer. As for the added amount of the electron-accepting substance to said layer, the weightwise ratio of the whole carrier-transport substance to the electron-accepting substance is 100:0.01 to 100, preferably 100:0.1 to 50.

The photo-receptor of the present invention may contain other needed compounds, such as an ultraviolet ray absorbent, or antioxidant, to protect the photosensitive layer and may also contain a dye to correct color-sensitivity.

The photo-receptor for electrophotography containing an azo compound of the present invention can react satisfactorily to visible light rays and near-infrared rays, and its absorption maximum is preferably between 400 and 700 μm.

Used as the light sources having the above wavelength are gas lasers and semiconductor lasers, for example, halogen lamp, tungsten-filament lamp, argon laser, helium, and neon lasers, etc.

The photo-receptor for electrophotography of the present invention is constructed as described above, and as also apparent from the examples that will be described later, its electrification sensitivity and image formation are all superior and it is less sensitive to fatigue and deterioration particularly when it is repeatedly used, as well as possessing excellent durability.

[EXAMPLE]

The followings are specific examples of the present invention, but they in no way limit the manner of the embodiment of the present invention.

EXAMPLE 1

The intermediate layer with a thickness of 0.05 μm made of "S-LEC MF-10" (manufactured by Sekisui Chemical Co., Ltd.), a vinyl chloride-vinyl acetate-maleic anhydride copolymer, was provided onto an electroconductive support formed by laminating polyesther film with aluminum foil. In addition, 2 g of the illustrated compound No. I-71 and 2 g of a polycarbonate resin "PANLITE L-1250" (manufactured by Teijin Chemicals Ltd.) were added to 110 mL of 1,2-dichloroethane to be dispersed with a ball mill for 12 hours. The resulting dispersion solution was then applied to the above intermediate layer for a membrane thickness of 0.5 μm after drying, thus leading to the formation of the carrier-generation layer. A solution prepared by dissolving 6 g of a carrier-transport substance of the below specified structural formula (CT-1) and 10 g of the polycarbonate resin "PANLITE L-1250" in 80 mL of 1,2-dichloroethane was applied to this layer for a membrane thickness of 15 μm after drying, resulting in formation of the carrier-transport layer of a photo-receptor of the present invention.

(CT-1)

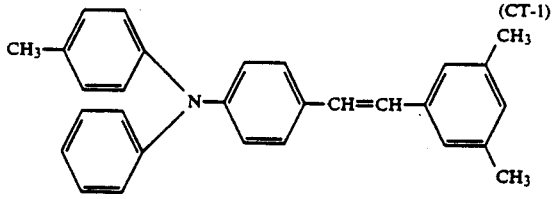

For the photo-receptor obtained by the above mentioned process, evaluation of its properties was conducted as specified below using a model EPA-8100 electrostatic paper test machine manufactured by Kawaguchi Electric Works Co., Ltd. After charging for 5 sec with a charge voltage of −6 kV, the photo-receptor was left dark for 5 sec and then exposed to 35 lux of halogen light, on the surface of the photo-receptor, thus resulting in the measurement of E ½, i.e., the amount of exposure needed to damp the surface potential to a half (half-life exposure). Further, after exposure with an exposure amount of 30 lux/sec, surface potential (residual potential) $V_R$ was measured. The same measurement was repeated 100 times. The results are indicated in Table 1.

COMPARISON EXAMPLE 1

A photo-receptor for comparison was prepared using the process described in Example 1, except that the below specified bis-azo compound (CG-1) specified below was used as the carrier-generation substance.

(CG-1)

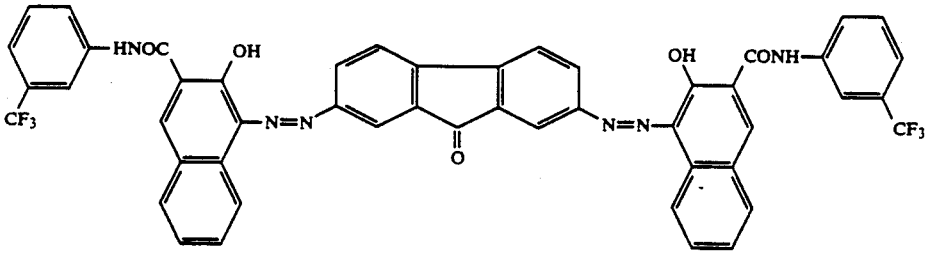

The measurement for said photo-receptor for comparison was performed by the same method as that specified in Example 1, resulting in the data shown in Table 1.

TABLE 1

| | Example 1 | | Comparative Example 1 | |
|---|---|---|---|---|
| | 1st time | 100th time | 1st time | 100th time |
| E½ (lux/sec) | 0.9 | 1.0 | 2.4 | 2.9 |
| VR (V) | 0 | 0 | 0 | −25 |

As apparent from the above results, the photoreceptor of the present invention has superior sensitivity, residual potential and stability in repeated use than the one it was compared to.

EXAMPLES 2 to 4

The photoreceptors of the present invention were prepared using the process specified in Example 1, using the illustrated compounds No. I-72, No. I-36 and No. I-74, as the carrier-generation substances and also using the below specified respective compounds as the carrier-transport substances, and the same measurements were executed results are shown in Table 2.

(CT-2)

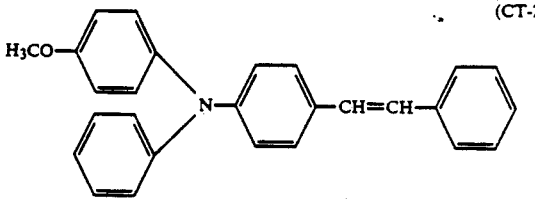

(CT-3)

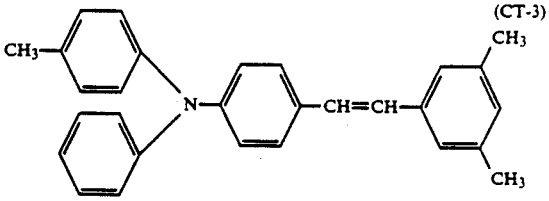

(CT-4)

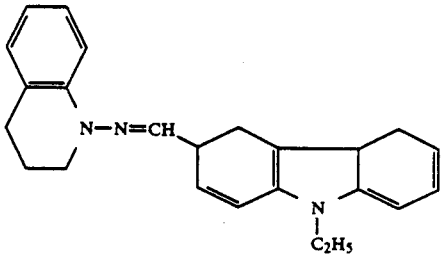

TABLE 2

| Example | Bis-azo Compound | 1st time E½ (lux/sec) | 1st time $V_R$ (V) | 100th time E½ (lux/sec) | 100th time $V_R$ (V) |
|---|---|---|---|---|---|
| 2 | Illust. comp. No. I-72 | 1.3 | 0 | 1.7 | 0 |
| 3 | Illust. comp. No. I-36 | 1.4 | 0 | 1.7 | 0 |
| 4 | Illust. comp. No., I-74 | 1.5 | 0 | 2.1 | 0 |

As can be seen from the results shown above, the photo-receptors for electrophotography using the azo compounds of the present invention possess high sensitivity, low residual potential and superior property of repetition, as shown in Example 1.

EXAMPLES 5 to 9

With the intermediate layer as used in Example 1 being provided onto polyester film evaporated with aluminum, 2 g each of the illustrated compounds Nos. I-37, I-1, I-39 and I-106 and 2 g of the polycarbonate resin "PANLITE L-1250" were added in 110 mL of 1,2-dichloroethane and dispersed for 8 hours with a sand grinder. This dispersion solution was applied to the above intermediate layer for a membrane thickness of 0.5 μm after drying, thus being formed into the carrier-generation layer.

Further onto this layer, a solution prepared by dissolving 6 g of a carrier-transport substance of the below specified structural formula (CT-5) and 10 g of a polycarbonate resin "PANLITE K-1300" (manufactured by Teijin Chemicals Ltd.) in 80 mL of 1,2-dichloroethane was applied so obtain a membrane thickness of 15 μm after drying, resulting in formation of a carrier-transport layer as well as the preparation of each photo-receptor of the present invention.

(CT-5)

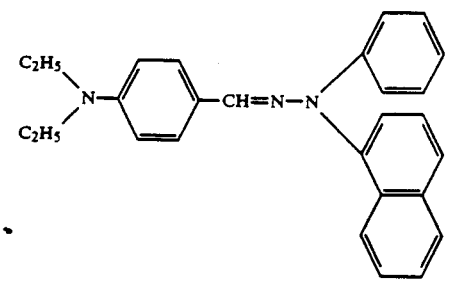

The measurements described in Example 1 were performed for the photo-receptors described above, and the results are shown in Table 3.

COMPARATIVE EXAMPLE 2

A photo-receptor for electrophotography was formed by the process described in Example 5, except that a bis-azo pigment of the below specified structural formula (CG-2) was used as the carrier-generation substance. The measurement shown in Example 1 was conducted for this photo-receptor for comparison, and the results are shown in Table 3.

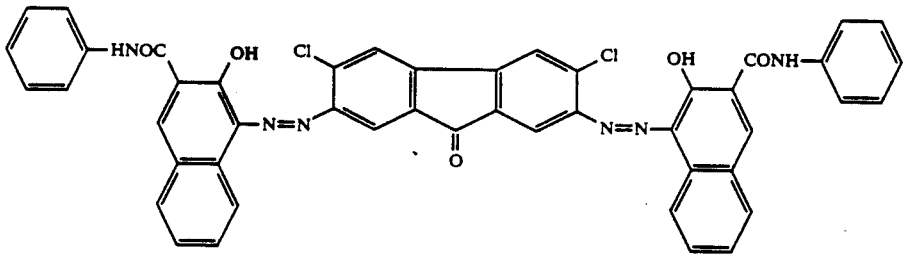

TABLE 3

| Example | Bis-azo Compound | 1st time E ½ (lux/sec) | 1st time $V_R$ (V) | 100th time E ½ (lux/sec) | 100th time $V_R$ (V) |
|---|---|---|---|---|---|
| 5 (present invention) | Illust. comp. No. I-37 | 1.4 | 0 | 1.7 | 0 |
| 6 (present invention) | Illust. comp. No. I-1 | 1.6 | 0 | 2.4 | 0 |
| 7 (present invention) | Illust. comp. No. I-39 | 1.3 | 0 | 1.8 | −5 |
| 8 (present invention) | Illust. comp. No. I-75 | 1.2 | 0 | 1.6 | −2 |
| 9 (present invention) | Illust. comp. No. I-106 | 1.8 | 0 | 2.5 | 0 |
| Comparative example | CG-2 | 2.8 | −5 | 3.2 | −12 |

As clearly indicated in the above results, the photo-receptors of the present invention have excellent sensitivity, residual potential and stability in repetition in comparison with the photo-receptor for comparison.

EXAMPLES 10 TO 12

The intermediate layer with a thickness of 0.05 μm made of a vinyl chloride-vinyl acetate-maleic anhydride copolymer "S-LEC MF-10" (manufactured by Sekisui Chemical Co., Ltd.) was provided on an eletroconductive support formed by laminating polyester film with aluminum, and in addition, 6 g of an illustrated compound No. I-147 and 2 g of the polycarbonate resin "PANLITE L-1250" were added to 110 mL of tetrahydrofuran and then dispersed with a ball mill for 12 hours. This dispersion solution was applied to the above intermediate layer to obtain a membrane thickness of 0.5 μm after drying, thus being formed into the carrier-generation layer. Further onto this layer, a solution formed by dissolving 6 g each of carrier-transport substances indicated by the below specified structural formulae (CT-6), (CT-7) and (CT-8) and 10 g of a polycarbonate resin "Z-200" (manufactured by Mitsubishi Gas Chemical Co., Ltd.) in 80 mL of 1,2-dichloroethane was applied to build up a layer with a membrane thickness of 1.5 μm, thus to form a carrier-transport layer as well as completing the photo-receptor of the present invention.

(CT-6)

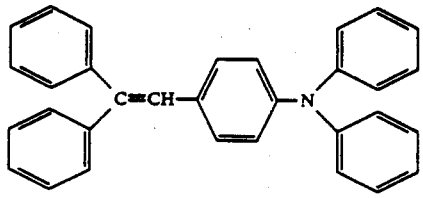

(CT-7)

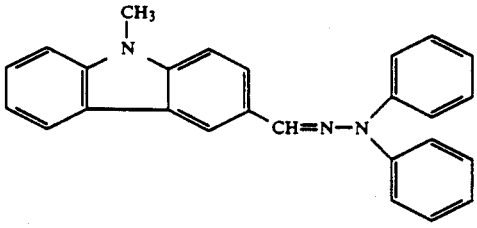

(CT-8)

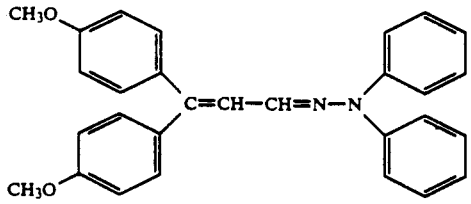

The measurements shown in Example 1 were conducted except for use of a fluorescent lamp in place of the halogen lamp as used in Example 1, resulting in the data shown in Table 4.

TABLE 4

| Example | Carrier generat. substance | Carrier generat. substance | 1st time E ½ (lux/sec) | 1st time $V_R$ (V) | 100th time E ½ (lux/sec) | 100th time $V_R$ (V) |
|---|---|---|---|---|---|---|
| 10 | Comp. I-147 | CT-6 | 1.1 | 0 | 1.3 | 0 |
| 11 | Comp. I-147 | CT-7 | 1.3 | 0 | 1.7 | 0 |
| 12 | Comp. I-147 | CT-8 | 1.2 | 0 | 1.5 | 0 |

EXAMPLE 13

The intermediate layer with a thickness of 0.05 μm made of a vinyl chloride-vinyl acetate-maleic anhydride copolymer "S-LEC MF-10" (manufactured by Sekisui Chemical Co., Ltd.) was provided onto the surface of an aluminum drum with a diameter of 60 mm and was then applied with a dispersion solution formed by mixing 2 g each of the illustrated compounds Nos. I-2, I-4, I-46, I-82 and I-154 and 2 g of a polyester resin "Vylon 200" (manufactured by Toyobo Co., Ltd.) with 110 mL of 1,2-dichloroethane for dispersion with use of a ball mill dispersion apparatus, so that the resulting layer would have a membrane thickness of 0.6 μm after drying, thus formating the carrier-generation layer.

In addition, 30 g of the below specified compound (CT-9) and 50 g of a polycarbonate resin "IUPILON S-1000" (Mitsubishi Gas Chemical Co., Ltd.) was dissolved in 400 mL of 1,2-dichloroethane, and the resulting solution was applied to the above carrier-generation layer to obtain a membrane thickness of 18 μm after drying, thus resulting in the formation of the carrier-transport layer as well as production of a drum-shape photo-receptor.

(CT-9)

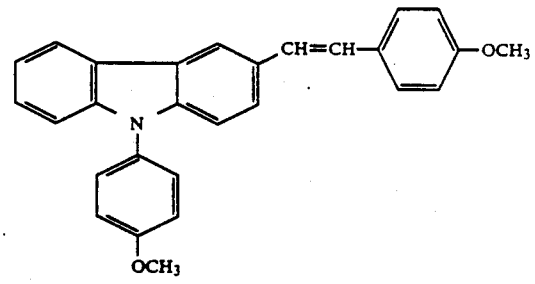

With the photo-receptor prepared by the above process mounted on a modified "U-Bix 1500 MR" electrophotographic copier (manufactured by Konica Co.), images were copied. The copied images were characterized by high contrast, high fidelity to the original photographs and great distinction as well. Image characteristics were unchanged even when the above operation was repeated 50,000 times.

COMPARATIVE EXAMPLE 3

A drum-shape photo-receptor for comparison was produced by the same process as described in Example 13 except for the replacement of the illustrated compounds in Example 13 with an azo compound represented by the below specified structural formula (CG-3), and the copied images obtained by use of the photo-receptor were evaluated in the same way as those in Example 13, resulting only in heavily fogged images. In addition, the contrast of the copied images decreased as copying was repeated, and hardly any image was copied when copying was repeated 10,000 times.

(CG-3)

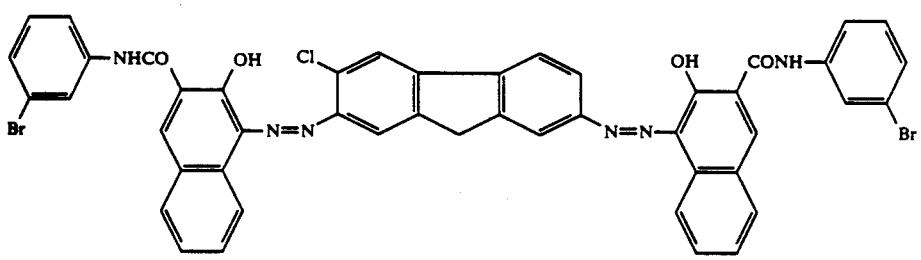

EXAMPLES 14 to 17

The intermediate layer with a thickness of 0.05 μm made of a vinyl chloride-vinyl acetate-maleic anhydride copolymer "S-LEC MF-10" (manufactured by Sekisui Chemical Co., Ltd.) was provided on an electroconductive support produced by laminating polyester film with aluminum foil, and a solution prepared by dissolving 6 g of the carrier-transport substance represented by the below specified structural formula (CT-10) and 10 g of the polycarbonate resin "PANLITE L-1250" in 80 mL of 1,2-dichloroethane was then applied to the above mentioned intermediate layer, thus leading to the formation of the carrier-transport layer.

(CT-10)

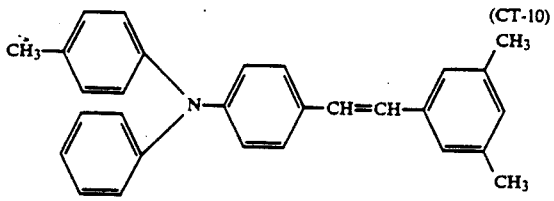

Further, 2 g each of the illustrated compounds I-211, I-215, I-223 and I-231, and 1.5 g of the carrier-transport substance and 2 g of the polycarbonate resin "PANLITE L-1250" were added to 70 mL of 1,2-dichloroethane and 30 mL of 1,1,2-trichloroethane, then being dispersed for hours with a ball mill. The resulting solution was further applied to the above mentioned carrier-transport layer to be formed into the carrier-generation layer with a membrane thickness of 4 μm, thus to prepare respective photo-receptors of the present invention.

The measurements for these photo-receptors were conducted as described in Example 1. Results are shown in Table 5.

TABLE 5

| Example | Carrier Generation Substance | 1st Time E ½ (lux sec) | 1st Time $V_R$ (V) | 100th Time E ½ (lux sec) | 100th Time $V_R$ (V) |
|---|---|---|---|---|---|
| 14 | I-211 | 1.5 | 0 | 1.7 | 0 |
| 15 | I-215 | 1.2 | 0 | 1.4 | 0 |
| 16 | I-223 | 1.7 | 0 | 2.0 | 0 |
| 17 | I-231 | 2.0 | 0 | 2.5 | 0 |

EXAMPLE 18

2 g of illustrated compound No. 219 and 2 g of polycarbonate resin "PANLITE L-1250" were added to 110 mL of 1,2-dichloroethane and were then dispersed for 12 hours with a ball mill. This dispersion solution was applied onto polyester film evaporated with aluminum for a membrane thickness of 1 μm after drying, thus being formed into the carrier-generating layer, and further onto said carrier-generation layer, a solution prepared by dissolving 6 g of a carrier-transport substance expressed by the below specified structural structure (CT-11) and 10 g of the polycarbonate resin "PANLITE L-1250" in 110 mL of 1,2-dichloroethane was applied for a membrane thickness of m after drying. The membrane is thus formed into the carrier-transporting layer as well as being the photo-receptor for electrophotography in the present invention.

(CT-11)

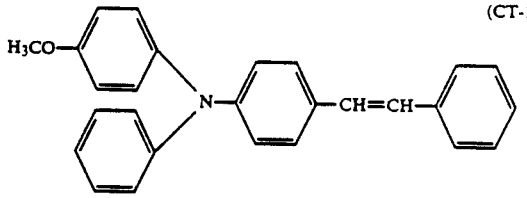

For the above mentioned photo-receptor, the measurement was carried out by the same method as in Example 1, the results thereof were shown in Table 6.

COMPARATIVE EXAMPLE 4

A photo-receptor for comparison was produced by the same process as in Example 18 except that the below specified bis-azo compound was used as the carrier-generation substance.

(CG-4)

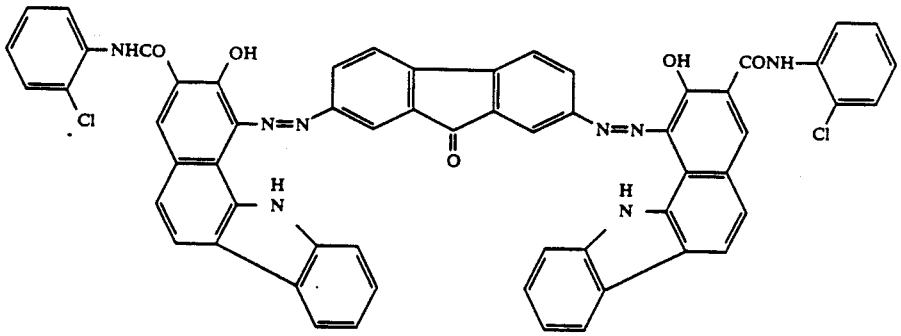

The measurements shown in Example 1 were carried out for the above mentioned photo-receptor for comparison, and the results are shown in Table 6.

TABLE 6

| | Example 18 1st Time | Example 18 100th Time | Comparative Example 4 1st Time | Comparative Example 4 100th Time |
|---|---|---|---|---|
| E ½ (lux sec) | 2.2 | 2.5 | 6.4 | 8.2 |
| $V_R$ (V) | 0 | 0 | −20 | −60 |

EXAMPLES 19 to 21

Using the illusrated compounds Nos. K-213, K-217 and K-221 as the carrier-generation substances and also using the respective compounds represented by the below specified structural formulae as the carrier-transport substances, the remaining steps were followed in the same way as in Example 18, resulting in the formation of the photoreceptors of the present invention, for which the same measurements were performed. The results of these measurements are shown in Table 7.

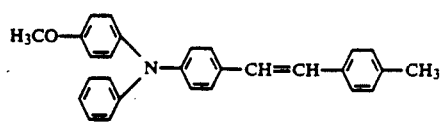
(CT-12)

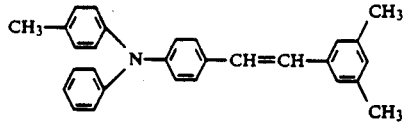
(CT-13)

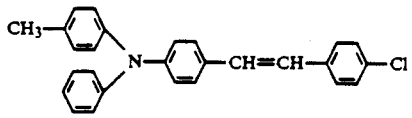
(CT-14)

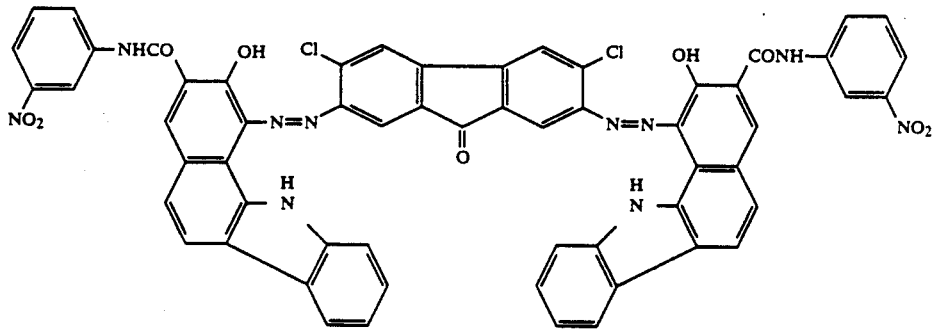
(CG-5)

TABLE 7

| Example | Bis-azo Compound | 1st time $E_{\frac{1}{2}}$ (lux/sec) | 1st time $V_R$ (V) | 100th time $E_{\frac{1}{2}}$ (lux/sec) | 100th time $V_R$ (V) |
|---|---|---|---|---|---|
| 19 | 213 | 1.5 | 0 | 1.7 | 0 |
| 20 | 217 | 1.1 | 0 | 1.3 | 0 |
| 21 | 221 | 2.0 | 0 | 2.3 | 0 |

EXAMPLE 22

The intermediate layer with a thickness of 1.05 μm made of a vinyl chloride-vinyl acetate-maleic anhydride copolymer "S-LEC MF-10" (manufactured by Sekisui Chemical Co., Ltd.) was provided on the surface of an aluminum drum with a diameter of 100 mm. Further, a dispersion solution was prepared by mixing 4 g of the illustrated compound No. I-220 with 400 mL of 1,2-dichloroethane and then dispersing the mixture for 24 hours with a ball mill dispersion apparatus. Then, the above dispersion solution was applied to the above intermediate layer for a membrane thickness of 0.6 μm after drying, to form the carrier-generation layer.

Still further, a solution formed by dissolving 30 g of a compound represented by the already described structural formula (K-9) and 50 g of a polycarbonate resin "IUPILON S-1000" (Mitsubishi Gas Chemical Co.) in 400 mL of 1,2 dichloroethane was applied to the above described carrier-generation layer for a membrane thickness of 13 μm after drying, and resulting in production of the carrier-transport layer, to prepare a drum-shape photo-receptor.

The photo-receptor thus created was mounted on a remodelled "LP-3010" electrophotographic printer (manufactured by Konica), resulting in high contrast, high fidelity to the original photographs and high-resolution copies. These phenomena were unchanged even when the operation was repeated 10,000 times.

COMPARATIVE EXAMPLE 5

A drum-shape photo-receptor was produced by the same process as in Example 22 except using a bis-azo compound expressed by the below specified structural structure instead of the carrier-generation substance in Example 22, and the copied images for said photo-receptor for comparison were evaluated by the same method as in Example 22, resulting in heavily-fogged images. As photographs were being copied repeatedly, in addition, the contrast of the copied images was increased, and no copied image was obtainable after 2,000 copies.

As clearly understandable from the results of the above mentioned Examples and Comparative Examples, the photo-receptors of the present invention have superior stability, sensitivity, and durability in combination with a wide variety of carrier-transport substances than the photo-receptors used for comparison.

EXAMPLE 23

An intermediate 0.05 μm layer made of vinyl chloride-vinyl acetate-maleic anhydride copolymer "S-LEC MF-10" (manufactured by Sekisui Chemical Co.) was distributed onto an electroconductive support composed of polyester film laminated with aluminum foil. Then 2 g of the illustrated compound No. II-7 and 2 g of polycarbonate resin "PANLITE L-1250" (manufactured by Teijin Chemicals Ltd.) were added to 110 mL of 1,2-dichloroethane and dispersed with a ball mill for 12 hours. This dispersion solution was applied to the above mentioned intermediate layer to build up a dry membrane thickness of 0.5 μm thus forming a carrier-generation layer. Further, 6 g of a compound of the below specified structural formula (K-1) as a carrier-transport substance and 10 g of a polycarbonate resin "PANLITE L-1250" were dissolved in 80 mL of 1,2-dichloroethane, and the resulting solution was applied to the above mentioned carrier-generation layer to build up a membrane thickness of 15 μm after drying for formation of a carrier-transport layer, resulting in a photo-receptor of the present invention.

(K-1)

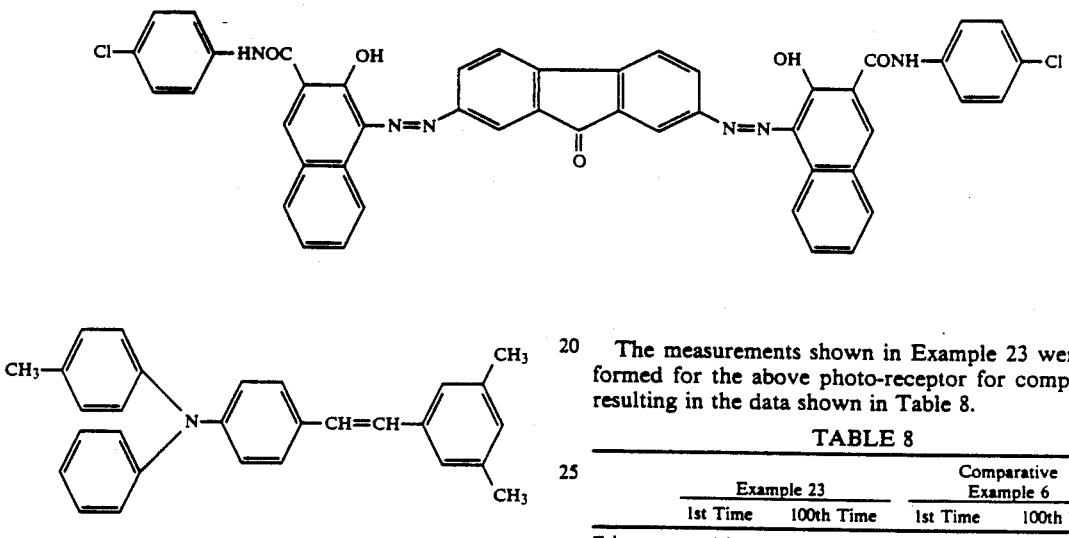

The photo-receptor prepared by the above process was analyzed to evaluate its properties using an SP-428 model electrostatic paper analyzer manufactured by Kawaguchi Electric Works Co. After charging for 5 sec with a charged voltage of −6 kV, the above photo-receptor was left dark for 5 sec and was then exposed 35 lux hologen light on the surface of the pohoto-receptor, thus leading to the measurement of E ½, an amount of exposure that is necessary to allow the surface potential to decay to a half (half-life exposure). Another measurement was $V_R$, the surface potential after exposure to 30 lux sec (residual potential). The same measurements were further repeated 100 times. Results are shown in Table 8.

COMPARATIVE EXAMPLE 6

A photo-receptor for comparison was produced by the same process as in Example 23 except that the following bis-azo compound (G-1) was used as a carrier-generation substance.

(G-1)

The measurements shown in Example 23 were performed for the above photo-receptor for comparison, resulting in the data shown in Table 8.

TABLE 8

| | Example 23 | | Comparative Example 6 | |
|---|---|---|---|---|
| | 1st Time | 100th Time | 1st Time | 100th Time |
| E ½ (lux sec) | 1.0 | 1.3 | 1.4 | 2.7 |
| $V_R$ (V) | 0 | 0 | 0 | −26 |

As shown in the above results, the photo-receptor of the present invention has superior sensitivity, residual potential and stability in repetition than the photo-receptor used for comparison.

EXAMPLES 24 to 26

The illustrated compounds II-17, II-86 and II-297, respectively, were used as carrier-generation substances, and the following compounds were used as carrier-transport substances. Other steps were performed as shown in Example 23 to form the photo-receptors of the present invention. The same measurements as Example 23 were carried out for the above photo-receptors, resulting in the data as shown in Table 9.

(K-2)

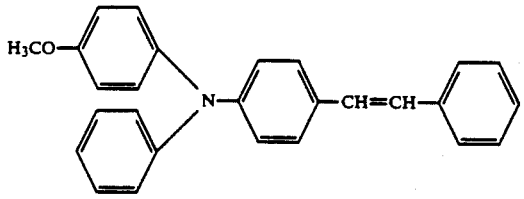

(K-3)

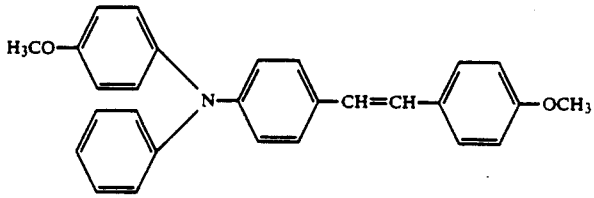

-continued (K-4)

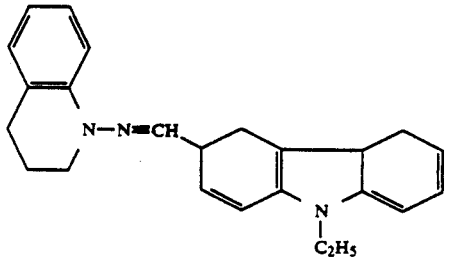

TABLE 9

| Example | Bis-azo Compound | 1st time E½ (lux/sec) | 1st time $V_R$ (V) | 100th time E½ (lux/sec) | 100th time $V_R$ (V) |
|---|---|---|---|---|---|
| 24 | II-17 | 1.4 | 0 | 1.8 | 0 |
| 25 | II-86 | 1.5 | 0 | 1.7 | 0 |
| 26 | II-297 | 1.2 | 0 | 1.8 | 0 |

The above results indicate that photoreceptors for electrophotography using the bis-azo compounds of the present invention as the carrier-generation substances possess high sensitivity, low residual potential and excellent properties in repetition, same as in the case of Example 23.

EXAMPLES 27 to 36

The intermediate layer used in Example 23 was provided on polyester film evaporated with aluminum. Then, 2 g each of the illustrated compounds II-1, II-31, II-81, II-97, II-112, II-192, II-274, II-307, II-476 and II-602 and 2 g of a polycarbonate resin "PANLITE L-1250" were added to 110 mL of 1,2-dichloroethane to be dispersed with a sand grinder for 8 hours. This dispersion solution was applied to the intermediate layer described above to build up a membrane thickness of 0.5 μm after drying to form a carrier-generation layer. In addition to this layer, a mixed solution of 6 g of the structural formula specified below (K-5) compound as a carrier-transport substance and 10 g of a polycarbonate resin "PANLITE K-1300" (manufactured by Teijin Chemicals Ltd.) with 80 mL of 1,2-dichloroethane was applied to build up a membrane thickness of 15 μm after drying for formation of a carrier-transportion layer, thus resulting in the creation of the photo-receptors 27 to 36 of the present invention, respectively.

(K-5)

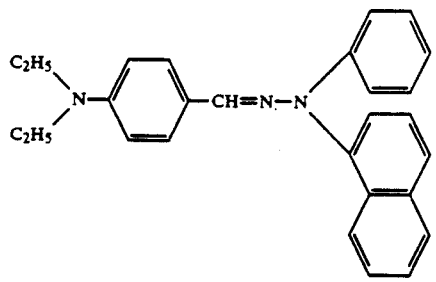

The measurements shown in Example 23 were conducted for the photo-receptors described above, resulting in the data exhibited in Table 10.

COMPARATIVE EXAMPLE 7

A photo-receptor for electrophotography was produced by the same process as in Example 27 except for use of a bis-azo pigment represented by the below specified structural formula (G-2) as a carrier-generation substance. The measurements described in Example 23 was performed for the above photo-receptor, and the results shown in Table 10 were obtained.

(G-2)

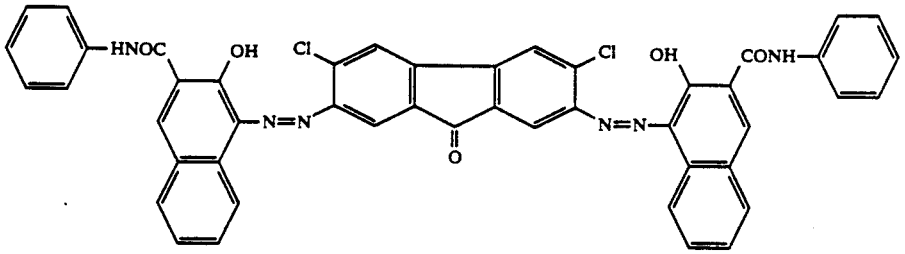

TABLE 10

| Example | Bis-azo Compound | 1st time E½ (lux/sec) | 1st time $V_R$ (V) | 100th time E½ (lux/sec) | 100th time $V_R$ (V) |
|---|---|---|---|---|---|
| 27 (present invention) | II-1 | 1.5 | 0 | 1.8 | −2 |
| 28 (present invention) | II-31 | 1.4 | 0 | 1.8 | 0 |
| 29 (present invention) | II-81 | 1.7 | 0 | 2.0 | 0 |
| 30 (present invention) | II-97 | 1.6 | 0 | 2.0 | −5 |
| 31 (present invention) | II-112 | 1.3 | 0 | 1.9 | 0 |
| 32 (present invention) | II-192 | 1.3 | 0 | 1.5 | −2 |
| 33 (present invention) | II-274 | 1.2 | 0 | 1.5 | 0 |
| 34 (present | II-307 | 1.8 | 0 | 2.2 | −2 |

TABLE 10-continued

| Example | Bis-azo Compound | 1st time E ½ (lux/sec) | 1st time $V_R$ (V) | 100th time E ½ (lux/sec) | 100th time $V_R$ (V) |
|---|---|---|---|---|---|
| invention) | | | | | |
| 35 (present invention) | II-476 | 1.5 | 0 | 1.9 | 0 |
| 36 (present invention) | II-602 | 1.4 | 0 | 1.7 | 0 |
| Comparative Example 7 | G-2 | 2.8 | −5 | 3.2 | −12 |

As shown in the above results, the photo-receptors of the present invention have superior sensitivity, residual potential and stability in repetition than the photo-receptor for comparison.

EXAMPLES 37 TO 39

An intermediate layer with a thickness of 0.05 μm made of vinyl chloride-vinyl acetate-maleic anhydride copolymer "S-LEC MF-10" (manufactured by Sekisui Chemical Co.) was provided on polyester film laminated with aluminum foil. 2 g of the illustrated compound No. II-548 and 2 g of polycarbonate resin "PANLITE L-1250" were added to 110 mL of tetrahydrofuran to be dispersed with a ball mill for 12 hours. This dispersion solution was then applied to the intermediate layer described above to build up a dry membrane thickness of 0.5 μm for formation of a carrier-generation layer. In addition, a mixed solution of 6 g each of compounds represented by the below specified structural formulae (K-6), (K-7) and (K-8) as carrier-transport substances and 10 g of a polycarbonate resin "Z-200" (manufactured by Mitsubishi Gas Chemical Co.) with 80 mL of 1,2-dichloroethane was further applied to the above mentioned carrier-generation layer to build up a dry membrane thickness of 15 μm to form a carrier-transport layer, thus resulting in completion of the photo-receptors for the present invention.

(K-6)

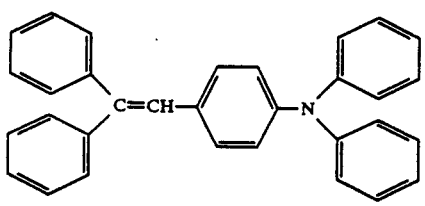

(K-7)

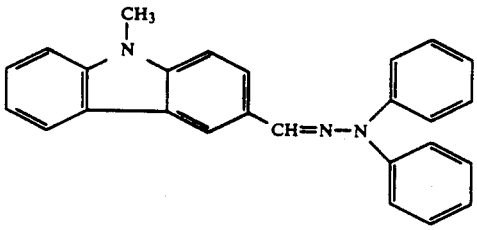

(K-8)

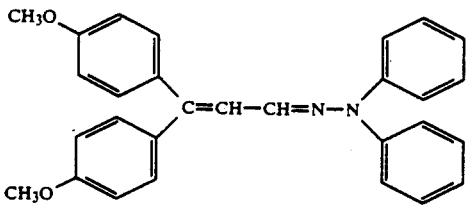

The measurements shown in Example 23 were conducted using a fluorescent lamp in place of the halogen lamp as used in Example 23, resulting in the data in Table 11.

TABLE 11

| Example | Carrier generat. substance | Carrier transport substance | 1st time E ½ (lux/sec) | 1st time $V_R$ (V) | 100th time E ½ (lux/sec) | 100th time $V_R$ (V) |
|---|---|---|---|---|---|---|
| 37 | II-548 | K-6 | 1.2 | 0 | 1.4 | 0 |
| 38 | II-548 | K-7 | 1.6 | 0 | 1.9 | 0 |
| 39 | II-548 | K-8 | 1.5 | 0 | 2.1 | 0 |

EXAMPLES 40 TO 45

An intermediate layer with a thickness of 0.05 μm made of a vinyl chloride-vinyl acetate-maleic anhydride copolymer "S-LEC MF-10" (manufactured by Sekisui Chemical Co.) was distributed on the surface of an aluminum drum with a diameter of 60 mm. In addition, 2 g each of the illustrated compounds Nos. II-96, II-301, II-659, II-668, II-675 and II-680 and 2 g of a polyester resin "VYLON 200" (manufactured by TOYOBO Co., Ltd.) were mixed with 110 mL of 1,2-dichloroethane to be dispersed with a ball mill dispersion apparatus for 24 hours. This dispersion solution was then applied to the intermediate layer described above to build up a membrane thickness of 0.6 μm for formation of the respective carrier-generation layers.

In addition, 30 g of the below specified compound (K-9) and 50 g of a polycarbonate resin "IUPILON S-1000" (manufactured by Mitsubishi Gas Chemical Co.) were dissolved in 400 mL of 1,2-dichloroethane, and the resulting solution was applied to the respective carrier-generation layers described above to form the respective carrier-transport layers, thus allowing the drum-shape photoreceptors 40 to 45 to be prepared respectively.

(K-9)

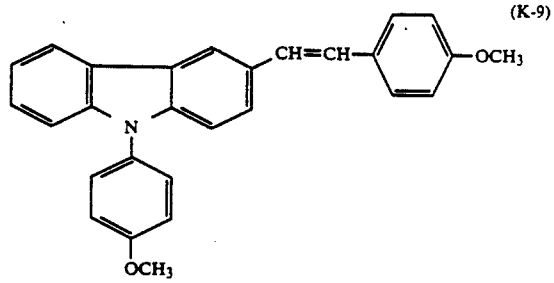

The photo-receptors prepared as described above were mounted on a modified "U-Bix 1550 MR" electrophotographic copier (manufactured by Konica) to copy pictures, creating the copies that exhibited high contrast, good reproducibility of the orignal picture, and excellent visibility in all the cases of the above photo-receptors. This performance, in addition, showed no change even when copying was repeated 50,000 times.

COMPARATIVE EXAMPLE 8

A Drum-shape photo-receptor for comparison was prepared by the same process as in Examples 40 to 45 except replacing one of the illustrated compounds in Examples 40 to 45 with a bis-azo compound represented by the below specified structural formula, and the copied picture was evaluated by the same method as that used in Examples 40 to 45, resulting in only those copies having much fog. When the picture was repeatedly copied, the contrast of the copied picture was deteriorated, and 5,000 copy repetitions resulted in almost no formation of the copied picture.

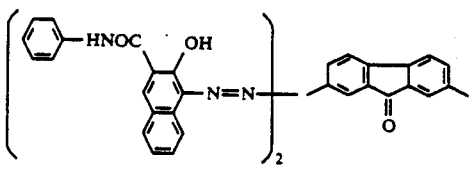

(G-3)

EXAMPLE 46

An intermediate layer with a thickness of 0.05 μm made of a vinyl chloride-vinyl acetate-maleic anhydride copolymer "S-LEC MF-10" (manufactured by Sekisui Chemical Co.) was distributed on an electroconductive support composed of polyester film laminated with aluminum foil, and a mixed solution of 6 g of a compound of the below specified structural formula (K-10) as a carrier-transport substance and 10 g of a polycarbonate resin "PANLITE L-1250" with 80 mL of 1,2-dichloroethane was applied to the intermediate layer described above to build up a dry membrane thickness of 15 μm for formation of a carrier-transport layer.

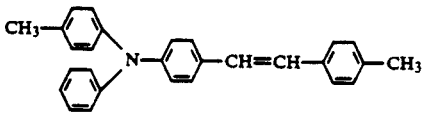

(K-10)

Furthermore, 2 g each of illustrated compounds II-203, II-227, II-441, II-665 and II-673, 1.5 g of the carrier-transport substance described above and 2 g of a polycarbonate resin "PANLITE L-1250" were added to 70 mL of 1,2-dichloroethane and 30 mL of 1,2-trichloroethane for dispersal with a ball mill for 24 hours, and each resulting dispersion solution was applied to the above mentioned carrier-transport layer to build up a dry membrane thickness of 4 μm for formation of a carrier-generation layer, thus resulting in creation of the photo-receptors 46 to 50, respectively.

The measurements were carried out by the same method as that in Example 23 for the above respective photo-receptors, and the data shown in Table 12 was obtained.

TABLE 12

| Example | Carrier generation substance | 1st time E ½ (lux/sec) | 1st time $V_R$ (V) | 100th time E ½ (lux/sec) | 100th time $V_R$ (V) |
|---|---|---|---|---|---|
| 46 | II-203 | 1.1 | 0 | 1.5 | 0 |
| 47 | II-227 | 1.3 | 0 | 1.6 | 0 |
| 48 | II-441 | 1.5 | 0 | 1.9 | 0 |
| 49 | II-665 | 1.2 | 0 | 1.7 | 0 |
| 50 | II-673 | 1.8 | 0 | 2.0 | 0 |

As apparent from the results in the above mentioned Examples and Comparative Examples, the photo-receptors of the present invention have superior stability, durability, ability to combine with a wide variety of carrier-transport substances, than the photo-receptors used for comparison.

EXAMPLE 51

An intermediate layer with a thickness of 0.05 μm made of a vinyl chloride-vinyl acetate-maleic anhydride copolymer "S-LEC MF-10" (manufactured by Sekisui Chemical Co.) was provided on an electroconductive support composed of polyester film laminated with aluminum foil. In addition, 2 g of the illustrated compound No. III-8 and 2g of polycarbonate resin "PANLITE L-1250" (manufactured by Teijin Chemicals Ltd.) were added to 110 mL of 1,2-dichloroethane for dispersal in with a ball mill for 12 hours. This dispersion solution was applied to the above mentioned intermediate layer to build up a dry membrane thickness of 0.5 μm for formation of a carrier-generation layer. In addition, a mixed solution of 6 g of a compound expressed by the below specified structural formula (K-1) as a carrier-transport substance and 10 g of a polycarbonate resin "PANLITE L-1250" with 80 mL of 1,2-dichloroethane was applied to the carrier-generation layer described above to build up a dry membrane thickness of 15 μm for formation of a carrier-transport layer, thus resulting in the production of a photo-receptor of the present invention.

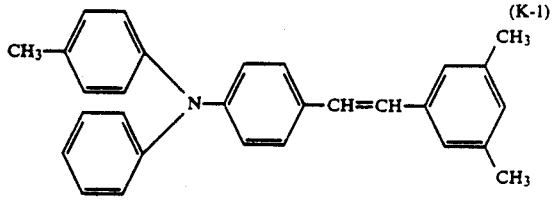

(K-1)

The photo-receptor fabricated by the process described above was analyzed for the following evaluation of properties using an SP-428 model electrostatic paper analyzer manufactured by Kawaguchi Electric Works Co. The photo-receptor was charged for 5 sec with a charged voltage of −6 kV and was then left dark for 5 sec, followed by exposure to the light of a halogen lamp so that the intensity of illumination would become 35 lux on the surface of the photo-receptor, then leading to the measurement of E ½, an amount of exposure that was necessary to allow the surface potential to decay to a half (half-life exposure). Another measurement was made for $V_R$, a surface potential after exposure with an exposure amount of 30 lux sec (residual potential). The same measurements were repeated 100 times. The results are exhibited in Table 13.

COMPARATIVE EXAMPLE 9

A photo-receptor for comparison was produced using the process described in Example 51 except that the bis-azo compound (G-1) described below was used as a carrier-generation substance.

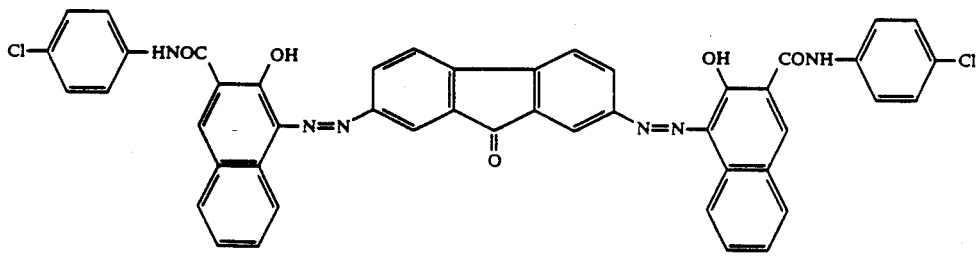

(G-1)

The measurements described in Example 51 were performed for the above photo-receptor for comparison, resulting in the data in Table 13.

TABLE 13

| | Example 51 | | Comparative Example 9 | |
|---|---|---|---|---|
| | 1st time | 100th time | 1st time | 100th time |
| $E\frac{1}{2}$ (lux/sec) | 0.9 | 1.1 | 1.4 | 2.7 |
| $V_R$ (V) | 0 | 0 | 0 | −26 |

As can be clearly seen from the above results, the photo-receptor of the present invention has superior sensitivity, residual potential and stability in repetition.

EXAMPLES 52 TO 53

The illustrated compounds III-6, and III-60, respectively, were used as carrier-generation substances, and the following respective compounds were used as carrier-transport substances. The rest of the process was conducted as described in Example 51 to create the photoreceptors of the present invention, which were evaluated as described in case of Example 51 to obtain the data appearing in Table 14.

TABLE 14

| Example | Bis-azo Compound | 1st time $E\frac{1}{2}$ (lux/sec) | 1st time $V_R$ (V) | 100th time $E\frac{1}{2}$ (lux/sec) | 100th time $V_R$ (V) |
|---|---|---|---|---|---|
| 52 | III-6 | 1.2 | 0 | 1.4 | 0 |
| 53 | III-60 | 1.1 | 0 | 1.4 | 0 |

The results described above indicate that the receptors for electrophotographs using the bis-azo compounds of the present invention have such attributes as high sensitivity, low residual potential and excellent properties in repetition.

EXAMPLES 54 TO 63

The intermediate layer used in Example 51 was firstly distributed on polyester film evaporated with aluminum. Then, 2 g each of the illustrated compounds III-88, III-107, III-197, III-207, III-212, III-313, III-332, III-350, III-443 and III-449 and 2 g of a polycarbonate resin "PANLITE L-1250" were added to 110 mL of 1,2-dichloroethane and dispersed with a sand grinder for 8 hours. This dispersion solution was applied to the above mentioned intermediate layer to form a carrier-generation layer with a dry membrane thickness of 0.5

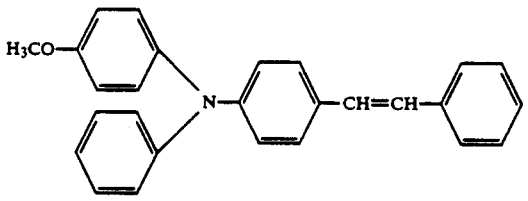

(K-2)

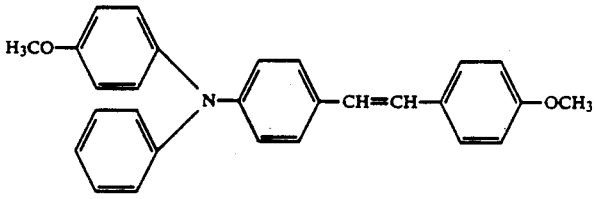

(K-3)

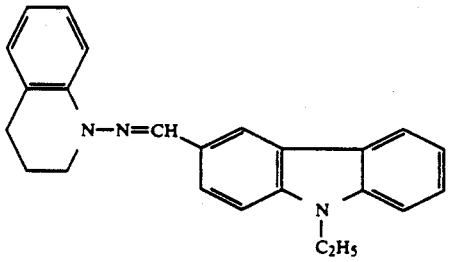

(K-4)

μm. Further, a solution was prepared by mixing 6 g of a compound expressed by the below structural formula (K-5) as a carrier-transport substance and 10 g of a polycarbonate resin "PANLITE K-1300" (Teijin Chemicals Ltd.) with 80 mL of 1,2-dichloroethane. This was applied to the above carrier-generation layer to form a carrier-transport layer with a dry membrane thickness of 15 μm, thus resulting in formation of photoreceptors 54 to 63 of the present invention.

(K-5)

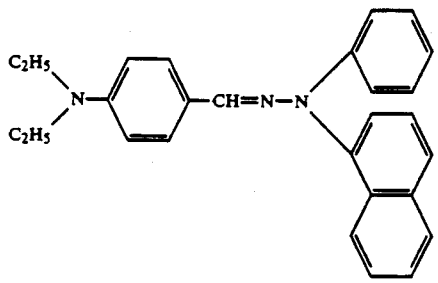

The measurements described in Example 51 were performed for the photo-receptor described above, resulting in the data shown in Table 15.

COMPARATIVE EXAMPLE

Except for use of a bis-azo pigment specified by the below structural formula (G-2) as a carrier-generation substance, the process shown in Example 5 was applied to form a photo-receptor for electrophotograph. This photo-receptor for comparison was measured as described in Example 51, resulting in the data shown in Table 15.

(G-2)

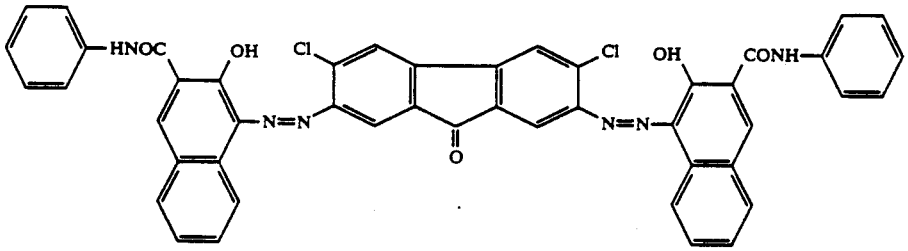

TABLE 15

| Example | Bis-azo Compound | 1st time E½ (lux/sec) | 1st time $V_R$ (V) | 100th time E½ (lux/sec) | 100th time $V_R$ (V) |
|---|---|---|---|---|---|
| 54 (present invention) | III-88 | 1.4 | 0 | 1.8 | 0 |
| 55 (present invention) | III-107 | 1.8 | 0 | 2.2 | −2 |
| 56 (present invention) | III-197 | 1.5 | 0 | 1.8 | −2 |
| 57 (present invention) | III-207 | 1.7 | 0 | 2.0 | 0 |
| 58 (present invention) | III-212 | 1.3 | 0 | 1.5 | −2 |
| 59 (present invention) | III-313 | 1.4 | 0 | 1.7 | 0 |
| 60 (present invention) | III-332 | 1.2 | 0 | 1.5 | 0 |
| 61 (present invention) | III-350 | 1.5 | 0 | 1.9 | 0 |
| 62 (present invention) | III-443 | 1.6 | 0 | 2.0 | −5 |
| 63 (present invention) | III-449 | 1.3 | 0 | 1.8 | 0 |

TABLE 15-continued

| Example | Bis-azo Compound | 1st time E½ (lux/sec) | 1st time $V_R$ (V) | 100th time E½ (lux/sec) | 100th time $V_R$ (V) |
|---|---|---|---|---|---|
| Comparative Example 14 | G-2 | 2.8 | −5 | 3.2 | −12 |

As the above results clearly show, the photoreceptors of the present invention have superior sensitivity, residual potential and stability in repetition to the photoreceptors for comparison.

EXAMPLES 64 TO 66

An intermediate layer with a thickness of 0.05 μm made of a vinyl chloride-vinyl acetate-maleic anhydride copolymer "S-LEC FM-10" (manufactured by Sekisui Chemical Co.) was provided an electroconductive support composed of polyester film laminated with aluminum foil. Further, 2 g of the illustrated compound No. III-286 and a polycarbonate resin "PANLITE L-1250" were added to 110 mL of tetrahydrofuran to be dispersed with a ball mill for 12 hours. This dispersion solution was then applied to the above intermediate layer to build up a membrane thickness of 0.5 μm after drying for formation of a carrier-generation substance. Still further, 6 g each of the respective compounds expressed by the below specified structural formulae (K-6), (K-7) and (K-8) as carrier-transport substances and 10 g of a polycarbonate resin "Z-200" (manufactured by Mitsubishi Gas Chemical Co.) were dissolved in 80 mL of 1,2-dichloroethane, and the resulting solution was applied to the carrier-generation substance described above to form a carrier-transport layer, thus leading, to prepare photo-receptors for the present invention.

(K-6)

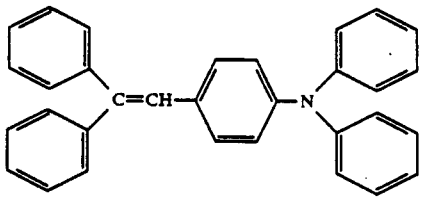

(K-7)

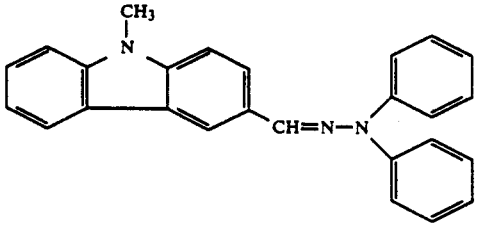

-continued

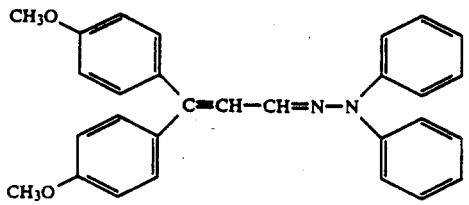

(K-8)

For the photo-receptors described above, the measurements shown in Example 51 were conducted except that a fluoresent lamp was used instead of the halogen lamp in Example 51, resulting in the data exhibited in Table 16.

TABLE 16

| Example | Carrier generat. substance | Carrier transport substance | 1st time E½ (lux/sec) | 1st time $V_R$ (V) | 100th time E½ (lux/sec) | 100th time $V_R$ (V) |
|---|---|---|---|---|---|---|
| 64 | III-286 | K-6 | 1.1 | 0 | 1.3 | 0 |
| 65 | III-286 | K-7 | 1.4 | 0 | 1.8 | 0 |
| 66 | III-286 | K-8 | 1.6 | 0 | 2.0 | 0 |

EXAMPLE 67

An intermediate layer with a thickness of 0.05 μm made of a vinyl chloride-vinyl acetate-maleic anhydride copolymer "S-LEC MF-10" (manufactured by Sekisui Chemical Co.) was distributed on the surface of an aluminum drum having a diameter of 60 mm. A disperson solution was then prepared by mixing 2 g of the illustrated compound No. IV-223 and 2 g of a polyester resin "VYLON 200" (manufactured by TOYOBO Co.) with 110 mL of 1,2-dichloroethane and allowing the mixture to be dispersed with a ball mill dispersion apparatus for 24 hours. The dispersion solution was applied to the intermediate layer desribed above to form a carrier-generation layer with a dry membrane thickness of 0.6 μm.

Furthermore, a mixed solution of 30 g of the following specified compound (K-9) and 50 g of a polycarbonate resin "IUPILON S-1000" (Mitsubishi Gas Chemical Co.) with 400 mL of 1,2-dichloroethane was applied to the carrier-generation layer described above to form a carrier-tranport layer with a dry membrane thickness of 18 μm thus resulting in the formation of a drum-shape photo-receptor.

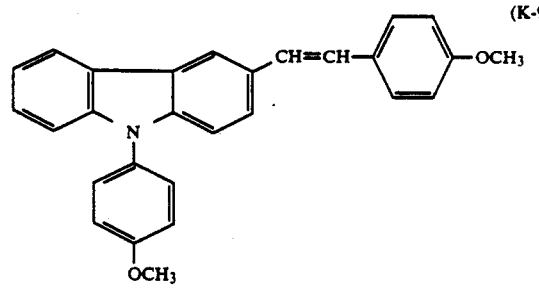

(K-9)

The photo-receptor formed as described above was mounted on a modified "U-Bix 1550 MR" electrophotographic copier (manufactured by Konica) to copy images. The copied images had high contrast and good reproducibility of the original picture and visibility as well. There was no change in this performance even when copying was repeated 50,000 times.

COMPARATIVE EXAMPLE 15

A drum-shape photo-receptor for comparison was prepared by the same process as described in Example 67 except that the illustrated compound described in Example 67 was replaced with an azo compound represented by the below specified structural formula (G-3), and the copied pictures were evaluated by the same method as that in Example 67, resulting in only those having much fog. As copying was repeated, in addition, the contrast of the copied pictures deteriorated, leading to little reproduction of the original picture after 5,000 copies.

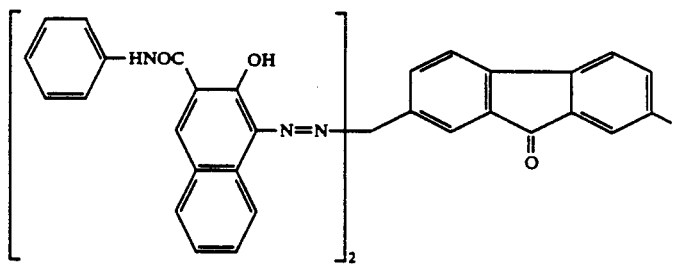

(G-3)

EXAMPLE 68

An intermediate 0.05 μm layer made of a vinyl chloride-vinyl acetate-maleic anhydride copolymer "S-LEC MF-10" (manufactured by Sekisui Chemical Co.) was distributed on an electroconductive support composed of polyester film laminated with aluminum foil. Then, 6 g of a compound expressed by the below structural formula (K-10) as a carrier-transporting substance and 10 g of a polycarbonate resin "PANLITE L-1250" were dissolved in 80 mL of 1,2-dichloroethane, and the resulting solution was applied to the intermediate layer described above to build up a dry membrane thickness of 15 μm, thus forming a carrier-transport layer.

(K-10)

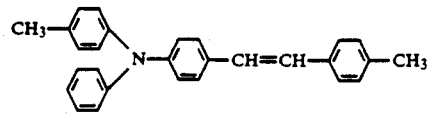

Furthermore, 2 g of the illustrated compound No. III-21, 1.5 g of the above mentioned carrier-transport substance 2 g of a polycarbonate resin "PANLITE L-1250" were added to 70 mL of 1,2-dichloroethane and 30 mL of 1,2-trichloroethane and were dispersed with a ball mill for 24 hours. This dispersion solution was then applied to the above mentioned carrier-transport layer to build a carrier-generation layer with a dry membrane thickness of 4 μm leading to the completion of a photo-receptor.

The measurements were performed for this photo-receptor as described in Example 51, resulting in the data revealed in Table 17.

TABLE 17

| | 1st time | 100th time |
|---|---|---|
| E ½ (lux/sec) | 1.1 | 1.4 |
| $V_R$ (V) | 0 | 0 |

As clarified by the results of the above mentioned carrier-transport layer, thus resulting in the production of the photo-receptor of the present invention.

(K-1)

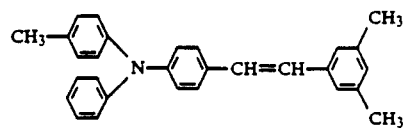

The photo-receptor obtained as described above was analyzed for the following evaluation of properties by use of an EPA-8100 model electrostatic paper analyzer. After charging for 5 sec with a charged voltage of −6 kV, the photo-receptor was left dark for 5 sec and was exposed a hologen lamp at 35 lux sec on the surface of the photo-receptor, thus leading to the measurement of E ½, an amount of exposure that was necessary to allow the surface potential to decay to a half (half-life exposure). Another measurement was $V_R$, a surface potential after exposure with an amount of 30 lux sec (residual potential). The same measurements were repeated 100 times. Results are as indicated in Table 18.

COMPARATIVE EXAMPLE 16

A photo-receptor for comparison was formed by the same process as in Example 69 except using the below specified bis-azo compound (G-1) as carrier-generation substance.

(G-1)

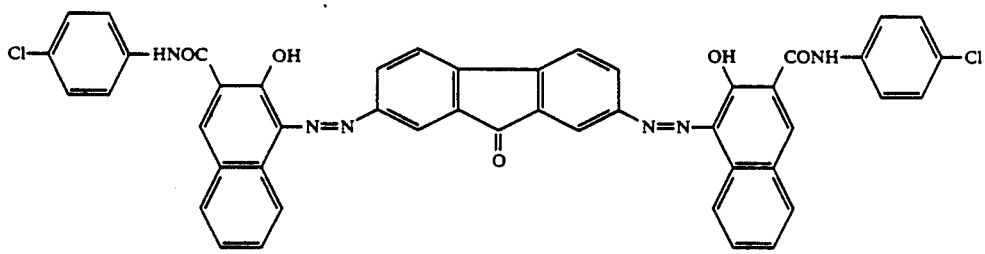

Examples and Comparative Examples, the photo-receptors of the present invention have superior stability, sensivity, durability, and ability to combine with a wide variety of carrier-transporting substances, than the photo-receptors used for comparison.

EXAMPLE 69

An intermediate 0.05 μm layer made of a vinyl chloride-vinyl acetate-maleic anhydride copolymer "S-LEC MF-10" (manufactured by Sekisui Chemical Co.) was distributed on an electroconductive support composed of polyester film laminated with aluminum foil, and 2 g of the illustrated compound expressed by General formula [A] and 2 g of a polycarbonate resin "PANLITE L-1250" (Teijin Chemicals Ltd.) were then added to 110 mL of 1,2-dichloroethane and dispersed with a ball mill for 12 hours. This dispersion solution was further applied to the above intermediate layer to build up a dry membrane thickness of 0.5 μm, to form a carrier-generation layer. In addition, a mixed solution of 6 g of the following structural formula (K-1) compound as a carrier-transport substance and 10 g of a polycarbonate resin "PANLITE L-1250" with 80 mL of 1,2-dichloroethane was applied to the above carrier-generation layer to build up a 0.5 μm dry membrane thickness to form of a The measurements described in Example 69 were performed for the above photo-receptor for comparison, resulting in the data shown in Table 18.

TABLE 18

| | Example 69 | | Comparative Example 16 | |
|---|---|---|---|---|
| | 1st time | 100th time | 1st time | 100th time |
| E ½ (lux/sec) | 1.2 | 1.5 | 1.5 | 2.3 |
| $V_R$ (V) | 0 | 0 | 0 | 0 |

As clearly seen in the above results, the photo-receptor of the present invention has superior sensitivity, residual potential and stability in repetition than the photo-receptor for comparison.

EXAMPLES 70 TO 72

The photo-receptors of the present invention were produced by the process described in Example 69 by use of IV-1 expressed by General formula [IV-A], IV-78 expressed by General formula [IV-B] and IV-584 expressed by General formula [IV-C], as carrier-generation substances and using the following compounds as carrier-transport substances, the rest of the process being same as in Example 69, and the same measurements as in Example 69 were performed, resulting in the data shown in Table 19.

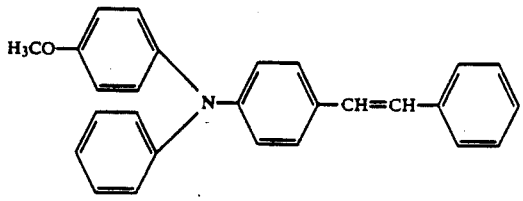

(K-2)

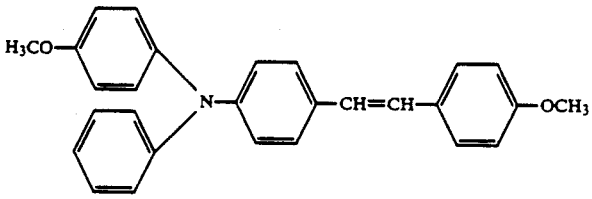

(K-3)

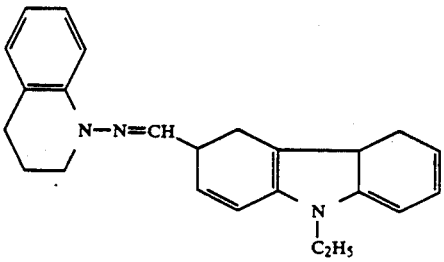

(K-4)

TABLE 19

| Example | Carrier generat. substance | Carrier transport substance | 1st time $E\frac{1}{2}$ (lux/sec) | 1st time $V_R$ (V) | 100th time $E\frac{1}{2}$ (lux/sec) | 100th time $V_R$ (V) |
|---|---|---|---|---|---|---|
| 70 | IV-1 | K-2 | 1.3 | 0 | 1.6 | 0 |
| 71 | IV-78 | K-3 | 1.4 | 0 | 1.7 | 0 |
| 72 | IV-584 | K-4 | 1.2 | 0 | 1.5 | 0 |

The above results indicate that the photo-receptors for electrophotograph using the bis-azo compounds of the present invention as carrier-generation substances are characterized by high sensitivity, low residual potential and excellent properties in repetition.

EXAMPLES 73 TO 77

The intermediate layer used in Example 69 was provided on polyester film evaporated with aluminum, and 2 g each of the illustrated compound IV-9 expressed by General formula [IV-A], the illustrated compound IV-169 expressed by General formula [IV-B], the illustrated compound IV-864 expressed by General formula [IV-C], the illustrated compound IV-940 expressed by General formula [IV-D] and the illustrated compound IV-98 expressed by General formula [IV-E] and 2 g of a polycarbonate resin "PANLITE L-1250" were added to 110 mL of 1,2-dichloroethane and dispersed with a sand grinder for 8 hours. Each of these dispersion solutions was applied to the above intermediate layer to build up a dry membrane thickness of 0.5 μm for formation of a carrier-generation layer. Furthermore, a mixed solution of 6 g of the below specified structural formula (K-5) compound as a carrier-transport substance and 10 g of a polycarbonate resin "PANLITE K-1300" (manufactured by Teijin Chemicals Ltd.) with 80 mL of 1,2-dichloroethane was applied to the above mentioned carrier-generation layer to build up a membrane thickness of 15 μm to form a carrier-transport layer, thus resulting the production of photo-receptors 75 to 79 of the present invention.

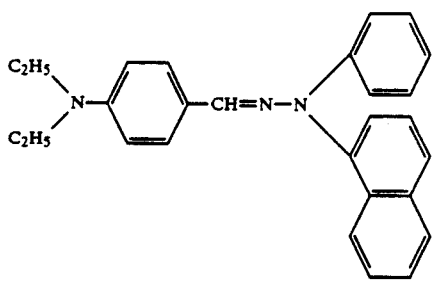

(K-5)

The measurements described in Example 69 were carried out for the above photo-receptors, and the results are given in Table 20.

COMPARATIVE EXAMPLE 17

A photo-receptor for electrophotograph was prepared as described in Example 73 except using a bis-azo pigment represented by the below specified structural formula (G-2) as a carrier-generation substance. The measurements as those shown in Example 69 were conducted for the above mentioned photo-receptor for comparison, resulting in the data contained in Table 20.

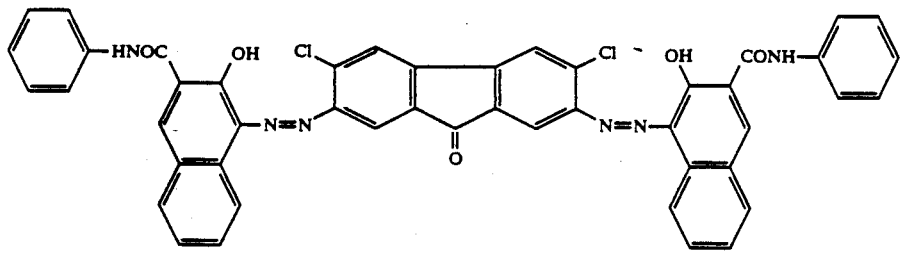

(G-2)

TABLE 20

| Example | Bis-azo Compound | 1st time $E_{\frac{1}{2}}$ (lux/sec) | 1st time $V_R$ (V) | 100th time $E_{\frac{1}{2}}$ (lux/sec) | 100th time $V_R$ (V) |
|---|---|---|---|---|---|
| 73 | IV-9 | 1.4 | 0 | 1.8 | 0 |
| 74 | IV-169 | 1.2 | 0 | 1.5 | 0 |
| 75 | IV-864 | 1.3 | 0 | 1.7 | −5 |
| 76 | IV-940 | 1.2 | 0 | 1.6 | −2 |
| 77 | IV-98 | 1.6 | 0 | 2.1 | 0 |
| Comparative Example | G-2 | 2.8 | −5 | 3.2 | −12 |

EXAMPLES 78 TO 80

An intermediate layer with a thickness of 0.05 μm made of a vinyl chloride-vinyl acetate-maleic anhydride copolymer "S-LEC MF-10" (manufactured by Sekisui Chemical Co.) was provided on an electroconductive support composed of polyester film laminated with aluminum foil. Further, 2 g of the illustrated compound No. IV-716 represented by General formula [IV-A] and 2 g of a polycarbonate resin "Panlite L-1250" were added to 110 mL of tetrahydrofuran for dispersion with a ball mill for 12 hours. The resulting dispersion solution was applied to the above mentioned intermediate layer to create a dry membrane thickness of 0.5 μm to form a carrier-generation layer. Furthermore, a solution was prepared by dissolving 6 g each of the compounds expressed by structural formulae (K-6), (K-7) and (K-8) below and 10 g of a polycarbonate resin "Z-200" (Mitsubishi Gas Chemical Co.) in 80 mL of 1,2-dichloroethane and was then applied to the above mentioned carrier-generation layer to build up a dry membrane thickness of 15 μm to form a carrier-transport layer, thus resulting in the production of the respective photoreceptors of the present invention.

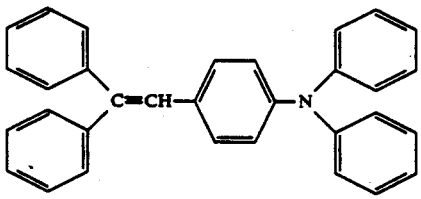

(K-6)

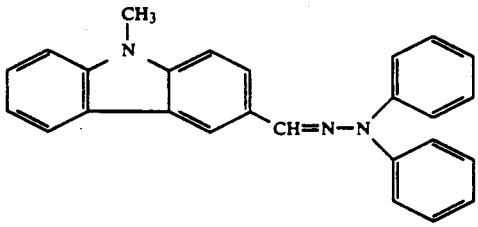

(K-7)

-continued

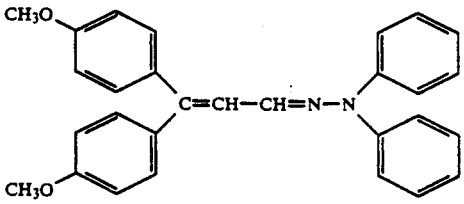

(K-8)

The measurements described in Example 69 were conducted using a fluorescent lamp in place of the halogen lamp in case of Example 69, resulting in the data in Table 21.

TABLE 21

| Example | Carrier generat. substance | Carrier transport substance | 1st time $E_{\frac{1}{2}}$ (lux/sec) | 1st time $V_R$ (V) | 100th time $E_{\frac{1}{2}}$ (lux/sec) | 100th time $V_R$ (V) |
|---|---|---|---|---|---|---|
| 78 | IV-716 | K-6 | 1.1 | 0 | 1.4 | 0 |
| 79 | IV-716 | K-7 | 1.4 | 0 | 1.9 | 0 |
| 80 | IV-716 | K-8 | 1.8 | 0 | 1.9 | 0 |

EXAMPLE 81

An 0.05 μm intermediate layer made of a vinyl chloride-vinyl acetate-maleic anhydride copolymer "S-LEC MF-10" manufactured by Sekisui Chemical Co.) was distributed on the surface of an aluminum drum with a diameter of 60 mm. Further, 2 g each of the illustrated compound IV-747 represented by General formula [IV-A], the illustrated compound IV-462 represented by General formula [IV-B], the illustrated compound IV-874 represented by General formula [IV-C], the illustrated compound IV-105 represented by General formula [IV-D], the illustrated compound IV-176 represented by General formula [IV-E] and the illustrated compound IV-840 represented by General formula [IV-F] and 2 g of a polyester resin "VYLON 200" (manufactured by TOYOBO Co.) were mixed with 100 mL of 1,2-dichloroethane and dispersed with a ball mill dispersion apparatus, and each dispersion solution was applied to the above mentioned intermediate layer to build up a dry membrane thickness of 0.6 μm thus forming the respective carrier-generation layers.

In addition to the above respective carrier-generation layers, a mixed solution of 30 g of the below specified compound (K-9) and 50 g of a polycarbonate resin "IUPILON S-1000" (manufactured by Mitsubishi Gas Chemical Co.) with 400 mL of 1,2-dichloroethane was applied to create a dry membrane thickness of 18 μm leading to formation of the respective carrier-transport layers.

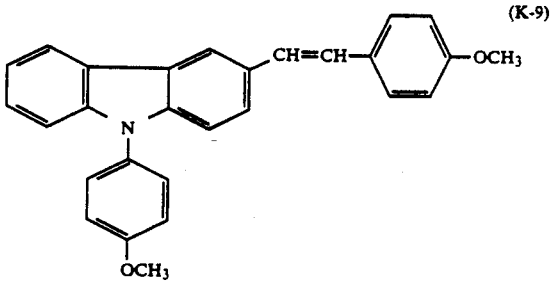

(K-9)

Each of the photo-receptors for electrophotograph produced in such a manner was mounted on a modified "U-Bix 1550 MR" electrophotographic copier (manufactured by Konica) to obtain copied pictures, which proved to have high contrast coupled with good reproducibility of the original pictures and fine visibility as well. In addition, no change was observed in performance even when the pictures were copied repeatedly 10,000 times.

COMPARATIVE EXAMPLE 18

A drum-shape photo-receptor for comparison was produced by the same process as that in Example 77 except replacing any illustrated compounds in Example 81 with a bis-azo compound represented by the below specified structural formula (G-3), and the resulting copied pictures were evaluated by the same method as in Example 77, which only produced heavily fogged pictures. As copying was being repeated, in addition, the contrast of the copied picture deteriorated, and hardly any copied picture was obtained after 10,000 repetition.

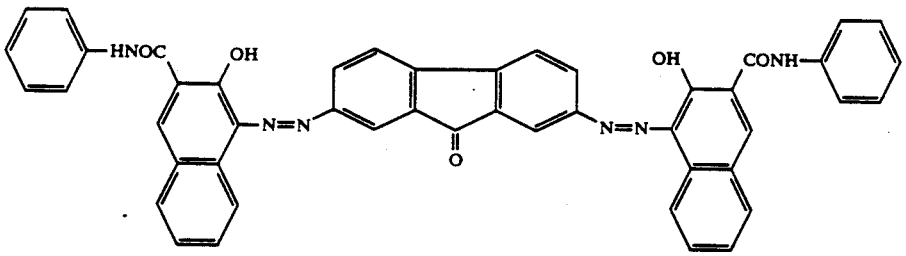

(G-3)

EXAMPLE 82

An 1.05 μm intermediate layer made of a vinyl chloride-vinyl acetate-maleic anhydride copolymer "S-LEC MF-10" (manufactured by Sekisui Chemical Co.) was distributed on an electroconductive support composed of polyester film laminated with aluminum foil, and a mixed solution of 6 g of a carrier-transport substance expressed by the below specified structural formula (K-10) and 10 g of a polycarbonate resin "PANLITE L-1250" with 80 mL of 1,2-dichloroethane was applied to the intermediate layer described above to create a membrane thickness of 15 μm for formation of a carrier-transporting layer.

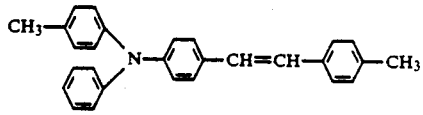

(K-10)

In addition, 2 g each of illustrated compound IV-402 represented by General formula [IV-F], illustrated compound IV-534 represented by General formula [IV-G], illustrated compound IV-630 represented by General formula [IV-H] and IV-729 illustrated compound represented by General formula [IV-I], 1.5 g of the above mentioned carrier-transport substance and 2 g of a polycarbonate resin "PANLITE L-1250" were added to 30 mL of 1,2-dichloroethane and were then dispersed with a ball mill for 24 hours. This dispersion solution was in turn applied to the above carrier-transport layer to create a membrane thickness of 4 μm to form a carrier-generation layer, and resulting in preparation of each photo-receptor of the present invention.

The meansurements were conducted for the above respective photo-receptors by the method described in Example 69, resulting in the data shown in Table 22.

TABLE 22

| Example | Carrier-generation substance | 1st time $E_{\frac{1}{2}}$ (lux/sec) | 1st time $V_R$ (V) | 100th time $E_{\frac{1}{2}}$ (lux/sec) | 100th time $V_R$ (V) |
|---|---|---|---|---|---|
| 82 | IV-797 | 1.3 | 0 | 1.6 | 0 |
| 83 | IV-900 | 1.4 | 0 | 1.7 | 0 |
| 84 | IV-864 | 1.1 | 0 | 1.3 | 0 |
| 85 | IV-141 | 1.3 | 0 | 1.5 | 0 |

As clarified in the above mentioned Examples and Comparative Examples, the photo-receptors of the present invention have superior stability, sensitivity, durability, and ability to combine with a wide variety of carrier-transport substances, than the photo-receptors for comparison.

EXAMPLE 86

2 g of the illustrated compound IV-943 expressed by General formula [IV-J] and 2 g of a polycarbonate resin "PANLITE L-1250" (manufactured by Teijin Chemicals Ltd.) were added 110 mL of 1,2-dichloroethane, and dispersed in a ball mill for 12 hours. This dispersion solution was applied on polyester film evaporated with aluminum to build up a dry membrane thickness of 1 μm form of a carrier-generation layer. On this layer, a mixed solution of 6 g of the below specified structural formula (K-11) and 10 g of a polycarbonate resin "PANLITE L-1250" with 110 mL of 1,2-dichloroethane was applied to form a carrier-transport layer with a dry membrane thickness of 15 μm thus resulting in creation of the photo-receptor for electrophotography of the present invention.

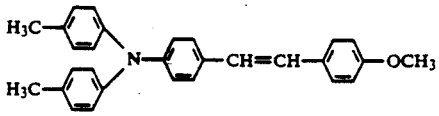

(K-11)

The measurements described in Example 69 were made for the above photo-receptor, resulting in the data included in Table 23.

COMPARATIVE EXAMPLE 19

A photo-receptor for comparison was formed by the same process as that in Example 79 except for use of the bis-azo compound specified below (G-4) as a carrier-generation substance.

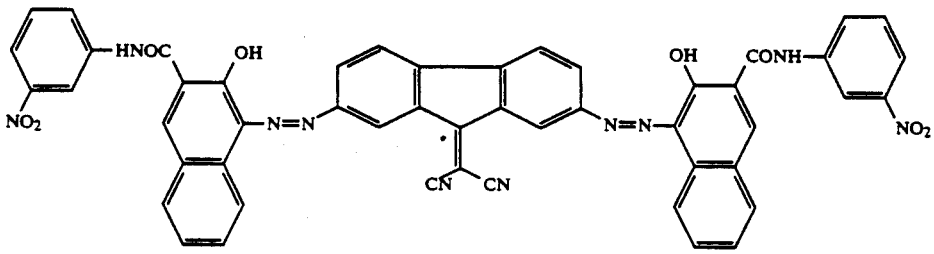

(G-4)

The same measurements as those in Example 69 were conducted for the above mentioned photo-receptor for comparison, resulting in the data contained in Table 23.

TABLE 23

| | Example 88 | | Comparative Example 19 | |
|---|---|---|---|---|
| | 1st time | 100th time | 1st time | 100th time |
| $E\frac{1}{2}$ (lux/sec) | 1.3 | 1.5 | 6.4 | 8.2 |
| $V_R$ (V) | 0 | 0 | −20 | −60 |

EXAMPLES 87 TO 89

Using the illustrated compounds IV-945 and IV-981 represented by General formula [IV-K] and the illustrated compound IV-1009 represented by General formula [IV-L], respectively as carrier-generation substances and of the respective compounds of the below specified structural formulae as carrier-transport substances, the rest of the process was followed just as in Example 69 for formation of the photo-receptors of the present invention, for which the same measurements were performed, thus resulting in the data shown in Table 24.

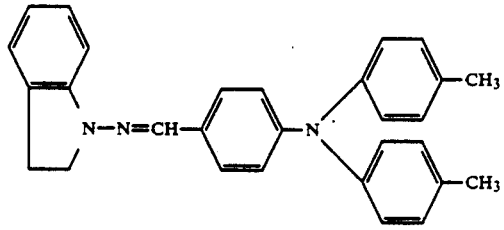

(K-12)

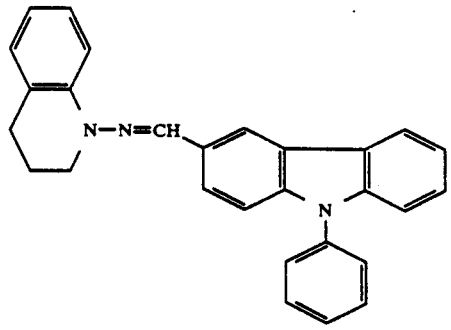

(K-13)

-continued (K-14)

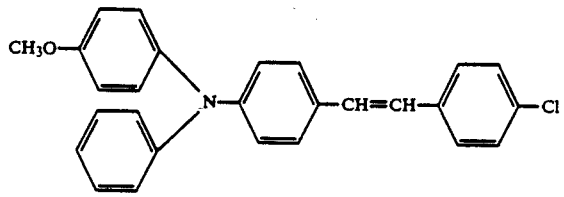

TABLE 24

| Example | Bis-azo compound illustrat. compouned | Carrier transport substance | 1st time $E_{\frac{1}{2}}$ (lux/sec) | 1st time $V_R$ (V) | 100th time $E_{\frac{1}{2}}$ (lux/sec) | 100th time $V_R$ (V) |
|---|---|---|---|---|---|---|
| 87 | IV-945 | K-12 | 1.3 | 0 | 1.5 | 0 |
| 88 | IV-981 | K-13 | 1.5 | 0 | 1.8 | 0 |
| 89 | IV-1009 | K-14 | 1.6 | 0 | 2.0 | 0 |

EXAMPLE 90

An 1.05 μm intermediate layer made of a vinyl chloride-vinyl acetate-maleic anhydride copolymer "SS-LEC MF-10" (manufactured by Sekisui Chemical Co.) was distributed onto the surface of an aluminum drum with a diameter of 100 mm. Further, 4 g of the illustrated compound I033 represented by General formula [L] was mixed with 400 mL of 1,2-dichloroethane and dispersed with a ball mill dispersion apparatus for 24 hours, and the resulting dispersion solution was applied onto the intermediate layer described above to build up a dry membrane thickness of 0.6 μm to form a carrier-generation layer.

Futhermore, a mixed solution of 30 g of a compound of the already set forth structural formula (K-9) and 50 g of a polycarbonate resin "IUPILON S-1000" (manufactured by Mitsubishi Gas Chemical Co.) with 400 mL of 1,2-dichlorethane was applied onto the above mentioned carrier-generation layer to build up a carrier-transport layer with a dry membrane thickness of 13 μm thus resulting in the preparation of a drum-shape photo-receptor.

The photo-receptor produced as mention above was mounted on a modified "LP-3010" an electrophotographic copier (manufactured by Konica) to create copied pictures, which proved to be characterized by high contrast, good reproducibility of the original picture and fine visibility. In addition, no change in these characteristics was caused by copying 10,000 times.

COMPARATIVE EXAMPLE 20

A drum-shape photo-receptor for comparison was formed as described in Example 84 except that the carrier-generating substance was replaced with a bis-azo compound expressed by the below specified structural formula (G-5) in Example 83, and the copied pictures were evaluated by the same method as in Example 83, resulting in heavily fogged copies. In copying repeatedly, in addition, the contrast of the copied image increased, leading to little availability of the copied image after 2,000 repetitions.

(G-5)

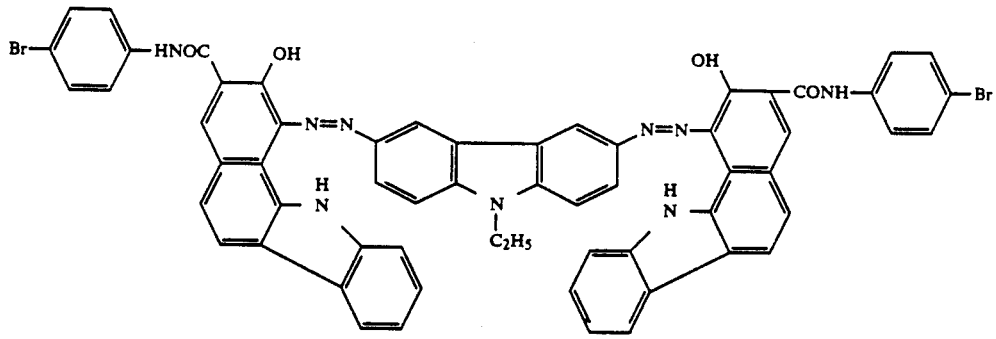

As clearly indicated by the results of the above mentioned Examples and Comparative Examples, the photoreceptors of the present invention have notably superior stability, sensitivity, durability, and ability to combine with a broad variety of carrier-transport substances, than the photo-receptors for comparison.

What is claimed is:

1. An electrophotographic photoreceptor comprising a conductive support and provided thereon a photoconductive layer containing a binder, a carrier transport substance and at least one azo compound from the group consisting of those represented by the formulae I, IV, and V;

I

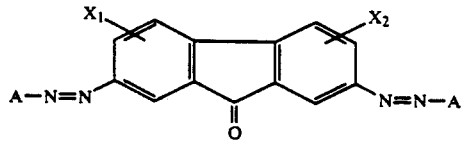

wherein $X_1$ and $X_2$ independently are a hydrogen atom or a halogen atom, provided that $X_1$ and $X_2$ are not simultaneously a hydrogen atom; A is a group represented by formula a;

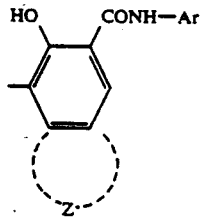

wherein Ar is an aromatic hydrocarbon ring having a fluorinated hydrocarbon group or an aromatic heterocyclic group having a fluorinated hydrocarbon group; Z is a group of non-metal atoms necessary to complete a substituted or unsubstituted aromatic group or a substituted or unsubstituted aromatic heterocyclic group;

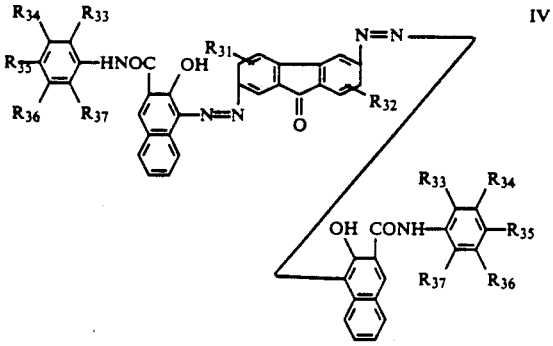

wherein $R_{31}$ and $R_{32}$ independently are a hydrogen atom, a halogen atom, an alkyl group, an alkoxy group, a nitro group, a cyano group, or a hydroxyl group; $R_{33}$, $R_{34}$, $R_{35}$, $R_{36}$, and $R_{37}$ independently are a hydrogen atom, an alkyl group, an alkoxy group, a halogen atom, a cyano group, or a nitro group;

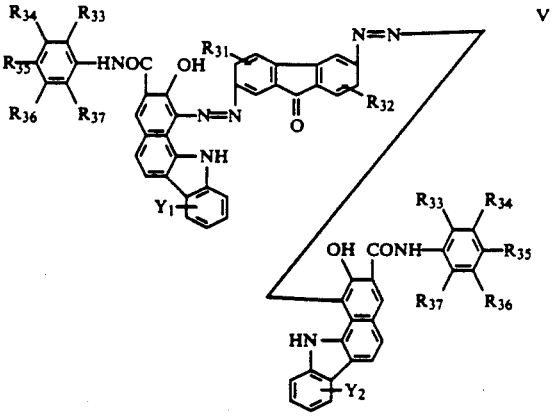

wherein $R_{31}$, and $R_{32}$ independently are a hydrogen atom, a halogen atom, an alkyl group, an alkoxy group, a nitro group, a cyano group or a hydroxy group; $R_{33}$, $R_{34}$, $R_{35}$, $R_{36}$, and $R_{37}$ independently are a hydrogen atom, an alkyl group, an alkoxy group, a halogen atom, a cyano group or a nitro group; $Y_1$ and $Y_2$ independently are a hydrogen atom, an alkyl group, an alkoxy group, a halogen atom, a cyano group or a nitro group.

2. The electrophotographic photoreceptor of claim 1, wherein said $X_1$ is attached to 4 position and $X_2$ is attached to 5 position of the fluorenone nucleus, respectively.

3. The electrophotographic photoreceptor of claim 1 wherein said $X_1$ represents a halogen atom and is substituted at 4 position of the fluorenone nucleus and $X_2$ is a hydrogen atom.

4. The electrophotographic photoreceptor of claim 2, wherein said Z is a group of atoms necessary to complete a phenyl group.

5. The electrophotographic photoreceptor of claim 3, wherein said aromatic ring formed by Z is a phenyl group.

6. The electrophotographic photoreceptor of claim 4, wherein said Ar is an aromatic hydrocarbon ring having a fluorinated hydrocarbon group.

7. The electrophotographic photoreceptor of claim 5, wherein said Ar is an aromatic hydrocarbon ring having a fluorinated hydrocarbon group.

8. The electrophotographic photoreceptor of claim 6, wherein said fluorinated hydrocarbon group is fluorinated alkyl group having 1 to 4 carbon atoms.

9. The electrophotographic photoreceptor of claim 7, wherein said fluorinated hydrocarbon group is fluorinated alkyl group having 1 to 4 carbon atoms.

10. The electrophotographic photoreceptor of claim 8, wherein said fluorinated hydrocarbon group is a trifluoromethyl group.

11. The electrophotographic photoreceptor of claim 9, wherein said fluorinated hydrocarbon group is a trifluoromethyl group.

12. The electrophotographic photoreceptor of claim 10, wherein said Ar is a trifluoromethyl substituted phenyl group.

13. The electrophotographic photoreceptor of claim 11, wherein said Ar is a trifuoromethyl substituted phenyl group.

14. The electrophotographic photoreceptor of claim 1, wherein said photoconductive layer comprises a compound selected from A, B and C as a carrier transport substance;

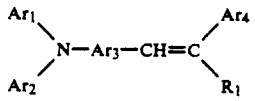

wherein $Ar_1$, $Ar_2$ and $Ar_4$ independently are a substituted or unsubstituted aryl group; $Ar_3$ is a substituted or unsubstituted arylene group; and $R_1$ is a hydrogen atom, a substituted or unsubstituted alkyl group or a substituted or unsubstituted aryl group;

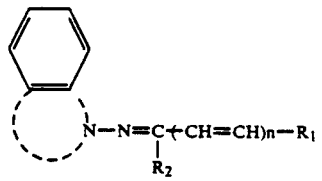

wherein $R_1$ is a substituted or unsubstituted aryl group or a substituted or unsubstituted heterocyclic group; $R_2$ is a hydrogen atom, a substituted or unsubstituted alkyl group, or a substituted or unsubstituted aryl group; and

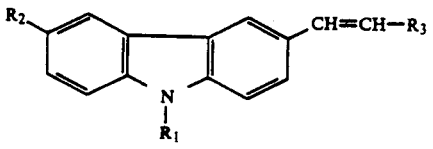
C
wherein $R_1$ is a substituted or unsubstituted aryl group; $R_2$ is a hydrogen atom, a halogen atom, a substituted or unsubstituted alkyl group, a substituted or unsubstituted heterocyclic group, a substituted or unsubstituted amino or hydroxyl group; and $R_3$ is a substituted or unsubstituted aryl group, a substituted or unsubstituted heterocyclic group.
* * * * *